US010786033B2

(12) United States Patent
Brown et al.

(10) Patent No.: US 10,786,033 B2
(45) Date of Patent: Sep. 29, 2020

(54) RACING HELMET WITH VISUAL AND AUDIBLE INFORMATION EXCHANGE

(71) Applicant: Robotarmy Corp., Woodland Hills, CA (US)

(72) Inventors: Alan Gary Brown, Austin, TX (US); Damien Phelan Stolarz, Los Angeles, CA (US)

(73) Assignee: Robotarmy Corp., Woodland Hills, CA (US)

( * ) Notice: Subject to any disclaimer, the term of this patent is extended or adjusted under 35 U.S.C. 154(b) by 0 days.

(21) Appl. No.: 16/666,031

(22) Filed: Oct. 28, 2019

(65) Prior Publication Data

US 2020/0128902 A1 Apr. 30, 2020

Related U.S. Application Data

(60) Provisional application No. 62/275,089, filed on Oct. 29, 2018.

(51) Int. Cl.
*A42B 3/30* (2006.01)

(52) U.S. Cl.
CPC ..... *A42B 3/30* (2013.01)

(58) Field of Classification Search
None
See application file for complete search history.

(56) References Cited

U.S. PATENT DOCUMENTS 4,018,514 A * 4/1977 Plummer ..... A61B 3/14 351/206
6,028,627 A 2/2000 Helmsderfer
6,373,961 B1 * 4/2002 Richardson ..... G06F 3/013 345/8
6,819,354 B1 * 11/2004 Foster ..... H04N 7/183 348/157
9,389,677 B2 * 7/2016 Hobby ..... H04B 1/385
9,554,606 B2 * 1/2017 Ratner ..... A42B 3/042
9,610,476 B1 4/2017 Tran et al.
10,321,102 B2 * 6/2019 Zhang ..... H04N 5/23293
2006/0048286 A1 * 3/2006 Donato ..... G02B 27/0176 2/422
2006/0073449 A1 * 4/2006 Kumar ..... F41A 33/00 434/219
2007/0233506 A1 * 10/2007 Moore ..... G06Q 50/00 705/500

(Continued)

OTHER PUBLICATIONS

International Search Report and Written Opinion dated Mar. 16, 2020, issued in corresponding International Patent Application No. PCT/US2019/058407.

(Continued)

*Primary Examiner* — Mohammad J Rahman
(74) *Attorney, Agent, or Firm* — Athorus, PLLC

(57) ABSTRACT

The disclosed embodiments illustrate methods and systems for training users in sports using mixed reality. The method includes retrieving data from athletes wearing helmets, wearable glasses, and/or motion-capture suits in real time. The helmets and the wearable glasses are integrated with mixed-reality technology. Further, physical performance data of the athletes is captured using a variety of time-synchronized measurement techniques. Thereafter, the athletes are trained using the captured data and audio, visual and haptic feedback.

22 Claims, 54 Drawing Sheets

(56) References Cited

U.S. PATENT DOCUMENTS

2009/0109292 A1 4/2009 Ennis
2012/0062734 A1* 3/2012 Mironichev ..... H04N 7/185 348/143
2012/0081564 A1 4/2012 Kamiya
2013/0021448 A1* 1/2013 Fairburn ..... G03B 35/08 348/47
2013/0197166 A1* 8/2013 Isahaya ..... C08G 64/305 525/462
2014/0218281 A1* 8/2014 Amayeh ..... A61B 3/14 345/156
2014/0362244 A1* 12/2014 Martin ..... H04N 5/23241 348/211.2
2015/0070274 A1* 3/2015 Morozov ..... G06F 3/0346 345/156
2015/0223683 A1* 8/2015 Davidovics ..... G02B 27/0093 351/210
2015/0338723 A1* 11/2015 Duncan ..... G03B 17/561 348/373
2015/0381941 A1* 12/2015 Watkins ..... H04N 7/183 348/148
2016/0007849 A1* 1/2016 Krueger ..... A61B 3/113 600/301
2016/0037849 A1* 2/2016 Shearman ..... A42B 3/0426 2/424
2016/0058091 A1* 3/2016 Sasaki ..... F16M 13/04 348/376
2016/0058095 A1* 3/2016 Barta ..... A42B 3/06 2/424
2016/0129280 A1* 5/2016 Douglas ..... A61M 21/00 607/88
2016/0227866 A1* 8/2016 Tal ..... H04N 5/23293
2016/0262608 A1* 9/2016 Krueger ..... A61B 3/0041
2016/0285551 A1* 9/2016 Mateti ..... H04B 10/1123
2016/0355126 A1* 12/2016 Anderson ..... A42B 3/0453
2017/0007351 A1* 1/2017 Yu ..... G06F 3/011
2017/0119078 A1* 5/2017 Chen ..... A42B 3/30
2017/0125058 A1* 5/2017 Shearman ..... G11B 27/031
2018/0017742 A1 1/2018 Louderback
2018/0199455 A1* 7/2018 Hurbi ..... G06F 1/1658
2018/0228238 A1* 8/2018 Gansauskas ..... A42B 3/042
2018/0246290 A1* 8/2018 Wang ..... G02B 13/0045
2018/0301056 A1* 10/2018 Cross ..... G09B 19/003
2018/0338557 A1* 11/2018 Gallizzi ..... A42B 3/066
2018/0343497 A1* 11/2018 Brown ..... H04B 1/205
2019/0377189 A1* 12/2019 Toleno ..... B29C 70/86

OTHER PUBLICATIONS

Partial Search Report dated Jan. 21, 2020, issued in corresponding International Patent Application No. PCT/US2019/058407.

* cited by examiner

RACING HELMET WITH VISUAL AND AUDIBLE INFORMATION EXCHANGE

PRIORITY CLAIM

This application claims priority to U.S. Provisional Patent Application No. 62/752,089, filed Oct. 29, 2019, and titled "Methods And Systems For Physical Training Using Spacial Computing And Mixed Reality," the contents of which are herein incorporated by reference in their entirety.

BACKGROUND

Sports training is used to provide instruction to users and/or improve the performance of users in various sports and bodily performance activities, including, but not limited to, ice hockey, soccer, football, baseball, basketball, lacrosse, tennis, running sports, martial arts, dance, theatrical performance, cycling, horseback riding, volleyball, automobile (drag racing, off road racing, open wheel Formula 1 racing, stock car racing), karting, karate, figure skating, snow skiing, golf, single- and multi-player augmented reality (AR) games, swimming, gymnastics, hunting, bowling, skateboarding, surfing, offshore racing, sailing, skateboarding, swimming, and wakeboarding. The users may be players, athletes, or trainees. Further, the users may be assisted by coaches and viewed by spectators.

In sports training, coaches use various techniques and specialized knowledge to guide athletes to improve their performance. These coaching techniques and knowledge are not generally susceptible to automation but must be carefully taught to coaches-in-training, then passed on from the coach to the trainee by observation and metered by skill and aptitude.

Athlete performance in any given sport requires the acquisition of highly specialized skills requiring consideration and fine tuning of numerous highly specific factors. For example, in skiing, the coach and athlete must consider center of gravity; lean angle; ski shape, curvature, and other characteristics; wax types and amounts; temperature, snow, and weather conditions; topographical layout of the ski run; and other factors. Each sport entails its own set of relevant factors, and the understanding of these factors is constantly changing over time. Coaches and athletes must constantly study and train to understand and control such factors to optimize their performance to remain competitive.

Currently, various technologies are used for providing training to users and/or improving the performance of users in the various sports and physical activities. These technologies may include sports simulators, audiovisual and computing technologies, multi-view recordings of professional athletes, and audiovisual aids for coaches and trainers to provide training for the users. Further, these technologies are used for relay of information in the field of the sports training and sports competition. For example, motion capture (mocap) devices are used to capture, analyze, and re-present athletic performance. Further, audio, visual, and motion sensors are used to capture the position, kinematics, orientation and real-time communication of the athletes on the field or in a controlled space, for the purpose of entertainment and training.

Further, helmets and other protective headgear are used in various sports. As an example, helmets are used in American football and automobile racing sports. For another example, protective headgear is used in martial arts and fighting sports. Further, the protective headgear along with trackers are used to determine a location of players on the sports field or to shoot a first-person video. However, such solutions are heavy and do not comply with regulations. For example, sports cameras mounted on helmets may resultantly fly off or collide with other athletes during practice.

Typically, a variety of technologies are used to create audiovisual experiences that overlay, augment, enhance, or temporarily replace the user's experience of physical reality. For example, current virtual reality (VR) technology involves stereoscopic headsets. Further, a variety of other devices—such as handheld controllers, tracking headgear, haptic garments, or wearable devices—are used in VR to create and provide physical, audio, and visual simulation. Technologies such as augmented reality (AR) or mixed reality use a combination of similar technologies—i.e., use of the user's sensory inputs along with visual overlays that blend with the physical world and stay synchronized.

Currently, various display technologies are used for VR and AR. VR and AR create varying degrees of immersion and realism. In VR, high refresh rate, high resolution, and precise head motion tracking are critical to avoiding dizziness, nausea, and other uncomfortable physical reactions in users. On the other hand, in AR, translucent and transparent screens of various shapes and sizes are used to provide imagery that is convincingly overlaid on physical reality. Further, VR and AR vary widely in the field of view they present. It should be noted that the human field of view exceeds 200 degrees. However, current display technologies fail to provide a full wraparound view. In AR, headgear is used to simulate holography, or creation of three-dimensional (3D) illusions that appear real in space. However, in AR, a narrow field of view causes overlays to be limited to users looking straight ahead or slightly to the side. Additionally, when an AR interface displays an image on a lens such as glasses, projected images formed are translucent to a degree and do not have the same color characteristics as actual images. It should be noted that techniques such as retinal image projection and eye position tracking increase the quality, comfort, fidelity, and immersiveness of both AR and VR technologies. However, such techniques have not been broadly deployed in a commercial context.

Communication technologies cover telephony using Voice over Long-Term Evolution (VoLTE) technology and a variety of Video over Internet Protocol (IP) and Voice over IP (VoIP) technologies. Such communication technologies provide low-latency bidirectional audio or visual communication as long as underlying networks support low latency requirements. Further, such communication technologies require a selection of one or more parties to call and include a setup time. It should be noted that the connection may be negotiated through protocols such as Session Initiation Protocol (SIP) or Extensible Messaging and Presence Protocol (XMPP). However, compatible protocols are less developed and standardized and, in some cases, do not yet exist for applications such as video conferencing, transmission of more than 2D videos (such as 3D conferencing or multi-position conferencing), or for conferencing conveying more than audiovisual data, such as fine-grained personal kinematic, positional data, or haptic data.

Various technologies suffer from one or more drawbacks, making them ineffective for high-fidelity capture and relay of athletic performance. For example, video has the drawback of shrinking and displaying athletic examples in an altered size and orientation, and aligning high-resolution cameras can be costly and labor intensive. As another example, motion capture devices are either too coarse in target capture range or require instrumenting an athlete in a way that obstructs natural performance. Further, helmets or headgear outfitted with aftermarket cameras for capturing team activities can be cost-prohibitive, and such equipment is bulky when worn.

Current virtual reality technology suffers from drawbacks in the training of athletes in that it often provides a poor simulation of the sport being modeled. Current haptic devices and range-of-motion apparatus for sports simulation fail to effectively replicate the physical perceptions and conditions of a sport, preventing the development of authentic muscle memory in training.

BRIEF DESCRIPTION OF DRAWINGS

The accompanying drawings illustrate the various embodiments of systems, methods, and other aspects of the disclosure. Any person with ordinary skill in the art will appreciate that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa. Further, the elements may not be drawn to scale.

Various embodiments will hereinafter be described in accordance with the appended drawings, which are provided to illustrate and not to limit the scope in any manner, wherein similar designations denote similar elements, and in which.

DETAILED DESCRIPTION

The present disclosure is best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented, and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Figure 1:
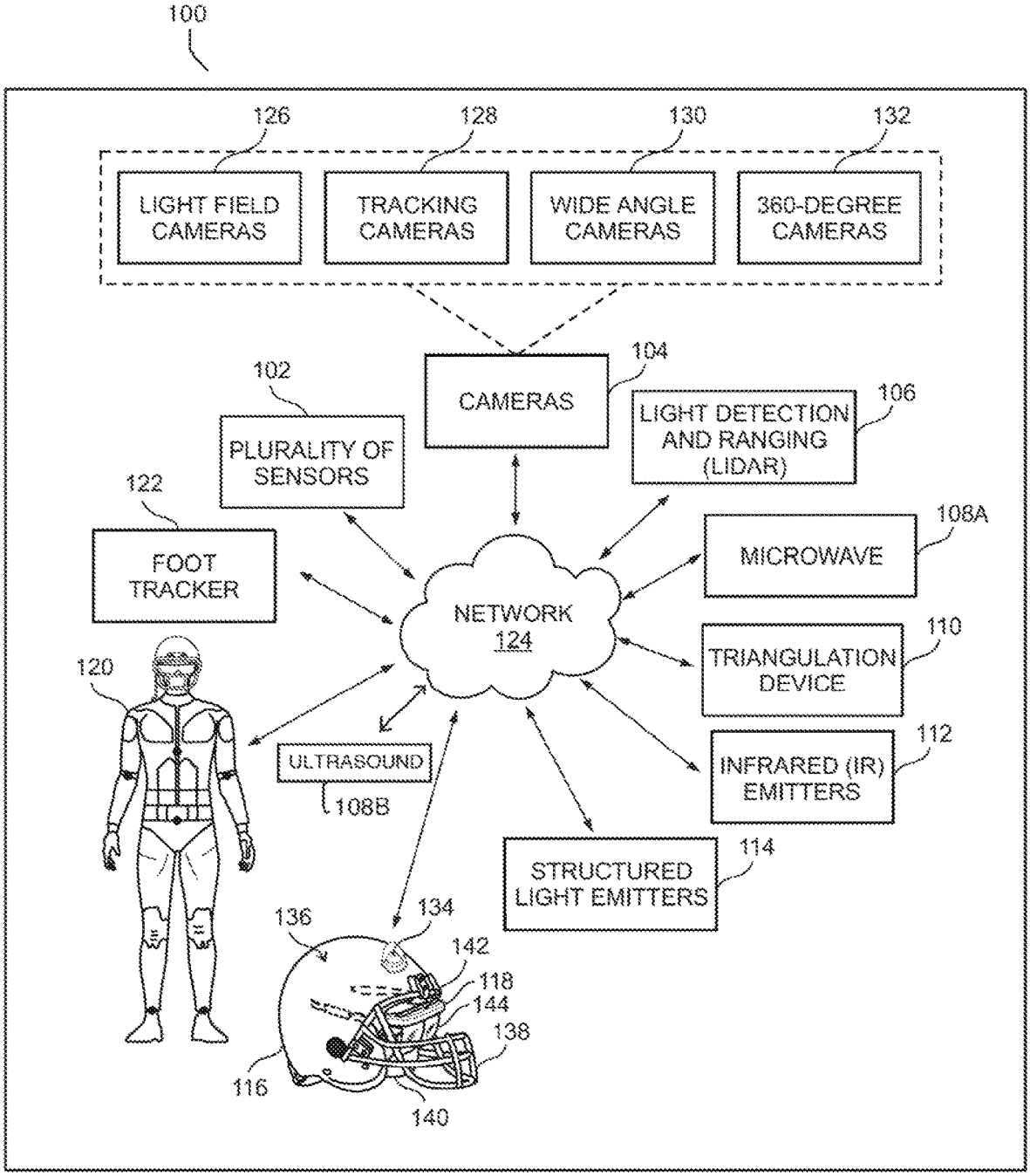
FIG. 1 illustrates a block diagram showing a system environment in which various embodiments may be implemented.

FIG. 1 illustrates a block diagram showing a system environment 100 in which various embodiments may be implemented. The system environment 100 includes a plurality of sensors 102, one or more cameras 104, Light Detection and Ranging (LIDAR or lidar) 106, microwave transmitter/receivers 108A, ultrasound emitters and detectors 108B, triangulation devices 110, infrared (IR) emitters 112, structured light emitters 114, a helmet 116 integrated with wearable glasses 118, a motion capture (mocap) suit 120 worn by a user, a foot tracker 122, and a network 124. Various components in the system environment 100 may be interconnected over the network 124.

The plurality of sensors 102 may be configured to sense or record motion of users on a sports field. In one embodiment, the plurality of sensors 102 may detect the position of the users on the sports field with millimeter accuracy, and detect motion of the users with sub-millisecond temporal accuracy. The plurality of sensors 102 may be integrated with the helmet 116 and/or the wearable glasses 118. Further, the plurality of sensors 102 may be stitched to clothes of the users, e.g., using a hook-and-loop mechanism. The plurality of sensors 102 may include, but is not limited to, geomagnetic sensors, acceleration sensors, tilt sensors, gyroscopic sensors, biometric information sensors, altitude sensors, atmospheric pressure sensors, eyeball-tracking sensors, neuron sensors, and position sensors. The users may be athletes, players, and/or trainees. The sports field may include, but is not limited to, a soccer field, an American football field, a basketball court, a tennis court, a volleyball court, or a Formula 1 racing track. It should be noted that the above-mentioned sports fields have been provided for illustration purposes, and should not be considered limiting.

The one or more cameras 104 may be configured to capture data related to the sports field. The one or more cameras 104 may be positioned around various locations of the sports field. The data may correspond to visual data and/or positional data of the users. The one or more cameras 104 may include light field cameras (i.e., plenoptic cameras) 126, tracking cameras 128, wide angle cameras 130, and/or 360-degree cameras 132.

In one embodiment, the light field cameras 126 and the tracking cameras 128 may be configured to capture information related to the users in the sports field. For example, a tracking camera 128 may be disposed on the helmet 116 of a player. The tracking camera 128 may track a particular player on the sports field. Further, the tracking camera 128 may be used to capture each and every activity related to the player on the sports field. It should be noted that the tracking cameras 128 may correspond to robotically aimed or operated cameras. The wide angle cameras 130 may provide a wide field of view for capturing images and/or videos of the users in the sports field—e.g., GoPro® cameras. The 360-degree cameras 132 may provide a 360-degree field of view in a horizontal plane, or with a larger visual field coverage. In at least one embodiment, the 360-degree cameras 132 may be positioned in the middle on the edges of the sports field. In other embodiments, the 360-degree cameras 132 may be positioned on one or more vehicles, such as racecars, operating on the sports field. The 360-degree cameras 132 may be referred to as omnidirectional cameras. It should be noted that the above-mentioned cameras 104 have been provided only for illustration purposes. The system environment 100 may include other cameras as well, without departing from the scope of the disclosure.

The lidar 106 may be used to track players or objects on the sports field. For example, the objects may be bats, balls, sticks, clubs, rackets, or hockey pucks. Further, the microwave transceivers 108 may be used to capture data related to the players' motion on a sports field or in an enclosed space. In one embodiment, the microwave transceivers 108 may use millimeter waves in the 30-300 GHz frequency range. It should be noted that microwaves may be replaced or augmented by ultrasonic audio frequency waves. Further, triangulation devices 110 may be used to capture data related to the players (e.g., outside-in tracking). In an example, the players may be located using the triangulation devices 110. In at least one embodiment, the system environment 100 may include IR emitters 112 that may act as a source of light energy in the infrared spectrum. For example, in a virtual reality (VR) positioning technique, the IR emitters 112 may be positioned on a player to be tracked. In another example, the IR emitters 112 may be positioned on the edges of the sports field. Further, the structured light emitters 114 may be used to illuminate a scene with patterns of visible or non-visible light that may be detected by the one or more cameras 104.

Further, a player or an object may be tracked using visual processing and object identification of one or more continuous video images using computer vision algorithms that are well known in the art (e.g., inside-out tracking). Such techniques may be used to implement six-degree-of-freedom (6DoF) tracking of players in free space. In one embodiment, a continuous and seamless visual representation of a particular feature—such as a player or an object on a sports field—may be created. The feature on the sports field may be tracked by any of the above-mentioned techniques. Further, a location of the feature may be fed into a video control system. The video control system may create a single and continuous output video showing a perspective of the tracked object. For example, a dozen cameras may be placed along sides of a hockey rink for tracking a player. The player may be tracked continuously, and a video of the player may shift from one camera to another camera. It should be noted that the shifting may be based on which camera provides the best perspective of the tracked player and movements of the player. Further, a visual system may use high-resolution imagery, perform zooming and cropping of images, and transition smoothly from the image of one camera to another camera by stitching the overlapping images together in a seamless blend, producing one frame stitched together from multiple cameras views of the same target.

Further, the images captured may be rendered to a virtual three-dimensional (3D) space, adjusted to match, and recombined. In one embodiment, for camera equipment that may be steered, re-focused, and/or zoomed, a system may provide real-time feedback to a steerable camera to focus on the feature to be targeted, to point at the target, or to adjust exposure or frame rate of video for capturing the target with high fidelity. Further, the frame rate of a camera near the target may be increased, and a camera on the other end of a court, rink, or field where no action is happening may switch to a lower frame rate, use a telephoto zoom, and/or change direction to look across the court, rink, or field to where the action is happening.

It should be noted that the zoom, focus, and exposure feature may be implemented in post-processing or by a software method, using footage captured with sufficient resolution, high dynamic range, or light field technology so that such aspects may be adjusted after capture. In some embodiments, a set of cameras around the court, rink, or field may create an effect where a single camera is following a player as each camera "hands off" the image capture to another camera, but starting from a zoomed in or cropped perspective and then switching to a proper size. In other embodiments, background aspects of the images and foreground tracked target may be filled in by the one or more cameras 104 and the information may be composited. In one embodiment, a player may traverse the whole field in any direction, and it may appear that the player has been closely followed by a mobile steadicam operator. It should be noted that the image may be a composite of stationary images.

It will be apparent to one skilled in the art that the above-mentioned techniques used for 6DoF have been provided only for illustration purposes. In other embodiments, the techniques may be used for three degrees of freedom (3DoF) without departing from the scope of the disclosure.

A specially configured helmet 116 may be worn by players in one or more sports, such as, but not limited to, American football, baseball, skiing, hockey, automobile racing, motorcycle racing, etc. The helmet 116 may be integrated with AR technology, light field display technology, VR technology, gaze tracking technology, and/or 6DoF positioning technology. It should be noted that the helmet 116 may include other technologies as well, without departing from the scope of the disclosure. The helmet 116 may include an IR camera 134 for capturing an absolute location of the players on the sports field. The IR camera 134 may be disposed on the shell 136 of the helmet 116. Further, the helmet 116 may include a face mask 138 and a chinstrap 140. It should be noted that the face mask 138 may be made up of one or more plastic-coated metal bars. Further, the helmet 116 may be integrated with directional headphones for recognizing directional sound of players or coach. In some embodiments, the helmet 116 may include one or more transceivers for transmitting and receiving data related to the sports field.

As shown in FIG. 1, the helmet 116 may be integrated with wearable glasses 118. The wearable glasses 118 may be referred to as augmented reality glasses. In some embodiments, the wearable glasses 118 may be a separate device and worn by users. The wearable glasses 118 may be integrated with AR technology, light field technology, and/or VR positioning technology. It should be noted that the wearable glasses 118 may include some other technologies as well, without departing from the scope of the disclosure. For example, as discussed further below with respect to FIGS. 36-39, a helmet may include an output device, such as a projector, that is operable to present visual information into a field of view of a user, such as a driver, while the user is wearing the helmet.

The wearable glasses 118 may include a frame 142 and one or more lenses 144. The one or more lenses 144 may be detachably mounted in the frame 142. The frame 142 may be made up of a material such as a plastic and/or metal. The wearable glasses 118 may receive data corresponding to players on the sports field from an external device. The data may include the visual data and/or the positional data and timecode reference of the players on the field. The wearable glasses 118 may store the data in a memory. Further, the wearable glasses 118 may provide the data in various forms. For example, the wearable glasses 118 may display the data on a display in the form of AR, mixed reality (MR), or VR. A detailed description of the helmet 116 integrated with the wearable glasses 118 is given later in conjunction with FIGS. 2A-2B and 3A-3D.

It will be apparent to one skilled in the art that the above-mentioned elements of the helmet 116 and the wearable glasses 118 have been provided only for illustrative purposes. In some embodiments, the wearable glasses 118 may include a separate display device, a sound output unit, a plurality of cameras, and/or an elastic band, without departing from the scope of the disclosure. For example, additional details of a racing helmet integrated with one or more tracking cameras 128, HUD, and audio input/output is discussed further below in conjunction with FIGS. 34-37.

The mocap suit 120 may correspond to a wearable device that records data such as body movements of the users or athletes. The mocap suit and helmet may use any of a number of technologies to capture the position and motion of the body, including, but not limited to, ultrasound, radar, lidar, piezoelectric elements, and accelerometers. In some embodiments, a number of sensors or reflective devices are placed at articulated points of the body. Waves—such as ultrasound, radar, or lidar—may be reflected off each of the reflective devices placed at the body's articulated points, and triangulation of calculated wave transmission distance used to calculate the relative position of each of the reflective devices. In other embodiments, the sensors placed at the body's articulated points would actively receive and transmit signals to indicate their position. In yet other embodiments, such as piezoelectric elements or accelerometers, the sensors themselves would detect and track relative position and actively transmit position changes to the central processor via any of a number of communication technologies, including but not limited to Bluetooth, Wi-Fi, infrared, or modulated radio waves.

In one embodiment, the mocap suit 120 may be configured for capturing the athlete's skeletal kinematics while playing a sport such as American football. After capturing the data, the mocap suit 120 may transfer the data to the helmet 116. It should be noted that the mocap suit 120 may be coupled to the helmet 116 in a wired or a wireless manner. Thereafter, the data may be viewed by the users or the athletes. In some embodiments, the mocap suit 120 may use a plurality of sensors 102 to measure the movement of arms, legs, and trunk of the users.

The foot tracker 122 may be configured to track movements of one or more players/athletes on the sports field. The foot tracker 122 may be worn by the one or more players/athletes. The foot tracker 122 may determine one or more parameters related to running or walking form such as foot landing, cadence, and time on the ground. Based at least on the determination of the one or more parameters, the foot tracker 122 may track how fast a player runs and/or how well the player runs.

The network 124 corresponds to a medium through which content and data flow between various components of the system environment 100 (i.e., the plurality of sensors 102, the one or more cameras 104, the lidar 106, the microwave transceivers 108, the ultrasound emitters and detectors, the triangulation device 110, the IR emitters 112, the structured light emitters 114, the helmet 116, the wearable glasses 118, the mocap suit 120, and the foot tracker 122). The network 124 may be wired and/or wireless. Examples of the network 124 may include, but are not limited to, a Wi-Fi network, a Bluetooth mesh network, a wide area network (WAN), a local area network (LAN), or a metropolitan area network (MAN). Various devices in the system environment 100 can connect to the network 124 in accordance with various wired and wireless communication protocols such as Transmission Control Protocol and Internet Protocol (TCP/IP), User Datagram Protocol (UDP), and 2G, 3G, or 4G communication protocols. In some embodiments, the network 124 may be a cloud network or cloud-based network.

Figure 2A:
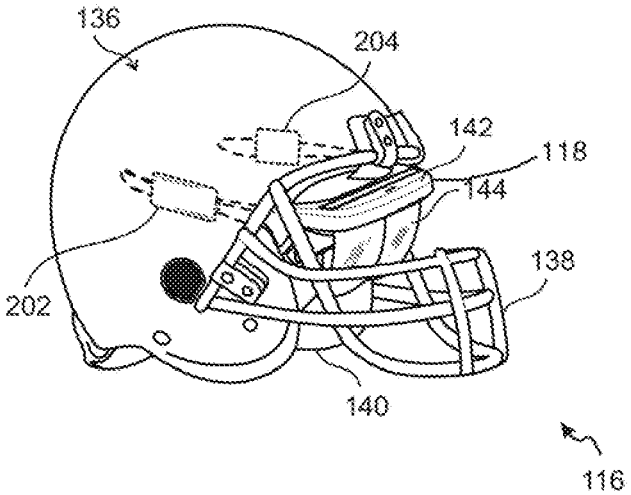
FIG. 2A illustrates a helmet integrated with translucent display lenses, having an integrated battery and a central processing unit (CPU), in accordance with at least one embodiment.

FIG. 2A illustrates the helmet 116 integrated with the wearable glasses 118, where the wearable glasses 118 have an integrated battery 202 and a central processing unit (CPU) 204, in accordance with at least one embodiment. The battery 202 may be disposed within the frame 142 of the wearable glasses 118. It should be noted that the battery 202 may be disposed at various positions on the frame 142. For example, the battery 202 may be disposed at an end of the frame 142 of the wearable glasses 118. In some embodiments, the battery 202 may be embedded within the helmet 116. The battery 202 may supply power to each element of the helmet 116 and the wearable glasses 118. In some embodiments, the battery 202 may be a rechargeable battery.

Figure 2B:
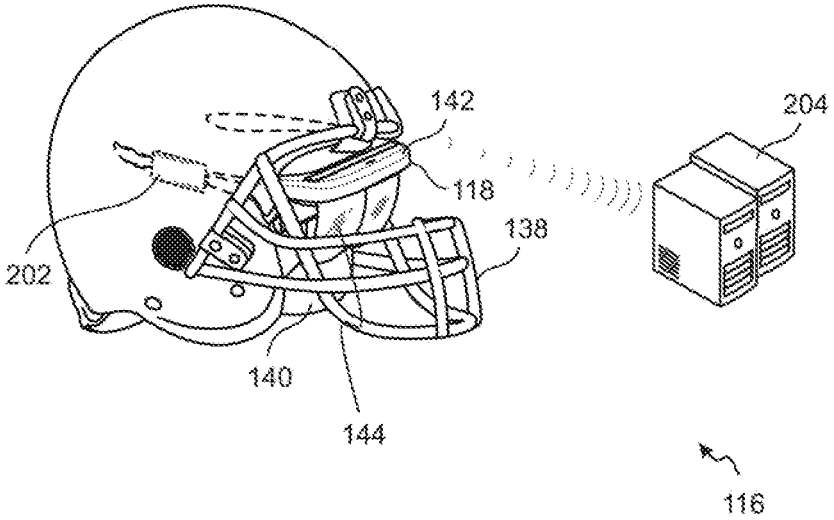
FIG. 2B illustrates the helmet integrated with wearable glasses, showing the CPU as a separate entity, in accordance with at least one embodiment.

Further, the CPU 204 may be disposed within the frame 142 of the wearable glasses 118. It should be noted that the CPU 204 may be disposed at various positions on the frame 142. For example, the CPU 204 may be disposed at an end of the frame 142 of the wearable glasses 118. In some embodiments, the CPU 204 may be embedded within the helmet 116. In other embodiments, the CPU 204 may be a separate entity and may communicate with the helmet 116 and/or the wearable glasses 118 in a wired or wireless manner, as shown in FIG. 2B. The CPU 204 may process the data related to the sports field. As discussed above, the data may include the visual data and/or the positional data of the players. The CPU 204 may be implemented using any of a number of hardware and software technologies, including, but not limited to, a microprocessor, a microcontroller, a system on a chip (SoC), a field-programmable gate array (FPGA), and/or a digital signal processor (DSP), using custom firmware/software or an array of off-the-shelf software, as is well known to those skilled in the art.

Figure 3A:
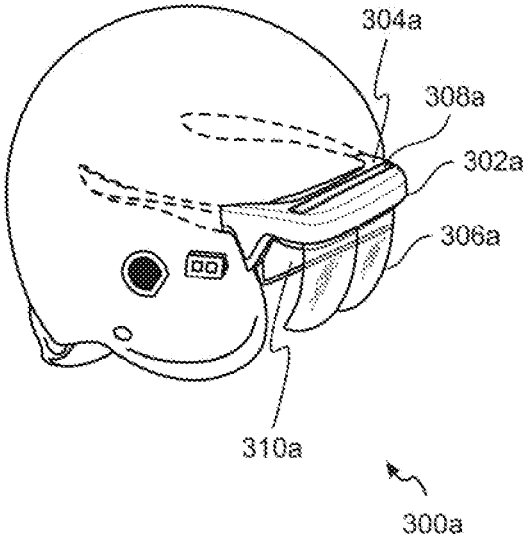
FIG. 3A illustrates an alternate embodiment of a helmet showing an insert for storing a mobile device, in accordance with at least one embodiment.

FIG. 3A illustrates an alternate embodiment of a helmet 300*a*, in accordance with at least one embodiment. As shown in FIG. 3A, the helmet 300*a* may be integrated with wearable glasses 302*a*. The wearable glasses 302*a* may include a frame 304*a* and one or more lenses 306*a*. The one or more lenses 306*a* may be detachably mounted in the frame 304*a*. In one embodiment, the one or more lenses 306*a* may be curved translucent lenses. Further, the wearable glasses 302*a* may have an insert 308*a* for storing a mobile device 310*a*. The mobile device 310*a* may be directed into the insert 308*a* from a first side (i.e., a top side) of the helmet 300*a*. In one embodiment, the mobile device 310*a* may be a smartphone. Further, the helmet 300*a* may be incorporated with an eye-guard plastic. In one embodiment, the wearable glasses 302*a* may work at a distance of between two and five feet. In other embodiments, the working distance of the wearable glasses may be less than two feet and/or greater than five feet. It should be noted that the most effective visual mixed-reality projection range may lie between two and ten feet.

Figure 3B:
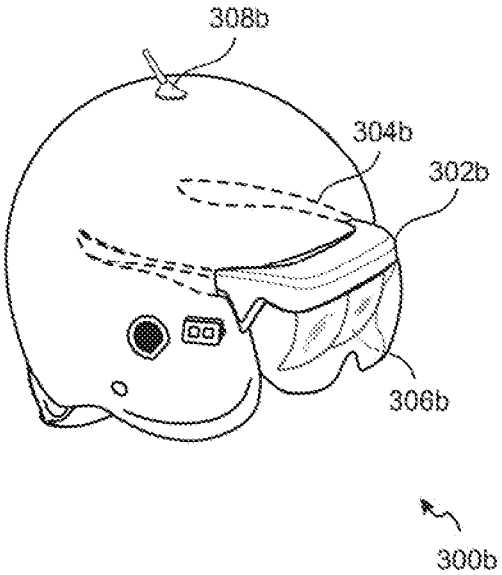
FIG. 3B illustrates an alternate embodiment of a helmet integrated with a display screen, in accordance with at least one embodiment.

FIG. 3B illustrates an alternate embodiment of a helmet 300*b* integrated with a display screen 302*b*, in accordance with at least one embodiment. The display screen 302*b* may be an AR screen projector, a liquid crystal display (LCD), or a light-emitting diode (LED) display, etc. Further, the helmet 300*b* may be integrated with wearable glasses 304*b* having a curved lens 306*b*. The curved lens 306*b* may be used for projecting an image to the user. In one embodiment, the curved lens 306*b* may be a shatterproof curved lens.

Figure 3C:
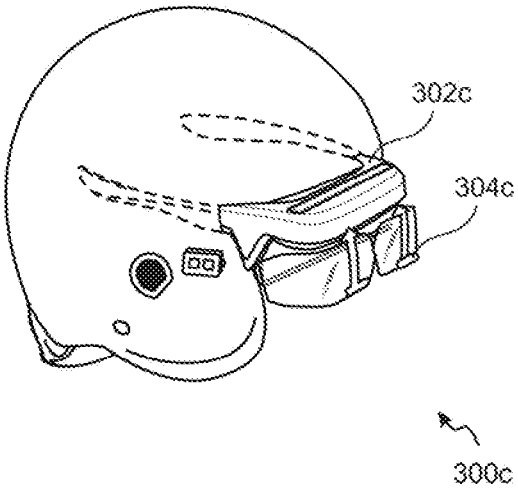
FIG. 3C illustrates an alternate embodiment of a helmet integrated with a retinal virtual reality (VR) display, in accordance with at least one embodiment.

FIG. 3C illustrates an alternate embodiment of a helmet 300*c*, in accordance with at least one embodiment. The helmet 300*c* may be integrated with wearable glasses 302*c*. In one embodiment, the wearable glasses 302*c* may be a head-mounted display. The wearable glasses 302*c* may use a retinal VR display 304*c* for projecting an image directly onto the retina. The VR display 304*c* may include a single LED light source and an array of micro-mirrors. In one embodiment, the VR display 304*c* may be referred to as screenless technology. It should be noted that the VR display 304*c* may superimpose 3D computer generated imagery over real-world objects by projecting a digital light field into the user's eye.

Figure 3D:
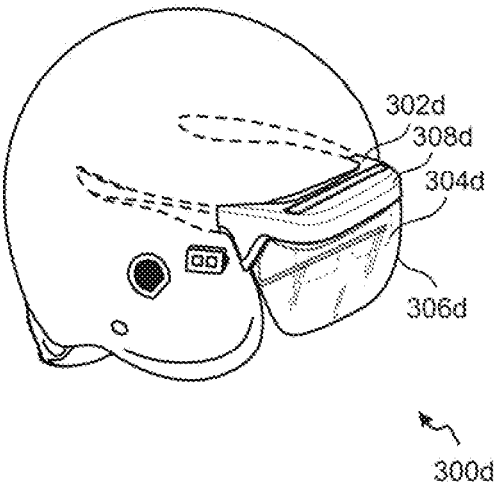
FIG. 3D illustrates an alternate embodiment of a helmet integrated with multiple-focal plane projection technology, in accordance with at least one embodiment.

FIG. 3D illustrates an alternate embodiment of a helmet 300*d*, in accordance with at least one embodiment. The helmet 300*d* may be integrated with the wearable glasses 302*d*. The wearable glasses 302*d* may include one or more lenses 304*d* and a screen 306*d* that may be coupled to a frame 308*d*. The helmet 300*d* may be integrated with projection technology capable of displaying multiple focal planes, sometimes called "light field" technology. By emulating light coming from multiple angles entering the eye, images and/or videos of the players look more realistic as the players look closer to reality. In some embodiments, the wearable glasses 302*d* may be integrated with multiple-focal plane projection technology.

Each of the helmets 300*a*, 300*b*, 300*c* and 300*d* may include a CPU. Further, each helmet 300*a*, 300*b*, 300*c* and 300*d* may be integrated with a wireless antenna 308*b*. In some embodiments, each helmet 300*a*, 300*b*, 300*c* or 300*d* may receive data from an external device via the wireless antenna 308*b*. Thereafter, each helmet 300*a*, 300*b*, 300*c* and 300*d* may display the data on the display screen 302*a*, 302*b*, 302*c*, and 302*d*, respectively. It should be noted that each helmet 300*a*, 300*b*, 300*c* and 300*d* may include an accelerometer along with G-force sensors that are calibrated to harmful levels of collision, without departing from the scope of the disclosure.

It will be apparent to one skilled in the art that the helmet 300*a*, 300*b*, 300*c*, and 300*d* may include other components such as one or more cameras, sensors, Wi-Fi, and/or microphones. Further, functionality of the helmet 300*a*, 300*b*, 300*c*, and 300*d* may be integrated with the helmet 116 without departing from the scope of the disclosure. Similarly, functionality of the wearable glasses 302*a*, 302*b*, 302*c*, and 302*d* may be integrated with the wearable glasses 118 without departing from the scope of the disclosure.

It will be apparent to one skilled in the art that other methods may be used to display holographic information for a user, such as commercially available current holograms (e.g., free space, volumetric imaging, ionizing air, or lasers on a 3D substrate), air ionization using lasers, laser projection on fog, medium-based holography, Pepper's ghost and full-sized "holography" in which the user may see the image with a mirror (e.g., the "Tupac" hologram technique routinely used to create live stage displays of non-living artists), non-3D head-tracking perspective, projection on film or a translucent window. and/or any future holography techniques.

Figure 4A:
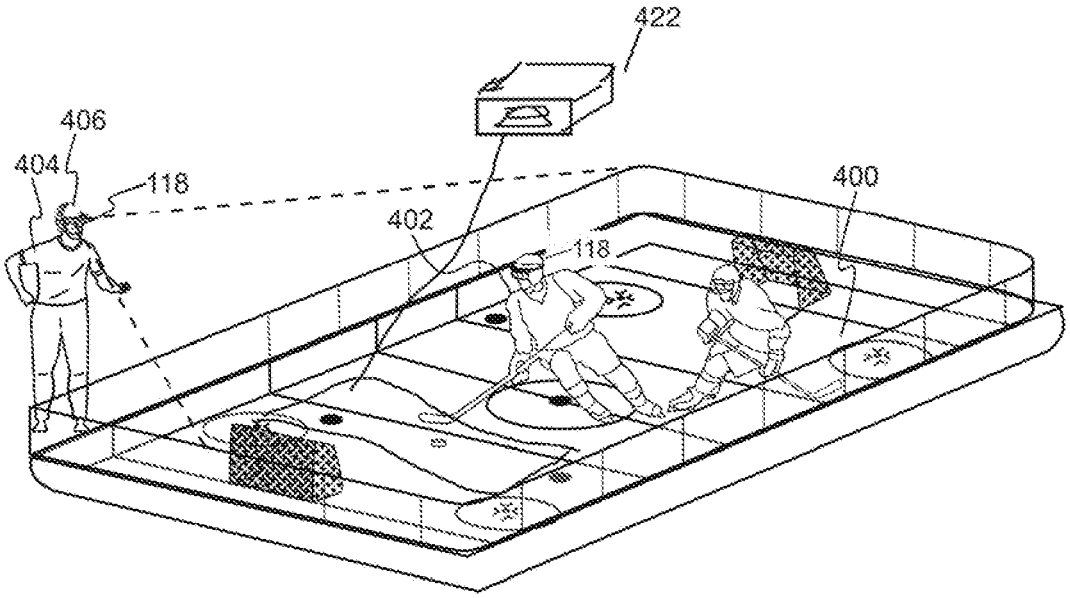
FIG. 4A illustrates an ice hockey rink, where a coach is watching an ice hockey game, in accordance with at least one embodiment.

FIG. 4A illustrates an ice hockey rink 400, in accordance with at least one embodiment. The ice hockey rink 400 may include a plurality of players 402 playing ice hockey. The plurality of players 402 may wear the wearable glasses 118. Further, a coach 404 equipped with wearable glasses 118 may watch the ice hockey game through an AR interface of the wearable glasses 118. The coach 404 may stand along a side of the ice hockey rink 400. In one embodiment, the coach 404 may monitor the ice hockey game and may check movements of the players 402 in real time, using the wearable glasses 118. In some embodiments, the coach 404 may communicate with the players 402 using directional headphones 406. It should be noted that the directional headphones 406 may be integrated with the wearable glasses 118. In some embodiments, the rink can be surrounded with cameras and capture devices, such as is schematically indicated in FIG. 1. In some embodiments, a laser display device 422, mounted at the side or above rink, may be used to draw regions on the ice visible to the players, indicating things such as where to go to, where to hit, where to practice a movement, etc. In one embodiment, the puck 410 may be integrated with an accelerometer to track the puck 410 and measure the forces exerted. In some embodiments, the puck 410 may be integrated with a spin detector for calculating curves, such as dots or indicia on the puck 410. Further, the puck 410 may receive positional signals indicating one or more boundaries of the ice hockey rink 400. In one embodiment, if the puck 410 goes into a certain area, the puck 410 may change color from green to red. In another embodiment, if the puck 410 goes into a critical area, the player 402 may hit the puck 410 or the player 402 may take a defensive position. Such a method of changing the color of the puck 410, in real time or in an AR overlay, may be useful for training users.

In an alternate embodiment, the coach 404 may view the ice hockey game on a tablet. Further, the coach 404 may touch on an interface of the tablet to draw maneuvers. In one embodiment, the coach 404 may tap on an icon or a representation of a particular player 402. As a result of the coach's tapping, the coach 404 may be able to see information related to the player 402. The information may correspond to statistics of the player 402 in a practice session. The information may include, but is not limited to, how the player 402 performed in the practice session and/or how many games the player 402 has played, the amount of energy consumed by the player, the velocity or direction in which the player is moving, the size and/or height of the player, statistics about the player (e.g., scoring average), etc. Further, the coach 404 may draw a plan using the tablet interface. The coach 404 sketches a game plan (strategy) on the tablet for the player 402 to execute while playing the ice hockey game. Thereafter, the plan may be displayed on an interface of the wearable glasses 118 worn by the player 402.

Figure 4B:
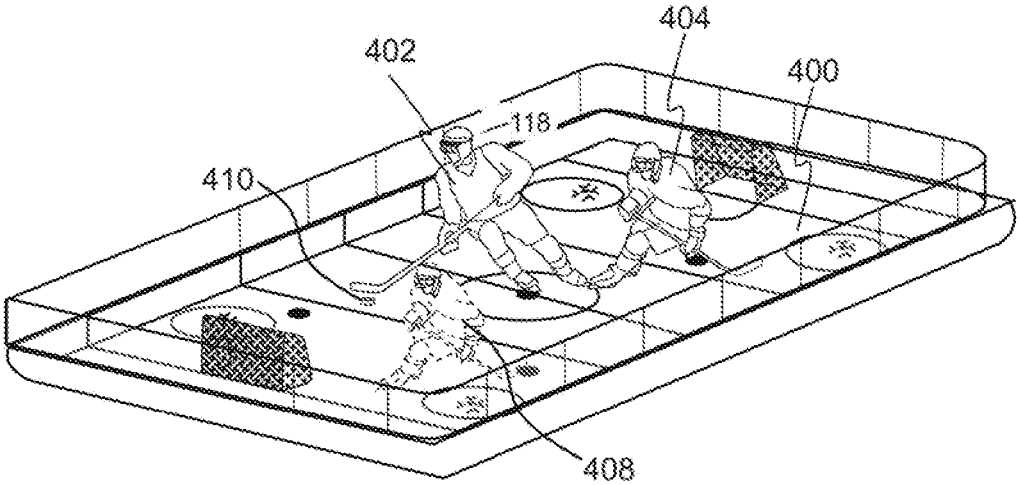
FIG. 4B illustrates the ice hockey rink, where a player is watching a virtual reality (VR) ghost of the coach in a real time, in accordance with at least one embodiment.

As shown in FIG. 4B, the coach 404 may record and demonstrate a specific practice routine presenting a holographic virtual coach for his students. Students can practice and follow behind the virtual coach. Coach 404 can train the other players 402. Successively, the coach 404 may show one or more techniques or moves to the players 402 on the ice hockey rink 400. In one embodiment, a player 402 may see a VR ghost 408 of the coach 404 on the interface of the wearable glasses 118 worn by the player 402. The VR ghost 408 of the coach 404 may appear life-size and show a technique such as how to hit a puck 410. In one embodiment, the coach may follow along behind players so that he can directly observe their activity, and a camera recording the coach's movements projects a holographic virtual image of the coach in real-time to the wearable glasses 118. In another embodiment, an actual, physically present coach may perform an action and one or more students performs the action (follow the leader), and the coach can see on their own wearable glasses 118 the action that is happening behind them through a camera mounted on the back of the coach's head.

Figure 4C:
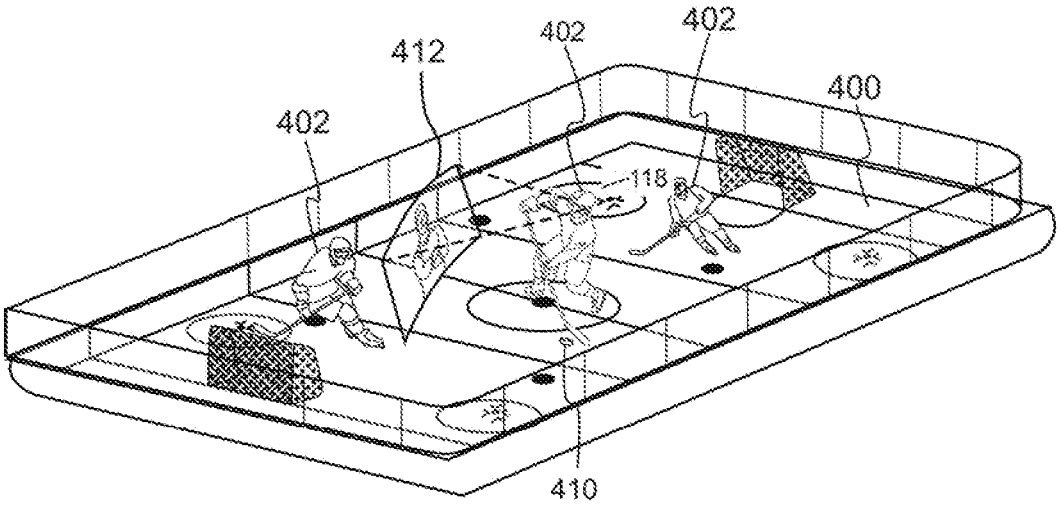
FIG. 4C illustrates the ice hockey rink where the player is watching one or more instructions of the coach on an augmented reality (AR) interface of the wearable glasses worn by the player, in accordance with at least one embodiment.

As shown in FIG. 4C, the player 402 may view a virtual coach 412 on the AR interface of the wearable glasses 118. It should be noted that the virtual coach 412 may not be present on the ice hockey rink 400, but may be either a recording of an earlier coaching session (time shifting), and/or a coach delivering real time coaching from another location (space shifting). Further, the virtual coach 412 may provide one or more instructions to the player 402. The one or more instructions may be displayed on the wearable glasses 118, such as a puck trajectory to the player 402 and/or the proper position the player 402 should be in to hit the puck. Thereafter, the player 402 may replay the one or more instructions given by the virtual coach 412. In an example, when the player 402 hits the puck 410, the puck 410 may be moved based on an initial speed, a velocity vector, and an angle of attack.

Figure 5A:
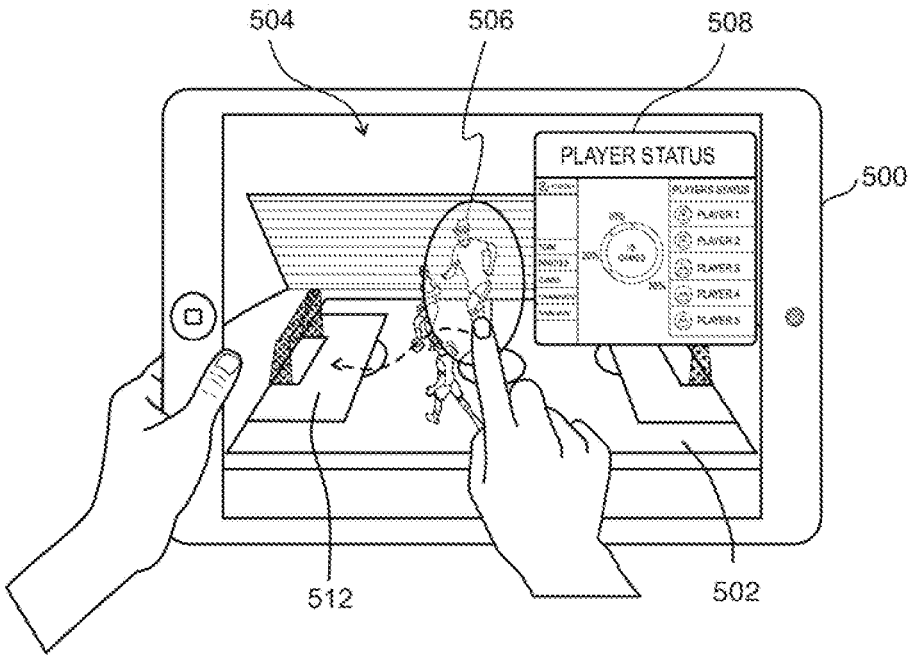
FIG. 5A illustrates a tablet showing a coach drawing a maneuver of a soccer field on the tablet, in accordance with at least one embodiment.

FIG. 5A illustrates a tablet 500, showing a coach drawing a training routine on a soccer field 502 on the tablet 500, in accordance with at least one embodiment. The coach may touch an interface 504 of the tablet 500 to draw the maneuver. In one embodiment, the coach may tap on an icon or a representation of a particular player 506. Based at least on the icon selection, the coach may be able to see information 508 related to the player 506. The information 508 may correspond to statistics of the player 506 in a practice session. The information 508 may include, but is not limited to, how the player 506 performed in the practice session and/or how many games the player 506 has played. It should be noted that each device such as the tablet 500 may be assigned to a user and logged in a database and associated with the user. In one embodiment, if the device is changed due to replacement or repair, the database may be updated and the information 508, such as performance and motion, may be recorded for the player 506.

Figure 5B:
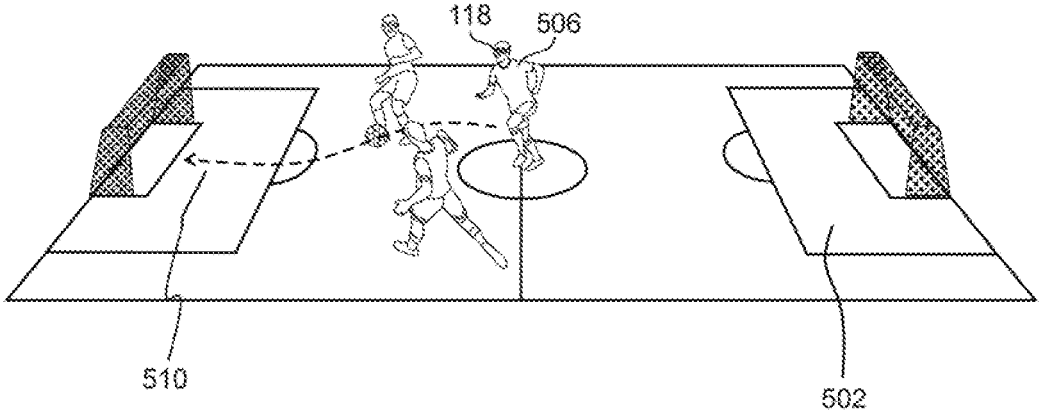
FIG. 5B illustrates a top view of a soccer field, in accordance with at least one embodiment.

Further, the coach may draw a plan on the interface 504 of the tablet 500. The plan may correspond to a game plan for the player 506 to execute while practicing or playing a game. As shown in FIG. 5B, a path (shown by an arrow 510) may be drawn by the coach for the player 506 to follow while playing the game.

Figure 6:
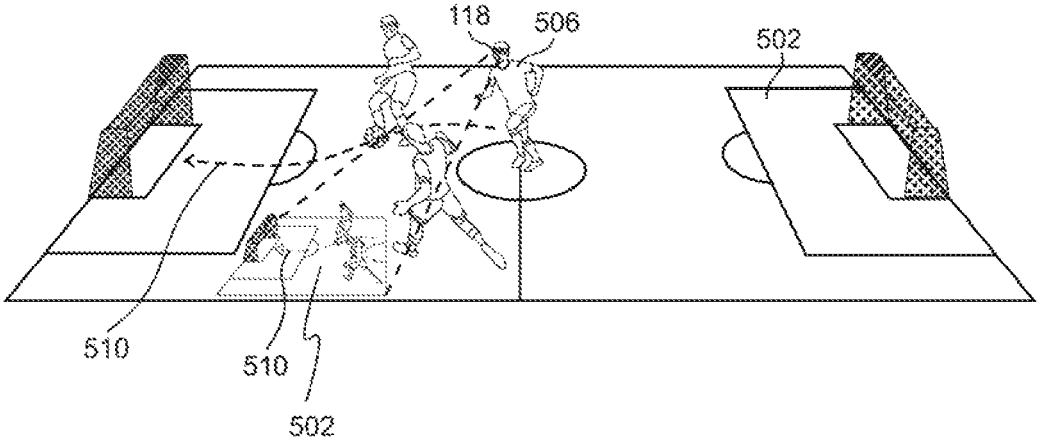
FIG. 6 illustrates a top view of the soccer field showing a path viewed by the player on an AR interface of the wearable glasses, in accordance with at least one embodiment.

As shown in FIG. 6, the path 510 may be displayed to the player 506 on the AR interface of the wearable glasses 118. It should be noted that the wearable glasses 118 may be worn by the player 506. In one embodiment, if the player 508 deviates from the path 510, then the player 506 may be able to see non-original path on the AR interface of the wearable glasses 118. In an alternate embodiment, the coach using the tablet 500 in FIG. 5A may monitor the game and may view or review the movements of the player 506. Based at least on the review, the coach may revise the path that needs to be followed during a practice session. In an example, a combination of the Global Positioning System (GPS), on-field location tracking, dead-reckoning, and other techniques may be used to define a trajectory for the player 506. The trajectory may be followed by the player 506 during the practice session. Such mechanisms may be used for training the player 506. It should be noted that the system may use artificial intelligence (AI) techniques as well, to analyze the motion of players within the game and to provide scenarios to train the players, without departing from the scope of the disclosure.

It will be apparent to one skilled in the art that the above-mentioned tablet 500 of the coach has been provided only for illustrative purposes. In other embodiments, the coach may use some other computing device, such as a desktop, a computer server, a laptop, a personal digital assistant (PDA), and/or a tablet computer as well, without departing from the scope of the disclosure.

Figure 7A:
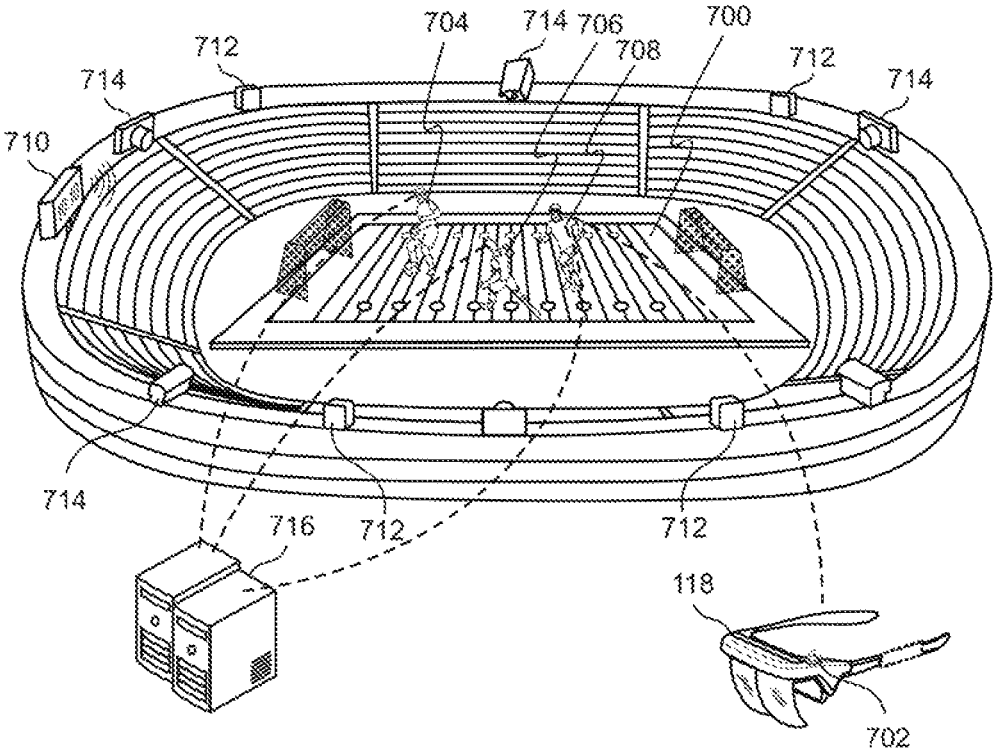
FIG. 7A illustrates an alternate embodiment of a soccer field showing a plurality of players wearing the wearable glasses, in accordance with at least one embodiment.

FIG. 7A illustrates an alternate embodiment of a soccer field 700 showing a plurality of players wearing the wearable glasses 118, in accordance with at least one embodiment, the each of the wearable glasses 118 having a first set of cameras 702. In one embodiment, the first set of cameras 702 may be 360-degree cameras. In another embodiment, the first set of cameras 702 may be 180-degree cameras and/or 720-degree cameras. The first set of cameras 702 may capture data such as positional data, streaming data, and/or visual data of other players at one or more times. In one embodiment, the first set of cameras 702 may be three. In other embodiments, the first set of cameras 702 may be less than three or more than three, without departing from the scope of the disclosure.

As an example, the wearable glasses 118 of a first athlete 704 may capture visual and positional data related to a second athlete 706 and a third athlete 708. Similarly, the wearable glasses 118 of the second athlete 706 may capture visual data and positional data related to the first athlete 704 and the third athlete 708. Similarly, the wearable glasses 118 of the third athlete 708 may capture visual data and positional data related to the first athlete 704 and the second athlete 706. It should be noted that time and position of each one of the first set of cameras 702 may be synchronized using a clock sync transmitter 710. In some embodiments, the clock sync transmitter 710 may transmit the clock via Bluetooth, Wi-Fi, Ethernet, radio frequency (RF), and/or other signal channels. In one embodiment, the clock sync transmitter 710 may provide timecodes above 100 frames per second (fps). It should be noted that the clock sync transmitter 710 may be used by the wearable glasses 118 to timecode all events that are recorded by the first set of cameras 702 and to synchronize the data.

In some embodiments, the wearable glasses 118 may include a positional receiver 712 for detecting the position and orientation of the glasses, and thus the user. Such techniques may be used for tracking the first set of cameras 702—i.e., where a camera is looking. In some embodiments, a beacon and audio time sync module may be used. In some embodiments, augmented or virtual reality positioning techniques may be used in conjunction with the first set of cameras 702. It will be apparent to one skilled in the art that one or more base stations, brighter IR or other frequencies of lights or RF may be used, without departing from the scope of the disclosure.

Further, a second set of cameras 714 may be positioned at one or more edges of the soccer field 700. It should be noted that the second set of cameras 714 may be placed at strategic positions. The second set of cameras 714 may capture visual data and/or positional data of the soccer field 700 with one or more timestamps (i.e., timecodes). Timecodes may need to be more granular than 30 fps, and may need to be as granular as 1,000 fps. In an example, the second set of cameras 714 may be a lidar. After capture, the visual data and/or positional data may be synchronized using the clock sync transmitter 710. Further, each one of the first set of cameras 702 and the second set of cameras 714 may be wirelessly coupled to a visual data processor 716. The visual data processor 716 may receive the positional data and/or the visual data from the first set of cameras 702 and the second set of cameras 714. Thereafter, the visual data processor 716 may combine the positional data and the visual data to extract the position and orientation of each player on the soccer field 700. Further, the visual data processor 716 may extract player's skeletal kinematics to create skeletal views of the player. Such extraction of the position and orientation of each player may be used in training users.

Figure 7B:
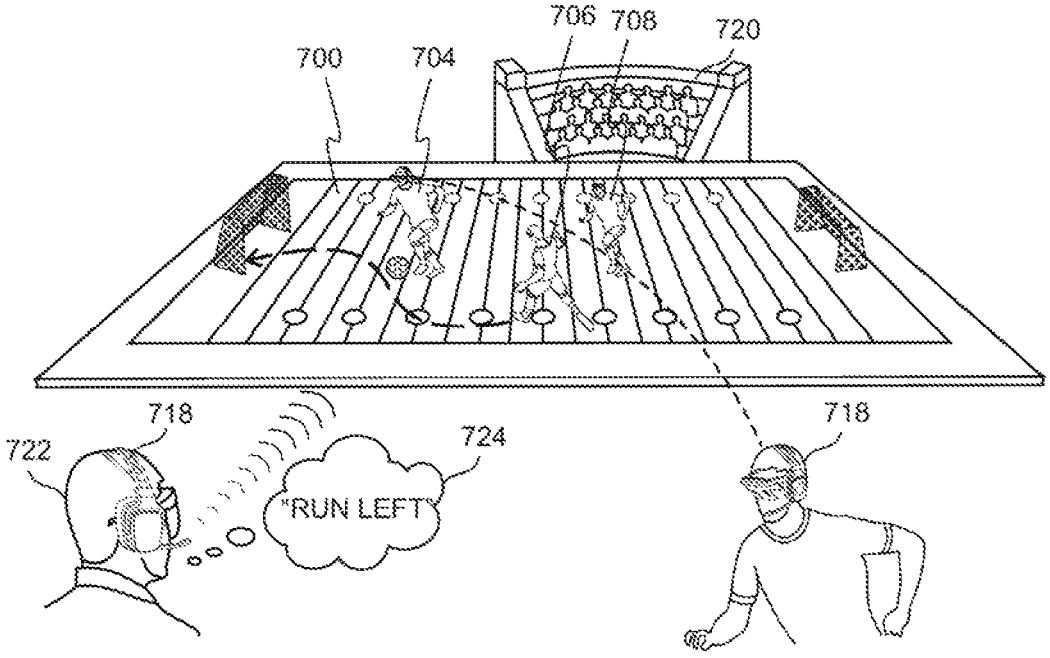
FIG. 7B illustrates a coach communicating with a first athlete using directional headphones in real time, in accordance with at least one embodiment.

As shown in FIG. 7B, the wearable glasses 118 may be capable of capturing sounds from the surroundings. The wearable glasses 118 may be integrated with directional headphones and microphones 718. In an example, sounds from an audience 720 and sounds from the plurality of players may be captured by the wearable glasses 118. Further, the directional headphones 718 may pass information through external audio to other players with low latency. Further, the wearable glasses 118 may include digital signal processing (DSP) filtering to perform noise cancelling to eliminate such sounds as the wind, ambient sound, noise of vehicles, and/or the sound of the audience 720. It should be noted that each sport has a sound profile, with different profiles during play versus during practice. For example, in a car, the cancelled noise may be motor noise. A driver may speak normally as the combination of the directional headphones 718 and the DSP may remove the engine noise from the sound of the directional headphones 718. Similarly, the directional headphones 718 may clean up the sounds for the people on the soccer field 700 and may remove the sounds of the audience 720. It should be noted that the noise of the audience 720 may be different form the car noise. In some embodiments, the correct profile may be selected automatically based on the location and the detected sounds. Further, the DSP filter may be turned off and on automatically to allow nearby sounds such as someone running towards a player.

As shown in FIG. 7B, a coach 722 wearing the directional headphones 718 may give instructions 724 to the first athlete 704 in the real time—for example, the instructions 724, such as, "Run left" or "Steer Left," etc. Thereafter, the first athlete 704 may listen to the coach 722 and may follow the instructions 724. In some embodiments, the instructions 724 may be displayed to the first athlete 704 on an AR interface of the wearable glasses 118. It should be noted that an indicator of what the coach 722 said, as a transcription, a confidence percentage, or a color of what the system thinks that the coach 722 said, may be shown to the first athlete 704. In an alternate embodiment, if the coach 722 makes a non-verbal utterance, then the system may record the time and the sound of the coach 722. Thereafter, the system may perform analysis of the exact time and vocal sounds of the coach 722. Thus, such a system may focus on or amplify nearby sounds but filter out far-field sounds.

Figure 8:
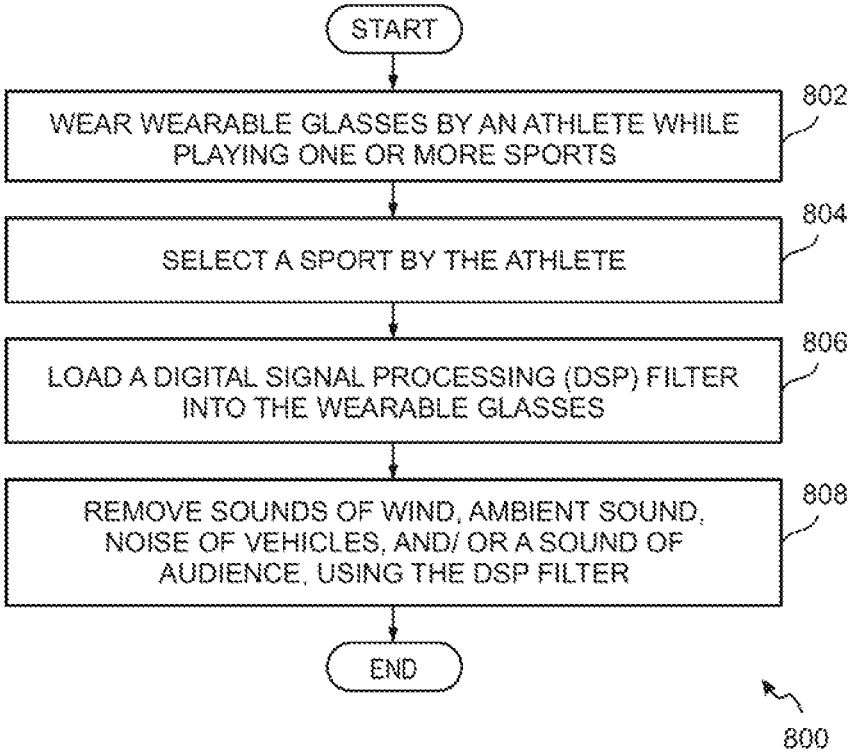
FIG. 8 illustrates a flowchart showing a method for filtering ambient sound, in accordance with at least one embodiment.

FIG. 8 illustrates a flowchart 800 showing a method for filtering out ambient sound, in accordance with at least one embodiment. The flowchart 800 is described in conjunction with FIGS. 5A, 5B, 6, 7A, and 7B.

At first, the wearable glasses 118 may be worn by an athlete while playing one or more sports, at step 802. The wearable glasses 118 may include an AR interface and directional headphones. The directional headphones may pass information through external audio to other players with low latency. Successively, a sport may be selected by the athlete, at step 804. In one embodiment, the sport may be detected based at least on the location and sounds of the users. The detected sport may include, but is not limited to, soccer, American football, baseball, tennis, volleyball, and/or vehicle racing. Successively, a DSP filter may be loaded into the wearable glasses 118, at step 806. Thereafter, sounds of wind, ambient sound, noise of vehicles, and/or the sound of the audience, may be removed using the DSP filter, at step 808.

Figure 9A:
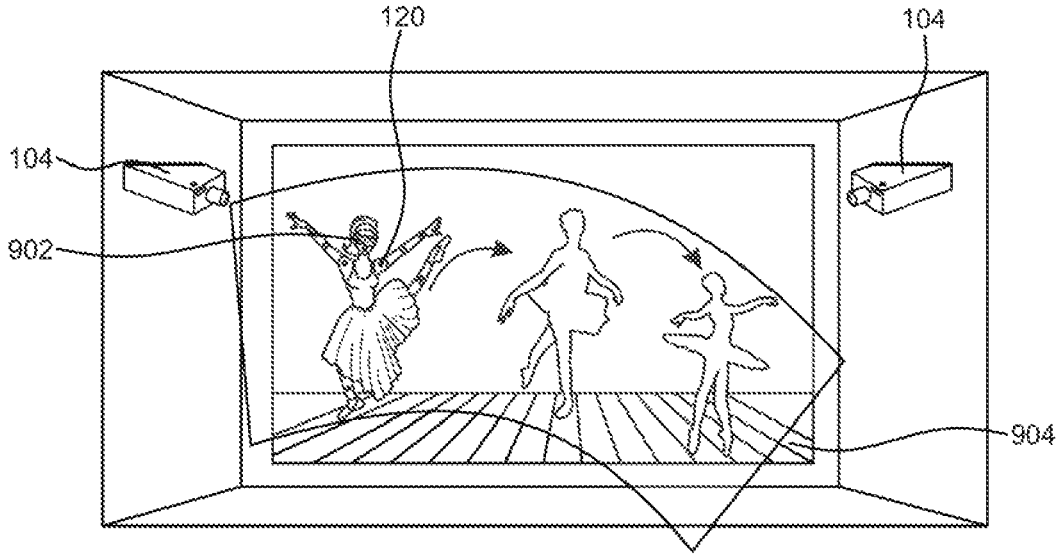
FIG. 9A illustrates a first dancer going through a dance routine, in accordance with at least one embodiment.
Figure 9B:
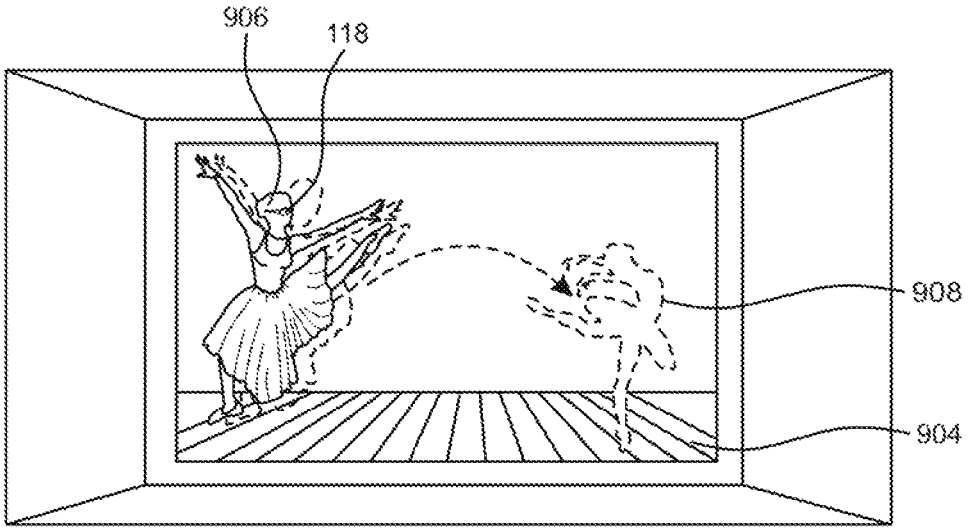
FIG. 9B illustrates a second dancer learning movements of the first dancer, in accordance with at least one embodiment.

FIG. 9A illustrates a first dancer 902 going through a dance routine, in accordance with at least one embodiment. The first dancer 902 may perform the dance on a stage 904. The motion of the first dancer 902 may be captured using a mocap suit 120 and the one or more cameras 104. The first dancer 902 may wear the wearable glasses 118 for recording one or more dance steps. In one embodiment, the first dancer 902 may be a teacher. In some embodiments, the movements of the dancer 902 may be recorded by other dancers. Further, a second dancer 906 wearing the wearable glasses 118 may try to follow the recorded dance routine of the first dancer 902, shown in FIG. 9B. In one embodiment, the second dancer 906 may be a trainee. The recorded dance steps may be in the form of a translucent image and VR ghosts 908 of the first dancer 902. It should be noted that changes in the movement of the first dancer 902 may be recorded at various keyframes at key time intervals. Thereafter, the second dancer 906 may follow the VR ghosts 908 of the first dancer 902 to learn the one or more dance steps.

Figure 9C:
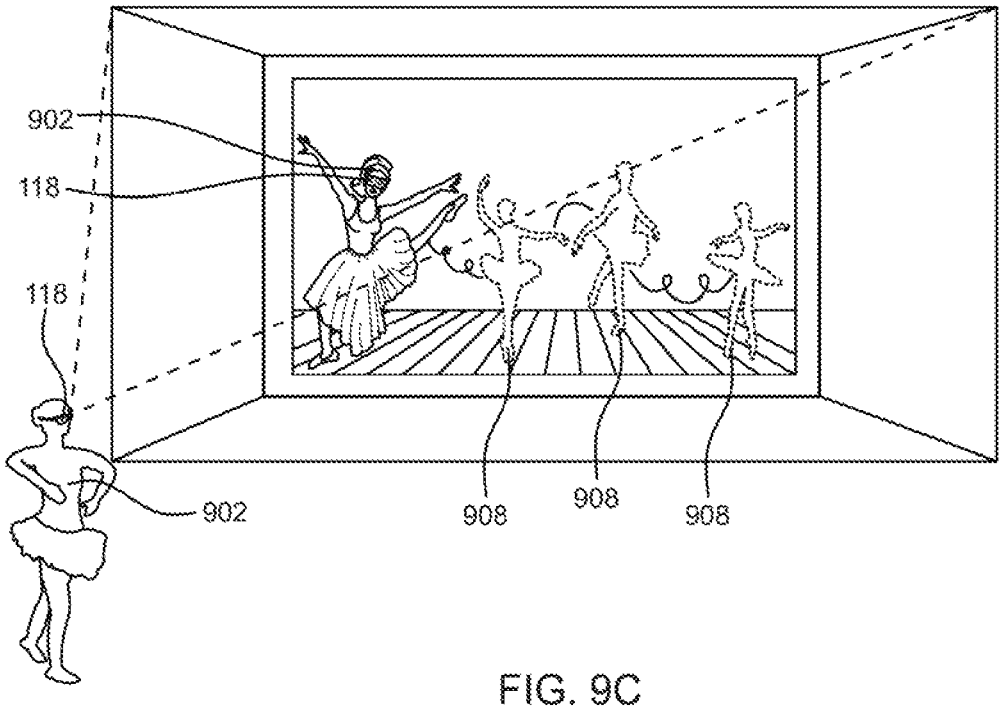
FIG. 9C illustrates the first dancer standing at one side and reviewing one or more dance steps, in accordance with at least one embodiment.

As shown in FIG. 9C, the first dancer 902 may stand at one side and see the one or more dance steps performed by the first dancer 902. The first dancer 902 may review all the movements and the positions of the one or more dance steps. In one embodiment, the first dancer 902 may view the VR ghosts 908 of the first dancer 902. It should be noted that the first dancer 902 may view the one or more dance steps through the wearable glasses 118. In some embodiments, the first dancer 902 may view virtual marks, spots for turns, and a line. The line may indicate where to perform the turns, including the locations or marks on the line at which to coordinate jumps. In one embodiment, the turns may correspond to chainé turns.

Figure 10A:
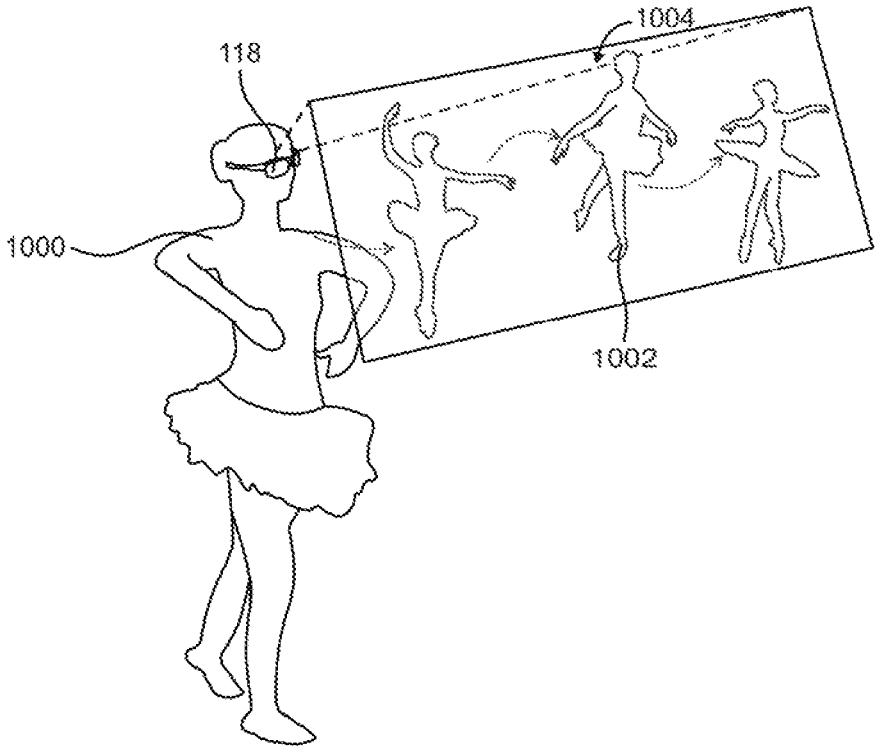
FIG. 10A illustrates a dancer learning one or more dance steps of the dance, in accordance with at least one embodiment.

FIG. 10A illustrates a dancer 1000 learning one or more dance steps 1002 of the dance, in accordance with at least one embodiment. The dancer 1000 wearing the wearable glasses 118, may stand at one side and view the recording. Such recording may be helpful for the dancer 1000 to learn the movements and the positions of the dance. In one embodiment, the dancer 1000 may view the one or more dance steps 1002 on an AR interface 1004 of the wearable glasses 118.

Figure 10B:
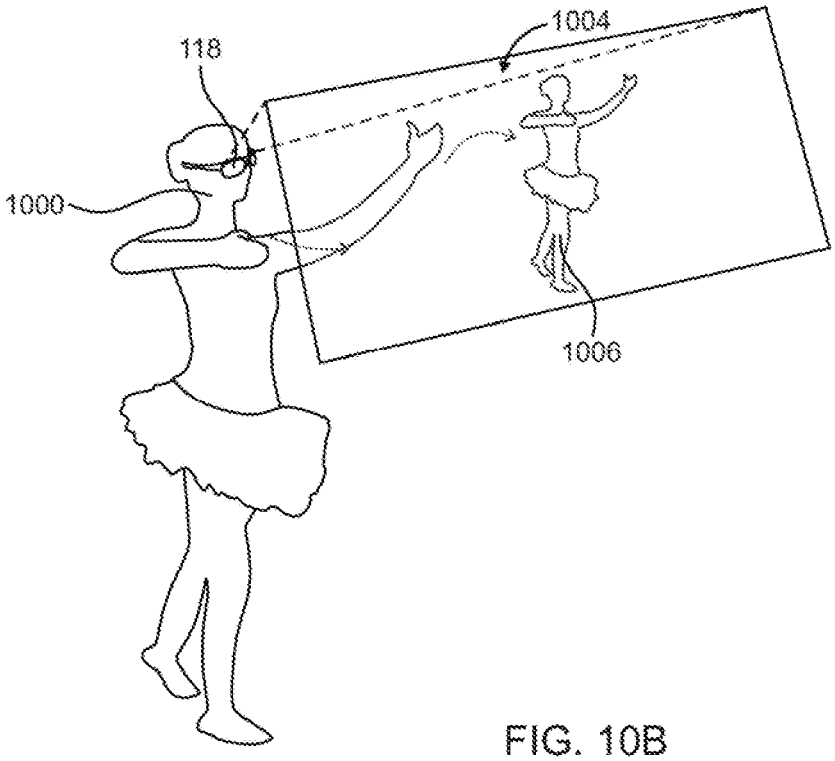
FIG. 10B illustrates the dancer viewing a single dance step through the wearable glasses, in accordance with at least one embodiment.

FIG. 10B shows a dancer 1000 reviewing a dance step 1006 on the AR interface 1004 of the wearable glasses 118. The AR interface 1004 may allow the dancer 1000 to zoom in on the single dance step 1006, loop through a portion of the activity, reposition the activity in space to look at it from different angles, scale the image to be larger than or smaller than the viewer, play the image backwards, focus in on a portion of the image for review, or otherwise manipulate the time and space of the holographic image in "bullet time" (i.e. multi-perspective slow motion viewing as popularized by the Matrix movies).

Figure 10C:
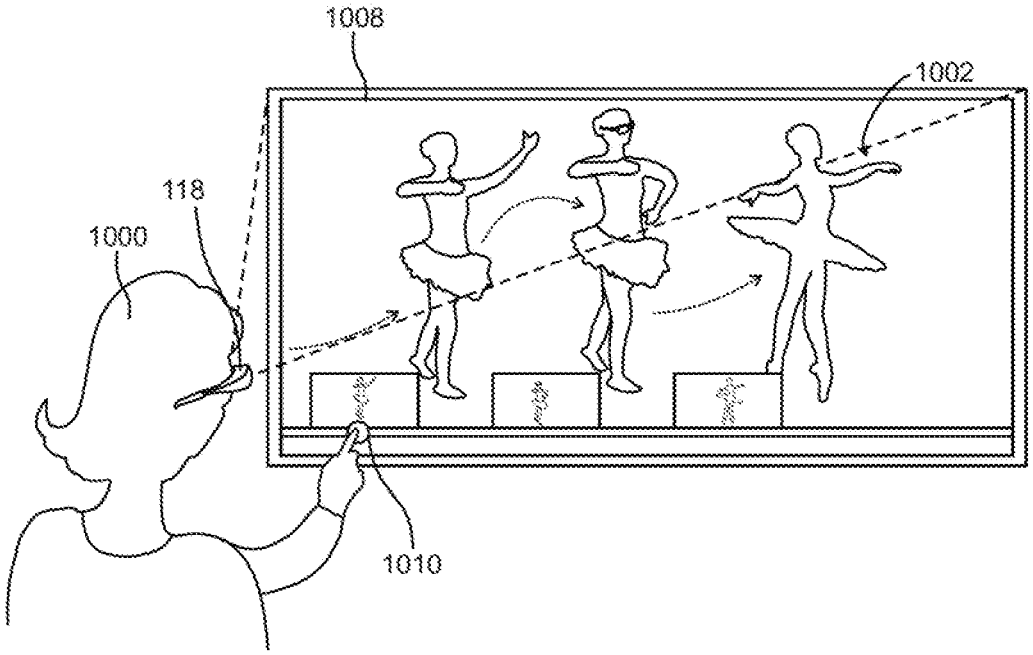
FIG. 10C illustrates a user interface of the dancer, in accordance with at least one embodiment.

FIG. 10C illustrates a user interface 1008 of the dancer 1000, in accordance with at least one embodiment. The user interface 1008 may show a video of the dancer 1000. In some embodiments, the user interface 1008 may show a video of some other dancer. The dancer 1000 may scrub through different seconds of different frames using a scrubbing tool 1010. For example, an interval such as every 10 milliseconds or every tenth of a second may be used for a single frame. The scrubbing tool 1010 may allow the dancer 1000 to scroll through 10 seconds of different frames so that the dancer 1000 may view different movements—i.e., all 3D frames for 10 seconds of the dancer 1000. It should be noted that different positions of the dancer 1000 may be viewed at a same time.

It should be noted that the user interface 1008 may be any of a number of interfaces, such as, but not limited to, the interface of a computing device, tablet, or laptop, without departing from the scope of the disclosure. In one embodiment, the user interface 1008 may be an AR interface of the wearable glasses 118.

Figure 10D:
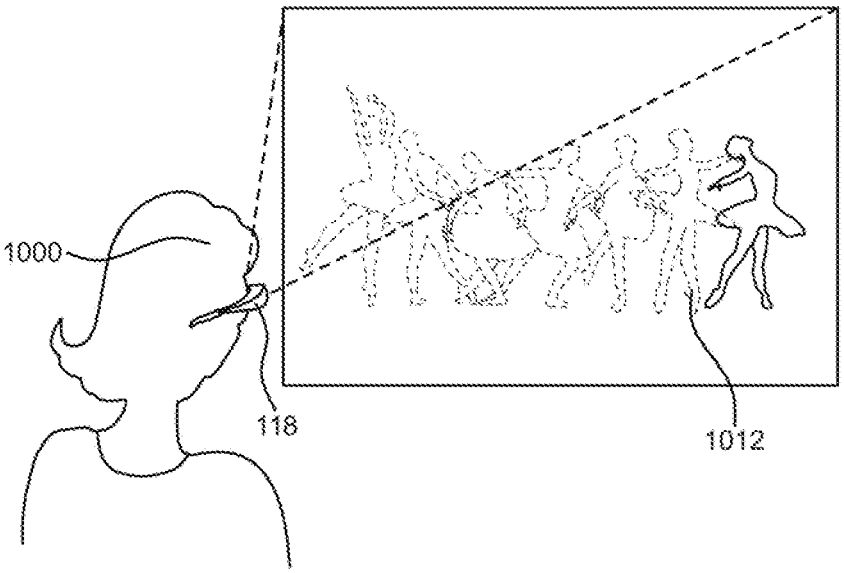
FIG. 10D illustrates superimposed frames of the one or more dance steps of the dancer, in accordance with at least one embodiment.
Figure 10E:
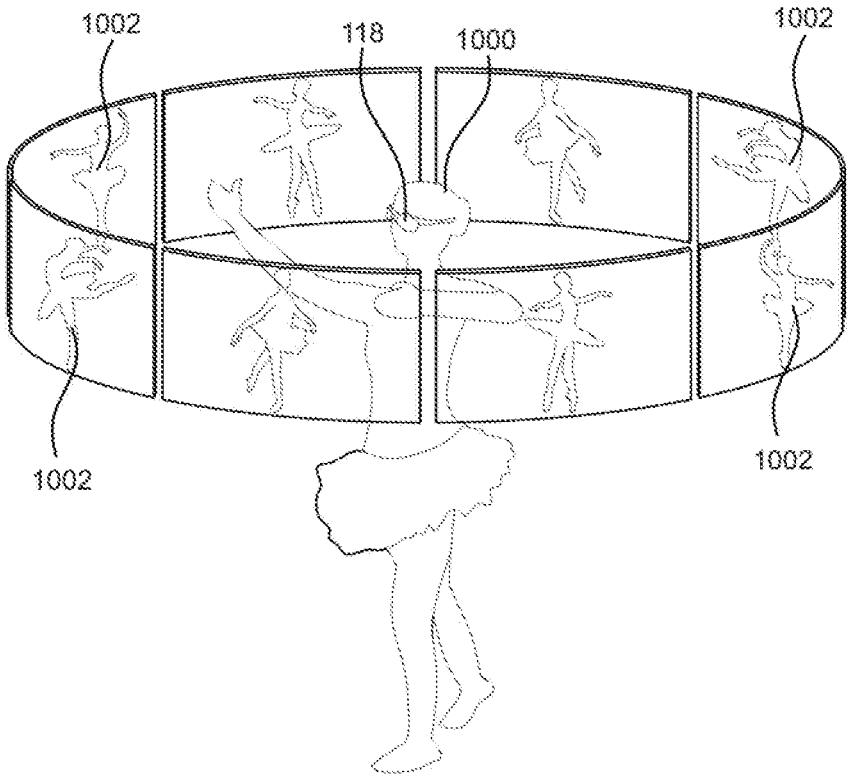
FIG. 10E illustrates the dancer moving around to look at the one or more dance steps through the wearable glasses, in accordance with at least one embodiment.

In some embodiments, the dancer 1000 may view a series of simultaneously displayed key frames 1012 of the one or more dance steps, as shown in FIG. 10D. Further, the dancer 1000 wearing the wearable glasses 118 may view a series of key frames 1002 encircling them, as shown in FIG. 10E. Further, the dancer 1000 may use a controller, such as a tablet, a motion of the dancer's 1000 hand in free space, or a handheld play controller, to rotate the interface or to scrub through video frames, either by rotating the entire interface around them, or by playing from the point in the frame in front of them. In one embodiment, if the dancer 1000 selects a frame, the frame 1002 may be displayed as bright in color and other frames 1002 may be dimmed to indicate they are not being focused upon. Further, the dancer 1000 may use hands in a widening motion to zoom in on a portion so it is larger than the actual size, and push hands together to shrink the view to smaller than the actual size. It should be noted that portions of the image outside of a 3D bounding box may be clipped so that a portion of the image may be more accurately studied without other parts of the image interfering, without departing from the scope of the disclosure.

Figure 10F:
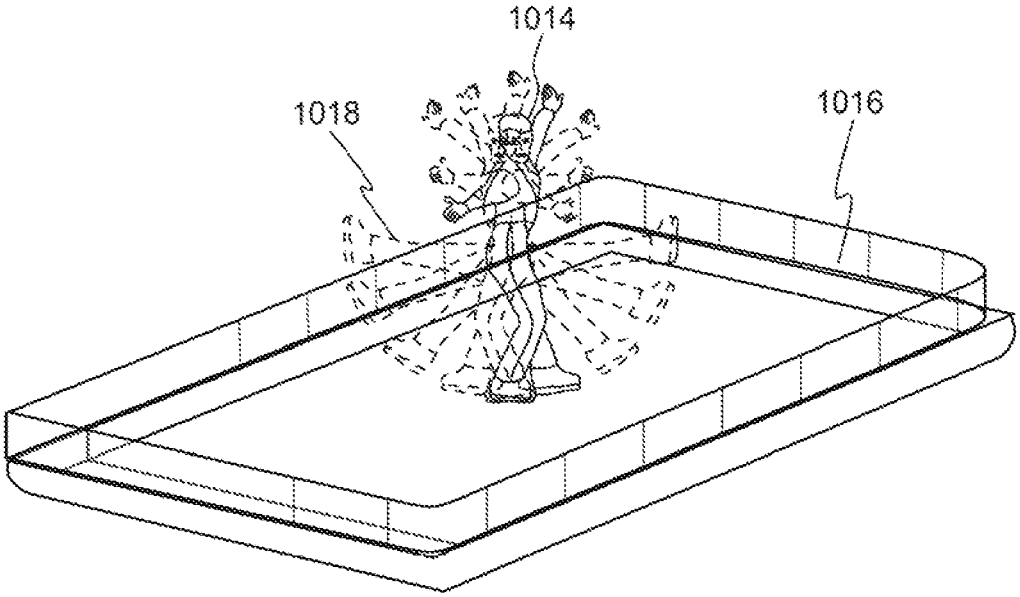
FIG. 10F illustrates a series of superimposed frames illustrating a set of motions of a figure skater, in accordance with at least one embodiment.

FIG. 10F shows a figure skater performing an in-place motion, such as a turn, crouching down, or moving the legs in a single position on the skating rink. In some embodiments, when reviewing this motion, the skater can see a set of superimposed, still, holographic frames simultaneously. As there are a large number of frames for a given motion at high frame rates, only a subset of the frames are shown—for example, every tenth frame in the sequence or only frames deemed important, such importance determined by a local maxima of motion or rate of change of a particular part of the body (legs, hands, etc.). All frames in the chosen subset are superimposed upon the same space. The viewer can "scrub" (move back and forth through recorded time using a scrubbing motion) through the key frames, which are translucent and suspended in space, and when a frame is selected it will be highlighted to make it stand out from the other frames before and after it in time. In this way, the user, wearing an augmented reality or virtual reality headset or viewing the scene holographically, is able to see the different frames of the motion simultaneously. This technique digitally simulates the effect of strobe light photography on the scene and allows the person to analyze in detail not only a single frame of motion or a single position but the sequence of movements that add up to a particular motion.

Figure 10G:
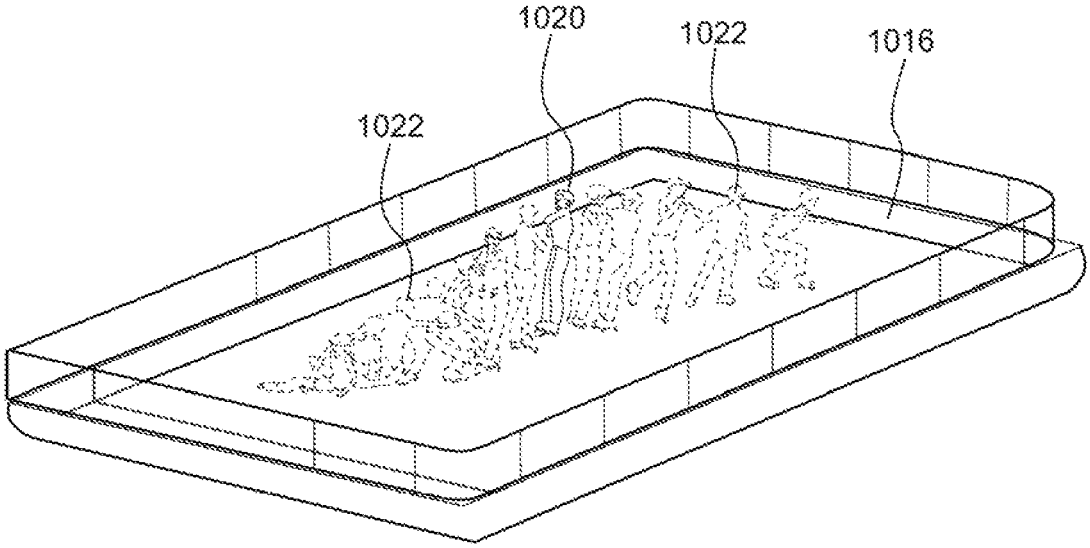
FIG. 10G illustrates a series of superimposed frames illustrating a set of motions of a figure skater, in accordance with at least one embodiment.

In some embodiments (FIG. 10G), the viewer can simultaneously see a set of key frames that add up to a particular series of motions—for instance, a skater moving through a turn and then landing on the ground, as shown from right to left; in this example, every tenth frame, for example, may be shown so that the series of still shots will simulate strobe light photography when digitally shown. The user can move through the space and see all of the stationary shots. This may be accomplished with augmented reality, virtual reality displays, or other forms of 3D spatial projection, such as holographic projection. In this way, the viewer is able to see a set of digital statues. The frame having focus is in full color, solidity, and/or brightness, and the other key frames not in focus are in shadow, dimmer, or more translucent; the user can scrub through the frames and bring the other frames into focus. The user may select a frame in the sequence, such as by placing their hands near the frame or moving their body over to the frame. Additionally, a user may be able to touch one of the frames, then move over and touch another of the frames, and the system will use those selections, remove the still frames, and animate the 3D motion between those frames. Additionally, the shadow frames may be preserved, but the motion between them animated, producing again a strobe still effect with a superimposed motion effect.

In one embodiment, the dancer 1000 may move around a room if the one or more dance steps 1002 are projected on the wall of the room. In an alternate embodiment, if the one or more dance steps 1002 or images are projected on the far screens, then the dancer 1000 may view the one or more dance steps 1002. It should be noted that each direction the dancer 1000 looks may show a different view, such as left, right, front, above, and below—the point of view changes accordingly.

Figure 11:
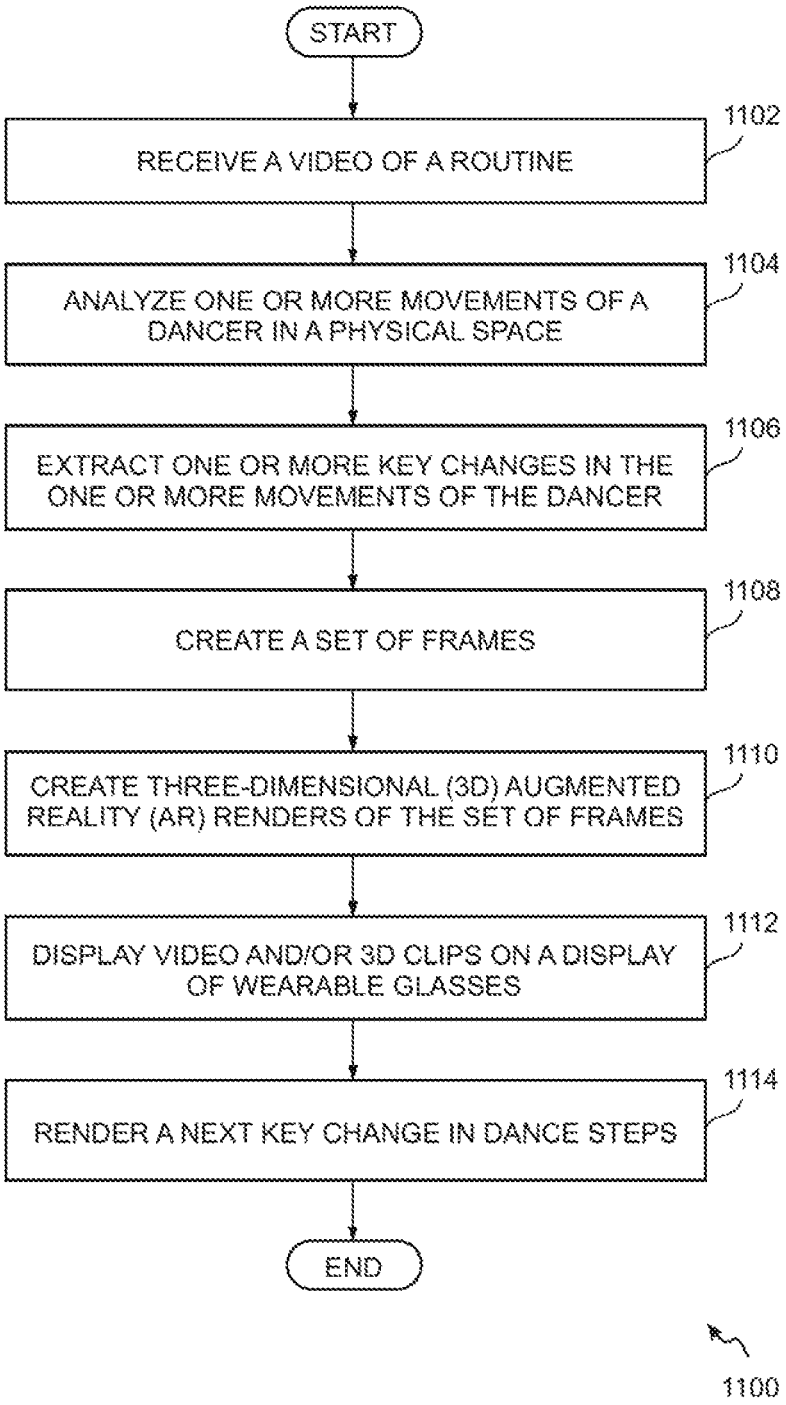
FIG. 11 illustrates a flowchart showing a method for learning the dance, in accordance with at least one embodiment.

FIG. 11 illustrates a flowchart 1100 showing a method for learning a dance, in accordance with at least one embodiment. The flowchart 1100 is described in conjunction with FIGS. 9A-9C and 10A-10E.

At step 1102, a video of a dance routine may be received. In one embodiment, the video may correspond to the dance routine of a dancer.

At step 1104, the video is analyzed to determine one or more movements of the dancer in a physical space. At step 1106, one or more key changes in the one or more movements of the dancer represented in the video may be extracted. In one embodiment, direction of the dancer in the physical space may be extracted.

At step 1108, a set of key frames may be created based at least on the one or more key changes in the one or more movements that are extracted from the video. The one or more key changes may be detected by a significant change in direction, position, or velocity. In one embodiment, short clips or animated images in the form of "key frames" or "key instants" may be created for each of the key changes.

At step 1110, 3D AR renders of the set of frames may be created. It should be noted that the 3D AR renders may be created for one or more key changes of movement of the dancer.

At step 1112, video and/or 3D clips may be delivered on the display of the wearable glasses 118. At step 1114, a next key change in dance steps may be rendered. The rendering of the key changes may be performed once a user completes a first key change. In one embodiment, the first key change may correspond to a past key change.

It will be apparent to one skilled in the art that the above-mentioned flowchart 1100 may be applicable to other sports, such as American football, as well, without departing from the scope of the disclosure.

Figure 12A:
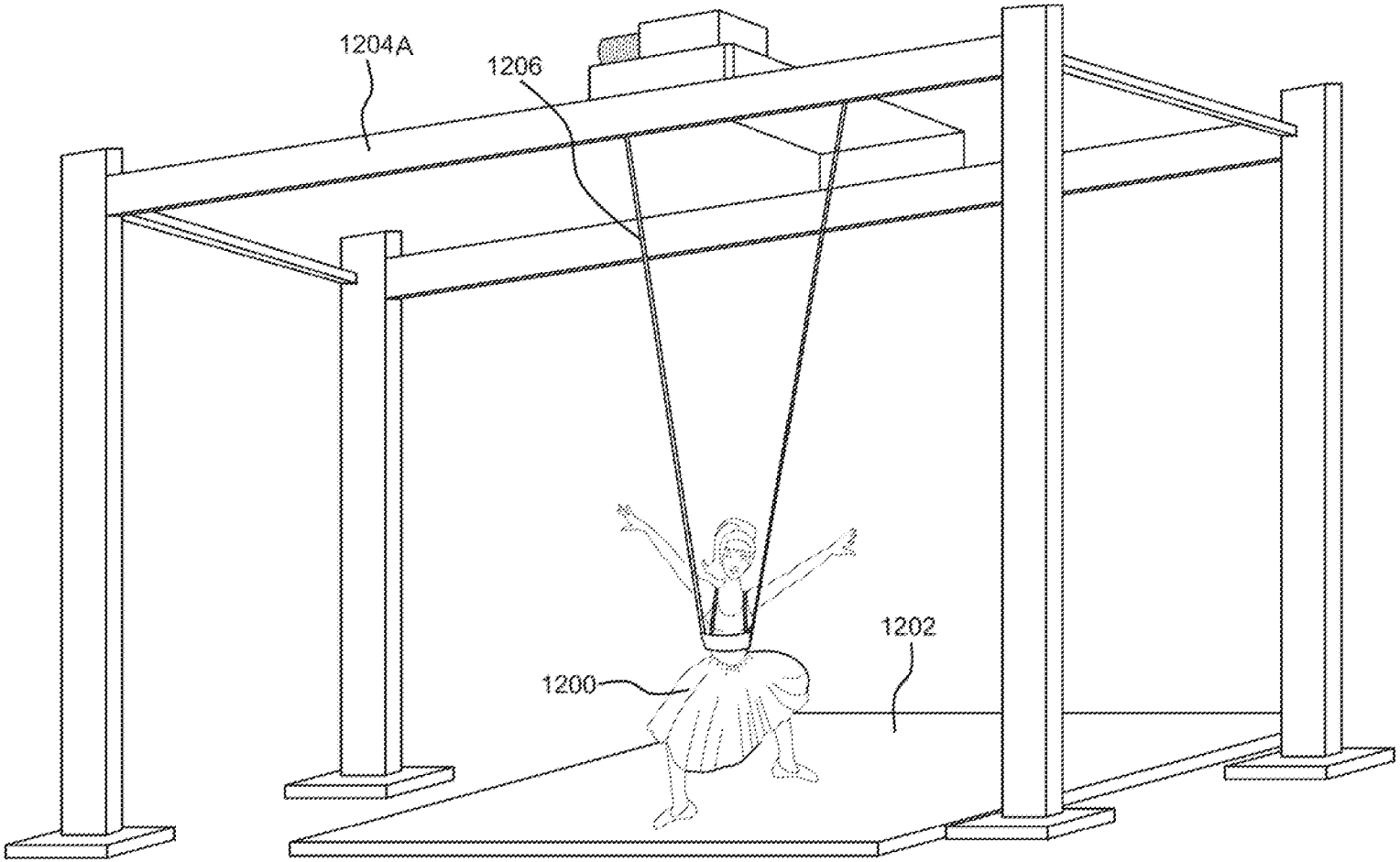
FIG. 12A illustrates a dancer practicing on a dance stage using a harness or track to assist motion of the dancer in three dimensions, in accordance with at least one embodiment.

FIG. 12A illustrates a dancer 1200 performing on a dance stage 1202 using a gantry 1204A with a motorized track capable of moving a suspension harness for the dancer, in accordance with at least one embodiment. At first, the dancer 1200 may follow a dance routine that requires aerial spins, and the gantry 1204A may assist the dancer 1200 to protect the dancer from falls or injury, as well as following and learning the dance routine. Thereafter, the dancer 1200 may rehearse the dance routine using the gantry 1204A. The gantry 1204A may assist the dancer by implementing and duplicating exact movements of the dancer 1200. It should be noted that the dancer 1200 may duplicate each motion of the dance routine using the gantry 1204A. Further, the gantry 1204A may detect tension and may avoid any injury to the dancer 1200. In some embodiments, the gantry 1204A may be used as a robotic spotter for the trainee. In such an example, the gantry 1204A may take the slack out of and follow the trainee's line as the trainee practices. The gantry 1204A may also automatically take the slack out of the line to elevate the trainee, doing so on the same acceleration curve the trainee is undergoing. This mechanism may adjust for trainee's weight and the speed of the trainee's jump. In some embodiments, a computer may be programmed to re-apply gravity so as to never let the trainee land too hard. Further, the gantry 1204A may help the dancer 1200 to do difficult movements and may allow the dancer 1200 to learn the difficult movements. In one embodiment, when the dancer 1200 may push hard enough to do the dance routine without the gantry 1204A, then the gantry 1204A may sense and may indicate by lowering tension on lines 1206.

It should be noted that the gantry 1204A may be substituted with a movable crane or some other machine without departing from the scope of the disclosure. In other embodiments, the gantry may be used to simulate other athletic conditions. For instance, the gantry 1204A can be used to practice weightlessness and can be used to practice landing while parachuting, by providing the same real-time dynamic counterbalancing to the user's own motion as would be experienced in these environments.

Figure 12B:
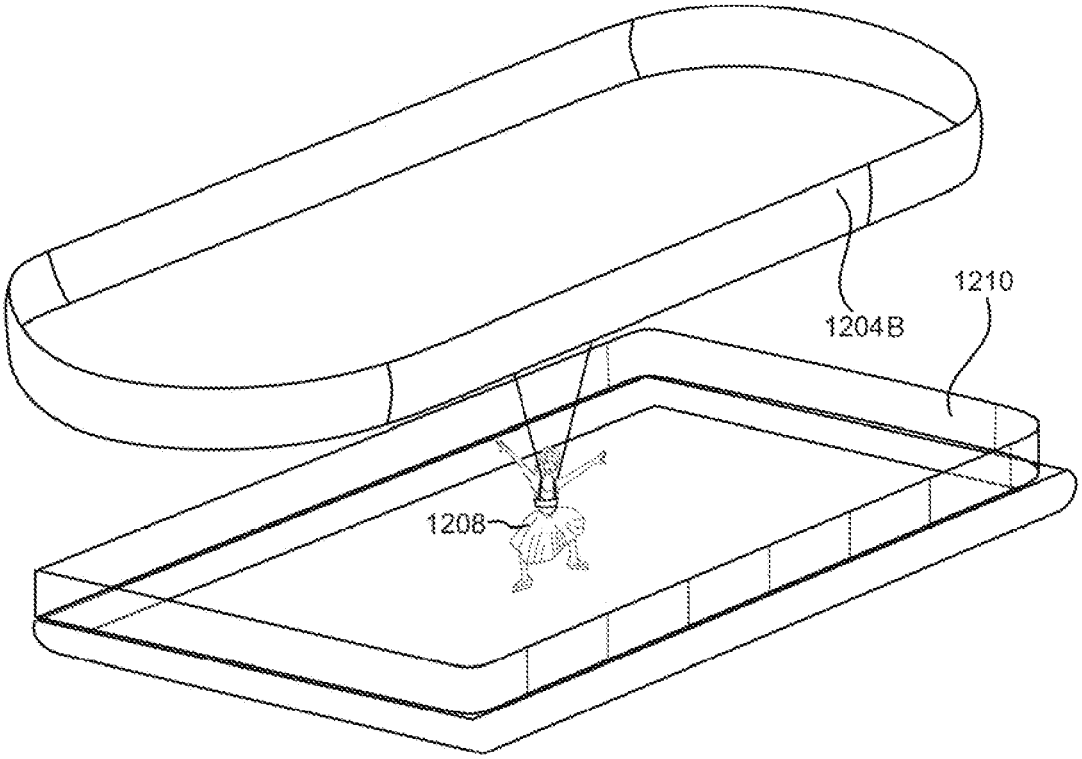
FIG. 12B illustrates a figure skater practicing on an ice skating rink using an oval suspension track, in accordance with at least one embodiment.

FIG. 12B illustrates a figure skater 1208 performing on an ice skating rink 1210 using a suspension track 1204B, in accordance with at least one embodiment. The track may be a mechanical tension track that merely follows the skater (like a zipline) and prevents the skater from falling. The track may have a mechanical sensor that automatically adjusts the tension of the cord to the figure skater to prevent the skater from falling and which follows the skater's speed of motion. Additionally, the motorized track may store a dance move after training and automatically reproduce these motions (adding and releasing tension, raising and lowering the dancer) according to a learned or pre-programmed routine. It should be noted that the frame of the suspension track 1204B may be circular, oval, or other shapes above the track without departing from the scope of the disclosure. In some embodiments, the suspension track 1204B may be used as a robotic spotter for the trainee. In such an example, the suspension track 1204B may take the slack out of and follow the trainee's line. The suspension track 1204B may also automatically take the slack out of the line to elevate the trainee, doing so on the same acceleration curve the trainee is undergoing. This mechanism may adjust for trainee's weight and the speed of the trainee's jump. In some embodiments, a computer may be programmed to re-apply gravity so as to never let the trainee land too hard.

Figure 12C:
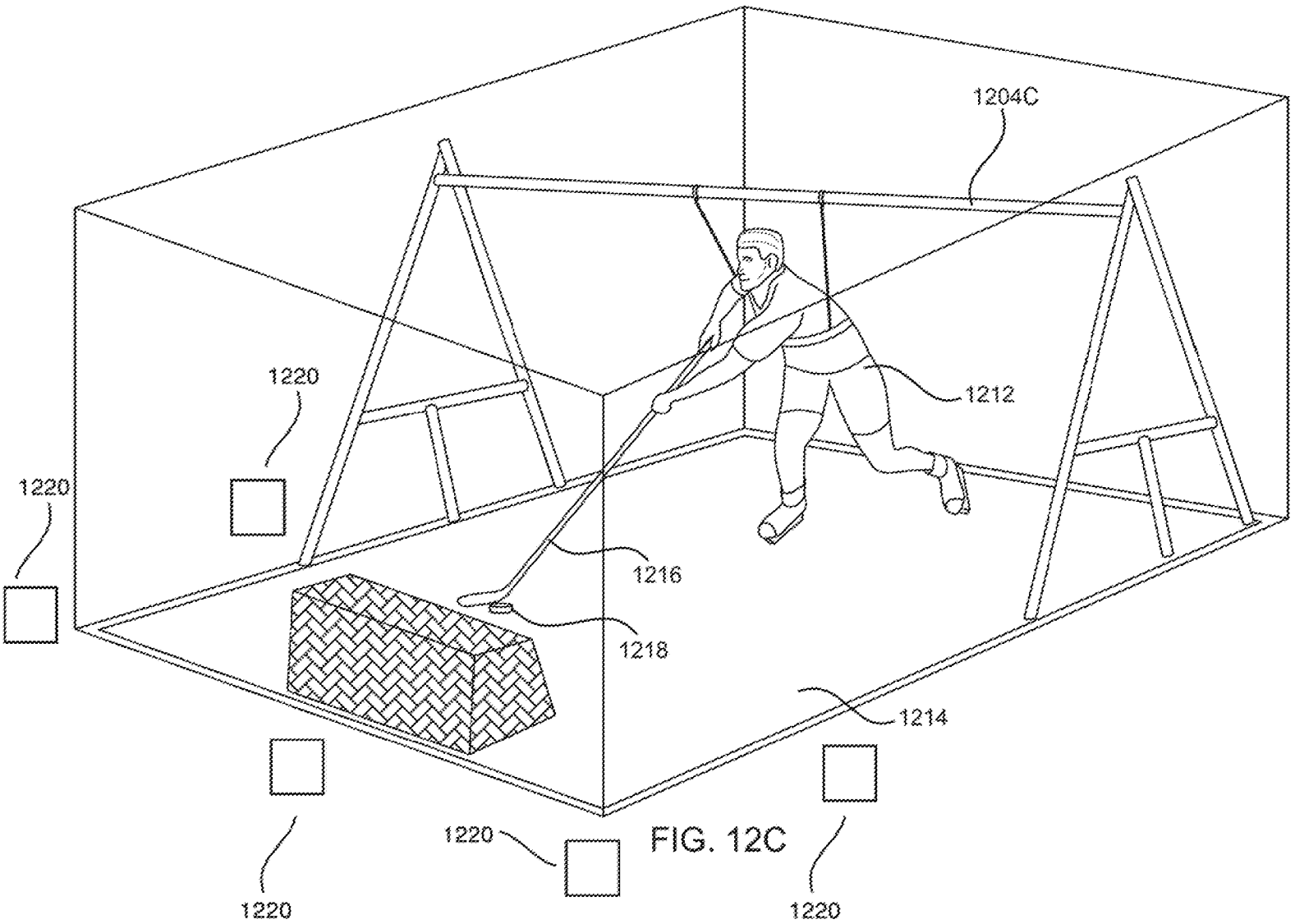
FIG. 12C illustrates an ice hockey player practicing on an ice skating practice area using a harness and skating treadmill, in accordance with at least one embodiment.

FIG. 12C illustrates an ice hockey player 1212 using stick 1216 to practice hitting a series of projected pucks 1218 on an ice skating practice area 1214 using a suspension track 1204C. The suspension track 1204C senses user acceleration and force, and dynamically subtracts and adds tension to the skater to ensure the skater does not fall while performing motions, without impeding the skater's motions or making the skater dependent upon the support. The skater may be on either synthetic ice (such as Teflon or plastic) or on a section of actual ice 1214. A hockey player can continuously skate toward the goal, and pucks 1218 can be projected from various locations, angles, and speeds in the surrounding area 1214. For example, the ice skating practice area 1214 may function as a treadmill such that the area 1214 moves under the hockey player as if the hockey player was skating toward the goal, thereby allowing the hockey player to continuously skate toward the goal. A set of puck projectors 1220 on the edges of the area 1214 shoot the puck into the play area much as a batting cage projects baseballs.

Figure 13A:
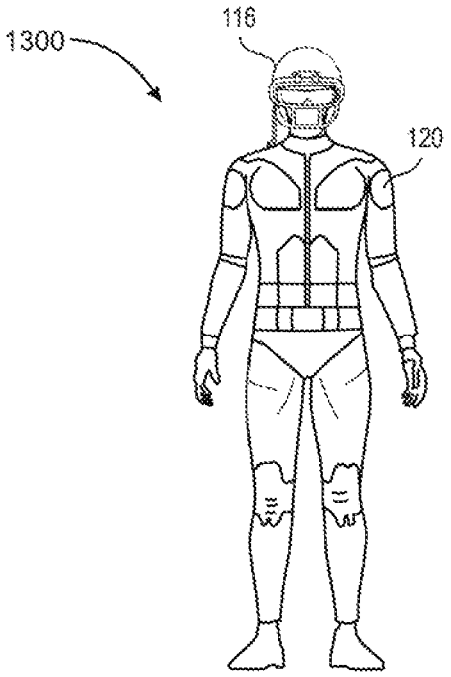
FIG. 13A illustrates an athlete wearing a motion capture (mocap) suit along with a helmet, in accordance with at least one embodiment.

FIG. 13A illustrates an athlete 1300 wearing the mocap suit 120 along with the helmet 116, in accordance with at least one embodiment. The mocap suit and helmet may use any of a number of technologies to capture the position and motion of the body, including, but not limited to, ultrasound, radar, lidar, piezoelectric elements, and accelerometers. In some embodiments, a number of sensors or reflective devices are placed at articulated points of the body. Waves, such as ultrasound, radar, or lidar, may be reflected off each of the reflective devices placed at the body's articulated points, and triangulation of calculated wave transmission distance used to calculate the relative position of each of the reflective devices. In other embodiments, the sensors placed at the body's articulated points would actively receive and transmit signals to indicate their position. In yet other embodiments, such as piezoelectric elements or accelerometers, the sensors themselves would detect and track relative position and actively transmit position changes to the central processor via any of a number of communication technologies, including but not limited to Bluetooth, Wi-Fi, infrared, or modulated radio waves.

The mocap suit 120 may capture information related to the athlete's skeletal kinematics at one or more times (i.e., timecodes). In an example, the timecodes may be Society of Motion Picture and Television Engineers (SMPTE) timecode. It should be noted that the SMPTE timecode may be a set of cooperating standards to label individual frames of the video and/or images with a timecode. The information may include muscular turns and/or positional movements of the athlete 1300. In one embodiment, the mocap suit 120 may be coupled to the helmet 116 in a wired manner. In another embodiment, the mocap suit 120 may be wirelessly connected to the helmet 116. After capturing the information, the information may be synchronized using a clock sync transmitter or a time synchronization module. In an example, the timecode at 30 frames per second or even 60 frames per second may be too coarse. In some embodiments, the timecodes may be highly granular, with a resolution as fine as milliseconds (such as 100 Hz) down to hundredths of a nanosecond.

Successively, the helmet 116 may receive the information along with the timecodes from the mocap suit 120. Thereafter, the helmet 116 may transmit the information to a computing device of the coach in real time or near real time. The coach may be able to review body movements of the athlete 1300. In some embodiments, the mocap suit 120 may include haptic feedback for sports training. The mocap suit 120 integrated with the haptic feedback may be referred to as "HoloSuit." The computing device may be any of a number of devices, including but not limited to a desktop, a computer server, a laptop, a PDA, or a tablet computer. It should be noted that the above-mentioned technologies for the detection of the body's position have been provided only for illustrative purposes and that other techniques can be used as well. The mocap suit 120 may include other technology as well, without departing from the scope of the disclosure.

In general, an athlete playing a sport is exerting forces and expending energy in certain patterns that produce the most efficacious results in the sport. Accordingly, in some embodiments of the present invention, the system makes use of one or more models of the physical application of force by the athlete, and thus measures the performance of the athlete for comparison against a defined ideal force pattern. This modeling may include the forces applied to and transmitted through implements including, but not limited to, baseball bats, baseballs, soccer balls, footballs, golf balls, skis, bicycles, tennis rackets, gymnastics equipment, etc. One or more pre-defined models may be applied to the system by the central processor. Additionally, some embodiments may use machine learning to infer or tune physical models for the athlete, the implements of the game, or the surrounding world.

Figure 13B:
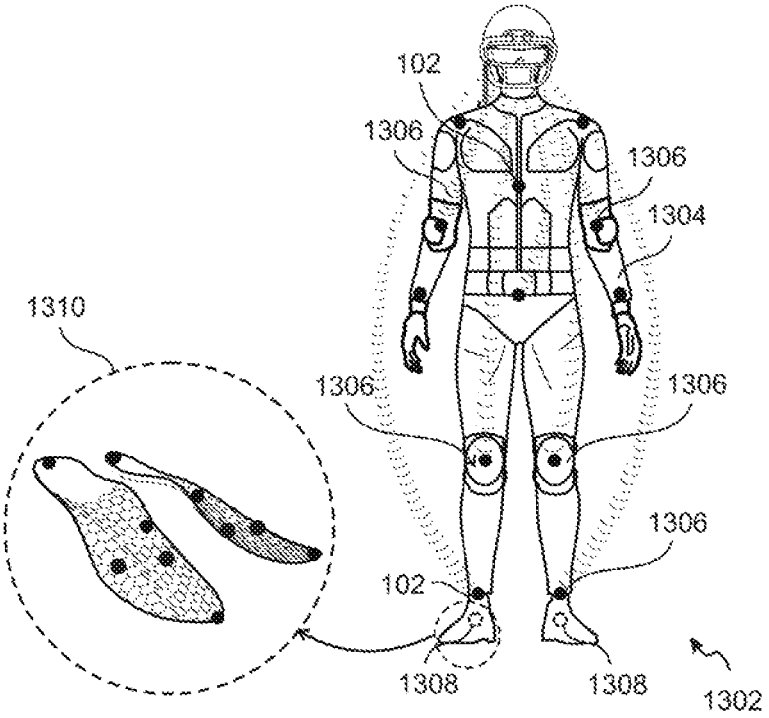
FIG. 13B illustrates an alternate embodiment of an athlete wearing a suit along with one or more pads, in accordance with at least one embodiment.

FIG. 13B illustrates an alternate embodiment of an athlete 1302 wearing a suit 1304 along with one or more pads 1306, in accordance with at least one embodiment. The one or more pads 1306 may include, but are not limited to, elbow pads, arm pads, and/or knee pads. The one or more pads 1306 may detect information related to the athlete 1302 at one or more articulation points. Further, the plurality of sensors 102 may be disposed at the one or more articulation points of the athlete 1302. The one or more articulation points may include head, shoulders, elbow, hand or wrist, pelvis, knee, and/or the back of the ankle. It should be noted that the distance between the one or more articulation points may be continuously monitored. Further, the plurality of sensors 102 may detect a difference in the distances. Further, the plurality of sensors 102 may have a different pattern, light reflection property, watermark, or other differentiation that is detected by a visual scanner.

In one embodiment, one or more pressure sensors 1308 may be fitted to the feet of the athlete 1302 for measuring one or more parameters related to running or walking form, such as foot landing, cadence, and time on the ground. In some embodiments, a sole 1310 may be used by an athlete in shoes, for measuring pressure in arch, insole, toes, and/or heel. Alternatively, the suit 1304 may be stitched with the plurality of sensors 102 at each one of the articulation points. In another embodiment, the plurality of sensors 102 may be attached using a Velcro® hook-and-loop fabric fastener. Further, the plurality of sensors 102 may sense the information related to the athlete's skeletal kinematics at one or more times (i.e., timecodes).

After capturing the information, the information may be synchronized using a clock sync transmitter or a time synchronization module. Further, the plurality of sensors 102, the pressure sensor 1308, and the sole 1310 may transmit the information to the helmet 116. It should be noted that the plurality of sensors 102, the pressure sensor 1308, and the sole 1310 may be wirelessly connected with the helmet 116. In one embodiment, the helmet 116 may establish wired communication with the plurality of sensors 102 disposed at the one or more articulation points. Further, the helmet 116 may sense the momentary positions of the plurality of sensors 102 disposed at the one or more articulation points using a radio or audio frequency wave. Thereafter, the helmet 116 may process the information for training the users. It should be noted that triangulation may be used to capture correct data at each articulation point. In some embodiments, three or more ultrasound transceivers may be integrated on the helmet 116 for the triangulation. Further, the ultrasound transceivers may transmit a signal to each one of the articulation points of the body. In one embodiment, active ultrasound transceivers at each articulation point may allow each articulation point to respond with a packet of data to the helmet 116 to assist in improving location accuracy. In other embodiments, the plurality of sensors 102 at each articulation point may need to be active for best accuracy, or it may be possible to achieve sufficient precision with passive reflectors. It will be apparent to one skilled in the art that none of these variations, or other similar variations, depart from the scope of the disclosure.

In other embodiments, a single RF receiver may be integrated on the helmet 116 (for example, Bluetooth or Wi-Fi) and may have a device on each of the articulation points tracking a relative position and transmitting the tracked position information to the helmet 116. It should be noted that above-mentioned methods may require some sort of "zeroing" to a reference body position for relative measurements. It will be apparent to one skilled in the art that the above-mentioned timecode has been provided only for illustrative purposes. In other embodiments, some other timecodes may be used without departing from the scope of the disclosure.

Figure 13C:
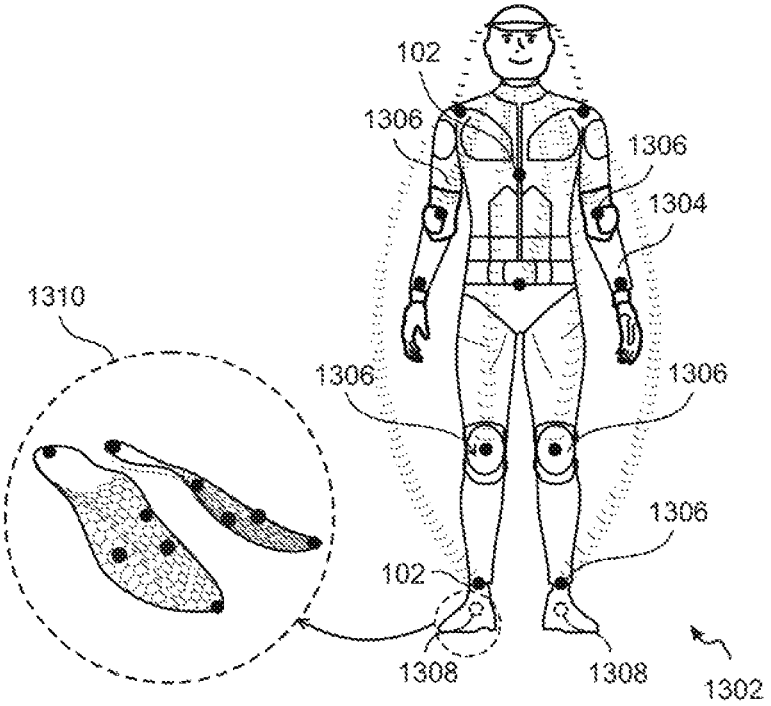
FIG. 13C illustrates another alternate embodiment of an athlete wearing a suit along with one or more pads, in accordance with at least one embodiment.

FIG. 13C illustrates another alternate embodiment of an athlete 1302 wearing a suit 1304 along with one or more pads 1306, in accordance with at least one embodiment. The one or more pads 1306 may include, but are not limited to, elbow pads, arm pads, and/or knee pads. The one or more pads 1306 may detect information related to the athlete 1302 at one or more articulation points. Further, the plurality of sensors 102 may be disposed at the one or more articulation points of the athlete 1302. The one or more articulation points may include head, shoulders, elbow, hand or wrist, pelvis, knee, and/or the back of the ankle. It should be noted that the distance between the one or more articulation points may be continuously monitored. Further, the plurality of sensors 102 may detect a difference in the distances. Further, the plurality of sensors 102 may have a different pattern, light reflection property, watermark, or other differentiation that is detected by a visual scanner.

In one embodiment, one or more pressure sensor 1308 may be fitted to the feet of the athlete 1302 for measuring one or more parameters related to running or walking form, such as foot landing, cadence, and time on the ground. In some embodiments, a sole 1310 may be used by an athlete in shoes, for measuring pressure in arch, insole, toes, and/or heel. Alternatively, the suit 1304 may be stitched with the plurality of sensors 102 at each one of the articulation points. In another embodiment, the plurality of sensors 102 may be attached using a Velcro® hook-and-loop fabric fastener. Further, the plurality of sensors 102 may sense the information related to the athlete's skeletal kinematics at one or more times (i.e., timecodes).

After capturing the information, the information may be synchronized using a clock sync transmitter or a time synchronization module. Further, the plurality of sensors 102, the pressure sensor 1308, and the sole 1310 may transmit the information to headwear 117, which may be any form of headwear including, but not limited to, a hat, headband, etc. It should be noted that the plurality of sensors 102, the pressure sensor 1308, and the sole 1310 may be wirelessly connected with the headwear 117. In one embodiment, the headwear 117 may establish wired communication with the plurality of sensors 102 disposed at the one or more articulation points. Further, the headwear 117 may sense the momentary positions of the plurality of sensors 102 disposed at the one or more articulation points using a radio or audio frequency wave. Thereafter, the headwear 117 may process the information for training the users. It should be noted that triangulation may be used to capture correct data at each articulation point. In some embodiments, three or more ultrasound transceivers may be integrated on the headwear 117 for the triangulation. Further, the ultrasound transceivers may transmit a signal to each one of the articulation points of the body. In one embodiment, active ultrasound transceivers at each articulation point may allow each articulation point to respond with a packet of data to the headwear 117 to assist in improving location accuracy. In other embodiments, the plurality of sensors 102 at each articulation point may need to be active for best accuracy, or it may be possible to achieve sufficient precision with passive reflectors. It will be apparent to one skilled in the art that none of these variations, or other similar variations, depart from the scope of the disclosure.

In other embodiments, a single RF receiver may be integrated on the headwear 117 (for example, Bluetooth or Wi-Fi) and may have a device on each of the articulation points tracking a relative position and transmitting the tracked position information to the headwear 117. It should be noted that above-mentioned methods may require some sort of "zeroing" to a reference body position for relative measurements. It will be apparent to one skilled in the art that the above-mentioned timecode has been provided only for illustrative purposes. In other embodiments, some other timecodes may be used without departing from the scope of the disclosure.

Figure 14A:
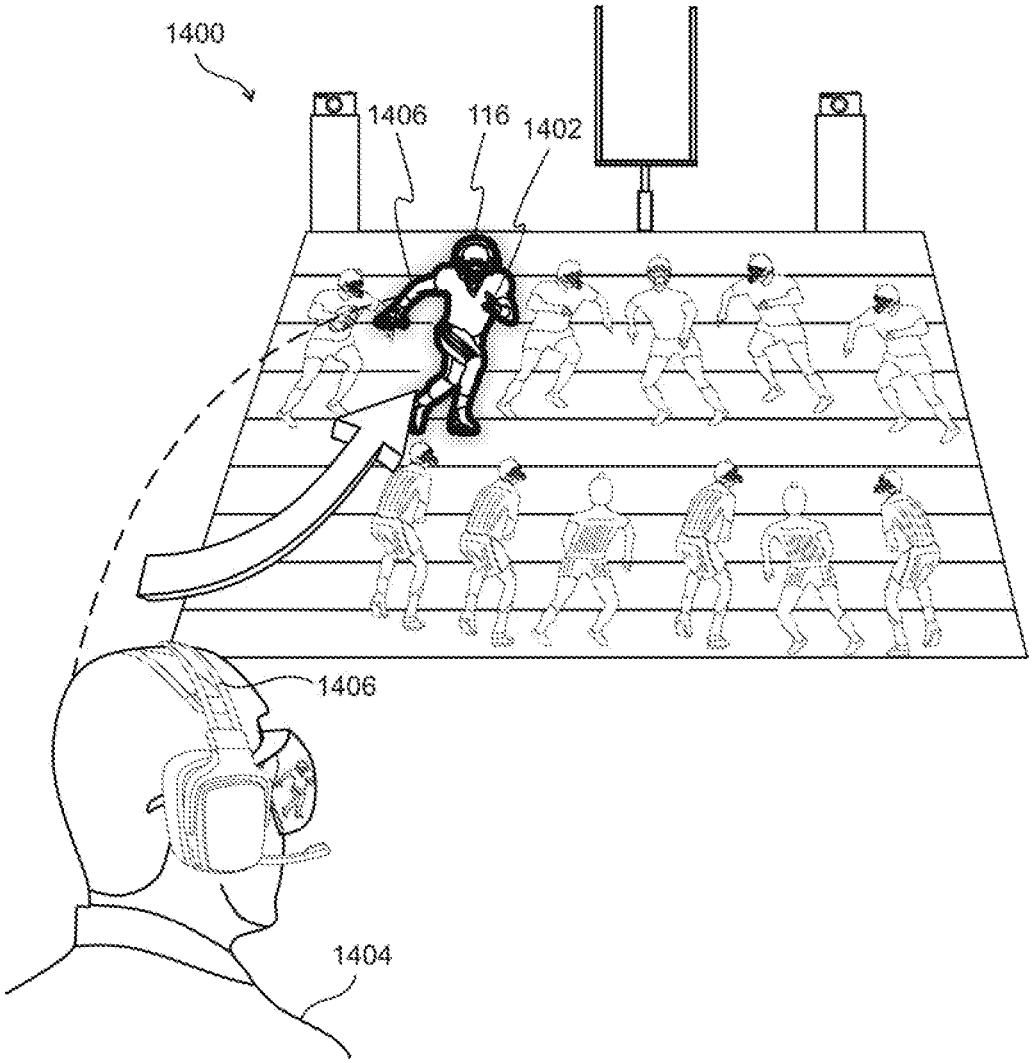
FIG. 14A illustrates a top-down view of an American football field showing a player and a coach, in accordance with at least one embodiment.

FIG. 14A illustrates a top-down view of an American football field 1400 showing a player 1402 and a coach 1404, in accordance with at least one embodiment. The player 1402 and the coach 1404 may wear the helmet 116 integrated with directional headphones 1406 and an AR interface. In one embodiment, when the player 1402 is playing American football, the coach 1404 may select the player 1402 through the AR interface. Based at least on the selection, the coach 1404 may give commands or talk to the player 1402. Thereafter, the player 1402 may be shown as a highlighted player on the AR interface of the coach 1404. On the other hand, when the player 1402 speaks, then the player 1402 may be highlighted on the AR interface of the coach 1404. It should be noted that the player 1402 may be able to listen to the coach 1404 using the helmet 116 integrated with the directional headphones 1406. In such an embodiment, the coach 1404 and the player 1402 may directly communicate with each other. In still further embodiments, indicators or identifiers may be visually presented on the AR interface of the coach 1404 indicating the identity, position, and/or other information about one or more of the players. The system may monitor a gaze direction of the coach 1404 to determine the player 1402 with which the coach 1404 desires to interact. Based on the monitored gaze of the coach 1404, the determined player 1402, and optionally verbal input from the coach, the embodiments may establish a direct communication channel (e.g., audio) between the coach 1404 and the player 1402.

Figure 14B:
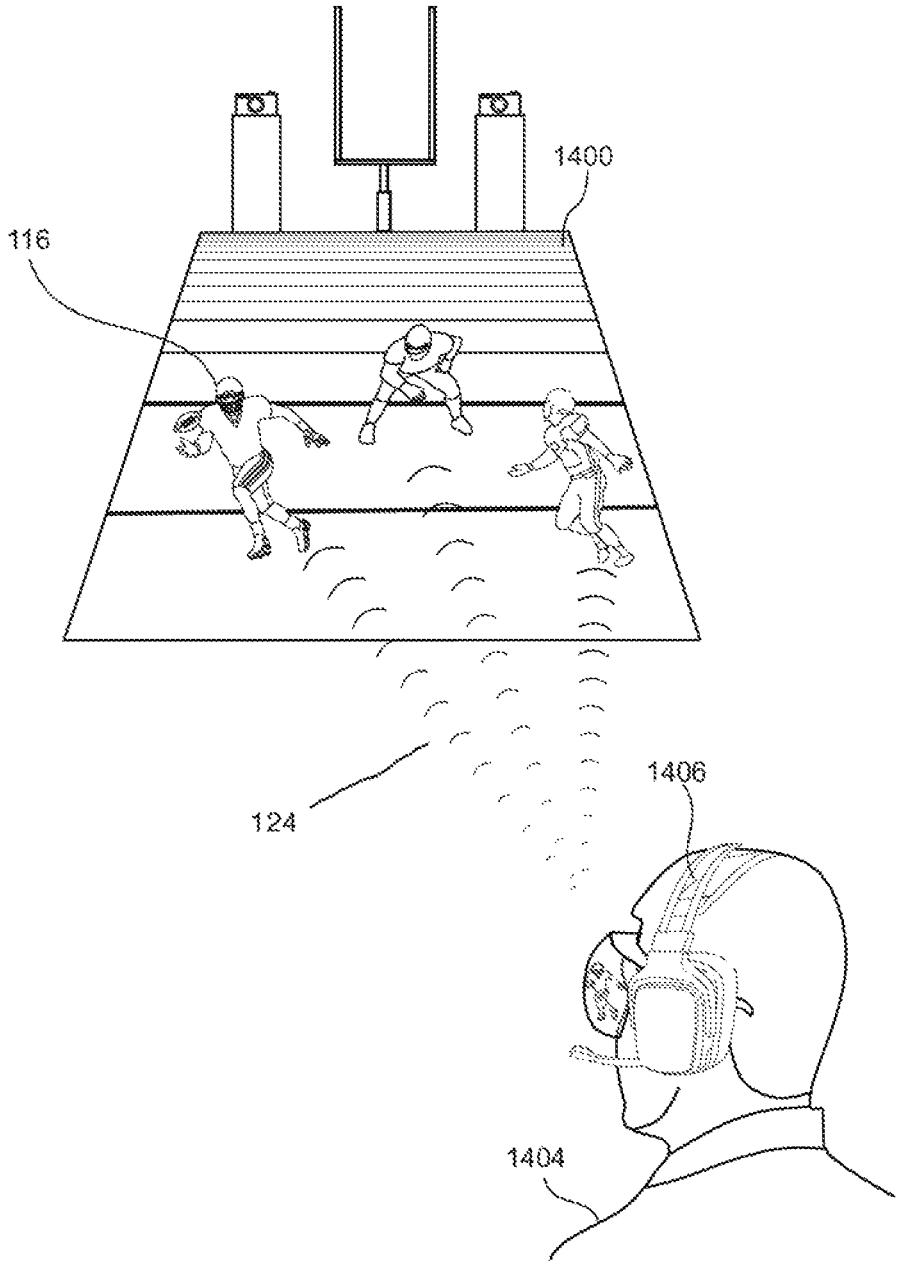
FIG. 14B illustrates a top-down view of the coach communicating with a plurality of players through a network, in accordance with at least one embodiment.

In other embodiments, the coach 1404 may communicate with a plurality of players through the network 124, as shown in FIG. 14B. It should be noted that the plurality of players may wear a helmet 116 integrated with the directional headphones 1406 and the AR interface in order to listen to the coach 1404. The coach 1404 may give commands to the plurality of players simultaneously.

Figure 14C:
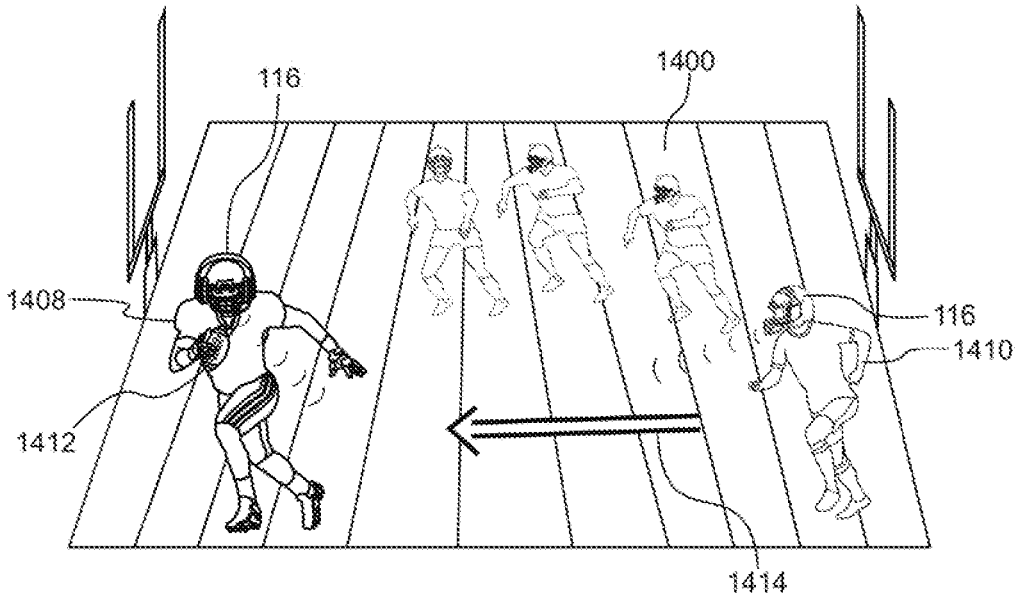
FIG. 14C illustrates an alternate embodiment of the American football field showing a first player and a second player communicating with each other, in accordance with at least one embodiment.

FIG. 14C illustrates an alternate embodiment of the American football field 1400 showing a first player 1408 and a second player 1410 communicating with each other, in accordance with at least one embodiment. As shown in FIG. 14C, the first player 1408 may carry a football 1412 and may run towards the end zone. Further, the first player 1408 may plan to throw the football 1412 to the second player 1410. Before throwing the football 1412, the first player 1408 may establish a communication with the second player 1410 using the helmet 116. In one embodiment, the first player 1408 may send positional audio over RF to the second player 1410. Further, the first player 1408 may look at the second player 1410 and an arrow 1414 may appear on the AR interface of the helmet 116. Once the second player 1410 sees the arrow 1414, a circle or other indicator appears around the target based on retinal tracking. The second player 1410 may turn up towards the first player 1408 based on positional audio and directional virtual sound. Thereafter, the first player 1408 may throw the football 1412 to the second player 1410. It should be noted that both the first player 1408 and the second player 1410 may be able to recognize who is talking, even when both the first player 1408 and the second player 1410 are talking at a normal volume.

Figure 15:
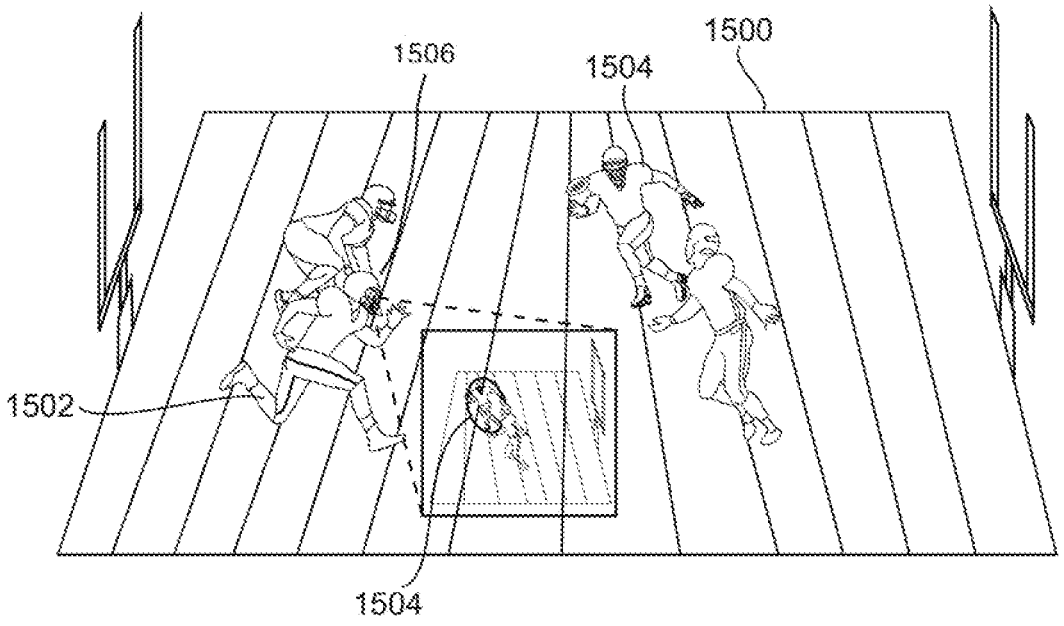
FIG. 15 illustrates a view of an AR interface of a first player, in accordance with at least one embodiment.

FIG. 15 illustrates a view of an augmented reality (AR) interface 1506 of a first player 1502, in accordance with at least one embodiment. The AR interface 1506 may allow the first player 1502 to view where each one of the teammates is on a field 1500, and use retinal tracking to detect when the first player 1502 is looking at a player that the first player 1502 wants to talk to. Further, the AR interface 1500 may allow the first player 1502 to see a second player 1504 with whom the first player 1502 is communicating. In an example, the second player 1504 may be shown as a selected target, using a cursor superimposed on the second player such as an area of color, an oval encircling the player, a box, a circle drawn on the ground below the player, or other similar indications, on the AR interface 1500 of the first player 1502. The color may be changed used to indicate who is speaking. Directional arrows may be drawn to indicate the current flow of audio between players 1502 and 1504. A reciprocal display may be shown in an AR interface worn by player 1504, matching in reverse that shown for player 1502.

Figure 16A:
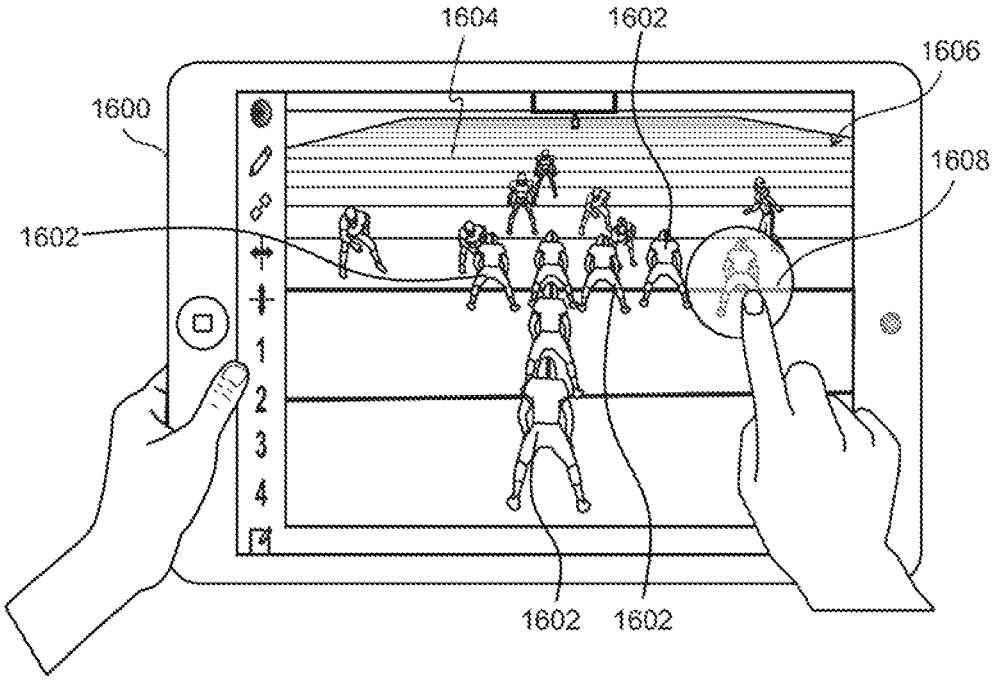
FIG. 16A illustrates a tablet of a coach, in accordance with at least one embodiment.

FIG. 16A illustrates a tablet 1600 of a coach, in accordance with at least one embodiment. The coach may be able to view a plurality of players 1602 playing on an American football field 1604 via an interface 1606 of the tablet 1600. It should be noted that the plurality of players 1602 may wear helmets 116 for communicating with the coach or other players on the field 1604. Further, the tablet 1600 may be used by the coach to draw a maneuver on the field 1604. The coach may touch the interface 1606 of the tablet 1600 to draw the maneuver. In one embodiment, the coach may tap on an icon or a representation of a player 1608. Based at least on the tapping, the coach may be able to communicate with the player 1608. Further, the coach may give one or more commands to the player 1608, such as "run" or "turn right and throw the ball." The one or more commands may be executed by the player 1608 while playing American football in the real time.

Figure 16B:
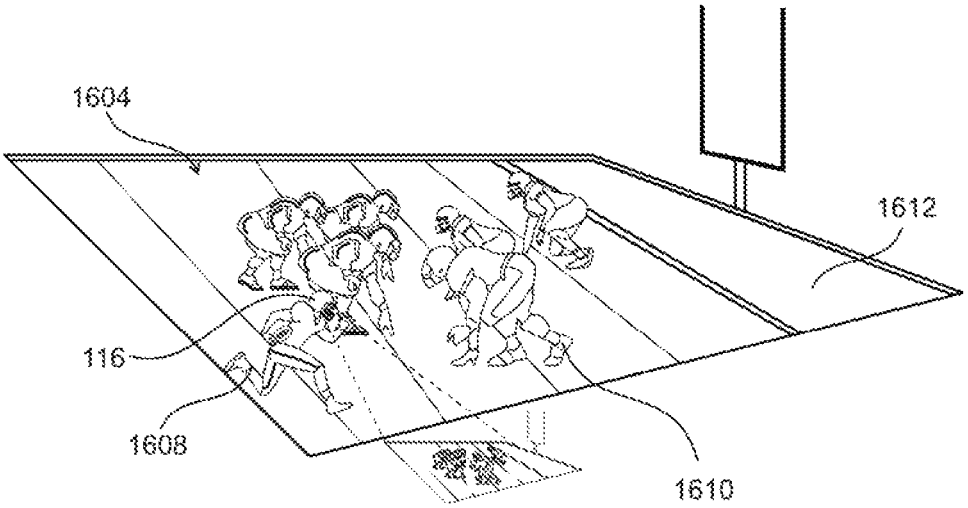
FIG. 16B illustrates an AR view of a helmet worn by a first player, in accordance with at least one embodiment.
Figure 16C:
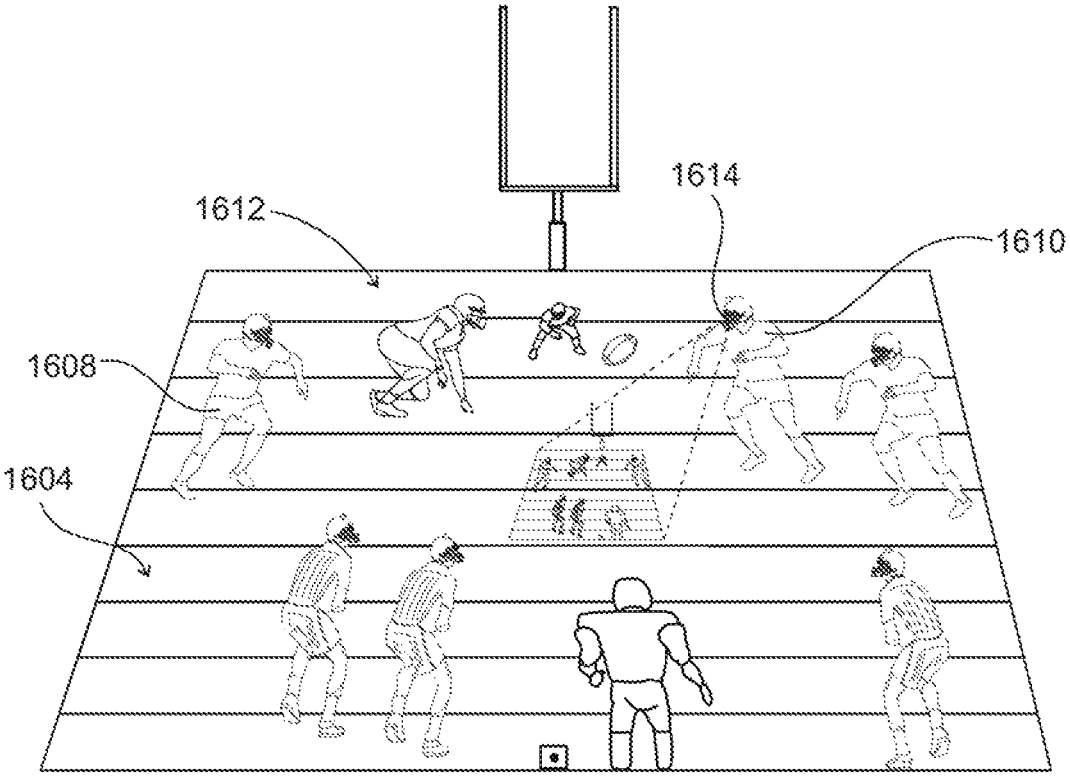
FIG. 16C illustrates a second player viewing an exact location of other players and a target on an AR interface, in accordance with at least one embodiment.

FIG. 16B illustrates an augmented reality (AR) interface of the helmet 116 worn by the player 1608, in accordance with at least one embodiment. The player 1608 may be able to see a quarterback's view of the field. The player 1608 may view the position of each player on the field 1604. Thereafter, the player 1608 may throw the ball to another player 1610 (i.e., a receiver). Another player 1610 may view an exact location of other players and a target 1612 on an AR interface 1614, as shown in FIG. 16C.

Figure 17A:
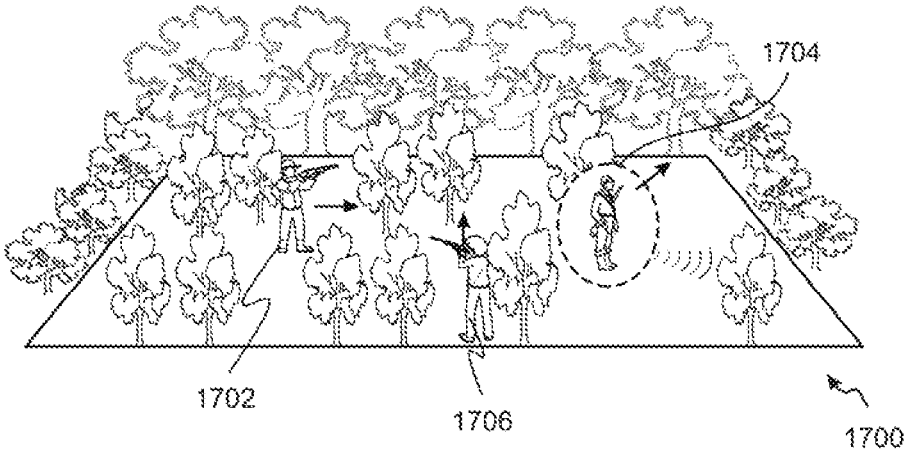
FIG. 17A illustrates a hunting field having a plurality of hunters, in accordance with at least one embodiment.
Figure 17B:
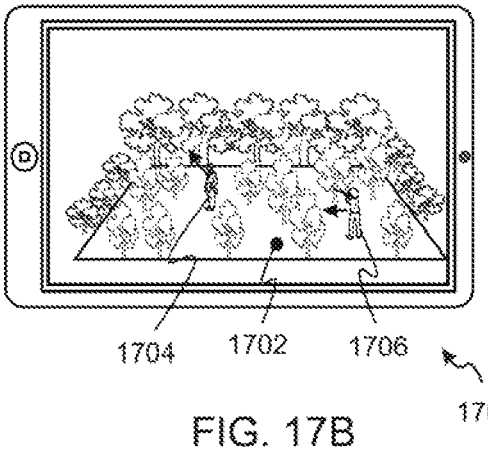
FIG. 17B illustrates a tablet of a first hunter, in accordance with at least one embodiment.
Figure 17C:
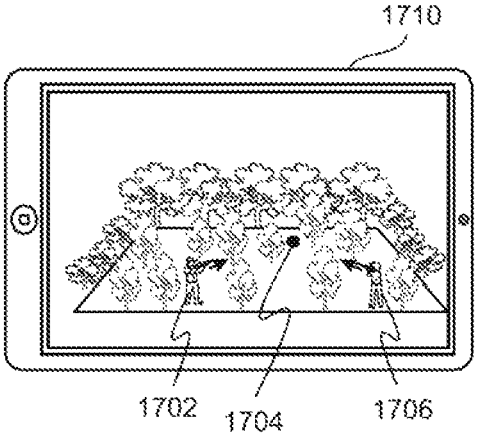
FIG. 17C illustrates a tablet of a second hunter, in accordance with at least one embodiment.
Figure 17D:
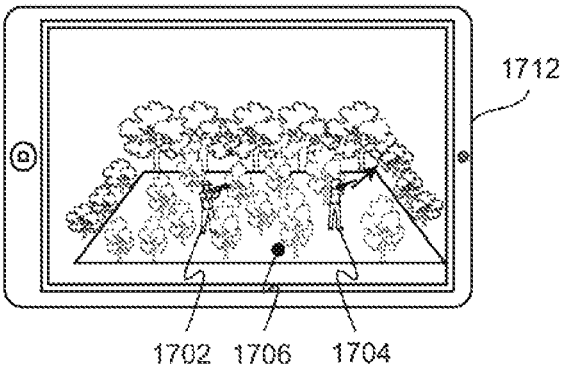
FIG. 17D illustrates a tablet of a third hunter, in accordance with at least one embodiment.

FIG. 17A illustrates a hunting field 1700 having a plurality of hunters, in accordance with at least one embodiment. The plurality of hunters may include a first hunter 1702, a second hunter 1704, and a third hunter 1706. In one embodiment, the first hunter 1702 may use a tablet 1708 for viewing locations and movements of the second hunter 1704 and the third hunter 1706, as shown in FIG. 17B. Similarly, the second hunter 1704 may use a tablet 1710 for viewing the locations and movements of the first hunter 1702 and the third hunter 1706, as shown in FIG. 17C. Similarly, the third hunter 1706 may use a tablet 1712 for viewing the locations and movements of the first hunter 1702 and the second hunter 1704, as shown in FIG. 17D.

Figure 17E:
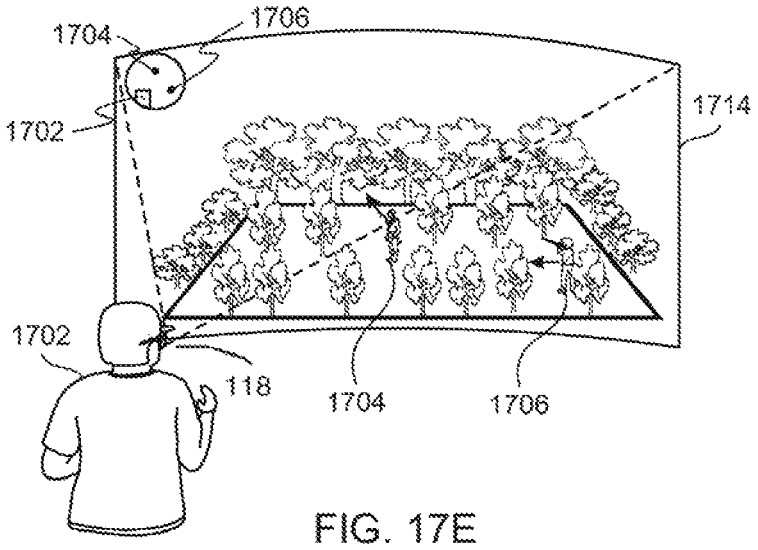
FIG. 17E illustrates an interface of the wearable glasses worn by the first hunter, in accordance with at least one embodiment.
Figure 17F:
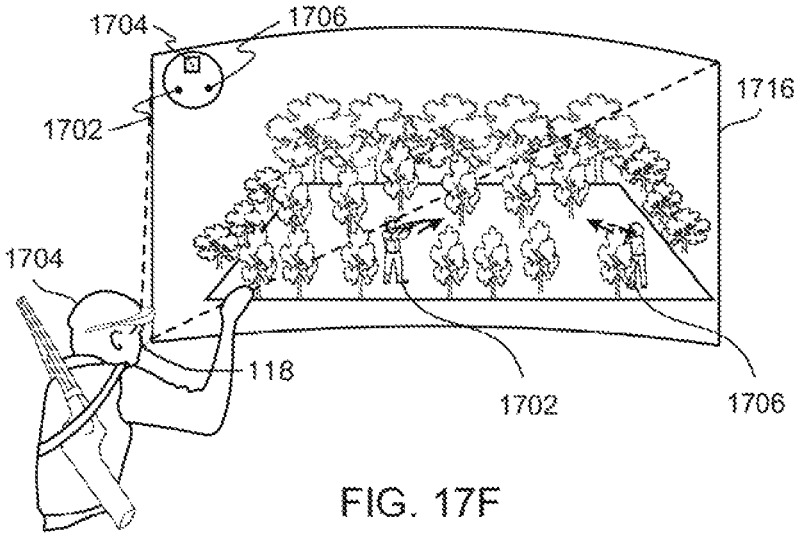
FIG. 17F illustrates an interface of the wearable glasses worn by the second hunter, in accordance with at least one embodiment.
Figure 17G:
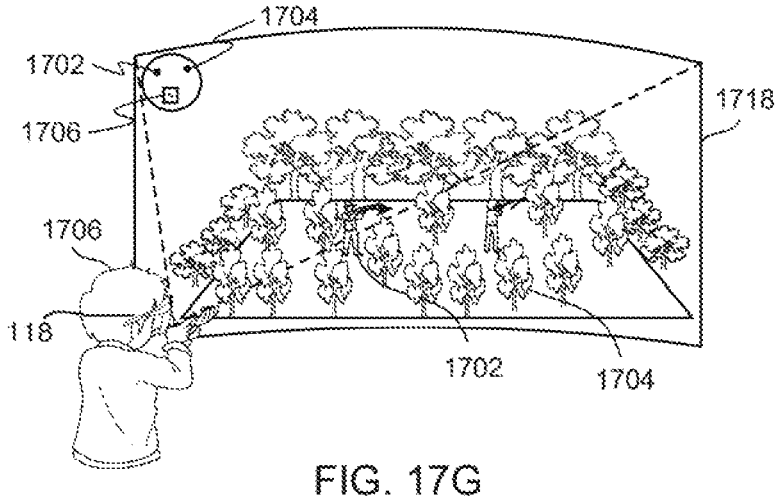
FIG. 17G illustrates an interface of the wearable glasses worn by the third hunter, in accordance with at least one embodiment.

Further, the plurality of hunters may be wearing the wearable glasses 118 for hunting. In one embodiment, the first hunter 1702 may view the locations and movements of the second hunter 1704 and the third hunter 1706 on an interface 1714 of the wearable glasses 118, as shown in FIG. 17E. Similarly, the second hunter 1704 may view the locations and movements of the first hunter 1702 and the third hunter 1706 on an interface 1716 of the wearable glasses 118, as shown in FIG. 17F. Similarly, the third hunter 1706 may view the locations and the movements of the first hunter 1702 and the third hunter 1706 on an interface 1718 of the wearable glasses 118, as shown in FIG. 17G. Such a method may be effective for getting the exact locations of the plurality of hunters on the hunting field 1700, thereby increasing the safety of each hunter as they are hunting.

Figure 18A:
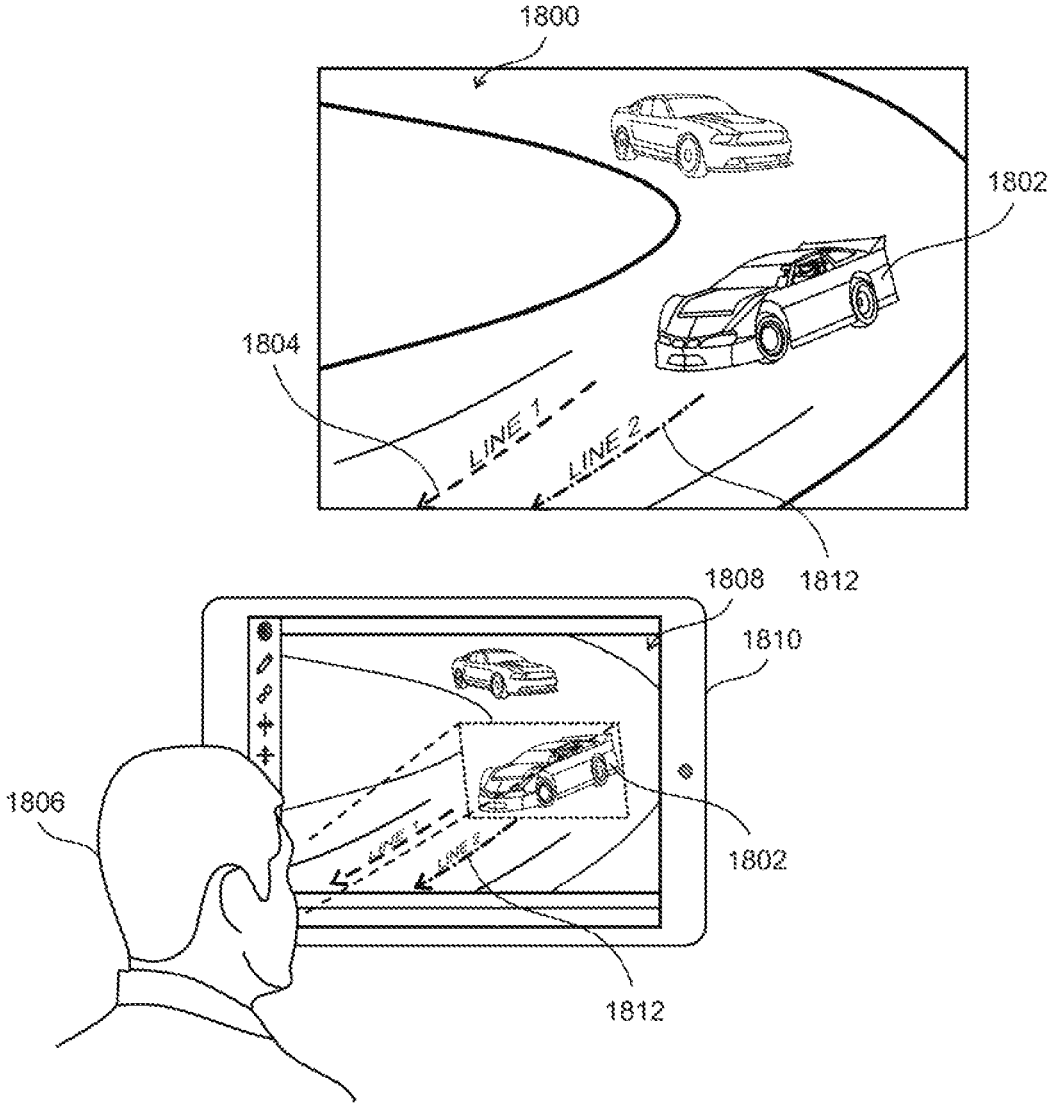
FIG. 18A illustrates a racetrack viewed by a coach on a tablet, in accordance with at least one embodiment.

FIG. 18A illustrates a racetrack 1800, in accordance with at least one embodiment. The racetrack 1800 may include a vehicle 1802 moving on a first line 1804 of the racetrack 1800. Further, the vehicle 1802 may include a driver wearing a helmet 116. As discussed above, the helmet 116 may be integrated with directional headphones and an AR interface. It should be noted that the driver may use the helmet 116 for communicating with a coach 1806. In one embodiment, the coach 1806 may be able to view the vehicle 1802 moving on the racetrack 1800 via an interface 1808 of a tablet 1810. The coach 1806 may touch on the interface 1808 of the tablet 1810 to draw the maneuver. In an example, the coach 1806 may tap on an icon or a representation of the vehicle 1802. Based at least on the tapping, the coach 1806 may be able to communicate with the driver of the vehicle 1802. Thereafter, the coach 1806 may give commands to the driver of the vehicle 1802, such as, "Switch to a second line 1812 from the first line 1804." Thereafter, the commands may be executed by the driver in real time.

Figure 18B:
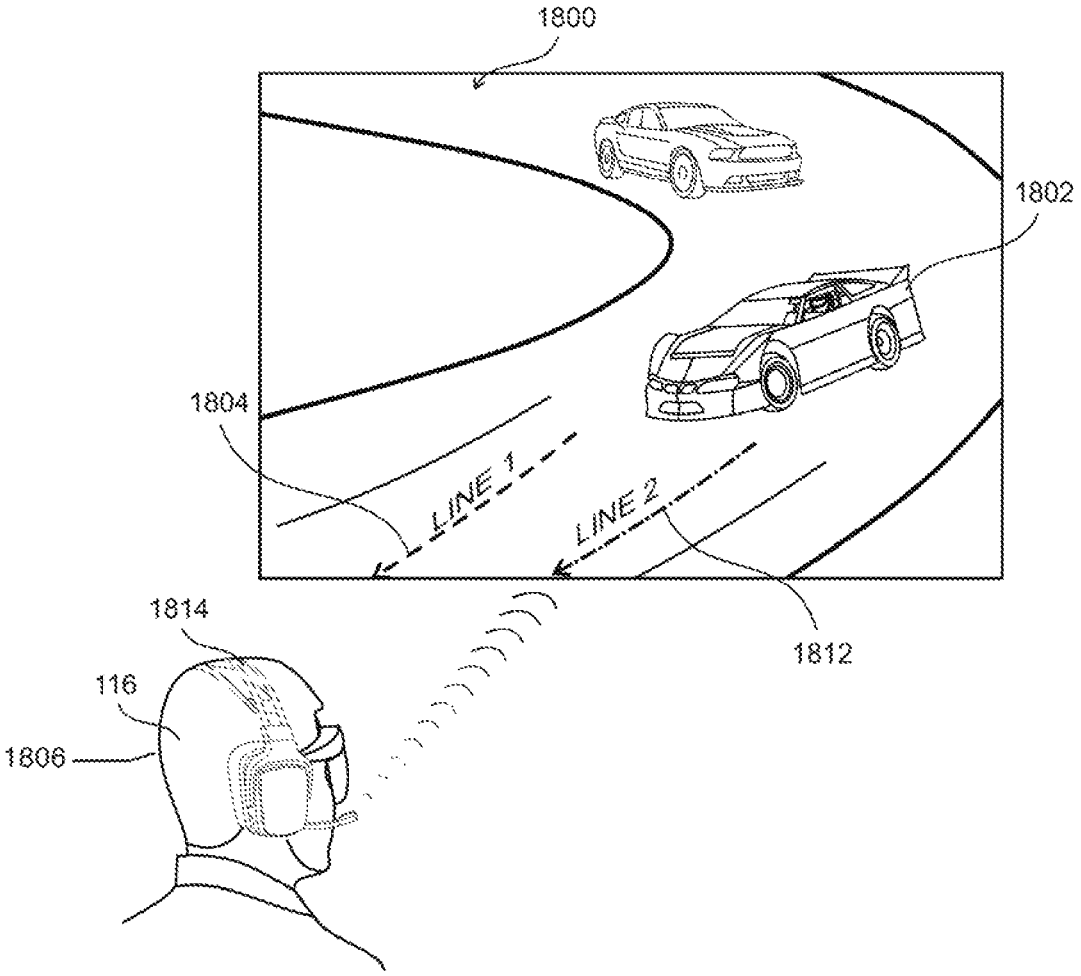
FIG. 18B illustrates the coach communicating with a driver of a vehicle using directional headphones, in accordance with at least one embodiment.
Figure 18C:
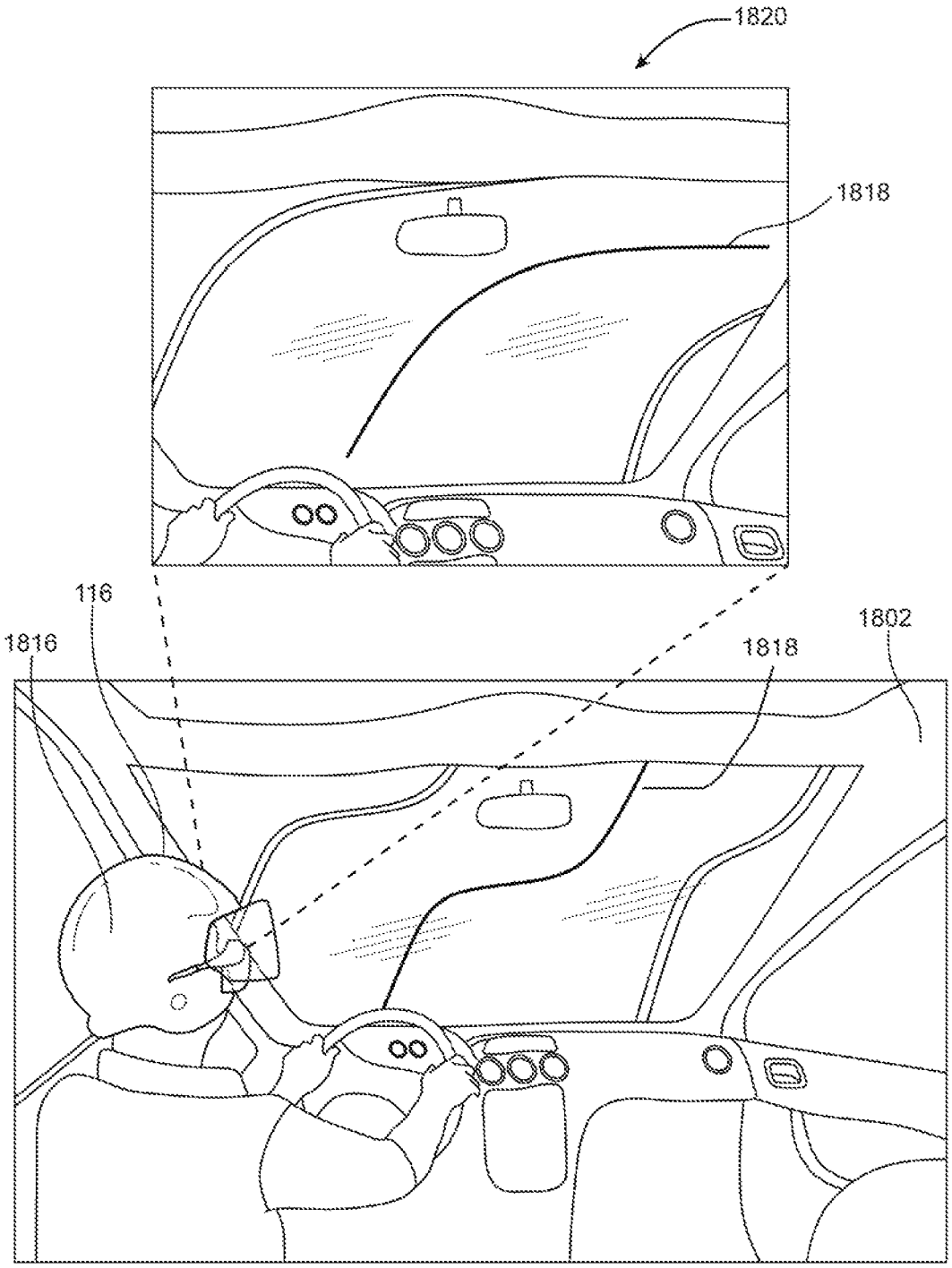
FIG. 18C illustrates a driver wearing a helmet viewing a path on an AR interface of the helmet, in accordance with at least one embodiment.

In another embodiment, the coach 1806 may wear the helmet 116 integrated with directional headphones 1814. Further, the coach 1806 may communicate with the driver of the vehicle 1802, as shown in FIG. 18B. Thereafter, using the directional headphones of the helmet 116, the coach may give commands to the driver of the vehicle 1802. It should be noted that the driver may be able to recognize a directional sound of the coach 1806 due to the use of the wearable glasses 118 integrated with the directional headphones. Such method may be effective for a direct communication between the coach 1806 and the driver. As shown in FIG. 18C, a driver 1816 may view a predetermined, proper driving line to be taken by the vehicle (shown by a line 1818) on an AR interface 1820 of the helmet 116. The path 1818 may be drawn by the coach 1806 on the tablet 1800, as in FIG. 18A, or may be other examples of drivers' lines, or the student's past laps recorded and overlaid in different colors on the track. Thereafter, the driver 1816 may follow the path 1818.

In some embodiments, data captured may be time-synchronized with the vehicle 1802 information, such as revolutions per minute (RPM), angular position of the steering wheel and steering equipment, traction control sensors, brakes, shifter, clutch, and/or gas/throttle. Further, one or more cameras on the vehicle 1802 may record the vehicle on the racetrack 1800 and may be used with an overview of the racetrack 1800 to precisely locate the vehicle 1802 after the fact and archive the vehicle position lines by holographic ("Holocode") timecode, without departing from the scope of the disclosure. In an alternate embodiment, the vehicle 1802 may have a chaser drone that follows the lap.

It should be noted that the driver may want to familiarize himself or herself and do a guided tour around the racetrack 1800. At first, the driver may walk the racetrack 1800 while wearing camera-equipped AR glasses or using tablet 1810, to become familiar with the surroundings, elevation changes, camber, temperature changes, and texture which affects tire grip of the racetrack 1800. In one embodiment, the driver may sit before the race quietly and review every corner in his or her mind by reviewing the recording made by the AR glasses or tablet 1810 and replaying it. Successively, the driver may mentally generate and commit to memory the quickest line of approach and exit for each turn of the racetrack and create a rough "line" 1800 by drawing it on tablet 1810. Further, using tablet 1810 before a drive, the driver may mark places on the racetrack 1800 at which to apply brakes, accelerate, and turn. Subsequently, the driver may drive the racetrack 1800, and may select one of the pre-drawn lines through the AR interface, and attempt to follow it while driving. The driver may select braking points or increase speed when entering and exiting the corners for testing purposes, and the vehicle 1802 will automatically store these driver choices to be recorded and displayed by the tablet or AR system. Further, over time, if the surface temperature of the racetrack 1800 changes, or the wind changes, or the vehicles 1802 on the racetrack 1800 affect whether the driver can follow the optimal line, or rubber is deposited onto the racetrack 1800, "grooving in" the track, affecting stiction, which further affects the profile of the racetrack 1800, and/or bits of tire form into small bead shapes ("marbles") that cover portions of the racetrack 1800, the system may automatically modify the stored lines based on a stored database of track condition influencing factors, to indicate to the driver that the conditions of the track have changed and display a corrected track and allow the driver to follow the corrected track. The parameters to include in this automatic stored lines are configurable, so that one or more parameters can be included or not depending on user preference. In one embodiment, the system may automatically alter the path based on selected algorithms relating to time of day, weather, track condition, the vehicle's tire condition (i.e., soft, medium, or hard compound tires), amount of fuel, and marble level of existing track. Thereafter, the system may modify the master splicing.

Further, the driver may learn where to position on each lap and may practice for multiple laps, creating either with the tablet or by driving, different lines for each lap. It should be noted that the system may allow the driver to more tightly implement rehearsed lines. At first, the driver may drive on the racetrack 1800 numerous times to determine optimal lines and to record or identify these lines for onscreen display by the AR system. Successively, the driver may bookmark and select the best versions of each successive turn, each braking point for each turn, each acceleration point at each turn, each shift point through a curve, each line through a curve, and recombine all elements of the lap for practice and training. Successively, the driver may create a master combination of optimal lap selections for various weather conditions, temperatures, and other variables. These selections may be made on the tablet 1810 or while driving using voice in conjunction with the AR interface.

It will be apparent to one skilled in the art that the above-mentioned techniques and methodology may be applicable to other sports, such as figure skating, bicycle, go-carts, alpine skiing, aerials/freestyle, and/or dancing, as well, without departing from the scope of the disclosure. Likewise, additional details of a helmet and system that may be utilized with the described embodiments are discussed further below with respect to FIGS. 34-41.

Figure 19A:
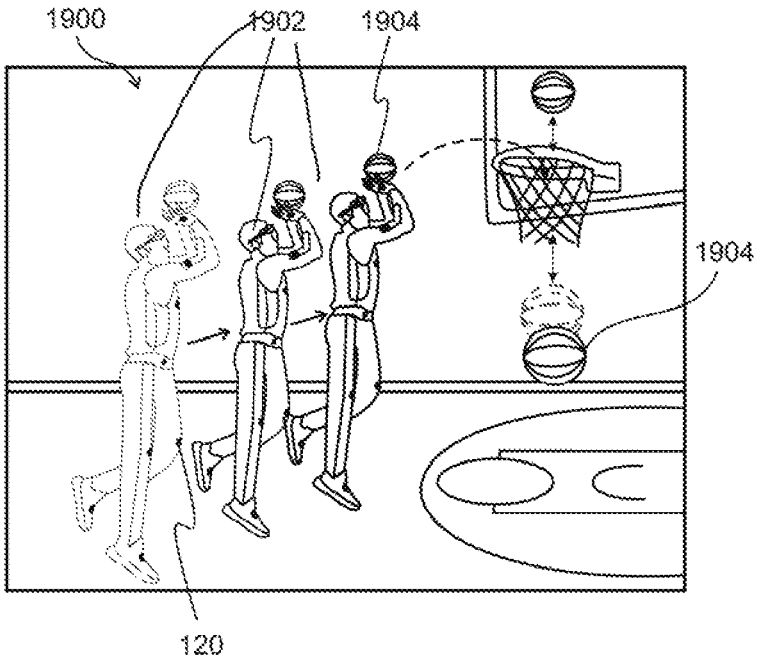
FIG. 19A illustrates a basketball court where a player is being recorded in 3D detail in accordance with at least one embodiment.

FIG. 19A illustrates a basketball court 1900, in accordance with at least one embodiment. The basketball court 1900 may include an athlete 1902 going through a set of motions while playing basketball. The athlete 1902 may wear a mocap (motion capture) suit 120 for capturing a first set of data related to the athlete's skeletal kinematics at one or more times. In an example, the mocap suit 120 may record body movements of the athlete 1902. Further, a second set of data such as position and motion of a ball 1904, may be captured using motion sensors attached to the ball 1904, or the motion of the ball 1904 may be sensed using a video. Successively, the first set of data and the second set of data may be transferred to an external device or a server through a wireless antenna. Successively, the first set of data and the second set of data may be processed. Based at least on the processing, the first set of data and the second set of data may be scaled using a scalar transform module. Successively, the scaled first set of data and the second set of data may be transformed using a musculature-aware or physiology-aware transform module. Thereafter, the scaled version (i.e., images and/or videos) of the athlete 1902 may be formed. In an example, data related to an athlete 1902 whose height is 7 feet 4 inches is recorded, which is then scaled kinesthetically to an athlete who is 5 feet 11 inches tall.

Figure 19B:
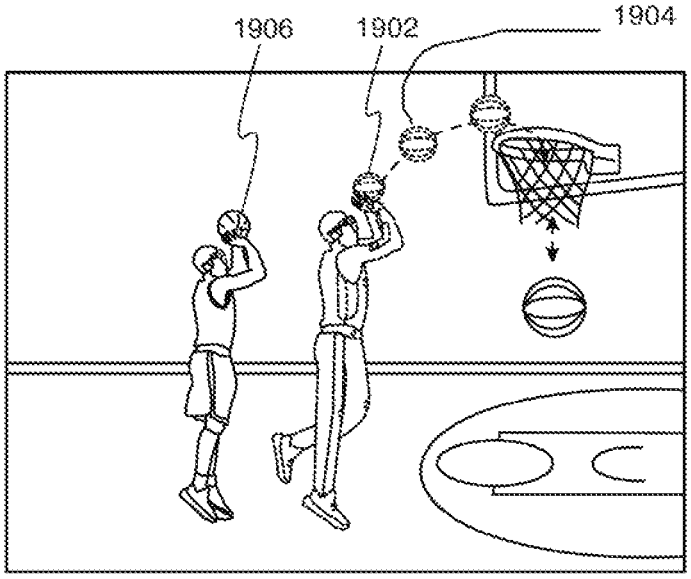
FIG. 19B illustrates a trainee watching a recording of an athlete playing basketball, in accordance with at least one embodiment.

As shown in FIG. 19B, a trainee 1906 wearing wearable glasses 118 may watch the holographic recording of the athlete 1902 playing basketball. The trainee 1906 may follow the movements and positions of the athlete 1902 to learn to play basketball. It should be noted that the trainee 1906 may follow holographic "ghosts" of the athlete 1902 and the ball 1904. Such a method may be effective for training users (i.e., trainees) whose heights are smaller than heights of other athletes. In one embodiment, a coach may inspect the play of the trainee 1906 in the real time. Further, the coach may give commands and directions to the trainee 1906 using the helmet 116 and/or the wearable glasses 118. In an embodiment, the athlete 1906 may review performance from different angles via the wearable glasses 118 by putting on VR goggles and walking around the environment to see their own performance. Such review may be effective for improving the performance of the athlete 1906. In an embodiment, player 1906 may be provided with visual, audio, or haptic feedback when they successfully or unsuccessfully emulate or duplicate the motions of recorded player 1902. For instance, the haptic feedback may be in the form of a smooth vibration, applied to the portion of the body that matched. Feedback for unsuccessfully performing a portion of a movement may be in the form of a pressure or coarse vibration applied to the portion of the body that did not successfully duplicate the motion. Sounds, or visual mixed-reality overlays may also be used to indicate successful and unsuccessful duplications of motion in real-time.

Figure 20A:
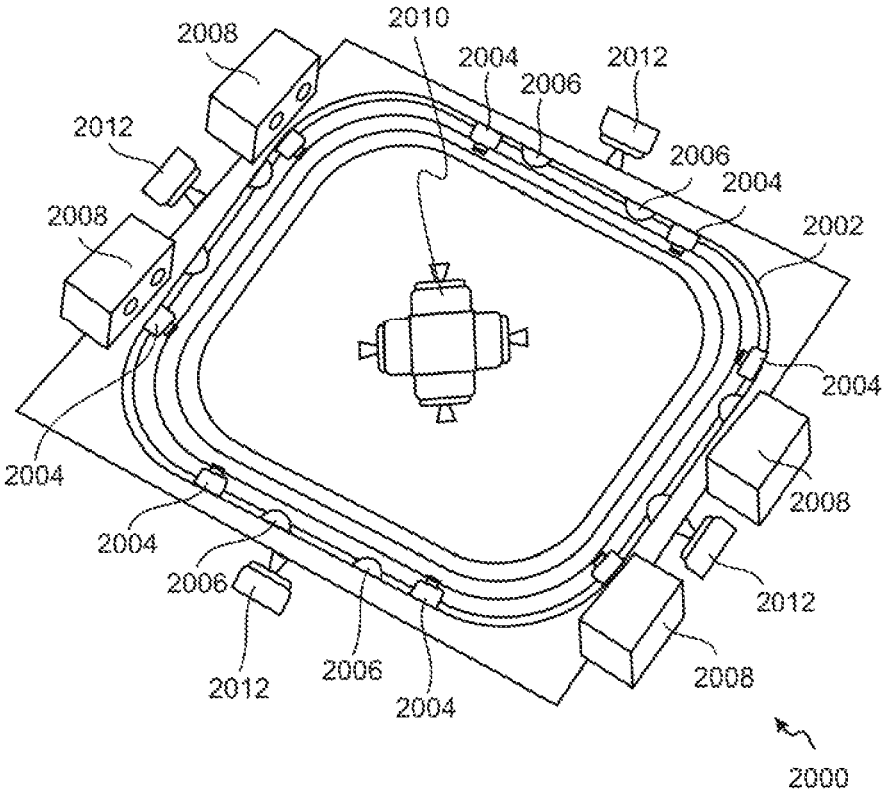
FIG. 20A illustrates a top view of a practice room, in accordance with at least one embodiment.

FIG. 20A illustrates a top view of a practice room 2000 showing an athlete practicing a stationary motion, in accordance with at least one embodiment. The practice motion could be, but is not limited to, a batting swing, throw, golf swing, or tennis swing. The practice room 2000 may include circular screens 2002 attached to walls of the practice room 2000. In one embodiment, the practice room 2000 may be 20×20 feet. Further, the practice room 2000 may include a plurality of cameras 2004, lidar sensors 2006, a speakers 2008, one or more front projectors 2010, and one or more rear projectors 2012. In one embodiment, when the athlete practices the practice motion, the plurality of cameras 2004, lidar sensors 2006, and speakers 2008 may capture data related to images and/or videos of the athlete. As examples, an array of more than 20 cameras or 6 cameras may be used. Further, the plurality of cameras 2004 may use a clock source for synchronizing data timestamps. In some embodiments, the clock source may transmit the clock via Bluetooth, Wi-Fi, Ethernet, or other signal channels.

The plurality of cameras 2004 may be fish-eye cameras, 180-degree cameras, and/or 360-degree cameras. The plurality of cameras 2004 may locate each other through one or more techniques, such as clock sync, infrared, and or triangulation. Further, the plurality of cameras 2004 may use sub-millimeter co-positioning in recomposing 3D imagery of what happens in the practice room 2000. Further, the plurality of cameras 2004 may passively and continuously capture what is happening in the practice room 2000. Further, the one or more front projectors 2010 and the one or more rear projectors 2012 may be used to display or replay images captured by the plurality of cameras 2004. Alternatively, the one or more front projectors 2010 and the one or more rear projectors 2012 may project a simulated sports environment and may show a simulated pitcher to increase the realism of the simulation for the athlete. It should be noted that the one or more rear projectors 2012 may be positioned behind screens in a rear-projection configuration.

Further, the practice room 2000 may include a change extractor engine on a side wall, which analyzes changes between what the athlete is attempting to do and what the athlete has actually done. The change extractor engine may store key frames at one or more portions of an activity in the practice room 2000 for review. Further, the change extractor engine may show an ideal motion and an actual motion of the athlete. Further, a hand-wave interface and a physical button interface, may reproject what is happening on large screens in the practice room 2000, behind one or more mirrors, in AR or VR.

Figure 20B:
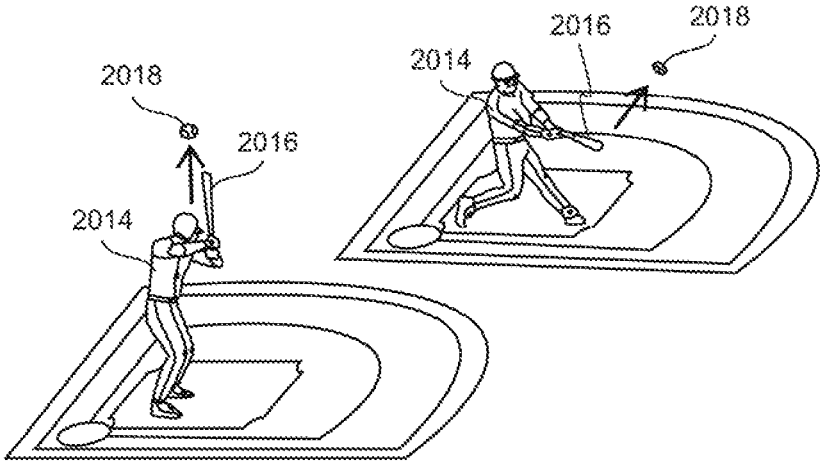
FIG. 20B illustrates an athlete practicing with a baseball bat and a virtual ball in the practice room of FIG. 20A, in accordance with at least one embodiment.
Figure 20C:
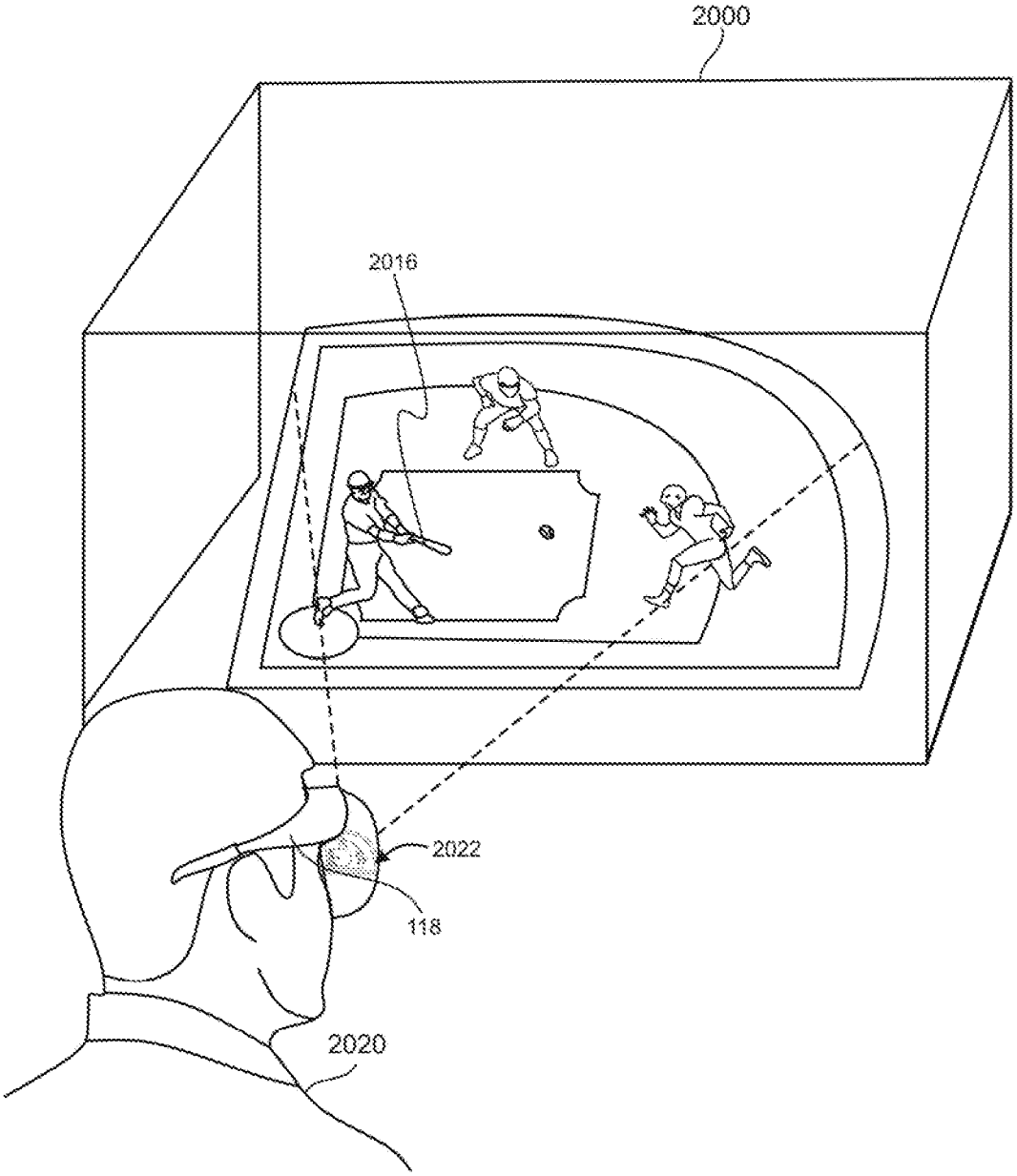
FIG. 20C illustrates a coach reviewing the performance of a plurality of athletes on an AR interface of the wearable glasses, in accordance with at least one embodiment.

In some embodiments, one or more motion sensors may be attached at one or more articulation points of the athlete. The one or more articulation points may be arms, knee, and/or elbows. The athlete may wear the mocap suit 120 for recording body movements. In an example, an athlete 2014 holding a baseball bat 2016, may practice with a virtual ball 2018 in the practice room 2000 of FIG. 20A, as shown in FIG. 20B. Further, data related to the athlete 2014 may be captured by the plurality of the cameras 2004, the lidar sensors 2006, the plurality of speakers 2008, and the motion sensors. Successively, the data may be transferred to an external device via the network 124. Thereafter, the data may be reviewed by a coach 2020 and/or the athlete 2014. In some embodiments, the coach 2020 may review the performance of a plurality of athletes using an AR interface 2022 of the wearable glasses 118, as shown in FIG. 20C. In one embodiment, the coach 2020 may review the performance of the plurality of athletes on a tablet. In another embodiment, the coach 2020 may watch the plurality of athletes on a side screen of the practice room 2000. The coach 2020 may review a game played by the plurality of athletes. Such mechanisms may be helpful for the coach 2020 in training the plurality of athletes.

It will be apparent to one skilled in the art that one or more motion sensors may be attached to various components, such as a physical ball, bat, and/or racket, to capture movements of the various components. Further, the practice room 2000 may include structured light emitters or IR emitters as well, without departing from the scope of the disclosure. It should be noted that the curved screen may be surrounded with rear projectors showing an immersive image of contiguous images stitched seamlessly together, and may be surrounded by a plurality of speakers (i.e., multi-point speakers).

Figure 20D:
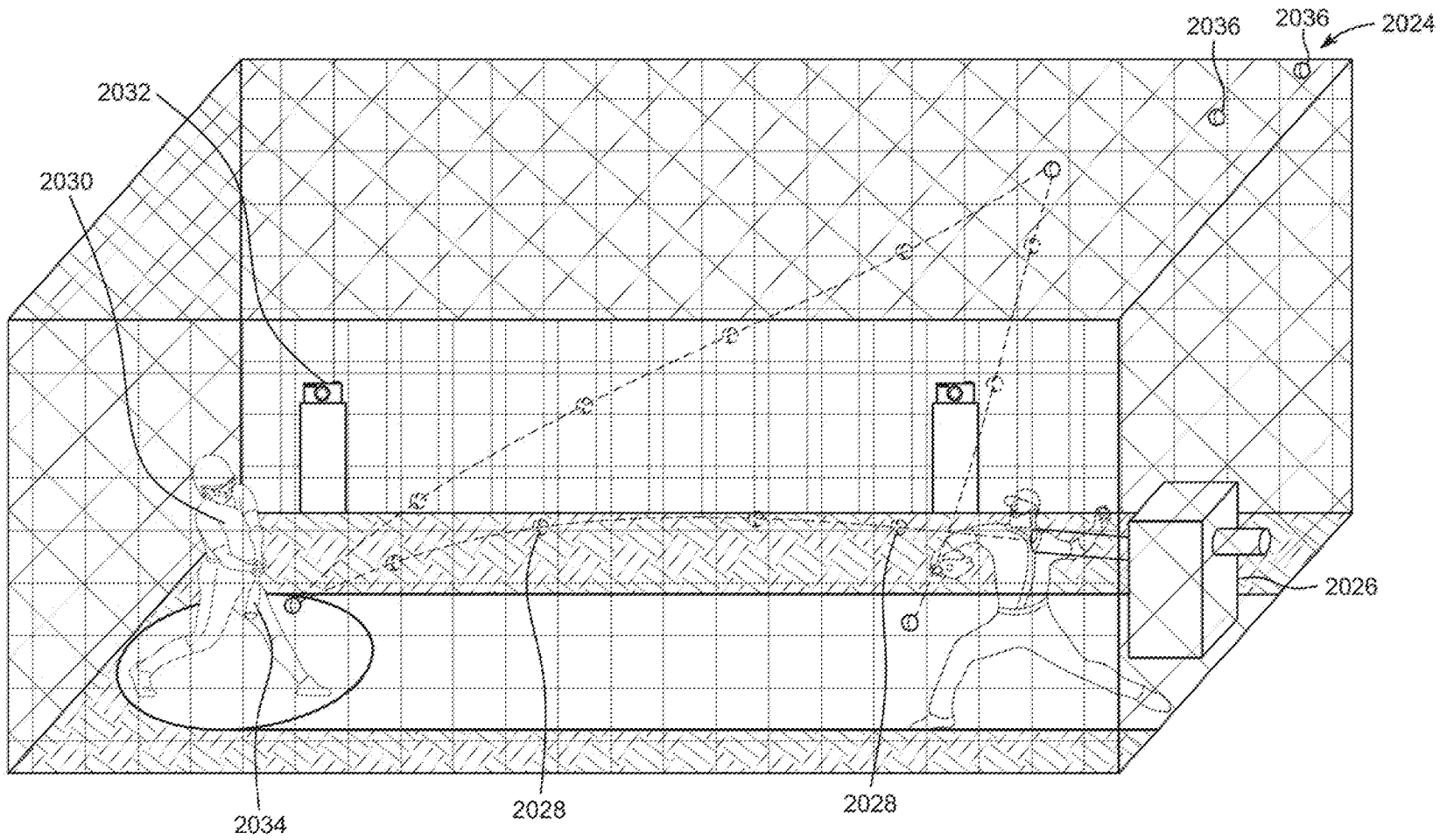
FIG. 20D illustrates a batting cage, in accordance with at least one embodiment.

FIG. 20D illustrates a batting cage 2024, in accordance with at least one embodiment. The batting cage 2024 may include a pitching machine 2026 for providing balls 2028 to a player 2030. The machine 2026 may be mounted on a computer-controlled gimbal and/or a track system allowing the balls 2028 to be launched quickly from different locations in space, at different angles and with different trajectories. In addition, the machine 2026 may be able to vary the velocity of the balls 2028. Further, the batting cage 2024 may include a plurality of cameras 2032 for capturing position and movement of the player 2030. Further, the player 2030 wearing the helmet 116, may hit the ball 2028 with a bat 2034. Successively, the ball 2028 may hit wall screens. Thereafter, the ball 2028 may bounce off. It should be noted that the helmet 116 may be integrated with the wearable glasses 118. Further, the player 2030 may view a trajectory of the ball 2028 through an AR interface of the helmet 116. It should be noted that a virtual ball 2036 may be viewed through the AR interface of the helmet 116 over the player's 2030 eyes. In one embodiment, the ball 2028 may be rendered using AR or on the wall screens. Thereafter, the rendered ball may track a real ball and mask one or more markers on the tracked real ball. It should be noted that the wall screens may be soft and may absorb the impact of the balls 2028 so that the balls 2028 tend to fall right down.

It will be apparent to one skilled in the art that such a scenario of the batting cage 2024 may be applicable to other sports, such as American football, baseball, golf, soccer, hockey, cricket and/or other sports, without departing from the scope of the disclosure. In such embodiments, a virtual image of the relevant opponent, such as a pitcher, server, catcher, tackle, goalie or other opponent may be projected in holographic form. The holographic opponent may be rendered such that the automatically pitched ball, puck or other item of play appears to have been delivered by the virtual opponent.

Figure 21A:
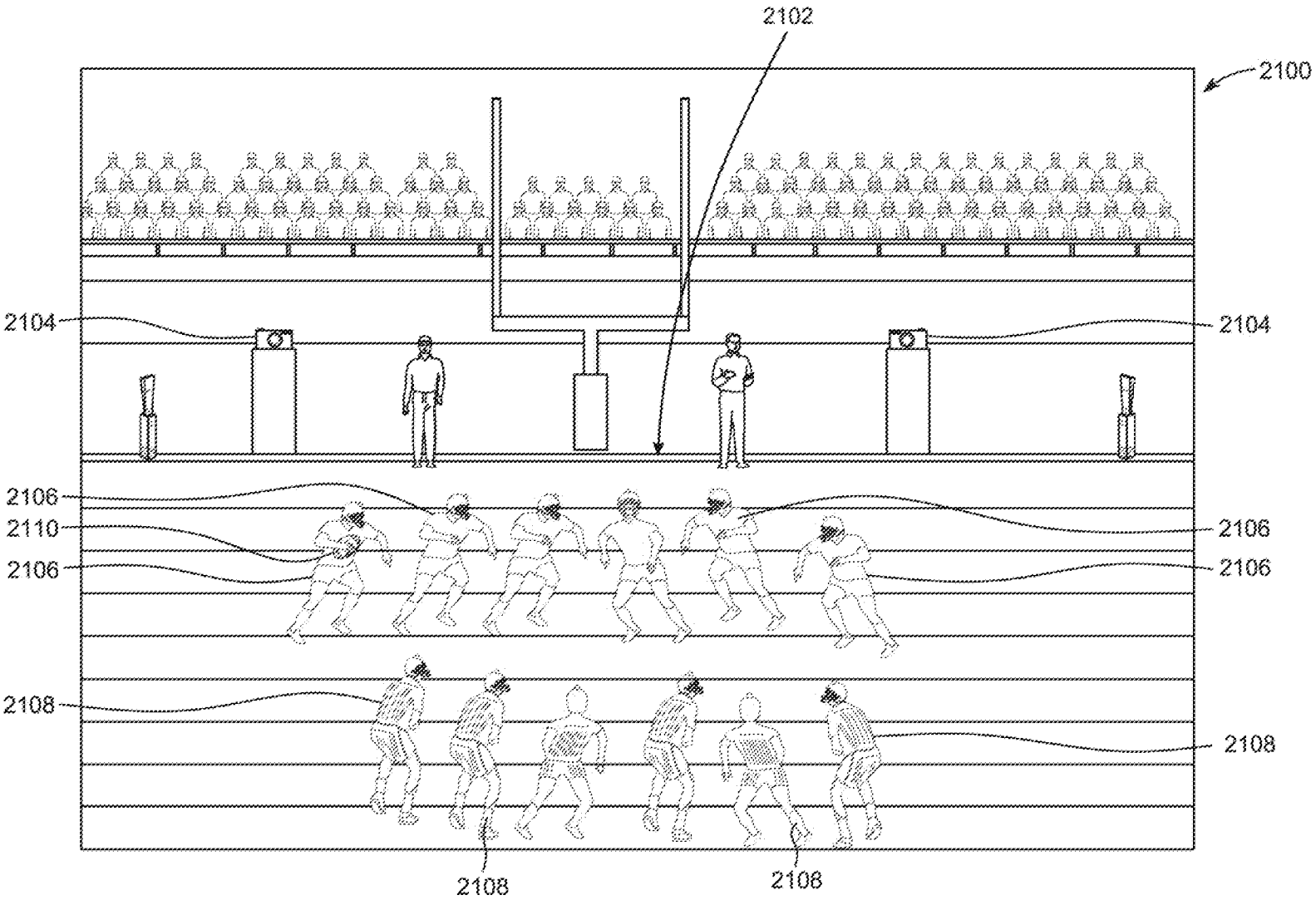
FIG. 21A illustrates a front view of an American football field showing a plurality of players, in accordance with at least one embodiment.

FIG. 21A illustrates a front view of an American football field 2100 showing a plurality of players, in accordance with at least one embodiment. The American football field 2100 may include an end zone 2102. Further, a plurality of cameras 2104 may be disposed on one or more sides of the American football field 2100. The plurality of cameras 2104 may capture data related to the plurality of players. The data may include positional data and/or visual data of the plurality of players playing on the field 2100. In one embodiment, the data may be stored in a memory. In some embodiments, the data may be transmitted to an external device or a server through the network 124. In one embodiment, one or more lidar sensors and a plurality of speakers may be disposed at one or more locations on the field 2100. It should be noted that the data obtained from the plurality of cameras 2104 may be synchronized using a time-synchronized module.

Figure 21B:
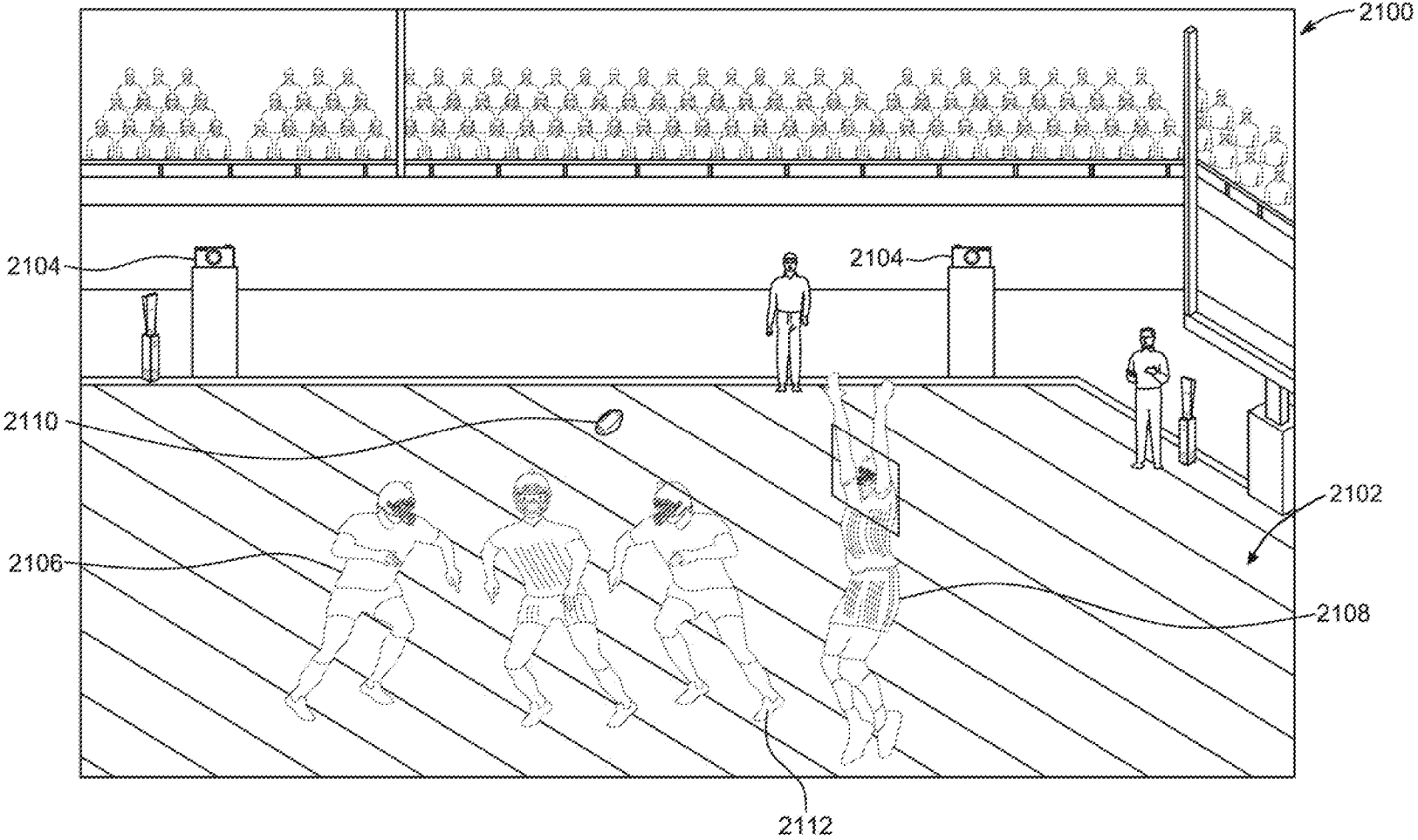
FIG. 21B illustrates a side view of an American football field showing a first player throwing a football, in accordance with at least one embodiment.

As shown in FIG. 21A, the plurality of players may wear a helmet 116 integrated with wearable glasses 118. These wearable glasses may be configured to superimpose virtual opponents in a space, that are visible to team members but not physically there. The helmet 116 may further be integrated with directional headphones, a position tracker, and an AR interface. The plurality of players may be arranged in a quarterback's view on the field 2100. Further, the plurality of players may be subdivided into a first set of players 2106 and a second set of players 2108. The first set of players 2106 may belong to one team and the second set of players 2108 may belong to another team. In an example, a player 2106 holding a football 2110 may view a position of the plurality of players on the AR interface of the helmet 116. The position of the plurality of players may be determined based at least on the position tracker integrated with the helmet 116. It should be noted that the player 2106 may be able to view a rendered end zone, a rendered referee, and a rendered plurality of players. Successively, the player 2106 may throw the football 2110 to an AR-rendered receiver 2112, as shown in FIG. 21B. Thereafter, the AR-rendered receiver 2112 may carry the football 2110 towards the end zone 2102. The AR-rendered receiver 2112 may hold a simulated football instead of a real football. It should be noted that the real football may be bounced off the screen.

Figure 22:
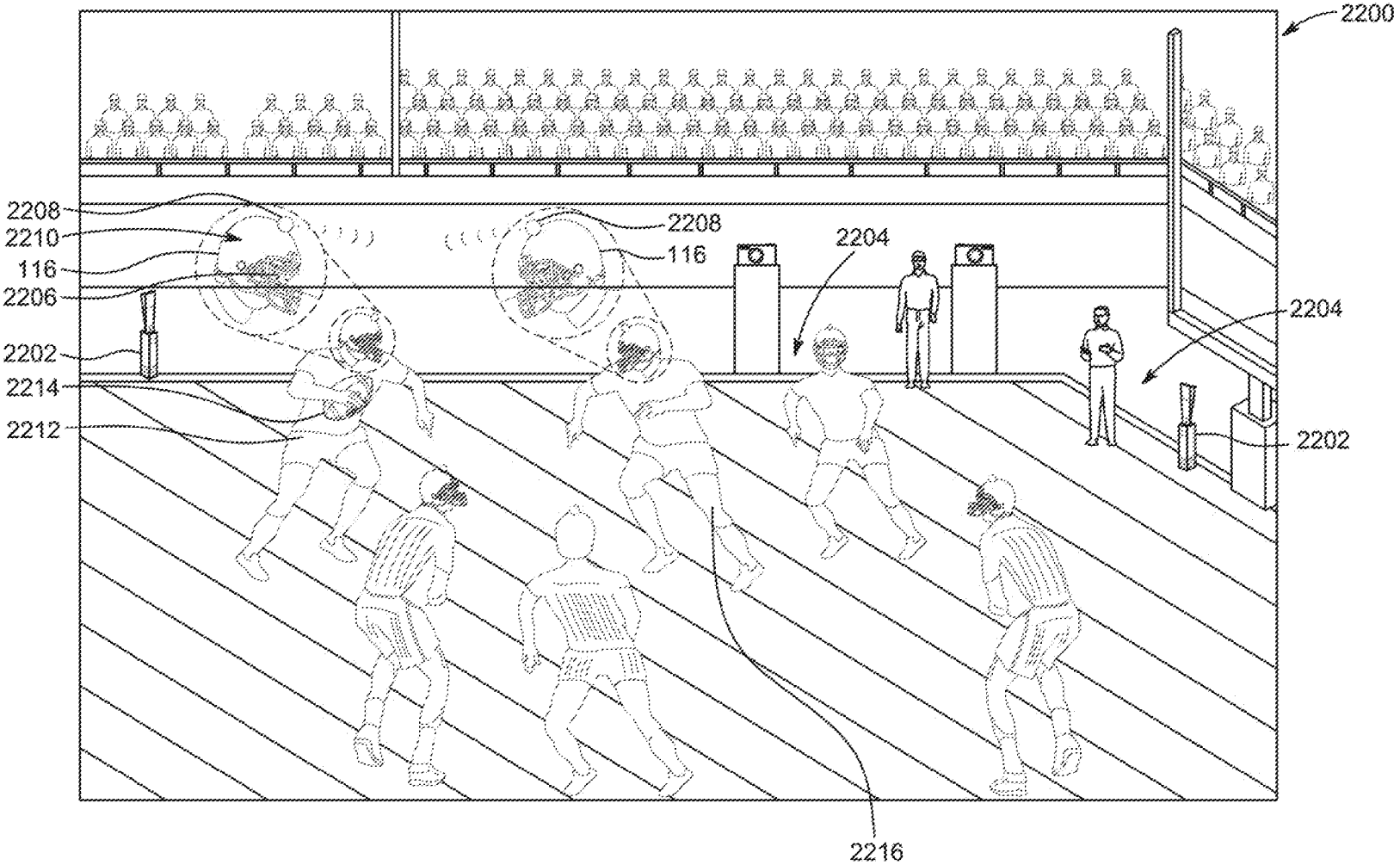
FIG. 22 illustrates a side view of an American football field showing one or more projectors, in accordance with at least one embodiment.

FIG. 22 illustrates a side view of an American football field 2200 showing one or more laser projectors 2202, in accordance with at least one embodiment. The one or more laser projectors 2202 may be disposed at one or more sides 2204 of the field 2200. Further, a plurality of players playing football may wear helmets 116 integrated with shutter glasses 2206. The shutter glasses 2206 may be synchronized with the one or more laser projectors 2202. The shutter glasses 2206 may provide, for each individual viewer, a near-field view synchronized with a far-field 3D view. Further, a projected far-field display may be shared by two or three players along with AR projection that synchronizes with the shutter glasses 2206 and overlays additional players. Further, the helmet 116 may include a positional tracker 2208 disposed on the shell 2210 of the helmet 116. The positional tracker 2208 may be used to track the position of the plurality of players.

As an example, a first player 2212 holding a football 2214, may detect a position and orientation of a second player 2216 using the positional tracker 2208. It should be noted that each one of the two or three players may share the far-field projected display with 3D shutter glass frequency offsets—e.g., 60 frames per second, 90 frames per second, 120 frames per second, 180 frames per second, 240 frames per second, or any integer or a fractional multiple of a single player's frame rate. In some embodiments, the helmet 116 may be integrated with gaze-tracking technology to identify where the first player 2212 is actually looking.

It should be noted that a focal depth of eye view may be used to render the view with the images in focus for the viewer. The direction of a player's eyes may further be used to aim, focus, adjust exposure, adjust cropping, and adjust compression rates for the objects the player is looking at. Further, the gaze and direction of gaze may be captured for the player at a very high frequency. The direction of the gaze for the player and a zone showing the direction of the gaze may be displayed to a coach. The coach may indicate to a player, or a computer program may indicate to a player automatically, where the gaze should be focused. Further, areas of the image may be colored distinctively or lit up for the player so that the player is reminded of where to look at that point in the game or action. For instance, a player may be trained to look far afield, nearby, to keep the eyes on the ball, or to maintain a sight of the ball at the beginning of and throughout a play. It should be noted that the system may continue to remind a player where the player should be looking to implement training desired by the coach.

Further, additional imagery may be projected in different color frequencies, polarization, or blanking intervals, which can only be viewed by a particular viewer by having the wearable glasses 118 tune to the frequency for detecting or re-rendering in a frequency viewable to the player. The net result of the illusion is that all users may share the same space and view the same far-field images and may see the shared images customized to the view, both in the wearable glasses 118 worn by the players and on the walls.

In an embodiment, the wearable glasses 118 track the direction, vergence, dilation, and thus focal depth of the user. This information is used to determine where and how far the user is looking. This information is further used to re-render the images displayed using the wearable glasses so that near field, mid field and far field images are properly focused or unfocused to simulate their correct depth with respect to the user. Similarly, images in the far-field are properly focused so as to simulate their correct depth to the user. This user eye information is tracked in real-time, dynamically, so that the images can be similarly altered in real-time and dynamically to look to the user as though they are simply focusing on different parts of the image. In an embodiment, the direction of the user's eyes is used to dynamically increase or decrease the resolution, rendering quality, compression rate, data size, and clipping region for portions of the image based on their viewability and focal relevance to the user. For instance, areas of the field not being viewed by the user may be rendered in low resolution, or low amounts of data bandwidth can be used to transmit information about this. In another embodiment, elements of a scene are logically or semantically analyzed for relevance to the user, and based on this analysis, the resolution, rendering quality, compression rate, data size, and clipping region can be adjusted. For instance, it could be determined that coaches who are off-court can be rendered in very low resolution while other opponents need to be rendered in higher resolution, especially those directly interacting or with the potential to interact with the player.

Figure 23:
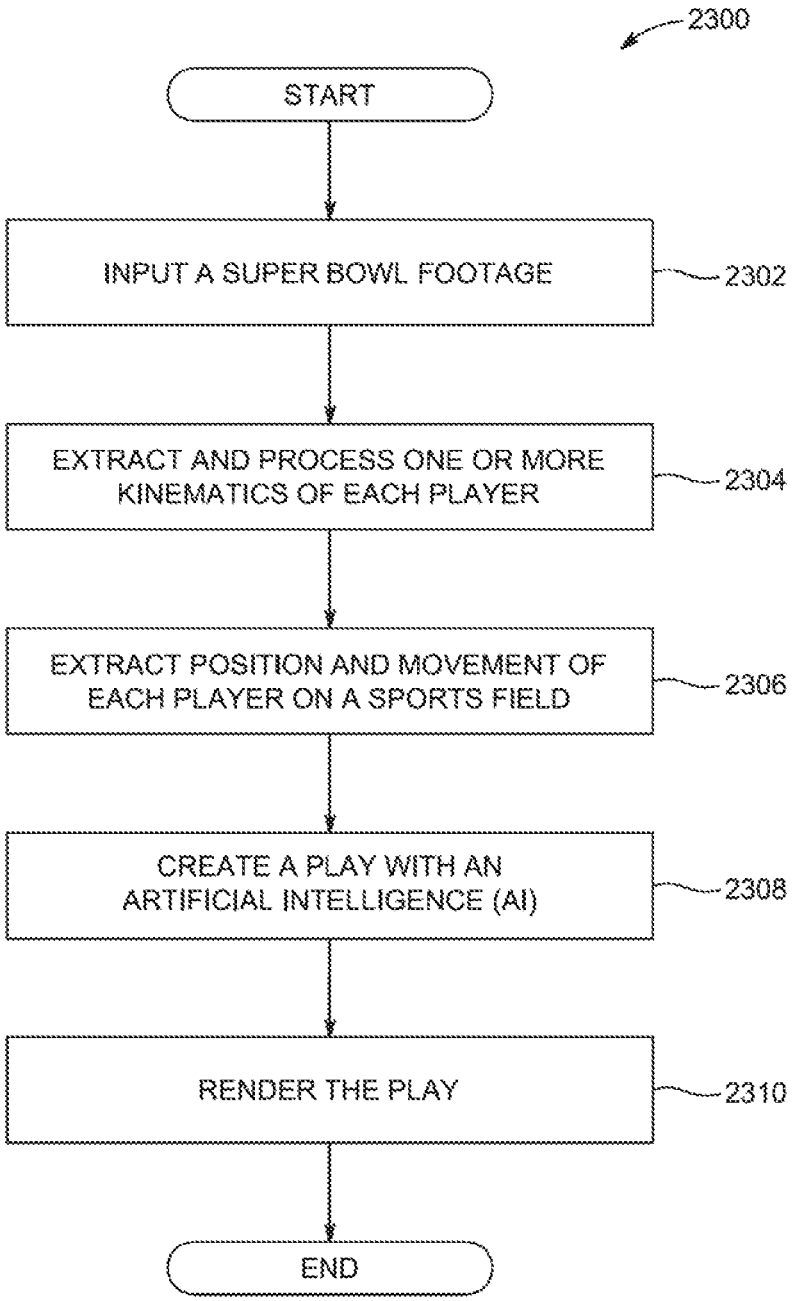
FIG. 23 illustrates a flowchart showing a method for rendering a play in American football, in accordance with at least one embodiment.

FIG. 23 illustrates a flowchart 2300 showing a method for rendering a play in American football, in accordance with at least one embodiment. The flowchart 2300 is described in conjunction with FIGS. 1-22.

At first, a coach may feed in Super Bowl footage, at step 2302. The Super Bowl footage may be viewed on a tablet. Successively, one or more kinematics of each player may be extracted and processed, at step 2304. In one embodiment, the one or more kinematics may include body movements, position, and orientation of each player. Successively, position and movement of each player on a sports field may be extracted, at step 2306. Successively, a play may be created with an AI, at step 2308. Thereafter, the play may be rendered, at step 2310.

Figure 24A:
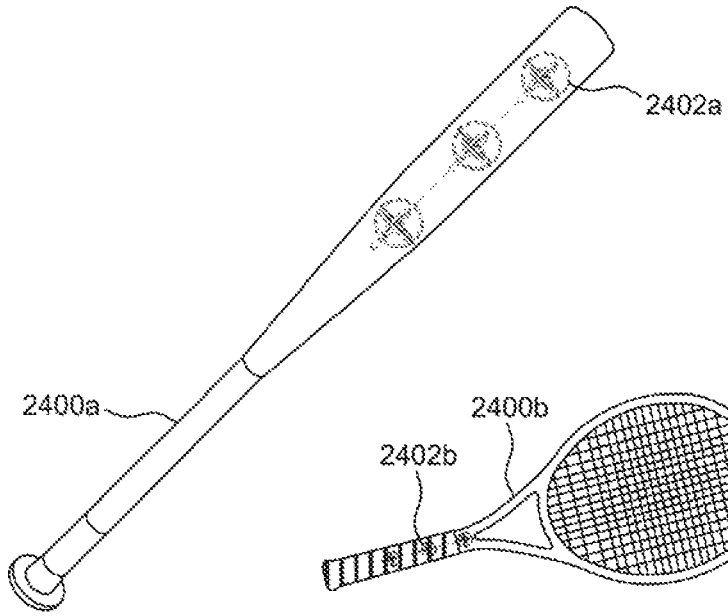
FIG. 24A illustrates a baseball bat integrated with one or more gyroscopes, in accordance with at least one embodiment.

FIG. 24A illustrates a baseball bat 2400*a* integrated with one or more gyroscopes 2402*a*, in accordance with at least one embodiment. The one or more gyroscopes 2402*a* may be used to determine and maintain orientation and angular velocity. The orientation may be, for example, 45 degrees, 90 degrees, or 360 degrees. Further, the one or more gyroscopes 2402*a* may simulate motion, drag, hitting a ball, and an absolute position of the bat. It should be noted that the one or more gyroscopes 2402*a* may be able to slide down within the baseball bat 2400*a*. Further, the one or more gyroscopes 2402*a* may be motorized to move back by climbing on a central track going through a center of the baseball bat 2400*a* lengthwise. Further, the one or more gyroscopes 2402*a* may rotate 90 degrees to create a moment at any location or direction for each one of devices.

Figure 24B:
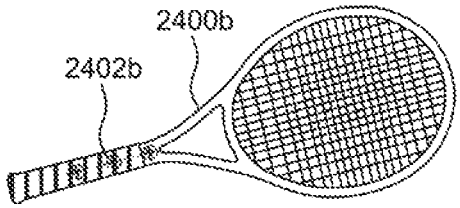
FIG. 24B illustrates a tennis racket integrated with one or more gyroscopes, in accordance with at least one embodiment.

FIG. 24B illustrates a tennis racket 2400*b* integrated with one or more gyroscopes 2402*b*, in accordance with at least one embodiment. The one or more gyroscopes 2402*b* may be used to determine and maintain orientation and angular velocity. The orientation may be, for example, 45 degrees, 90 degrees, or 360 degrees. Further, the one or more gyroscopes 2402*b* may simulate motion, drag, hitting a ball, and an absolute position of the racket. It should be noted that the one or more gyroscopes 2402*b* may be able to slide down within the tennis racket 2400*b*. Further, the one or more gyroscopes 2402*b* may be motorized to move back by climbing on a central track going through a center of the tennis racket 2400*b* lengthwise. Further, the one or more gyroscopes 2402*b* may rotate 90 degrees to create a moment at any location or direction for each one of the devices.

Figure 25:
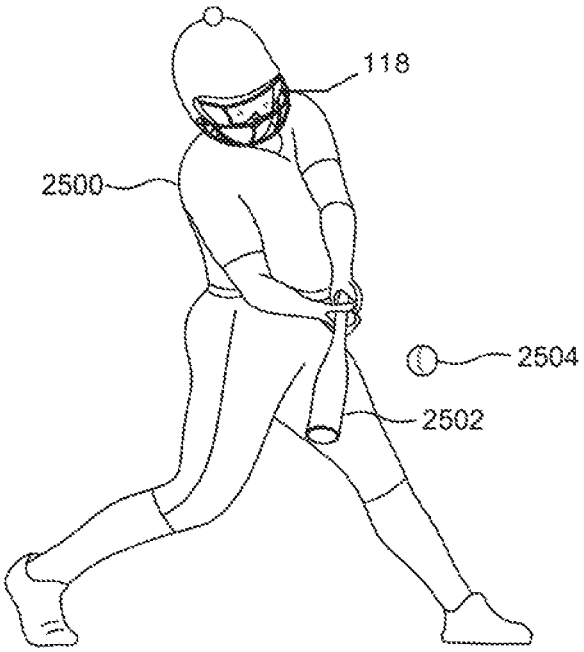
FIG. 25 illustrates a player holding a baseball bat, in accordance with at least one embodiment.

FIG. 25 illustrates a player 2500 holding a baseball bat 2502, in accordance with at least one embodiment. Further, the player 2500 may play with a virtual ball 2504. The virtual ball 2504 may be viewed through the wearable glasses 118 over the player's 2500 eyes. It should be noted that the baseball bat 2502 may be integrated with one or more gyroscopes. The one or more gyroscopes integrated within the baseball bat 2502 may provide a proper kick when the virtual ball 2504 hits the baseball bat 2502. Further, the one or more gyroscopes may be used to track position and orientation of the baseball bat 2502 in a physical space and a virtual space. Such usage of the one or more gyroscopes within the baseball bat 2502 may be useful for tracking performance of the player 2500.

Figure 26:
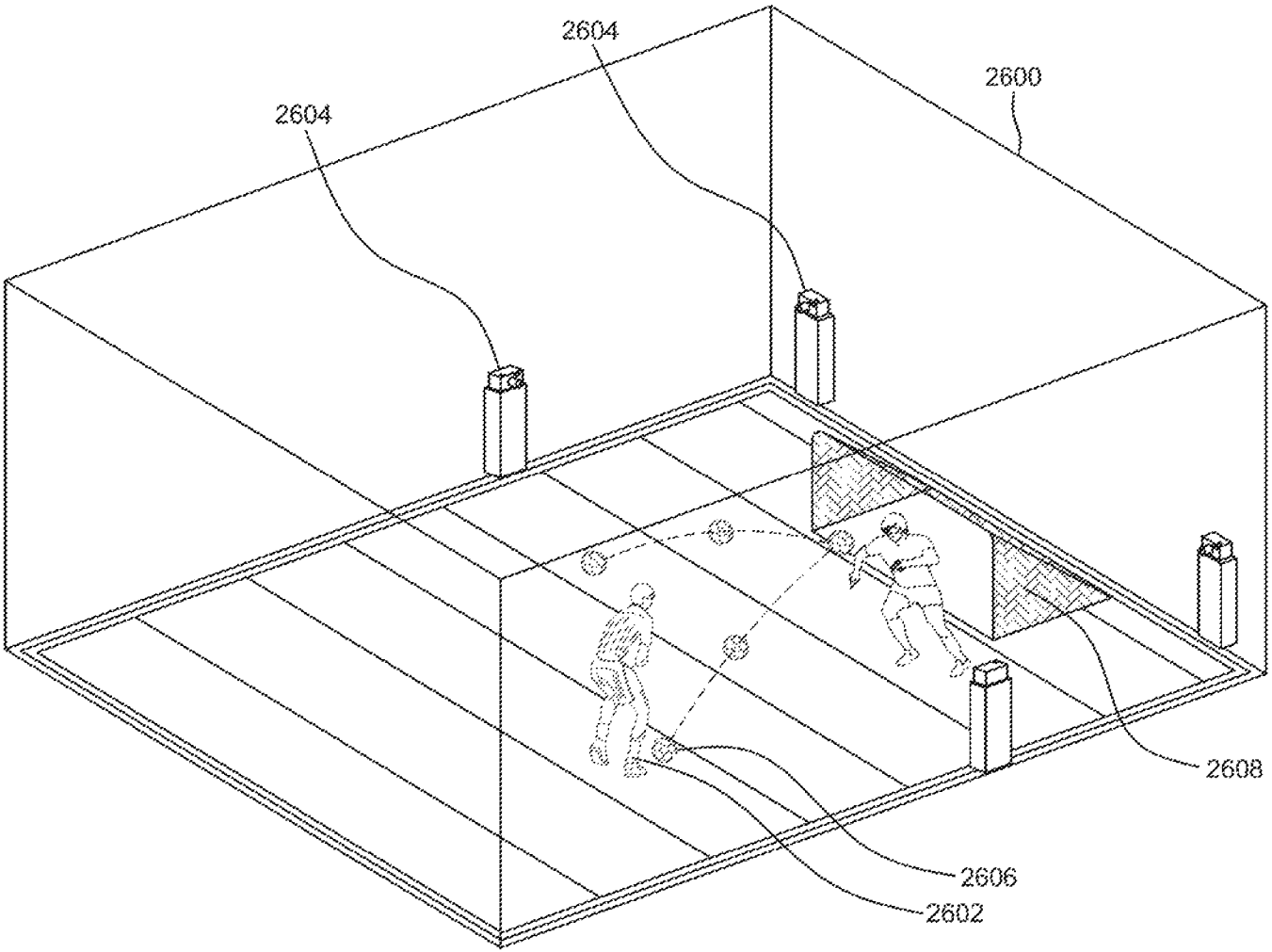
FIG. 26 illustrates a room showing a player playing soccer, in accordance with at least one embodiment.
Figure 27:
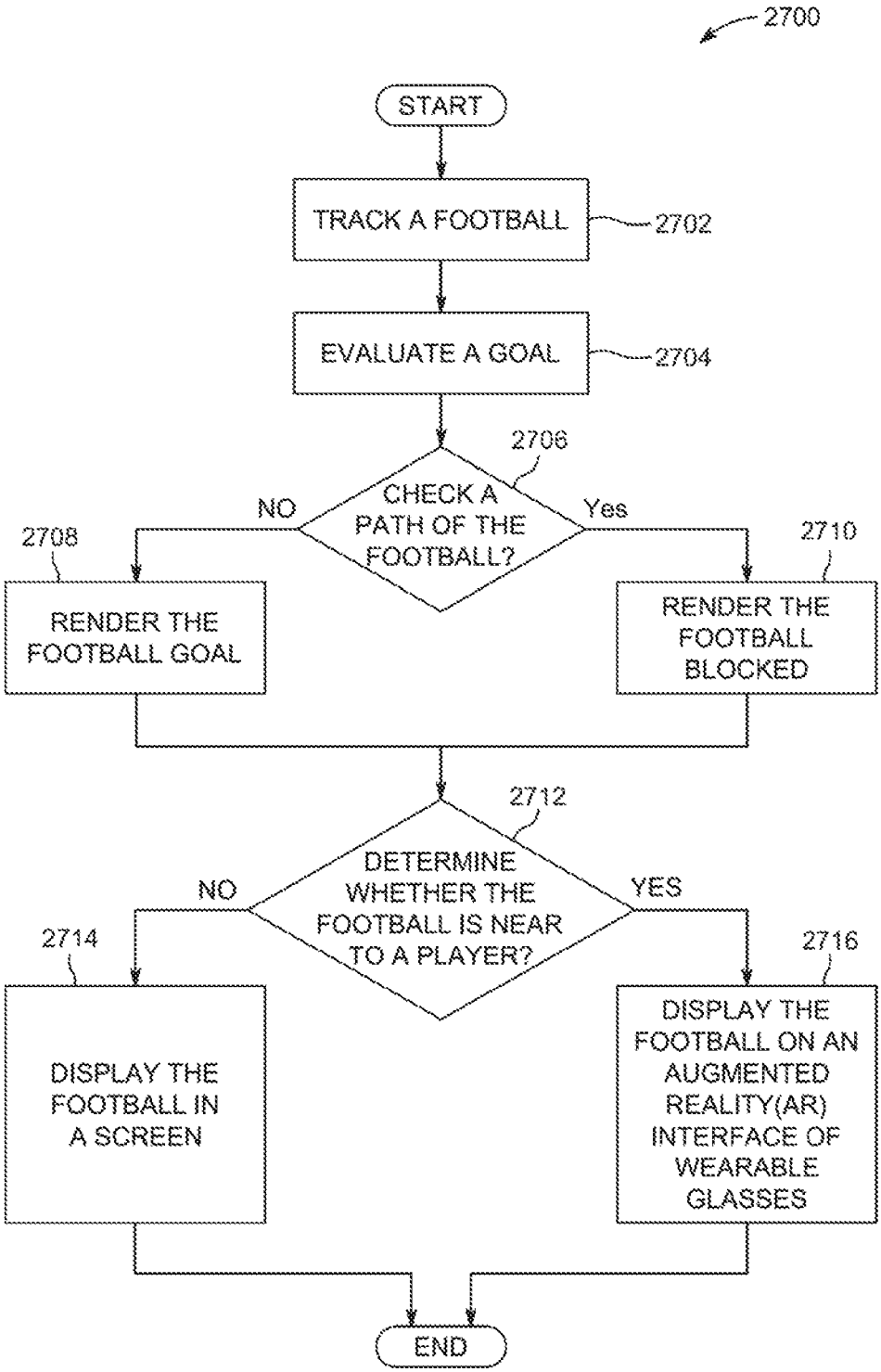
FIG. 27 illustrates a flowchart showing a method for playing soccer in the room of FIG. 26, in accordance with at least one embodiment.

FIG. 26 illustrates a room 2600 showing a player 2602 playing soccer, in accordance with at least one embodiment. FIG. 27 illustrates a flowchart 2700 showing a method for playing soccer in the room 2600, in accordance with at least one embodiment. The flowchart 2700 is described in conjunction with FIG. 26.

The room 2600 may include a plurality of cameras 2604. Further, the player 2602 wearing wearable glasses 118, may play soccer. In one embodiment, when the player 2602 kicks a football 2606, the football 2606 may be tracked, at step 2702. Successively, a goal 2608 may be evaluated, at step 2704. Successively, a path of the football 2606 may be analyzed, at step 2706. Based at least on the analysis, if the path of the football 2606 is not blocked by virtual opponents, then the football 2606 will be rendered for view by the player at step 2708. If the path of the football 2606 is blocked by the virtual opponents, then rendering of the football 2606 is blocked at step 2710. The rendering of the football 2606 can be either in the AR glasses or the more distant screen. This determination is made at step 2712. If the football 2606 is close to the player 2602 e.g. within the visual display range of the AR glasses, then it is displayed on the AR screen. If the football is farther than the visual display range of the AR glasses, then the football 2606 may be displayed on a screen, at step 2714. 118, at step 2716. It should be noted that the player 2602 may view a graphic indicating the trajectory of the football 2606 on the AR interface of the wearable glasses 118.

Figure 28:
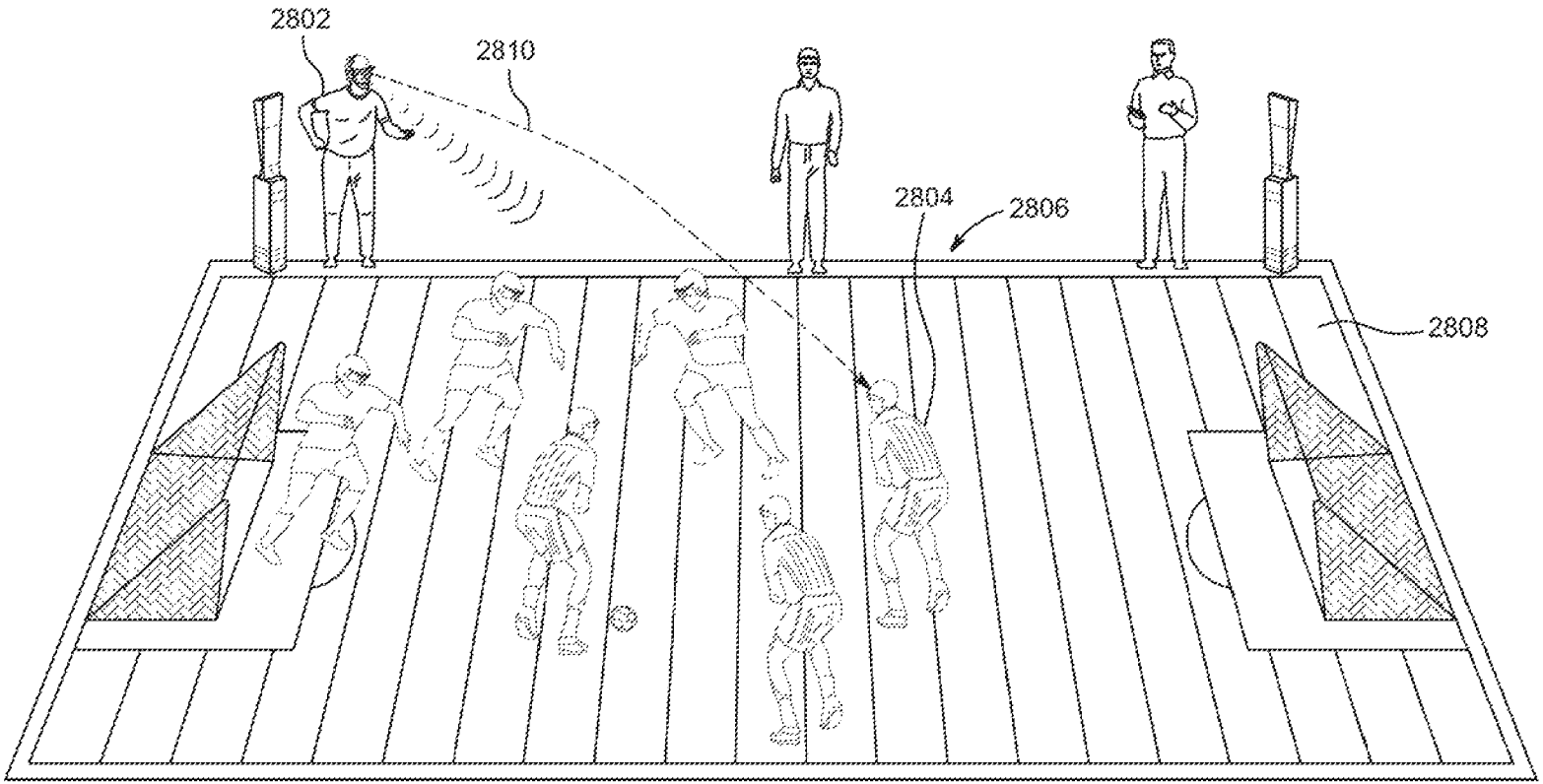
FIG. 28 shows a coach communicating with a player in real time using gaze-tracking technology, in accordance with at least one embodiment.

FIG. 28 shows a coach 2802 communicating with a player 2804 in real time using gaze-tracking technology, in accordance with at least one embodiment. The coach 2802, wearing the wearable glasses 118, may stand at one or more sidelines 2806 of a soccer field 2808. It should be noted that the wearable glasses 118 may be integrated with gaze-tracking technology. Further, the coach 2802 may look at the specific player 2804 through the wearable glasses 118. In one embodiment, a visual indicator line 2810 may be drawn to show the player 2804. Thereafter, when the coach 2802 speaks, a message from the coach 2802 may be transmitted to the player 2804. In one embodiment, the message may include such commands as "turn right," "kick the ball," or "turn left." Such communication between the coach 2802 and the player 2804 may be established using gaze-tracking technology. In some embodiments, the coach 2802, wearing the wearable glasses 118, may look at a large screen to check through retinal tracking whether the coach 2802 is looking at the same player 2804 and/or whether the message is transmitted to the same player 2804. Further, the coach 2802 may draw a game plan for the player 2804 playing soccer. In one embodiment, the game plan may be drawn on an AR interface of the wearable glasses 118. In another embodiment, the game plan may be made on a tablet of the coach 2802.

Figure 29:
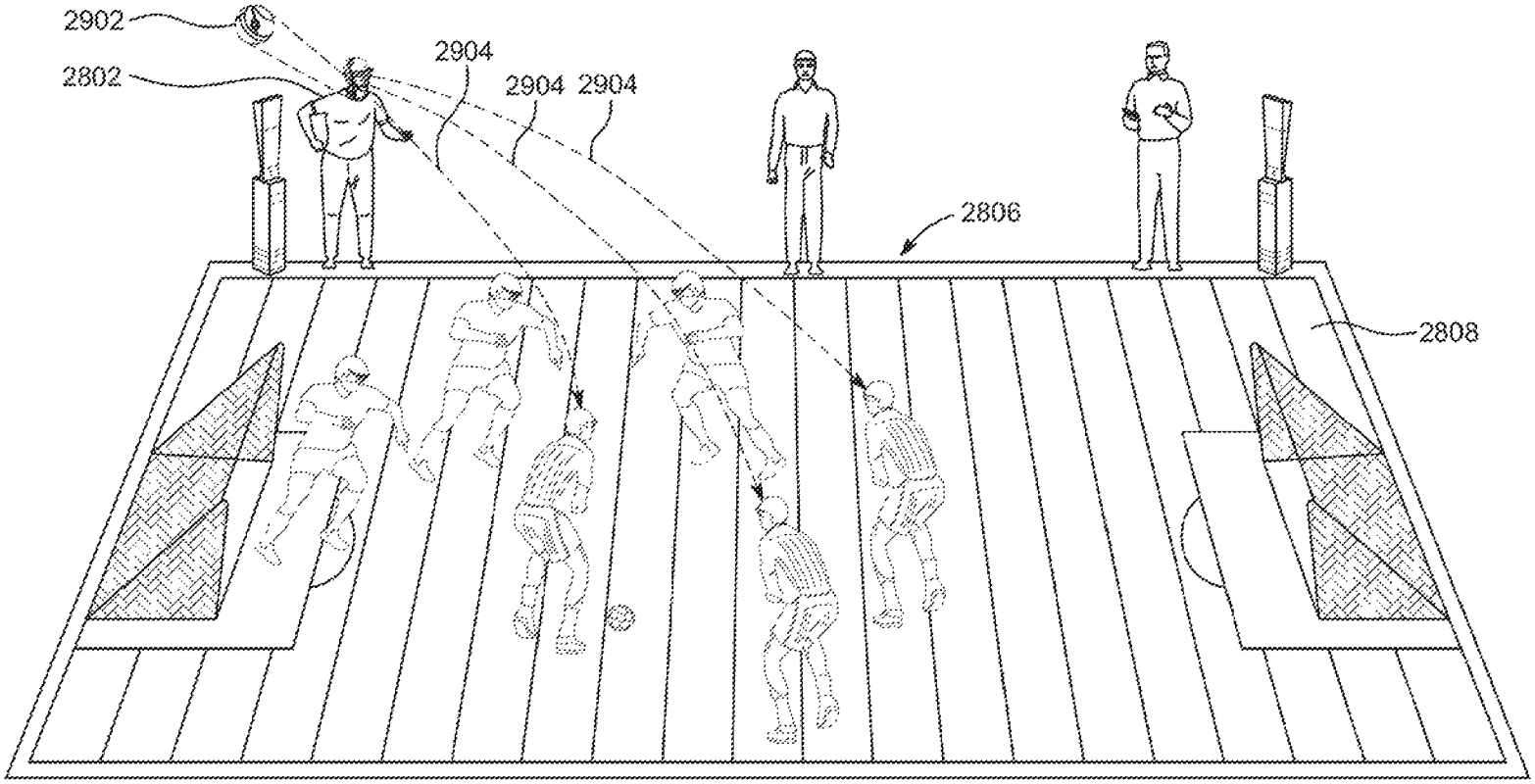
FIG. 29 shows a coach communicating with a plurality of players in a team using gaze-tracking technology, in accordance with at least one embodiment.

As shown in FIG. 29, the coach 2802 may hold a button 2902. In one embodiment, the button 2902 may be integrated within the wearable glasses 118. In one embodiment, the coach 2802 may hold a key (i.e., a modifier key) or look to the left at an icon representing an entire team. At first, the coach 2802 may activate the button 2902 to cause virtual lines 2904 to be drawn to each one of the players in a team. Thereafter, when the coach 2802 speaks, then each one of the players in the team may hear the voice of the coach 2802. Further, the coach 2802 may draw a game plan for each one of the players in the team. In one embodiment, the game plan may be drawn on an AR interface of the wearable glasses 118 in real time. In another embodiment, the game plan may be made on a tablet of the coach 2802 in real time. In an example, the coach 2802 may touch three players (i.e., with three fingers on a tablet) in real time. Further, the coach 2802 may circle a player on the soccer field 2808, indicating a threat. Thereafter, two-dimensional (2D) drawings of the threat may be transmitted to the players in the team. Such communication between the coach 2802 and the players may be established in real time using gaze-tracking technology.

It will be apparent to one skilled in the art that a single coach 2802 has been shown for illustration purposes. In some embodiments, more than one coach may send messages to the players in real time, without departing from the scope of the disclosure.

Figure 30:
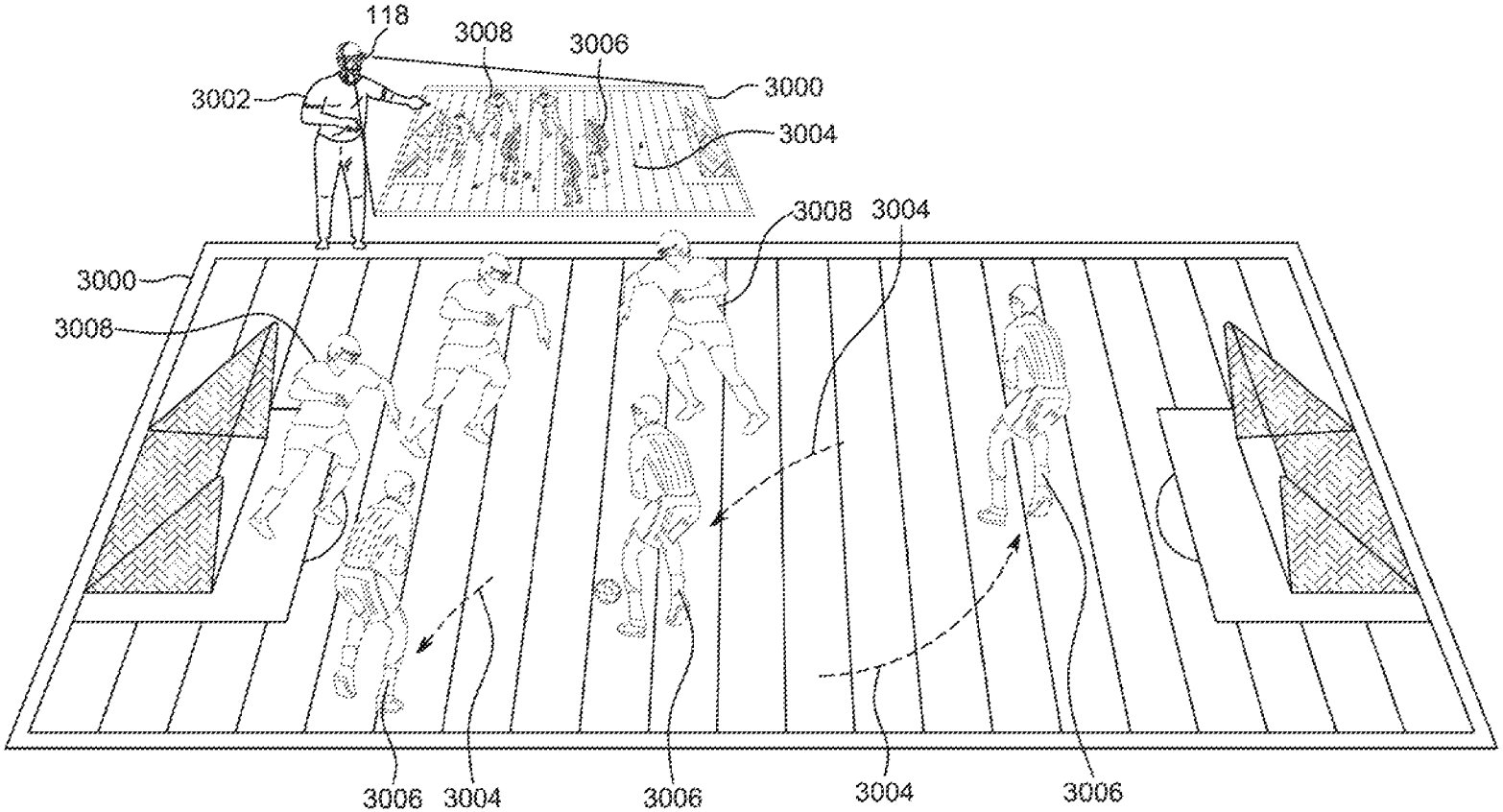
FIG. 30 illustrates a floating view of a soccer field in space in front of a coach, in accordance with at least one embodiment.

FIG. 30 illustrates a floating view of a soccer field 3000 in space in front of a coach 3002, in accordance with at least one embodiment. The coach 3002 may draw one or more lines 3004 in 3D space on the virtual soccer field 3000. The one or more lines 3004 may indicate a game plan, one or more instructions, and/or a path for one or more players 3006 against one or more opponents 3008. Successively, the coach 3002 may transmit the one or more lines 3004 to the one or more players 3006. Successively, the one or more players 3006 may view the one or more lines 3004 on an AR interface of the wearable glasses 118. Thereafter, the one or more players 3006 may follow the one or more lines 3004. Such a method may be very effective for receiving and executing instructions of the coach 3002 in real time.

Figure 31:
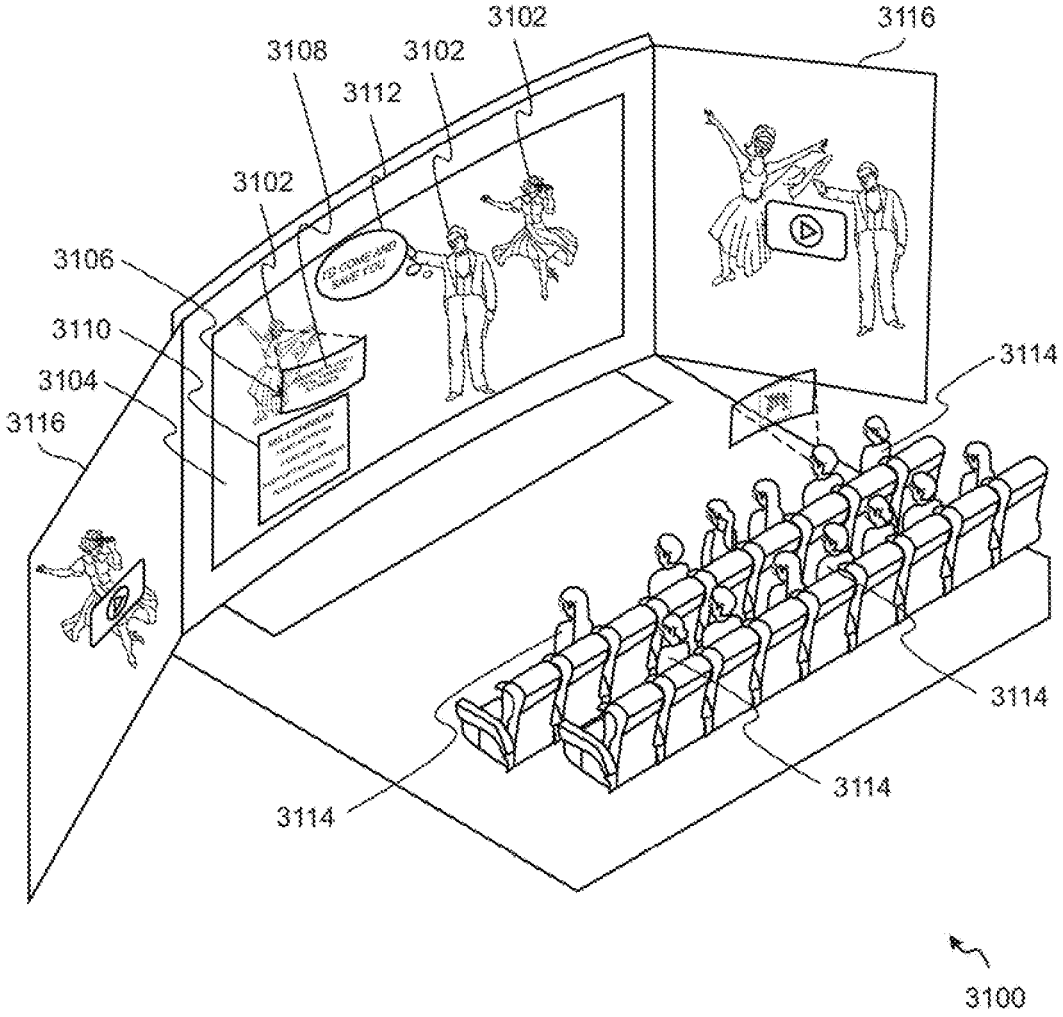
FIG. 31 illustrates a live stage show, where one or more performers are performing a play on a stage, in accordance with at least one embodiment.

FIG. 31 illustrates a live stage show 3100 where performers 3102 are performing a play on a stage 3104, in accordance with at least one embodiment. Each one of the performers 3102 may be assisted by the wearable glasses 118. The wearable glasses 118 may show paths and marks for each one of the performers 3102 in real time. It should be noted that the paths and marks for the performers 3102 may be displayed on an AR interface 3106 of the wearable glasses 118. In one embodiment, the performers 3102 may be able to view one or more dialogs 3108 on the AR interface 3106 in real time. Further, the audience 3114 may be able to view subtitles 3110. The subtitles 3110 may be placed under each speaking performer 3102. Further, 2D or 3D speech bubbles and/or thought bubbles 3112 may be displayed to the performers 3102 on the AR interface 3106, in a mixed-reality play. In one embodiment, the speech bubbles 3112 may float above each performer 3102. Further, the thought bubbles 3112 may show a subtext of the performer 3102 during the play. Such method may allow each performer 3102 to perform in a live stage show 3100 without rehearsal.

In one embodiment, an audience 3114 may wear the wearable glasses 118 for watching the play. Further, a set of the live stage show 3100 may have one or more rear-projection screens 3116. In one embodiment, the one or more rear-projection screens 3116 may be a circular screen. In an example, the circular screen may be a 270-degree screen. It should be noted that imagery may be stitched together on the circular screen for the audience 3114 to create sets and costumes for the performers 3102. In an example, one or more images of the performer 3102 wearing "green screen" clothes may be projected on the circular screen or an AR interface of the audience 3114. Further, the one or more images may be customized to the audience 3114. For example, the audience 3114 may select different costumes for the performers 3102. Further, such a method may allow correction of lip-syncing for the real-time or pre-recorded translations of the play. It should be noted that such a method may be effective for the performers 3102 while performing on the stage 3104.

It will be apparent to one skilled in the art that acting and recordings or acting of real actors may be blended with prerecorded non-player characters (NPC), who also interact with the actors according to the AR, thus improving the AR actors.

Figure 32:
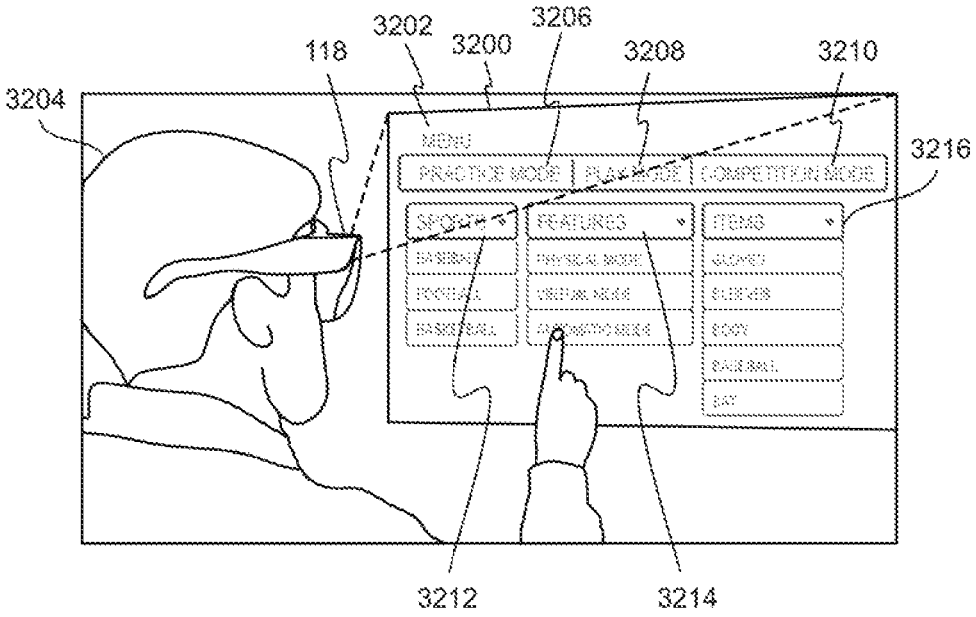
FIG. 32 illustrates an AR interface of the wearable glasses showing a menu, in accordance with at least one embodiment.

FIG. 32 illustrates an AR interface 3200 of the wearable glasses 118 showing a menu 3202, in accordance with at least one embodiment. A player 3204 wearing the wearable glasses 118 may view the menu 3202. The menu 3202 may display one or more modes such as a practice mode 3206, a play mode 3208, and a competition mode 3210. Further, the menu 3202 may display one or more sports 3212. The one or more sports 3212 might include, but are not limited to, baseball, football, or basketball. Further, the menu 3202 may display one or more features 3214 for playing the one or more sports 3212. In one embodiment, the one or more features 3214 may be a physical mode, a virtual mode, and an automatic mode. Further, the menu 3202 may display one or more items 3216 for the players 3204. The one or more items 3216 may include, but are not limited to, gloves, sleeves, body, baseball, and/or bat. The one or more items 3216 may include buttons (e.g., touch-sensitive spots) for activating certain features and changing views. The buttons may be physical or virtual. It should be noted that the buttons may be implemented by cameras and/or the accelerometers of the mocap suit 120 or the helmet 116. The buttons may be set and locked by the player 3204. Once the buttons are set by the player 3204, the functionality of the buttons may not change while playing the one or more sports 3212. For example, the functionality of the buttons may not change when the player 3204 collides with another player during a game. It will be apparent to one skilled in the art that the menu 3202 may include other options as well, without departing from the scope of the disclosure. For example, rather than touch buttons, the embodiments and menu may be voice controlled. For example, the player 3204 may use voice commands to activate, position, lock, etc. the buttons and/or otherwise interact with the AR interface 3200. In addition to voice or touch control, as discussed further below, in some embodiments, gaze tracking may be utilized to determine a direction in which the person is looking and, based on the determined gaze direction, alone or in combination with voice input, activate or enable interaction with the menu, buttons, etc., presented on the AR interface.

Figure 33:
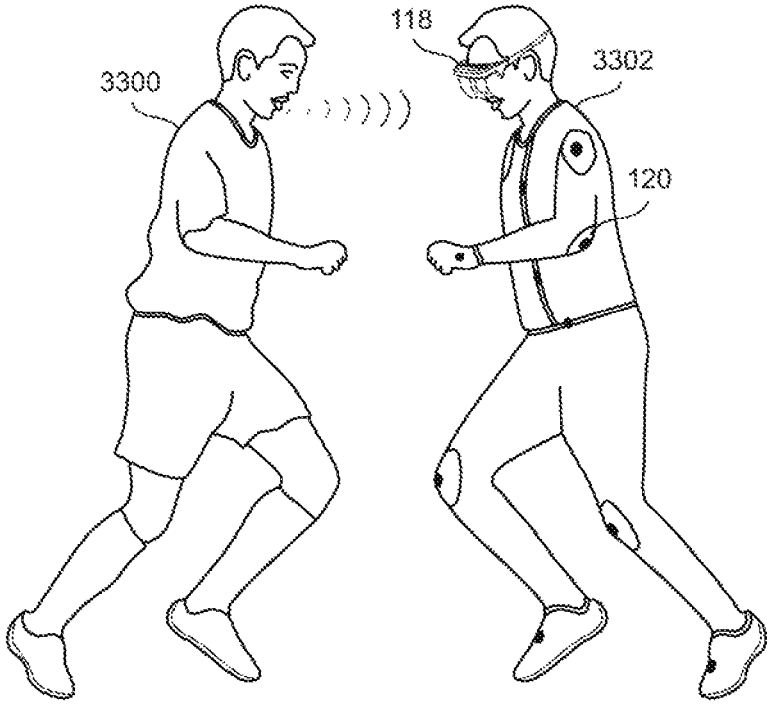
FIG. 33 illustrates a "maquette" (i.e., a body model) of an athlete, in accordance with at least one embodiment.

FIG. 33 illustrates a "maquette" 3300 (i.e., a body model) of an athlete 3302 wearing the wearable glasses 118 and the mocap suit 120, in accordance with at least one embodiment. The maquette 3300 may be used by the athlete 3302 for receiving feedback. The feedback may be audio feedback or visual feedback. Further, the maquette 3300 may use the kinematics of the athlete 3302 to compare execution of muscle memory to an idealized or correct rendition. Based at least on the comparison, the maquette 3300 may provide feedback to the athlete 3302 in real time. The feedback may correspond to how the athlete 3302 performed in a game. It should be noted that a virtual maquette may or may not be a mirror image.

As discussed above, the disclosed embodiments may include one or more of a helmet with one or more input/output components, such as cameras, microphones, speakers, etc. Likewise, while the above embodiments refer mostly to wearable glasses, it will be appreciated that any form of virtual and/or augmented reality device or feature may be utilized and the disclosed embodiments are not limited to wearable glasses. For example, as discussed below, information may be projected, reflected, and/or presented on a translucent or transparent display that is in the field of view of the user, athlete, coach, driver, etc.

Figure 34:
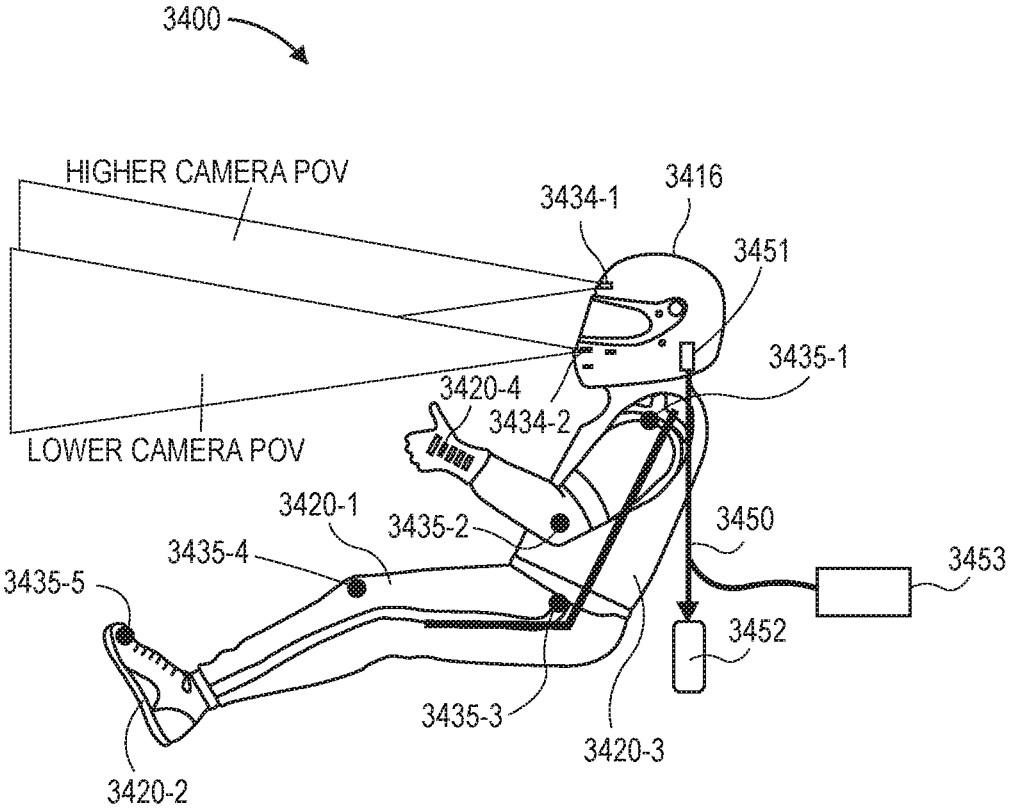
FIG. 34 illustrates a driver wearing a helmet and suit, in accordance with at least one embodiment.

FIG. 34 illustrates a driver 3400 wearing a helmet 3416 and a suit 3420, in accordance with at least one embodiment. In the illustrated example, the helmet 3416 includes at least two forward facing imaging elements 3434-1 and 3434-2 (e.g., cameras) that have a field of view that includes a direction in which the driver 3400 wearing the helmet is looking. As discussed further below, in some examples, only the lens and sensor may be included in the helmet 3416 and all other imaging components/circuitry may be remote from the helmet and communicatively (wired or wireless) connected to the lens and sensor. Limiting the imaging element components placed on the helmet 3416 reduces the weight added to the helmet as well as the risk of injury to the driver from the components in the event of an accident. In some examples, the lens and sensor may be only millimeters ("mm") in thickness and diameter (e.g., 15 mm×32 mm) thereby allowing the lens/sensor 3434 to be inserted into the shell of the helmet such that it does not protrude through the helmet shell or extend beyond the shell of the helmet. Helmets, such as racing helmets, generally range from three-sixteenths of an inch to one-quarter of an inch and may be formed of a variety of materials including, but not limited to, fiberglass, carbon fiber, plastic, metal, etc.

In the example illustrated in FIG. 34, a first imaging element 3434-1 is positioned above the face shield of the helmet and provides a high field of view corresponding to the field of view of the driver 3400 and a second imaging element 3434-2 is positioned below the face shield of the helmet 3416 and provides a low field of view corresponding to the field of view of the driver 3400. By including both a high field of view from imaging element 3434-1 and a low field of view from imaging element 3434-2, regardless of the direction in which the driver is looking (e.g., up, down, left, right) the field of view of the driver will correspond with at least a portion of one of the fields of view from the imaging elements 3434-1, 3434-2. In other examples, fewer or additional imaging elements may be included on the helmet 3416 and/or the imaging elements 3434 may be at different positions on the helmet 3416. For example, one or more imaging elements may be positioned on a left or right side of the helmet 3416, on the top or rear of the helmet 3416, etc. Likewise, in some embodiments, one or more imaging elements may be posited toward the bottom of the helmet and oriented toward a body of the driver wearing the helmet. As noted below, image data from downward facing imaging elements may be utilized alone or in combination with data from other sensors that are included on the helmet or remote from the helmet to generate image and/or other data corresponding to the driver, such as body position, movement, personal motion, "selfie" video footage, etc. In some embodiments, image and sensor data can be used to construct a complete view of the person by stitching together the data received from multiple sensors, and applying a mathematical transformation to the information to compensate for sensor distortion or nonlinearity, such as the curvature of a lens. For instance, a pair of downward-facing cameras, situated in the front and back of a helmet, may capture the front and rear of a person, but due to the long perspective of the shot and any "fish-eye" lensing, produce two elongated and distorted images. In some embodiments, the imaging elements may also emit signals to be sensed, as in laser raster scanning and reflection (visible and non-visible light), structured light projection (stationary or motion, visible and non-visible light), RF emission and receipt, microwave reflection, millimeter wave scanning, backscatter X-Ray, etc.

Still further, while the described embodiments focus primarily on imaging elements included in the shell of the helmet, in other implementations one or more other forms of sensors may be included in the shell of the helmet in a similar manner. Other sensors include, but are not limited to infrared ("IR") sensors, Sound Navigation and Ranging ("SONAR") sensors, Light Detection and Ranging ("LIDAR") sensors, structured light sensors, etc. In some embodiments, information obtained from sensor data can be combined with information obtained from other sensors to construct a complete visual or motion view of a driver.

The helmet 3416 may be communicatively coupled to one or more computing devices 3452 that are separate from the helmet. The computing devices 3452 may be local to the vehicle in which the driver 3400 is positioned and/or operating, referred to herein as in-vehicle computing devices, or the computing devices may be remote from the vehicle, referred to herein as remote computing devices. In-vehicle computing devices may be attached to the suit 3420 worn by the driver (e.g., clipped to the suit or incorporated into the suit), placed, or affixed to a portion of the vehicle, etc. The in-vehicle computing device 3452 may be a special purpose in-vehicle computing device designed to communicate with the helmet 3416 and, optionally, other components such as the suit 3420, the vehicle, etc. In other examples, the in-vehicle computing device may be any other form of computing device that is capable of receiving data from the helmet and/or providing data to the helmet 3416. For example, the in-vehicle computing device 3452 may be a laptop, cellular phone, tablet, wearable, etc.

In examples in which the helmet 3416 communicates with an in-vehicle computing device 3452, the communication may be wired or wireless. For example, a wired connection 3450 may exist between the in-vehicle computing device 3452 and the helmet 3416. To allow the driver to quickly exit the vehicle, in some embodiments, the wired connection 3450 may be detachably connected to the helmet 3416 at a connecting point 3451. The connecting point may be a clasp, a magnetic coupling, etc. Regardless of the configuration of the connecting point 3451, in operation the connecting point may be designed to allow separation between the wired connection 3450 and the helmet 3416 when a first force is applied, such as a driver exiting the vehicle, but remain attached when forces less than the first force are applied (e.g., forces from the driver moving their head), etc.

The wired connection 3450 may be used to provide power to the helmet 3416 provided by or through the in-vehicle computing device 3452 and/or provided by a power supply 3453 that is separate from the in-vehicle computing device 3452, provide data from the in-vehicle computing device 3452 to the helmet 3416 and/or provide data from the from the helmet 3416 to the in-vehicle computing device. Data provided from the in-vehicle computing device 3452 may include, but is not limited to, vehicle data, driver data, event data, etc. Vehicle data includes, but is not limited to tachometer, oil pressure, oil temperature, water temperature, battery voltage, battery amperage, fuel available/remaining, gear selection, warning standard setting changes, turbo or supercharger boost, fuel pressure, traction control, electric boost, speed, revolutions per minute ("rpm"), etc. Driver data, which may be obtained from the mocap suit 3420 and/or determined based on a processing of gaze tracking data corresponding to the driver (discussed further below), includes but is not limited to, heartrate, blood pressure, stress level, fatigue, temperature, etc. Event data, which may be obtained from one or more remote computing resources, may include, but is not limed to, pace, fastest lap, slowest lap, accidents, laps remaining, etc. In other examples, some or all of the communication and/or power may be wirelessly provided between the in-vehicle communication device 3452, the power supply 3453, and the helmet 3416.

In addition to providing power and/or data exchange with the helmet 3416, the in-vehicle computing device 3452 may also provide a wireless communication with one or more remote computing devices, as discussed further below with respect to FIG. 37. Likewise, the in-vehicle computing device 3452 may also communicate with, receive data from, and/or provide data to one or more vehicle devices or components.

As discussed above, the mocap suit 3420, which in this example includes pants 3420-1, shoes 3420-2, shirt or jacket 3420-3, and gloves 3420-4, may include one or more sensors 3435-1, 3435-2, 3435-3, 3435-4, 3435-5 to measure different aspects of the driver. For example, as discussed above, the mocap suit 3420 may measure the driver's body temperature, heart rate, blood pressure, knee pressure, foot pressure, forces applied to the driver (e.g., gravitational forces acting on the driver), hand/finger pressure, elbow pressure, body positions, etc. In other examples, one or more of the sensors 3435 may include an imaging element, such as a camera that collects visual data about the driver. For example, the sensor 3435-5 positioned on the shoe 3420-2 of the driver may be oriented upward toward the body of the driver and collect imaging data of the body of the driver. Data collected by sensors of the mocap suit 3420 may be provided to the helmet 3416, to the in-vehicle computing device 3452 and/or to one or more remote computing devices. For example, image data from downward facing imaging elements 3434 included in the helmet 3416 may be combined with position sensor data and/or image data collected by one or more sensors of the mocap suit 3420 to determine the position and/or forces applied to the body of the driver.

Figure 35:
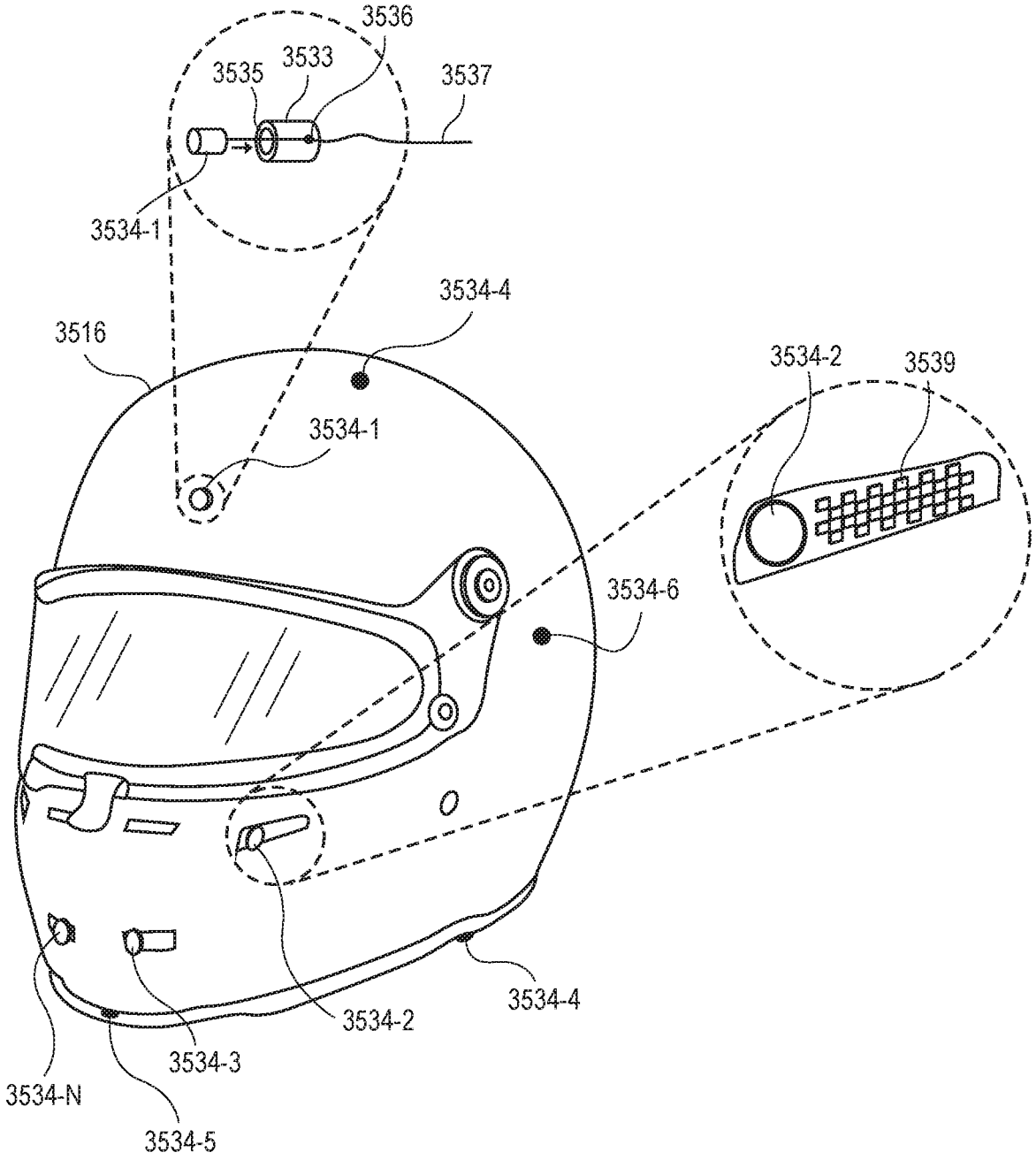
FIG. 35 illustrates additional details of helmet components of a helmet, in accordance with at least one embodiment.

FIG. 35 illustrates additional details of helmet components of a helmet 3516, in accordance with at least one embodiment. In various embodiments, existing helmets may be retrofitted with components to perform the disclosed embodiments. In other embodiments, helmets may be manufactured to include the discussed components. Likewise, in some embodiments, components, such as the imaging elements may be replaceable. For example, a helmet 3516 may include or be retrofitted to include a ferrule 3533 or other receiving member has one or more ridges 3535 that allow a lens 3534 to be inserted into the ferrule but not removed from the ferrule. For example, the ridge(s) 3535 may receive a lens and lock the lens into place such that lens cannot be dislodged. In such an example, the lens may need to be drilled out or otherwise destroyed to be replaced, but the ferrule may remain intact to receive a new lens. In other examples, the lens may be epoxied or otherwise secured into the ferrule.

The ferrule 3533 may also include an opening 3536 or hole in the back through which one or more wires may pass from the lens and/or sensor 3534-1. As discussed below, wires connecting components included the helmet 3516 may be routed through the helmet to a connection point, as discussed further below. The wires may be fabricated into the shell of the helmet, for new helmets, or secured along the inner and/or outer surface of the helmet 3516. For example, the wires may be secured along the inner surface of the shell of the helmet between the shell of the helmet and inner liner of the helmet.

As discussed, the imaging elements, such as the lens and/or sensors may be small enough to be positioned anywhere on the helmet without altering the safety to the driver or the structural integrity of the helmet. In the example illustrated in FIG. 35, the lenses are 3534 are small enough in diameter and depth to be positioned either in a ferrule or other receiver integrated into the shell of the helmet 3516, as illustrated by imaging element 3534-1, or integrated into one or more of the vents 3539 of the helmet, as illustrated by imaging elements 3534-2 and 3534-3. Likewise, any number of imaging elements 3534-N may be included on the helmet 3516 and utilized with the disclosed embodiments. Likewise, the imaging elements 3534 may be oriented in a direction of a field of view of a driver wearing the helmet, such as imaging elements 3534-1, 3534-2, 3534-3, and 3534-N, may be oriented in an opposite direction of a field of view of the driver wearing the helmet (e.g., rear-facing), may be oriented to either side of the field of view of the driver wearing the helmet, such as side-facing imaging elements 3534-6, may be oriented in an upward direction, such as imaging element 3534-4, may be oriented in a downward direction, such as imaging elements 3534-4, 3534-5, and/or in any other direction.

Figure 36:
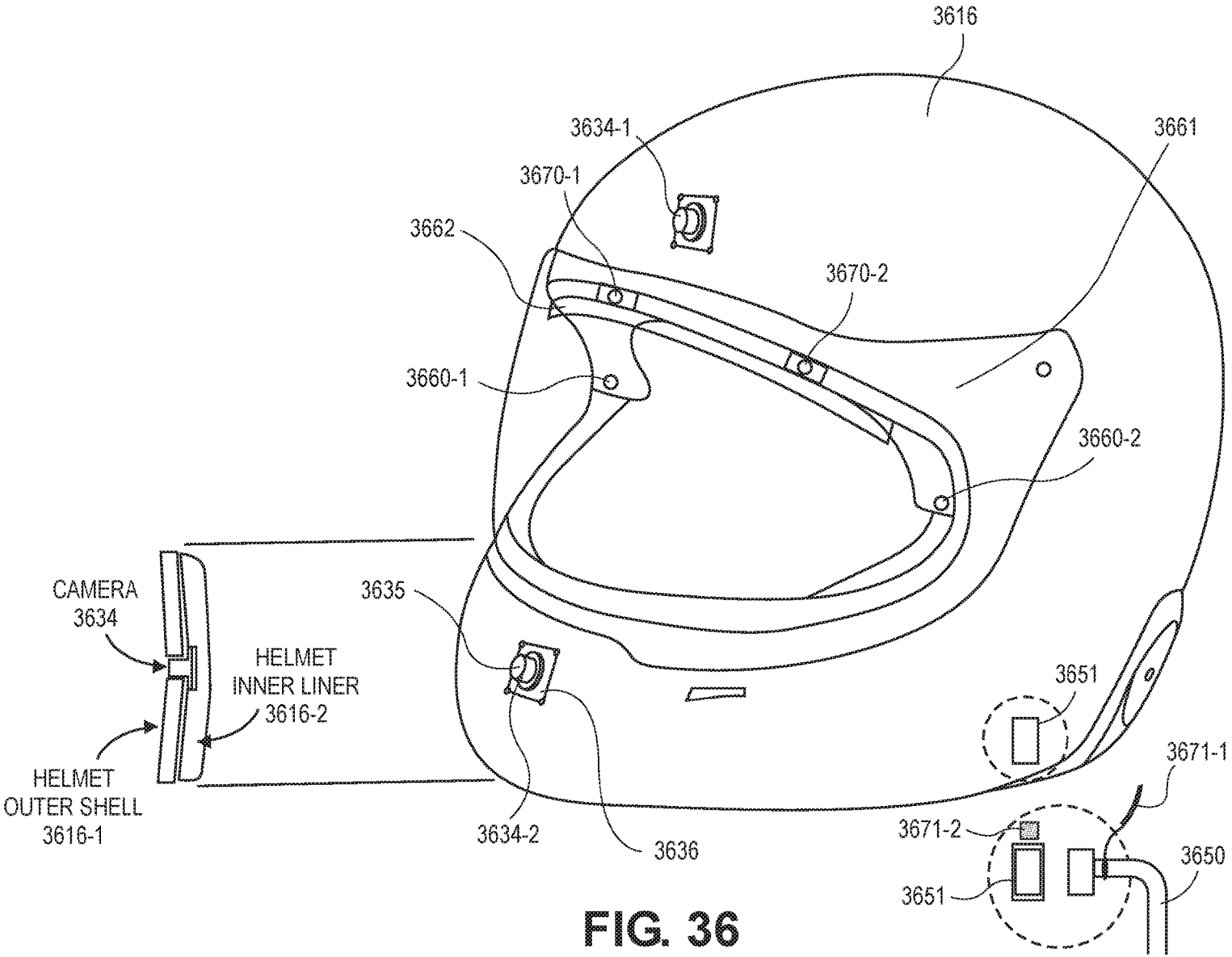
FIG. 36 illustrates additional details of helmet components of a helmet, in accordance with at least one embodiment.

FIG. 36 illustrates additional details of helmet components of a helmet, in accordance with at least one embodiment.

In the illustrated example, the helmet 3616 includes an upper imaging element 3634-1 and a lower imaging element 3634-2. Other imaging elements, such as downward facing imaging elements, side-facing imaging elements, etc., have been eliminated from FIG. 36 to simplify the illustration of the helmet and the corresponding discussion. However, it will be appreciated that any number of imaging elements and/or other sensors may be included, as discussed in the disclosed embodiments.

As illustrated, the imaging elements include a lens 3635 and a sensor 3636 that is coupled with and operable with the lens to convert an optical image into an electrical signal. As discussed above, the imaging elements 3634 may be small enough to fit within the shell of the helmet 3616 and the inner liner. For example, expanded view of imaging element 3634-2 illustrates the lens fitting within the surface of the helmet outer shell 3616-1 and the sensor fitting within the inner liner 3616-2.

In addition to forward or outward facing imaging elements 3634, in some embodiments, the helmet 3616 may include, or be retrofitted to include, one or more output devices, such as heads-up display ("HUD") projectors 3660-1, 3660-2 that are positioned on the interior of the helmet 3616 and oriented to project visual information into a field of view of a driver while the driver is wearing the helmet. For example, visual information may be presented by the HUD projector(s) 3660 onto the face shield 3661 of the helmet 3616 and/or onto a projection screen 3662 positioned on an upper ridge of the face opening of the helmet. The HUD projectors 3660-1, 3660-2 may present any type of information for viewing by the driver that is wearing the helmet 3616. For example, presented information may include vehicle information, driver information, and/or event information. In other embodiments, other forms of output devices may be included in the helmet. For example, the face shield itself may include a transparent display, such as a transparent OLED or LED display. In other examples, reflective technology may be utilized to present the information into the field of view of the driver.

In some embodiments, the helmet 3616 may also include, or be retrofitted to include, one or more gaze tracking imaging elements 3670-1, 3670-2 that are positioned on the rim of the face opening of the helmet 3616 and oriented such that the eyes of the driver wearing the helmet are within the field of view of the imaging elements 3670-1, 3670-2. Like the forward facing imaging elements 3634, the gaze tracking imaging elements may be limited to only include the lens and sensor in the helmet and all other components may be included in an in-vehicle computing device, and/or a remote computing device, that is communicatively coupled to the gaze tracking imaging elements 3670-1, 3670-2.

In some embodiments, the gaze tracking imaging elements 3670-1, 3670-2 may be adjustable in one or more directions such that each gaze tracking imaging element may be positioned in front of each eye of the driver wearing the helmet 3616. Image data generated by each of the gaze tracking imaging elements 3670-1, 3670-2 may be processed to determine the direction in which the driver is looking, driver fatigue, driver stress, etc. Processing imaging data for gaze tracking is known in the art and need not be discussed in further detail herein.

As discussed, each of the imaging elements 3634-1, 3634-2, 3670-1, 3670-2, and/or projectors 3660-1, 3660-2 may be communicatively coupled to an in-vehicle computing device and/or one or more remote computing devices. For example, each of the imaging elements 3634-1, 3634-2, 3670-1, 3670-2, and/or projectors 3660-1, 3660-2 may be wired to a connection point 3651 that enables a separable wired connection, such as a magnetic connection between the helmet 3616 and a wired connection 3650 that is coupled to an in-vehicle computing device, as discussed herein. As discussed, the separable connection point may be affixed via a magnetic connection, as discussed, and/or any other form of separable connection. In some embodiments, more than one form of separable connection may be utilized. In the illustrated example, in addition to the magnet connection, a hook and loop fastener 3671-1, 3671-2 may be included to further secure the wired connection 3651 to the helmet 3616 at the connection point 3651.

Figure 37:
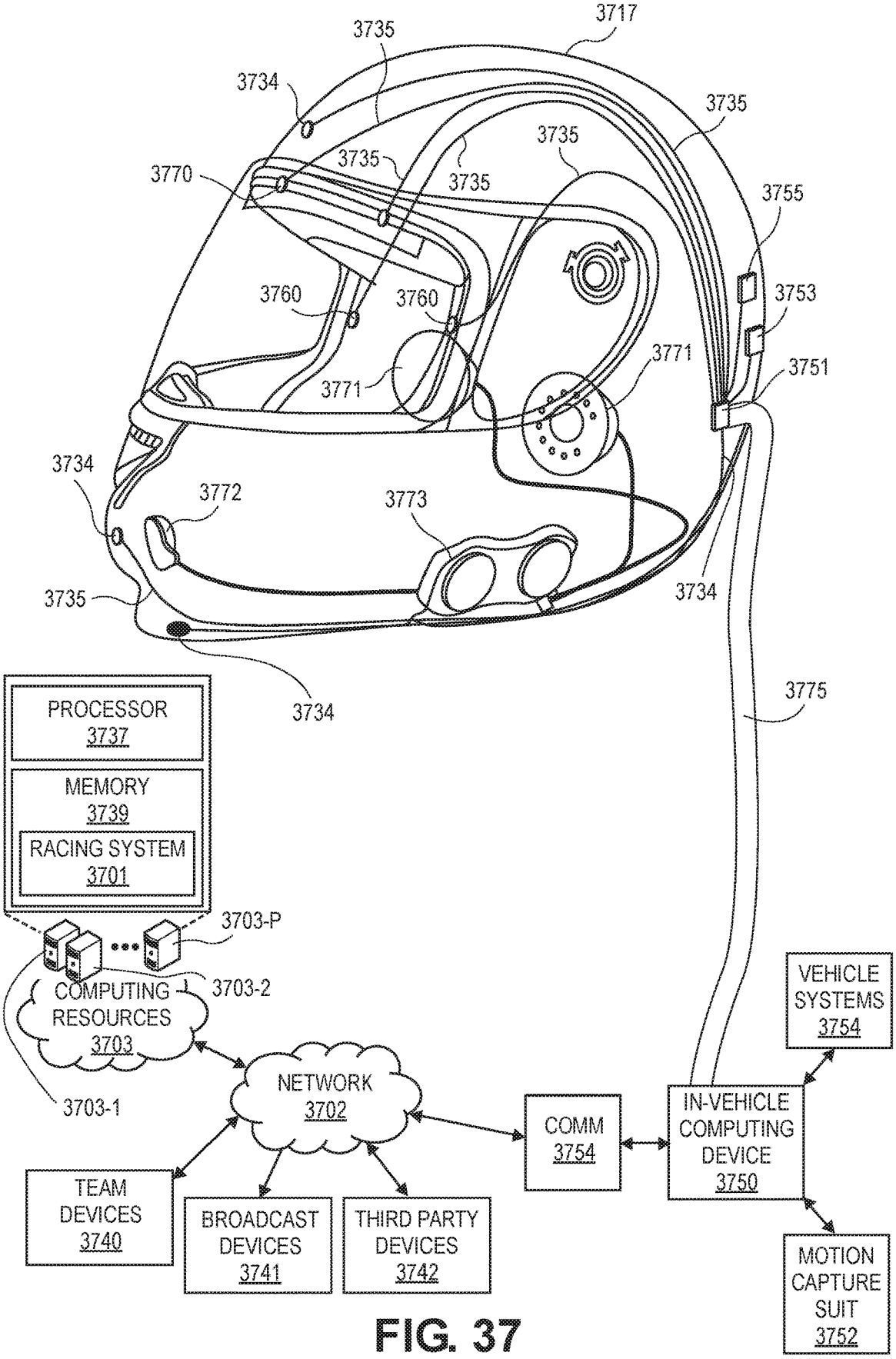
FIG. 37 illustrates additional details of helmet components of a helmet and communication with other computing devices, in accordance with at least one embodiment.

FIG. 37 illustrates additional details of helmet components of a helmet 3717 and communication with other computing devices, in accordance with at least one embodiment. As discussed, the helmet 3717 may include one or more imaging elements 3734, one or more gaze tracking imaging elements 3770, and/or one or more HUD projectors 3760. In addition, in some embodiments, the helmet 3717 may include, or be retrofitted to include, one or more microphones 3772 one or more transducers 3771 and/or a communication bus 3773 that is operable to allow connection of different sensors or devices that are added to the helmet, such as speakers 3771, microphone 3772, imaging elements 3734, etc. The communication bus 3773 may be connected to the connection point and distribute data between the connection point and different connected devices/sensors. The transducers 3771 may be utilized to provide audio output, such as audio from a team member, to the driver wearing the helmet 3717. In some embodiments, the transducers 3771 may be positioned to provide depth based audio output to simulate a position from which the audio is emanating. Likewise, the microphone 3772 may be utilized to receive audio generated by the driver wearing the helmet 3717 and transmit that audio as data to the in-vehicle computing device 3750 and/or one or more remote devices.

As discussed, the imaging elements 3734, 3770 may include a wired connection 3735 from the imaging element to a connection point 3751 on the helmet and data/electrical signals and/or power may be sent through the wire(s) between the imaging elements and the connection point 3751. Likewise, the projectors 3760 may also have wired 3735 connections between the projectors 3760 and the connection point 3751 and data/electrical signals and/or power may be sent through the wired connection between the projectors and the connection point. The connection point may provide a wired connection 3775 or wireless connection from the helmet 3717 to an in-vehicle computing device 3750.

In some embodiments, the helmet 3717 may also include or be retrofitted to include, a memory 3755 and/or a power supply 3753 to power one or more components of the helmet 3717 and/or to power the memory 3755. The memory may be utilized to store, among other information, driver information, gaze settings for the driver (also referred to herein as driver eye profile), audio settings for the driver, HUD settings for the driver, etc. In such an example, when the driver connects the helmet 3717 to the in-vehicle computing device 3750 and receives power from the in-vehicle computing device and/or the power supply 3753, the stored driver information may be provided to the in-vehicle computing device 3750 and information provided and/or settings established for the helmet 3717 according to the stored information.

As discussed, the in-vehicle computing device 3750 may be special purpose computing device or, in other embodiments, a general purpose device, such as a cellular phone, tablet, laptop, wearable, etc. In addition, the in-vehicle computing device 3750 may also communicate with, receive and/or send data to one or more vehicle systems 3754 and/or a mocap suit 3752 worn by the driver. Likewise, the in-vehicle computing device may provide power to one or more of the imaging elements 3734, 3770, projectors 3760, etc., of the helmet.

Still further, the in-vehicle computing device 3750 may be coupled to and/or include one or more communication components 3754 that enable wired and/or wireless communication via a network 3702, such as the Internet, with one or more remote computing devices, such as computing resources 3703, team devices 3740, broadcast devices 3741 (e.g., television broadcasting devices), and/or other third party devices 3742 (e.g., weather stations). In some embodiments, the communication component 3754 may be separate from the in-vehicle computing device 3750, as illustrated. In other embodiments, the communication component 3754 may be included in and part of the in-vehicle computing device 3750. For example, if the in-vehicle computing device 3750 is a cellular phone, tablet, laptop, wearable, etc., the in-vehicle computing device may include the communication component 3754.

The computing resource(s) 3703 are separate from the in-vehicle computing device 3750. Likewise, the computing resource(s) 3703 may be configured to communicate over the network 3702 with the in-vehicle computing device 3750 and/or other external computing resources, data stores, vehicle systems 3754, etc.

As illustrated, the computing resource(s) 3703 may be remote from the helmet 3717 and/or the in-vehicle computing device 3750 and implemented as one or more servers 3703(1), 3703(2), . . . , 3703(P) and may, in some instances, form a portion of a network-accessible computing platform implemented as a computing infrastructure of processors, storage, software, data access, and so forth that is maintained and accessible by components of the helmet 3717 and/or the in-vehicle computing device 3750 via the network 3702, such as an intranet (e.g., local area network), the Internet, etc.

The computing resource(s) 3703 do not require end-user knowledge of the physical location and configuration of the system that delivers the services. Common expressions associated for these remote computing resource(s) 3703 include "on-demand computing," "software as a service (SaaS)," "platform computing," "network-accessible platform," "cloud services," "data centers," and so forth. Each of the servers 3703(1)-(P) include a processor 3737 and memory 3739, which may store or otherwise have access to driver data and/or the racing system 3701.

The network 3702 may be any wired network, wireless network, or combination thereof, and may comprise the Internet in whole or in part. In addition, the network 3702 may be a personal area network, local area network, wide area network, cable network, satellite network, cellular telephone network, or combination thereof. The network 3702 may also be a publicly accessible network of linked networks, possibly operated by various distinct parties, such as the Internet. In some embodiments, the network 3702 may be a private or semi-private network, such as a corporate or university intranet. The network 3702 may include one or more wireless networks, such as a Global System for Mobile Communications (GSM) network, a Code Division Multiple Access (CDMA) network, a Long Term Evolution (LTE) network, or some other type of wireless network. Protocols and components for communicating via the Internet or any of the other aforementioned types of communication networks are well known to those skilled in the art of computer communications and thus, need not be described in more detail herein.

The computers, servers, helmet components, in-vehicle computing devices, remote devices and the like described herein have the necessary electronics, software, memory, storage, databases, firmware, logic/state machines, microprocessors, processors, communication links, displays or other visual or audio user interfaces, printing devices, and any other input/output interfaces to provide any of the functions or services described herein and/or achieve the results described herein. Also, those of ordinary skill in the pertinent art will recognize that users of such computers, servers, devices and the like may operate a keyboard, keypad, mouse, stylus, touch screen, or other device or method to interact with the computers, servers, devices and the like.

The racing system 3701, the in-vehicle computing device 3750, or an application executing thereon, and/or the helmet 3717 may use any web-enabled or Internet applications or features, or any other client-server applications or features, including messaging techniques, to connect to the network 3702, or to communicate with one another, such as through short or multimedia messaging service (SMS or MMS) text messages. For example, the servers 3703-1, 3703-2 . . . 3703-P may be adapted to transmit information or data in the form of synchronous or asynchronous messages from the racing system 3701 to the in-vehicle computing device 3750, the components of the helmet 3717, and/or any other computer device in real time or in near-real time, or in one or more offline processes, via the network 3702. Those of ordinary skill in the pertinent art would recognize that the racing system 3701 may operate on any of a number of computing devices that are capable of communicating over the network, including but not limited to set-top boxes, personal digital assistants, digital media players, web pads, laptop computers, desktop computers, cellular phones, wearables, and the like. The protocols and components for providing communication between such devices are well known to those skilled in the art of computer communications and need not be described in more detail herein.

The data and/or computer executable instructions, programs, firmware, software and the like (also referred to herein as "computer executable" components) described herein may be stored on a computer-readable medium that is within or accessible by the in-vehicle computing devices 3750, computers or computer components such as the servers 3703-1, 3703-2 . . . 3703-P, the processor 3737, the racing system 3701, and/or the helmet 3717, and having sequences of instructions which, when executed by a processor (e.g., a central processing unit, or "CPU"), cause the processor to perform all or a portion of the functions, services and/or methods described herein. Such computer executable instructions, programs, software and the like may be loaded into the memory of one or more computers using a drive mechanism associated with the computer readable medium, such as a floppy drive, CD-ROM drive, DVD-ROM drive, network interface, or the like, or via external connections.

Some embodiments of the systems and methods of the present disclosure may also be provided as a computer-executable program product including a non-transitory machine-readable storage medium having stored thereon instructions (in compressed or uncompressed form) that may be used to program a computer (or other electronic device) to perform processes or methods described herein. The machine-readable storage media of the present disclosure may include, but is not limited to, hard drives, floppy diskettes, optical disks, CD-ROMs, DVDs, ROMs, RAMs, erasable programmable ROMs ("EPROM"), electrically erasable programmable ROMs ("EEPROM"), flash memory, magnetic or optical cards, solid-state memory devices, or other types of media/machine-readable medium that may be suitable for storing electronic instructions. Further, embodiments may also be provided as a computer executable program product that includes a transitory machine-readable signal (in compressed or uncompressed form). Examples of machine-readable signals, whether modulated using a carrier or not, may include, but are not limited to, signals that a computer system or machine hosting or running a computer program can be configured to access, or including signals that may be downloaded through the Internet or other networks.

Figure 38:
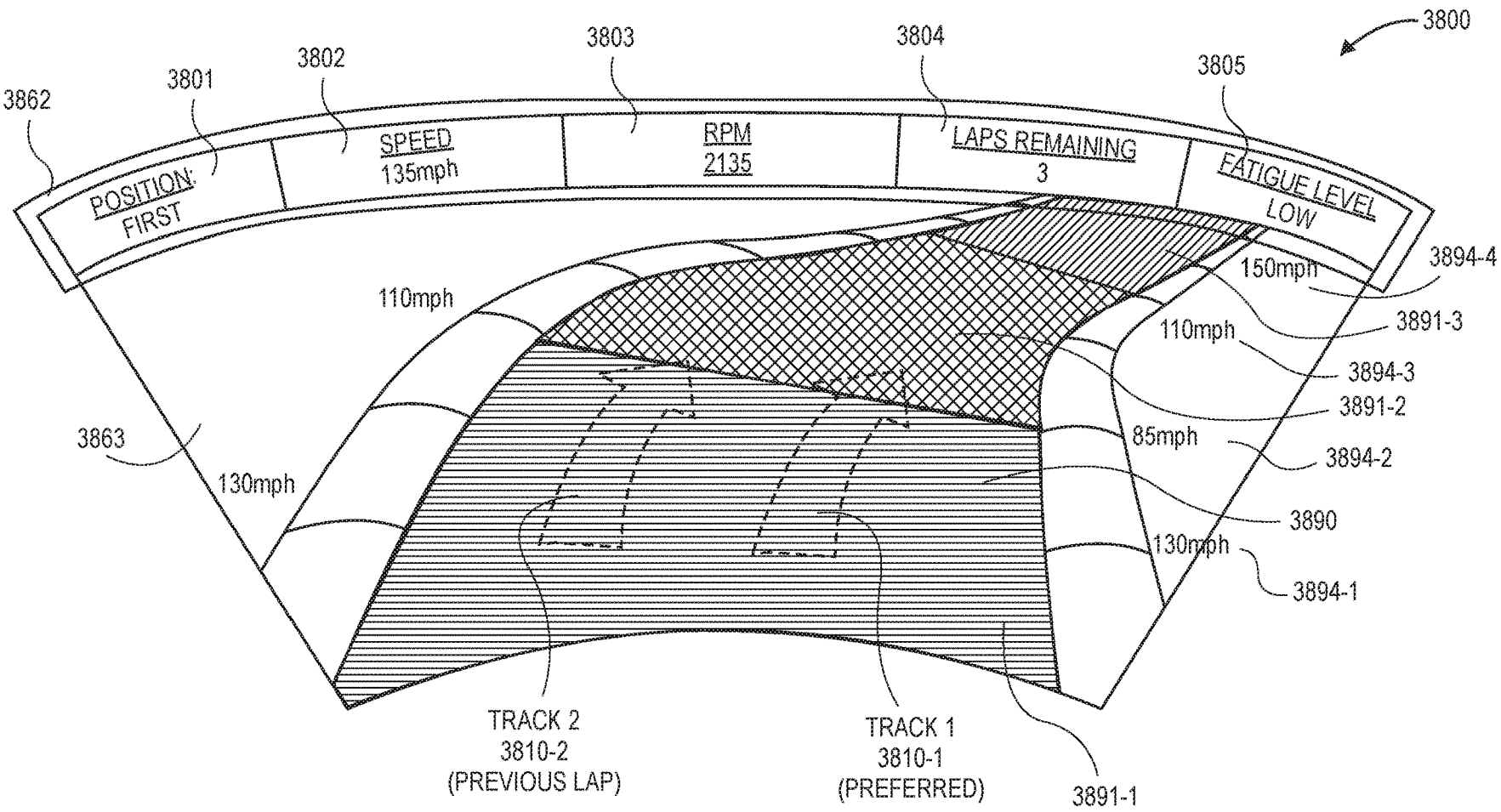
FIG. 38 illustrates an example view of a heads-up display presented to a driver, in accordance with at least one embodiment.

FIG. 38 illustrates an example view of a heads-up display 3800 presented to a driver from a helmet mounted projector as discussed above, in accordance with at least one embodiment. As illustrated, any type of information, including vehicle data, driver data, and/or event data may be presented to the driver. In the illustrated example, the presented information may include the current position 3801 of the driver in the event (event data), the current speed 3802 of the vehicle (vehicle data), the current RPM 3803 of the vehicle (vehicle data), the number of laps remaining 3804 (event data), and the driver fatigue level 3805 (driver data). In other examples, additional, fewer, and/or different information may be presented by the HUD 3800.

In the illustrated example, the event data 3801, 3804, driver data 3805, and vehicle data 3802, 3803 are presented by a helmet projector onto a projection screen 3862 included along the top edge of the opening of the helmet. In addition, visual information, such as track lines 3810-1, 3810-2, different desired speed regions 3891-1, 3891-2, 3891-3, different desired speed indicators 3894-1, 3894-2, 3894-3, 3894-4, etc., may be presented on the face shield 3863 of the helmet such that they appear as being projected into the environment in which the driver is operating. For example, information presented on the face shield 3863 may be presented in the form of augmented reality. In the illustrated example, two different track lines, track 1 3810-1, which illustrates the preferred track line, and track 2 3810-2, which illustrates the drivers track line on the previous lap, are presented on the face shield 3863 of the helmet and appear to the driver overlaid on the physical track 3890 on which the driver is driving the vehicle, showing different lines that the driver may take through a turn on the track 3890. Likewise, different speed regions 3891 indicating whether the driver should be breaking or accelerating may be presented on the face shield 3863 of the helmet and appear to the driver overlaid on the physical track 3890 as different color regions or different zones. As another example, different desired speed indicators 3894 may be presented to the driver indicating the desired speed at each point along the racetrack as if they were included on or near the physical track. In other examples, additional, less, or different information may be presented to the driver. In addition, a driver, or another individual, such a team member, may alter the information presented via the HUD to the driver.

As noted above, while the example illustrated with respect to FIG. 38 discusses projecting information onto the face shield of the helmet such that it is in the field of view of the driver, in other implementations other forms of presentation may be utilized to generate and augmented and/or virtual reality presentation to the driver. For example, the face shield itself may include a transparent display, such as a transparent OLED or LED display. In other examples, reflective technology may be utilized to present the information to the driver.

Figure 39:
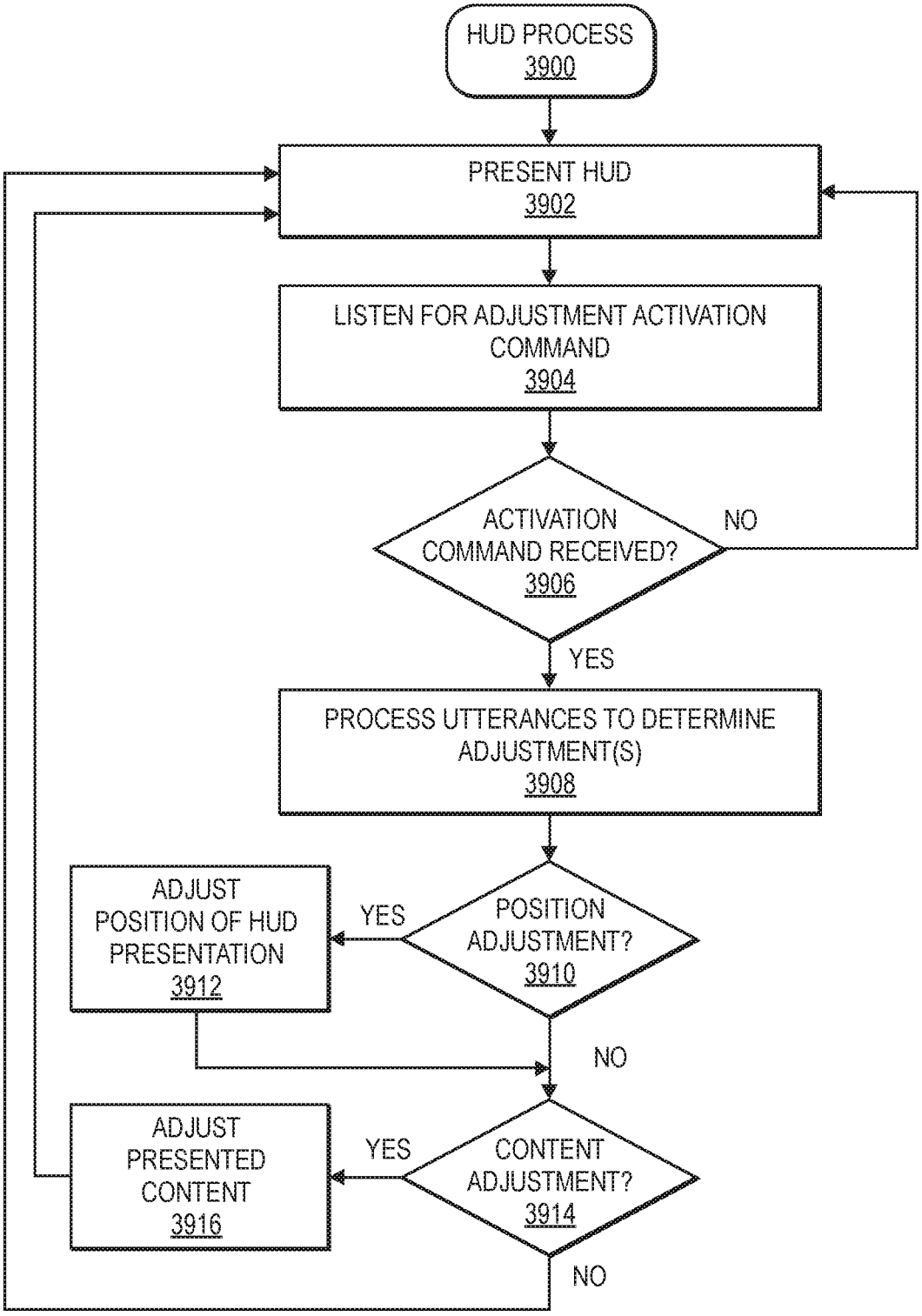
FIG. 39 illustrates an example heads-up display process, in accordance with at least one embodiment.

FIG. 39 illustrates an example heads-up display process 3900, in accordance with at least one embodiment. The example process 3900 may be performed by an application executing on the in-vehicle computing device and/or by an application executing on another computing device.

The example process 3900 begins by presenting a HUD to a driver, as in 3902. Presentation of a HUD is discussed above. As the HUD is presented, the example process 3900 listens for an adjustment activation command, as in 3904. The adjustment activation command may be any predefined term or "wake word" that, upon detection, will trigger the system to listen for an adjustment command. The adjustment activation command may be any term or command, such as "Display adjustment."

As the HUD process 3900 is executing, a determination is made as to whether an activation command has been received, as in 3906. If it is determined that an activation command has not been received, the example process returns to block 3902 and continues. However, if it is determined that the adjustment activation command has been received, the system receives and processes utterances provided to the system, as in 3908. For example, utterances may be provided by the driver, a team member, etc. The utterances may include one or more instructions to alter the information presented to the driver by the HUD and/or an utterance to alter a position at which one or more items of information are presented by the HUD. Any form of language processing, such as Natural Language Processing ("NLP"), etc., may be utilized with the disclosed embodiments.

Based on the processed utterances, a determination is made as to whether the utterance is a command to alter a position of one or more items of presented information, as in 3910. If a position of a presented item of information is to be altered, the example process alters the position of that item in the presentation of information by the HUD, as in 3912. For example, if the utterance includes a command to "move the driver information of fatigue level from a top right of the HUD to a bottom left of the HUD," that utterance will be processed and cause the currently presented driver information of fatigue level to be moved from presentation in top right of the HUD to the bottom left of the HUD.

If it is determined that the utterance does not include a position adjustment command, or after adjusting the position of presented information, a determination is made as to whether the utterance includes a content adjustment command, as in 3914. A content adjustment command may be any command to add an item of information to the information presented by the HUD or to remove an item of information from the information presented by the HUD. If it is determined that the utterance includes a command to adjust a content item, the example process causes the adjustment of one or more items of information presented by the HUD, as in 3916. For example, if the utterance includes the command "present driver heartrate," the example process 3900 will cause the heartrate of the driver to the presented by the HUD.

As will be appreciated, the order in which the command execution is determined or processed may be done in parallel or series and the discussion of first determining whether the utterance includes a command to adjust a position of presented information and then determining whether the utterance includes a command to alter the presented information, is just an example. In other examples, the determinations may be done in parallel or in a different order. Likewise, in some embodiments, the example process 3900 may process utterances to determine and perform several commands. For example, a driver may provide an utterance that includes "remove the speed and present total event time in the lower right corner." In such an example, the example process 3900 may process the utterance to determine that the utterance includes three commands—one to remove the presentation of speed information, a second to present total event time information, and a third to present the total event time information in the lower right corner of the HUD. In such an example, each of the commands are determined and performed by the example process 3900. Upon completion of the commands determined from an utterance, or if it is determined that there is no command detected in the utterance, the example process 3900 returns to block 3902 and continues.

Figure 40:
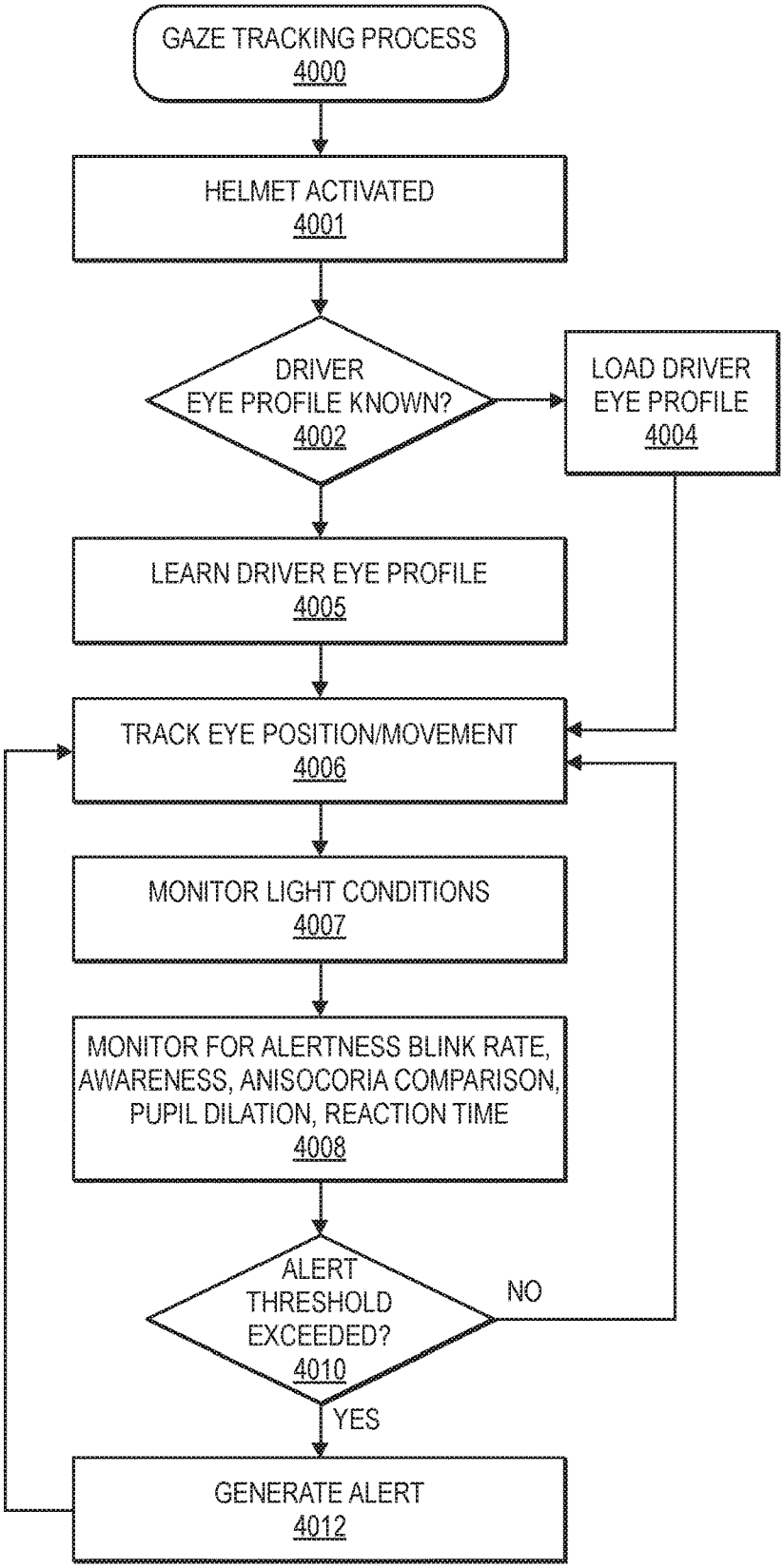
FIG. 40 illustrates an example gaze tracking process, in accordance with at least one embodiment.

FIG. 40 illustrates an example gaze tracking process 4000, in accordance with at least one embodiment.

The example process 4000 begins when a helmet is activated, as in 4001. For example, when a helmet is attached to a wired connection that connects the helmet to an in-vehicle computing device, as discussed above, and the helmet receives power through the wired connection, the helmet may be automatically activated. In other examples, the helmet may include one or more power switches that may be activated by a driver and/or include a motion switch that activates the helmet in response to a movement of the helmet. In still other examples, the helmet may include one or more pressure sensors that detect when the helmet is placed on a head of a driver and the detection causes the helmet to activate.

Upon activation of the helmet, a determination is made as to whether a driver eye profile of a driver wearing the helmet is known, as in 4002. A driver eye profile for gaze tracking may be established by the example process 4000 the first time a driver wears the helmet and that information may be stored in a memory of the helmet and/or associated with a helmet identifier and stored in a memory of the in-vehicle computing device and/or another computing device. The driver eye profile may include information regarding a position, size, range of movement, etc., of each driver eye with respect to the gaze tracking cameras included in the helmet.

If it is determined that the driver profile is known, the driver eye profile is loaded and utilized to perform gaze tracking of the driver, as in 4004. If it is determined that the driver eye profile is not known, the example process may learn the driver eye profile, as in 4005. For example, the example process 4000 may provide a series of instructions to the driver and utilize the gaze tracking cameras in the helmet to record information about the eyes of the driver as the driver performs the series of instructions. That information may then be processed by the example process 4000 to determine a driver eye profile for the driver. For example, the example process 4000 may provide instructions to the driver to look left, look right, look up, look down, open eyes wide, close eyes, etc., and record the drivers actions as the driver performs those instructions. The recorded information may be used to determine the driver eye profile for the driver which may indicate, among other information, the separation between each eye of the driver, the pupil shape of each eye of the driver, the range of motion of each eye of the driver, etc.

Upon determination of the driver eye profile, or after loading a known driver eye profile, the example process 4000 monitors the position or movement of the eyes of the driver, also referred to herein as gaze or gaze direction, as in 4006. In addition to monitoring the gaze of the driver, one or more lighting conditions may be monitored to determine light changes that may potentially affect the pupil dilation of the driver as the eyes of the driver are monitored, as in 4007. For example, the helmet may include a light sensor that can detect changes in light as the user drives in and out of shadows, etc.

Based on the monitored eye position, movement, and/or lighting information, the example process may monitor for an alertness blink rate of the driver, an awareness of the driver, an anisocoria comparison, a pupil dilation of the driver, a reaction time of the driver, etc., as in 4008. Such information may be utilized to determine if an alert threshold has been exceeded for the driver, as in 4010. For example, it may be determined that the fatigue level of the driver has exceeded a threshold based on the anisocoria comparison and the reaction time indicated by the gaze tracking information.

If it is determined that an alert threshold has not been exceeded, the example process 4000 returns to block 4006 and continues. If it is determined that an alert threshold has been exceeded, the example process 4000 generates one or more alerts, as in 4012. An alert may be a visual and/or audible notification to the driver, a driver team member, etc.

Figure 41:
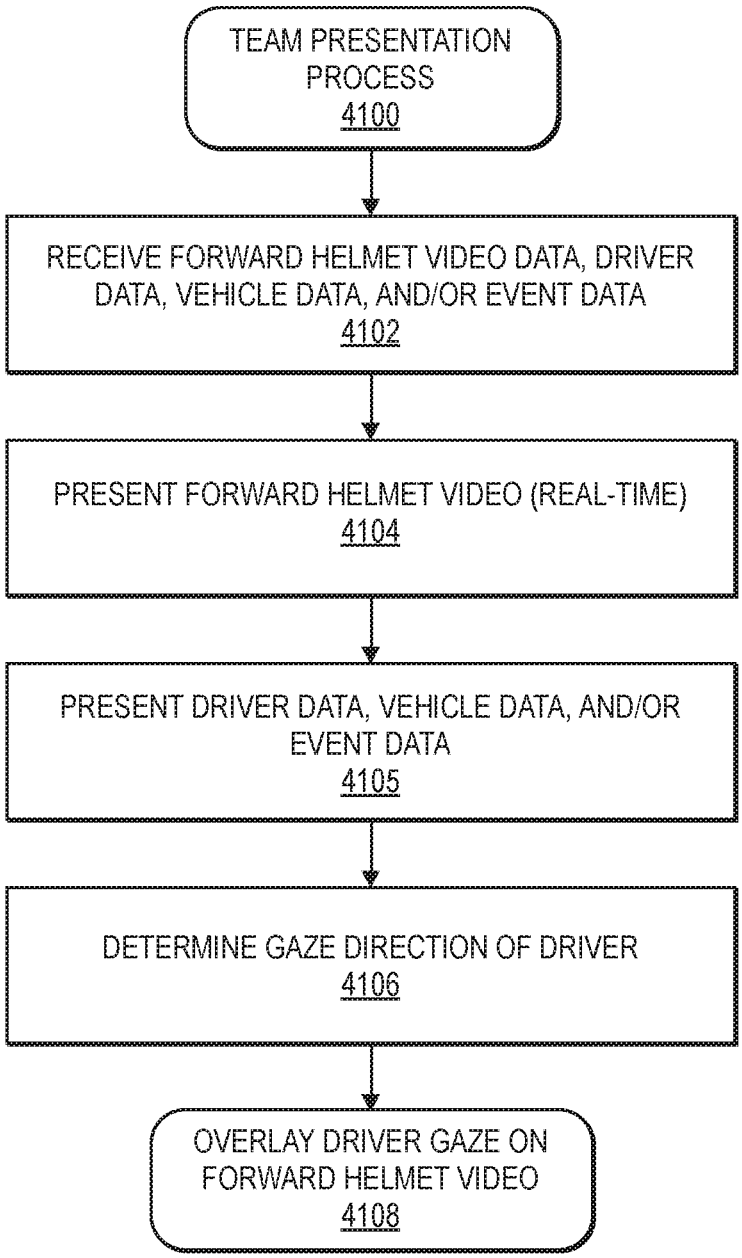
FIG. 41 is an example team presentation process, in accordance with at least one embodiment.

FIG. 41 is an example team presentation process 4100, in accordance with at least one embodiment. In addition to presenting information to the driver, in some embodiments driver data, vehicle data, event data, etc., may be presented to one or more team members and/or others in real time or near real time.

The example process 4100 receives driver data, vehicle data, and/or event data, as in 4102. As discussed above, this information may be collected and provided by the in-vehicle computing device.

As the data, such as the forward helmet video data generated by one or more forward facing cameras on the helmet of the driver, is received, that data may be presented on a display, such a computing device accessible by a team member, as in 4104. In addition, one or more items of information, such as driver data, vehicle data, and/or event data may also by presented, as in 4105. In some embodiments, the information presented may be configured to correspond to the information presented on the HUD of the driver such that team members are viewing what is viewed by the driver.

In addition, gaze direction information of the driver, determined by example process 4000 discussed above may also be received or determined by the example process 4100, as in 4106. In such an embodiment, the position of the gaze direction of the driver may be overlaid on the forward helmet video to illustrate the portion of the video information that corresponds to the current gaze direction of the driver, as in 4108. For example, the forward helmet data may include a field of view that is larger than a field of view of the driver. In such an example, the gaze direction of the driver may be overlaid to illustrate the portion of the forward helmet video data that corresponds to the current gaze direction of the driver. In other examples, only the portion of the forward direction video data that corresponds to the current gaze direction of the driver may be presented, thereby providing an approximate correlation between the driver's actual view and what is presented by the example process 4100.

While the above example process 4100 is discussed with respect to presenting information to team members of the driver, in other embodiments, one or more of video data from an imaging element of the helmet worn by the driver, event data, driver data, and/or vehicle data may be provided to a broadcast system, such as a television producer, for broadcast to a wider audience.

While the examples discussed above with respect to FIGS. 34 through 41 are directed toward a racing helmet, suit, and racecar driver, it will be appreciated that the disclosed embodiments are equally applicable to other sports and/or activities. For example, the helmet may be a football helmet, lacrosse helmet, baseball helmet, ice hockey helmet, snow skiing helmet, etc. In some embodiments, the helmet may simply be headwear and not protective in nature, but otherwise include the disclosed embodiments. For example, the disclosed embodiments may be incorporated into a hat, headband, etc., that is worn by a person. Likewise, the person may be any person or athlete that is wearing the helmet or headwear. Similarly, the suit may be any suit or a portion thereof that is worn by any person. For example, the suit, as discussed herein, may be limited to shoes that include sensors, as discussed herein.

In some embodiments, the players may want to learn one or more sports. To learn the one or more sports, one or more key skills and critical factors would be required by the players. The one or more sports might include, but are not limited to, soccer, football, basketball, lacrosse, tennis, track-running, volleyball, sports car racing, Formula 1 racing, stock car racing, drag racing, motorcycle road racing, karting, bicycling, BMX, motocross, martial arts (e.g., karate), ice hockey, figure skating, skiing, golf, baseball, single- and multi-player AR games, swimming, gymnastics, hunting, bowling, skateboarding, surfing, or wakeboarding. In each of the one or more sports, the players may be trained in factors such as where to place attention, where to look at various times during play, the position and attitude of the body, and center of balance. In addition, following are the one or more key skills and the critical factors for learning the one or more sports:

Soccer

For soccer, the players may require training in one or more key skills to prepare physically and mentally before participating in any session. The one or more key skills may include, but are not limited to, how to pass a soccer ball (football) to other teammates, how to trap the soccer ball with the player's feet or upper body, how to juggle the soccer ball, how to pass the soccer ball from left to right, how to pass the soccer ball to other players, how kick the soccer ball into a goal without allowing goalkeeper to block it, and/or mapping and understanding each players individual optimal balance to enhance and increase performance potential during game play. In one embodiment, a video demonstration may be used to learn the one or more key skills. Further, the players may need to build one or more muscle memories of a specific leg (i.e., calf, quad), or an arm (i.e., flexor, biceps, core muscles). The one or more muscle memories may be used for increasing strength and flexibility to benefit endurance, acceleration, and direction transition. In some embodiments, potential passes may be decoded by monitoring eye targets and body positioning of the players.

Further, one or more things may be required for teaching individual skills to the players off the field. The one or more things may include, but are not limited to, a flat turf simulation field, a holosphere rotational balance ball, or a simulation treadmill for training the players in running or focusing on ball, mid-foot, and/or heel balance positions, as well as arm positions. It should be noted that training in arm positions may be required for power, acceleration, defense blocking, and balance.

Further, one or more technologies may be needed to train the players off the field and/or on the field. There may be multiple modes, including sanctioned competition play versus training. Granularity of motion and video captured using one or more field cameras may be adjustable. In one embodiment, the one or more field cameras may be at least one. In another embodiment, the one or more field cameras may be more than 20. Further, a helmet camera and a body motion tracking system may work in conjunction with a synchronized clock to synchronize all equipment for simultaneously capturing player motion and individual video. It should be noted that the individual video overlay may combine 3D motion capture files with actual motion video. Further, the soccer training may include a projected soccer field with players. Further, the soccer training may include one or more scenarios—e.g., a player may kick and pass the football to another player where a trajectory of the football may be projected, and the football may be received or intercepted depending on the accuracy of the kick.

Further, a helmet or headgear may be integrated with a body motion tracker and cameras. The cameras may provide synchronized body motion and each player's point of view of what the players see. Further, one or more physical locations may be calculated relative to all other players and the football. Each player may be tracked and viewed after the practice to see exactly how the players reacted and what the players may have done differently. It should be noted that the helmet or headgear may be lightweight. Further, object tracking may be used to follow the football. The object tracking may be done using transponders and video object recognition. The video object recognition may enable monitoring of game play velocity, trajectory, passing targets, goals, and errors.

Further, remote coaching and data collection may be feasible using holographic data ("holodata") telemetry, video, or a live motion capture feed, any of which may be directed to a secure network location. It should be noted that individuals competing may be tracked in conjunction with all other monitored players. Further, videos with motion capture overlay may be displayed in conjunction with audio two-way communication between coach and wearer (i.e., players) in real time. Additionally, multiple players may be added to the communication console to enable team versus one-on-one coaching.

Further, AR may provide a motion analytic view of the game to each player, coach, and spectator. The motion analytic view may display synchronized statistics and player performance to track each play. Further, such techniques may automate a visual replay of physical body motion with a video of the play. Therefore, such techniques may make the analysis of the play more obvious and easier to critique from the point of view of the coach and the players.

Further, the teammates and a selected individual (i.e., one to one or one to many) may be tracked and engage in direct communication with each other during practice and competitive play. Such "group thinking" may result in updated individual and team strategy, thereby increasing the performance and strategic potential of the individual and the team.

Further, one or more items of protective gear may be used for the protection of players. In some embodiments, a lightweight helmet or headgear may be offered for wearer protection. Further, the lightweight helmet or headgear may be integrated with a communication module for enhanced data tracking and coaching. Further, other equipment, such as headgear, elbow pads, knee pads, and shoes, may be integrated with transmitting devices.

In some embodiments, players may wear a mocap suit for recording kinematic profiles during each play. Such kinematic profiles may enable a coach to analyze the players' offensive and defensive moves relative to each play. Further, the coach may be able to see how the player reads and readies for an offensive/defensive maneuver based on a particular play. Further, a footbed (insole) sensor may track each player's weight distribution throughout the play. In some embodiments, timecode may be used to synchronize each play so that motion and weight distribution of each player may be captured during the play, thus eliminating conventional video training that requires the coach to remember or isolate each specific play or event and attempt to recall the entire play even if the video only shows the football and the players near the football.

Further, one or more cameras may be placed at strategic (e.g., 10-yard) increments along a side of the field in conjunction with body sensors. Such placement of the one or more cameras may provide each coach, trainer, and player with a highly accurate record of high-resolution, multi-perspective synchronized volumetric video and motion images. Further, a large-scale volume rendering of the motion/video may accurately render the interplay of all players anywhere on the field, resulting in an unparalleled view of how each player performs and how the play is executed. In an alternate embodiment, a new form of analytical training strategy may be applied. The synchronized volume or motion video may be timecode-synced with the foot sensors and the motion capture headgear, which may capture and allow for re-rendering and analysis, the majority of significant physical motion during a practice or tournament.

In some embodiments, the plays and the recorded video practice may be rendered with individually selected ghost team members and potential offensive players on the field. Further, a master 3D play and a view for each player wearing AR headgear may broadcast and display the player's field of view during practice without exposing the player to potential injuries. Further, each team member may individually, or as a preprogrammed group, create or re-enact specific plays that may be practiced without actual players on the field. In one embodiment, the practice may be specific to the team's approved plays or to strategize new plays against an opponent that runs specific routines. Further, the potential injuries that may be sustained on a practice field with inexperienced or error-prone, poorly rehearsed team members may be reduced as holographic teammates may repeat the rehearsal without endangering the player's practice. Further, each one of the coaches and the team members may replay and rehearse the moves and/or review other players or team videos to strategically coordinate and synchronize the plays. It should be noted that each practice event may allow each player and coach to rehearse and refine training and game strategy using a playback system.

In some embodiments, a coach may be remotely positioned from the place where he is coaching. The coach may view a scene through any camera placed in the vicinity of the area they are coaching, or from a first-person perspective of any player in the area they are coaching. The coach may trigger holographic videos, place holographic players in a scene. The coach may be able to play a video game simulation of a game as in conventional video games (e.g. the "Madden NFL" game from Electronic Arts), but where the players rendered in the game are actual physical players on an actual field, and wherein the opponents rendered for the players on the actual field are the virtual players from the video game.

In some embodiments, a coach may use virtual reality goggles to see a complete, immersive view of a particular player. The coach may wear a motion capture suit and make motions to indicate to the person he is viewing, the motion they should perform. The person the coach is viewing may receive haptic feedback through their garments indicating physically what the coach expects them to do, such as throw a ball or look in a particular direction. For instance, the coach may move their head left, to indicate to look left, and the player may feel a haptic vibration or force on the portion of their body that should move, such as a pressure on the left side into which they should move their head. Similarly, the coach may lift their right arm and make a throwing motion, and the player would feel corresponding haptic pressure on their right arm and hand which was holding the ball, to throw the ball.

In some embodiments, a physical (actual) team may be able to re-play a famous play in a game, such as the final winning throw in a Superbowl game. The players would all be guided by haptic and visual means to perform their "part" in the original play, and the physical (actual) opponents would be similarly guided. The players would then be rewarded for the fidelity with which they duplicated the game. In another embodiment, the team can be coached through a poorly executed earlier play, where the opponents are guided to perform the winning move, and the players are encouraged to alter the way they responded in the poorly executed earlier play, in order to perform a successful play. In another embodiment, the system would project an entirely virtual set of opponents for a team who was physically real, and the portions of the game that could not be precisely simulated (e.g. tackling non-corporeal virtual players) would be nonetheless performed (a tackle by a real player would cause the virtual player to fall or be knocked over correctly.) In an embodiment, an AI component of the opponent simulation would use measured data on the performance of the actual physical team, and use it to alter the behavior of the simulated opponents, to increase the difficulty or to provide variety.

In some embodiments, individual metrics may be tracked and cataloged for practices and tournament play. The individual metrics may be completed passes, errors, opportunities, unsuccessful attempts, successful penetration of an offensive play, and/or defensive success on an opposing play. Body sensors linked via timecode may record a comprehensive physiological record of the players' stamina, time on the field, acceleration, and play performance metrics, and catalog G-force impacts. Further, additional metrics, such as retinal tracking and a specific direction of attention during the play, may be used to optimize strategic game play awareness. Further, when a player starts training or attempts to learn a new maneuver, then the player may know exactly what to concentrate and work on to progress more rapidly and with more certainty. Further, the individual performance metrics may be raised as each player/trainee has more certainty of exactly what was performed correctly and incorrectly so the players may have greater confidence in the moves, and what was performed incorrectly so the players may quickly stop or change bad habits and begin to improve training methodology to quickly advance ability in the sport.

Key Skills by Sport

The following section provides detailed explanations of the key skills developed by the system described herein, for each sport.

American Football

For American football, players may require training in one or more key skills to prepare physically and mentally before participating in a session. The one or more key skills may include, but are not limited to, how to properly execute offensive and defensive moves, how to pass and receive the football, how to avoid or "juke" opponents, and/or mapping and understanding each player individual optimal balance to enhance and increase performance potential during game play. In one embodiment, a video demonstration may be used to learn the one or more key skills. Further, players may need to build one or more muscle memories of a specific leg (i.e., calf, quad), or an arm (i.e., flexor, biceps, core muscles). The one or more muscle memories may be used for increasing strength and flexibility to benefit endurance, acceleration, and direction transition. In some embodiments, potential passes may be decoded by monitoring eye targets and body positioning of the players.

Further, one or more things may be required for teaching individual skills to players off the field. The one or more things may include, but are not limited to, a flat turf simulation field, a holosphere rotational balance ball, or a simulation treadmill for training players in running or focusing on ball, mid-foot, and/or heel balance positions, as well as arm positions. It should be noted that the training of the arm positions may be required for power, acceleration, defense blocking, and balancing.

Further, one or more technologies may be needed to train the players off the field and/or on the field. There may be modes for sanctioned competition play versus training. Granularity of motion and video captured using one or more field cameras may be adjustable. In one embodiment, the one or more field cameras may be at least one. In another embodiment, the one or more field cameras may be more than 20. Further, a helmet camera and a body motion tracking system may work in conjunction with a synchronized clock to synchronize all equipment for simultaneously capturing player motion and individual video. It should be noted that the individual video overlay may combine 3D motion capture files with an actual motion video. Further, the American football training may include a projected football field with players. Further, the American football training may include one or more scenarios—e.g., a player may pass or kick the football to another player where a trajectory of the football may be projected, and the football may be received or intercepted depending on the accuracy of the throw or kick.

Further, a helmet or headgear may be integrated with a body motion tracker and cameras. The cameras may provide synchronized body motion and each player's point of view of what the player sees. Further, one or more physical locations may be calculated relative to all other players and the football. Each player may be tracked and viewed after the practice to see exactly how the players reacted and what the players may have done differently. It should be noted that the helmet or headgear may be lightweight. Further, object tracking may be used to follow the football. The object tracking may be done using transponders and video object recognition. The video object recognition may enable monitoring of a game play velocity, trajectory, passing targets, goals, and errors.

Further, remote coaching and data collection may be feasible using holographic data ("holodata") telemetry, video, or a live motion capture feed, any of which may be directed to a secure network location. It should be noted that individuals participating in a scrimmage may be tracked in conjunction with all other monitored players. Further, videos with motion capture overlay may be displayed in conjunction with audio two-way communication between coach and wearer (i.e., players) in real time. Additionally, multiple players may be added to the communication console to enable team versus one-on-one coaching.

Further, AR may provide a motion analytic view of the game to each player, coach, and spectator. The motion analytic view may display synchronized statistics and player performance to track each play. Further, such techniques may automate visual replay of physical body motion with video of the play. Therefore, such techniques may make the analysis of the play more obvious and easier to critique from the coach and the players' point of view.

Further, the teammates and a selected individual (i.e., one to one or one to many) may be tracked and engage in direct communication with each other during practice and a competitive play. Such team communication or "group thinking" may result in updating individual strategy and team strategy, and thereby increasing the performance and strategic potential of the individual and the team. Further, one or more items of protective equipment may be used for the protection of players. In one embodiment, a traditional football helmet may be substituted for a lightweight helmet outfitted with a communication module for enhanced data tracking and coaching. Further, other equipment, such as headgear, elbow pads, knee pads, and shoes, may be integrated with transmitting devices.

In some embodiments, players may wear mocap suits for recording kinematic profiles during each play. Such kinematic profiles may enable a coach to analyze the players' offensive and defensive moves relative to each play to see how the player reads and readies for an offensive or defensive maneuver based on a particular play. Further, a footbed sensor may track each player's weight distribution throughout the entire play. In some embodiments, timecode may be used to synchronize each play so that motion and weight distribution of each player may be captured during the play, thus eliminating conventional video training that requires the coach to remember or isolate each specific play or event and attempt to recall the entire play even if the video only shows the football and the players near the football.

Further, one or more cameras may be placed at strategic (e.g., 10-yard) increments along a side of the field in conjunction with body sensors. Such placement of the one or more cameras may provide each coach, trainer, and player with a highly accurate record of UHDPV synchronized volume of action video and motion images. Further, a large-scale volume rendering of the motion/video may accurately render the interplay of all players anywhere on the field, resulting in an unparalleled view of how each player performs and how the play is executed. In an alternate embodiment, a new form of analytical training strategy may be applied. The synchronized volume and motion video may be timecode-synced with the foot sensors and the motion capture headgear, which may render all visual and physical motion during a practice or tournament. Further, reference videos or students' past recordings may provide a progressive and graduated learning curve of reference to track what the player did each time to see how the player truly progresses.

In some embodiments, the training and the recorded video practice may be rendered with individually selected ghost team members and potential offensive players on the field. Further, each team member may focus on specific plays that may be practiced without actual players on the field. In one embodiment, the practice may be specific to the team's approved plays or to strategize new plays against an opponent that runs specific routines. Further, the potential injuries that may be sustained on a practice field with inexperienced or error-prone, poorly rehearsed team members may be reduced as holographic teammates may repeat the rehearsal without endangering the player's practice. Further, each one of the coaches and the team members may replay and rehearse the moves and/or review other players or team videos to strategically coordinate and synchronize plays. It should be noted that each practice event may allow each player and coach to rehearse and refine training and game strategy using a playback system.

In some embodiments, individual metrics may be tracked and cataloged for practices and tournament play. The individual metrics may include completed passes, errors, opportunities, unsuccessful attempts, successful penetration of an offensive play, and/or defensive success on an opposing play. Body sensors linked via timecode may record a comprehensive physiological record of the players' stamina, time on the field, acceleration, and play performance metrics, and catalog G-force impacts. Further, additional metrics, such as retinal tracking and specific direction of attention during the play, may be used to help optimize strategic game play awareness. Further, when a player starts training or attempts to learn a new maneuver, the player may know exactly what to concentrate and work on to progress more rapidly and with more certainty. Further, the individual performance metrics may be raised as each player/trainee has more certainty of exactly what was performed correctly and incorrectly so the players may have greater confidence in the moves, and what was performed incorrectly so the players may quickly stop or change bad habits and begin to improve the training methodology to quickly advance ability in the sport.

Basketball

For basketball, players may require training in one or more key skills to prepare physically and mentally before participating in a session. The one or more key skills may include, but are not limited to, how to shoot baskets from inside and outside a key, lay-ups, dunks, passing plays and quick multi-passes to set up for a shot, dribbling and quick jukes to change direction, body scanning to determine muscle mass and individual body rotational flex points, and mapping and understanding each player's individual optimal balance to enhance and increase performance potential during game play. In one embodiment, a video demonstration may be used to learn the one or more key skills. Further, the players may need to build one or more muscle memories of a specific leg (i.e., calf, quad), or an arm (i.e., flexor, biceps, core muscles). The one or more muscle memories may be used for increasing strength and flexibility to benefit endurance, acceleration, and direction transition. In one embodiment, potential passes may be decoded by monitoring eye targets and body positioning of players.

It should be noted that basketball may be played on a gymnasium court (i.e., boards) or outside. Further, basketball courts may come in different sizes. For example, the court is 94 by 50 feet (28.7 by 15.2 meters) in the National Basketball Association (NBA). As another example, under International Basketball Federation (FIBA) rules, the court is 91.9 by 49.2 ft (28 by 15 meters). Further, a target may require an 18" hoop mounted on a 6' wide backboard for practice shooting mounted 10 feet off the floor for regulation play. Further, a regulation key and court boundaries may identify the boundaries. Further, sprinting and cardio workouts may help the players for short-duration high-energy practice.

Further, one or more technologies may be needed to learn the sport. There may be modes for sanctioned competition play versus training. Granularity of motion and video captured using one or more field court cameras may be adjustable. In one type of practice, such as dribbling, at least one court camera may be sufficient. In another embodiment, up to 20 or more court cameras may be required to capture the entire motion of the play. Further, a helmet camera and a body motion tracking system may work in conjunction with the court cameras, all unified by a synchronized network clock to synchronize all equipment for simultaneously capturing player motion and individual video. It should be noted that the individual video overlay may combine 3D motion capture files with actual motion video. Further, basketball training may include a projected basketball court with players. Further, the basketball training may include one or more scenarios—e.g., a player may pass the basketball to another player where the trajectory of the basketball may be projected, and the basketball may be received or intercepted depending on the accuracy of the pass or shot.

Further, a helmet or headgear may be integrated with a body motion tracker and wearers' point-of-view cameras. The cameras may allow synchronization of body motion and each player's point of view. Players may wear motion capture body scanners integrated into lightweight caps that can sense accurate motion of each appendage (knee, feet, arms, etc.) and can provide real-time kinematics of the players' motion as they move about the court. Further, one or more physical locations may be calculated relative to all other players and the basketball. Each player may be tracked and viewed after the practice to see exactly how the players reacted and what the players may have done differently. It should be noted that the helmet/headgear may be lightweight. Further, object tracking may be used to follow the basketball. The object tracking may be done using transponders and video object recognition. The video object recognition may enable monitoring of game play velocity, trajectory, passing targets, goals, and errors.

Further, remote coaching and data collection may be feasible using holographic data ("holodata") telemetry, video, or a live motion capture feed, any of which may be directed to a secure network location. It should be noted that competing individuals may be tracked in conjunction with all other monitored players. Further, videos with motion capture overlay may be displayed in conjunction with audio two-way communication between coach and wearer (i.e., players) in real time. Additionally, multiple players may be added to the communication console to enable team versus one-on-one coaching.

Further, AR may provide a motion analytic view of the game to each player, coach, and spectator. The motion analytic view may display synchronized statistics and player performance to track each play. Further, such techniques may automate a visual replay of physical body motion with a video of the play. Therefore, such techniques may make analysis of the play more obvious and easier to critique from the point of view of the coach and players.

Further, the teammates and a selected individual (i.e., one to one or one to many) may be tracked and engage in direct communication with each other during practice and competitive play. Such team communication or "group thinking" may result in updated individual and team strategy, thereby increasing the performance and strategic potential of the individual and the team. Further, one or more items of protective gear may be used for protection of players. In one embodiment, a lightweight helmet or headgear may be offered for wearer protection. Further, the lightweight headgear may be integrated with a communication module for enhanced data tracking and coaching. Further, other equipment, such as headgear, elbow pads, knee pads, and shoes, may be integrated with transmitting devices.

In some embodiments, the player may wear a mocap suit for recording kinematic profiles during each play. In other embodiments, the player may wear a motion capture body scanner that is integrated into a lightweight cap that can sense accurate motion of each appendage (knee, feet, arms) and can provide real-time kinematics of the player's motion as they move about the court. Such kinematic profiles may enable a coach to analyze the player's offensive and defensive moves relative to each play. Further, the coach may be able to see how the player reads and readies for an offensive/defensive maneuver based on a particular play. Further, a footbed sensor may track each player's weight distribution throughout the play. In some embodiments, timecode may be used to synchronize each play so that motion and weight distribution of each player may be captured during the play, thus eliminating conventional video training that requires the coach to remember or isolate each specific play or event and attempt to recall the entire play even if the video only shows the basketball and the players near the basketball.

Further, one or more cameras may be placed at strategic (e.g., 10-yard) increments along a side of the field in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field, resulting in an unparalleled view of how each player performs and how the play is executed. In an alternate embodiment, a new form of analytical training strategy may be applied. The synchronized volume/motion video may be timecode-synced with the foot sensors and the motion capture headgear which may render all visual and physical motion during a practice or tournament. Further, reference videos or students' past recordings may provide a progressive and graduated learning curve of reference to track what the player did each time to see how the player truly progresses.

In some embodiments, the plays and the recorded video practice may be rendered with individually selected ghost team-members and potential offensive players on the field. Further, each team member may focus on specific plays that may be practiced without actual players on the field. In one embodiment, the practice may be specific to the team's approved plays or to strategize new plays against an opponent that runs specific routines. Further, potential injuries that may be sustained on a practice field with inexperienced, error-prone, or poorly rehearsed team members may be reduced as holographic teammates may repeat the practice. Further, each one of the coaches and the team members may replay and rehearse the moves and/or review other players or team videos to strategically coordinate and synchronize the plays. It should be noted that each practice event may allow each player and coach to rehearse and refine training and game strategy using a playback system.

In some embodiments, individual metrics may be tracked and cataloged for practices and tournament play. The individual metrics may be completed passes, errors, opportunities, and unsuccessful attempts, including a comprehensive physiological record of the player's stamina, time on the field, acceleration, play performance metrics, impacts, successful penetration of an offensive play, and/or defensive success on an opposing play. Further, additional metrics, such as retinal tracking and a specific direction of attention during the play, may be used to optimize strategic game play awareness. Further, when a player starts training or attempts to learn a new maneuver, the player may know exactly what to concentrate and work on to progress more rapidly and with more certainty. Further, the individual metrics may be raised as each player/trainee has more certainty of exactly what was done correctly and incorrectly so the players may have greater confidence in the moves, and what was done incorrectly so the players may quickly stop or change bad habits and begin to improve training methodology to quickly advance ability in the sport.

Lacrosse

For lacrosse, the players may require training in one or more key skills to prepare physically and mentally before participating in any session. The one or more key skills may include, but not limited to, how to clamp, clear, cradle, cut and shoot the crease. Further, the one or more key skills may include strategies for a face off, fast break, clearing and feed pass that is visible in the wearable glasses. Further, the one or more key skills may include mapping and understanding each player individual optimal balance to enhance and increase performance potential in a game play. Further, a body scanning may be used to determine muscle mass and individual body rotational flex points. In one embodiment, a video demonstration may be used to learn the one or more key skills. Further, the players may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, one or more things may be required for training individual skills to the players off the field. The one or more things may include, but not limited to, a flat turf simulation field, Holosphere-rotational balance ball, or a simulation treadmill for training the players in running or focusing on ball, mid foot, heel balance positions, and/or arm positions. The training of the arm positions may be required for power, acceleration, defense blocking, and balancing. Further, sprinting and cardio workouts may help the players for short high energy duration practice. It should be noted that a Lacrosse field may be 110 yards long and may be from 53⅓ to 60 yards wide. Further, the goals may be 80 yards apart with a playing area of 15 yards behind each goal. Further, a length of the Lacrosse field may be divided in half by a center line. Further, an 18 feet diameter circle may be drawn around each goal and may be referred to as "crease".

Further, one or more technologies may be needed to train the players off the field and/or on the field. The one or more technologies may include a sanctioned competition play vs training, a granularity of motion and video captured using one or more field cameras. In one embodiment, the one or more field cameras may be at least 1. In another embodiment, the one or more field cameras may be more 20. Further, a lightweight Lacrosse Helmet camera and a body motion tracker system may work in conjunction with a synchronized clock to synchronize all equipment for capturing a simultaneous player motion and individual video. It should be noted that the individual video overlay may combine a three-dimensional (3D) motion capture files with an actual motion video. Further, the Lacrosse training may include a projected ball field with players. Further, the Lacrosse training may include one or more scenarios such as a player may pass the ball to another player where a trajectory of the ball may be projected, and the ball may be received or intercepted depending on the accuracy of the throw. Further, recorded video of the player defense and attacks may be used to further train the trainees or students.

Further, a helmet/headgear may be integrated with a body motion tracker and point-of-view (POV) cameras. The player may wear a motion capture body scanner that is integrated into a lightweight cap that can sense accurate motion of each appendage knee, feet, arms and can provide a real-time kinematic of the layers motion as they move about the field. The cameras may provide synchronized body motion and each players point of view of what the players see. Further, one or more physical locations may be calculated relative to all other players and the ball. Each player may be tracked and viewed after the practice to see exactly how the players reacted and what the players may have done differently. It should be noted that the helmet/headgear may be light weight. Further, an object tracking may be used to follow Lacrosse players and the ball. The object tracking may be done using transponders and a video object recognition. The video object recognition may enable monitoring of a game play velocity, trajectory, passing targets, goals, and errors.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the players point of view.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the players. In one embodiment, a lightweight helmet or headgear may be offered for wearer protection. Further, the lightweight helmet or headgear may be integrated with a communication module for enhanced data tracking and coaching. Further, other equipment such as headgear elbow pads, knee pads, shoes with footbed sensors, may be integrated with transmitting devices.

In one embodiment, the players may wear mocap suit for recording kinematic profiles during each play. Such kinematic profiles may enable a coach to analyze the players offensive and defensive moves relative to each play to see how the player reads and readies for an offensive/defensive maneuver based on a particular play. Further, a footbed sensor may track each players weight distribution throughout the entire play. In one embodiment, timecode may be used to synchronize each play so that motion and weight distribution of each player may be captured during the play, and thus eliminates conventional video training that requires the coach to remember or isolate each specific play or event and attempt to recall the entire play even if the video only shows the ball and the players near the ball.

Further, one or more cameras may be placed at strategic (i.e., 10 yard) increments along a side of the field in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be timecode synched with the foot sensors and the motion capture headgears which may render all visual and physical motion during a practice or tournament. Further, reference videos or students' past recordings may provide a progressive and graduated learning curve of reference to track what the player did each time to see how the player truly progresses.

In one embodiment, the training and the recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and tournament play. The individual metrics may include completed passes, errors, advanced opportunities and unsuccessful attempts, including a comprehensive physiological record of the players stamina, time on the field, acceleration, play performance metrics, impacts, successful penetration of an offensive play, and/or defensive success on an opposing play. Further, additional metrics such as retinal tracking and a specific direction of attention during the play may be used to help optimize strategic game play awareness. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Tennis

For playing the tennis, the players may require training in one or more key skills to prepare physically and mentally before participating in any session. The one or more key skills may include, but not limited to, how to properly stroke, overhand, backhand, slice, cut, topspin, lob, power stroke, position basics and advanced volley, play the net, overhead smash, lob, serve, return, backhand, forehand, underhand stroke, and topspin may be seen in the wearable glasses. Further, the one or more key skills may include body scanning to determine muscle mass and individual body rotational flex points, mapping and understanding each player individual optimal balance to enhance and increase performance potential in a game play. In one embodiment, a video demonstration may be used to learn the one or more key skills. Further, the players may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

It should be noted that a regulation tennis court may be 78 feet (i.e., 23.77 meters) long and 27 feet (i.e., 8.23 meters) wide for singles matches and 36 feet (i.e., 10.97 meters) wide for doubles matches. Further, a service line may be 21 feet (i.e., 6.40 meters) from the net. Further, a backboard may be used to practice playing against and thus results in increasing reaction times. Further, a simulation training with pitching/serve machine may be used for delivering a precisely delivered ball at different speeds and from angles to practice stroke returns and backhand returns. Further, sprinting and cardio workouts may help the players for short high energy duration practice.

Further, one or more technologies may be needed to train the players off the field and/or on the field. The one or more technologies may include a sanctioned competition play vs training, a granularity of motion and video captured using one or more field cameras. In one embodiment, the one or more field cameras may be at least 1. In another embodiment, the one or more field cameras may be more 20. Further, a lightweight wearable glasses camera and a body motion tracker system may work in conjunction with a synchronized clock to coordinate all equipment for capturing a simultaneous player motion and individual video. It should be noted that the individual video overlay may combine a three-dimensional (3D) motion capture files with an actual motion video. Further, the tennis training may include a projected ball field with players. Further, the tennis training may include one or more scenarios such as a player may pass the ball to another player where a trajectory of the ball may be projected, and the ball may be received or intercepted depending on the accuracy of the throw. Further, recorded video of the player defense and attacks may be used to further train the trainees or students.

Further, a hat/headgear may be integrated with a body motion tracker and cameras. The cameras may provide synchronized body motion and each players point of view of what the players see. Further, one or more physical locations may be calculated relative to all other players and the ball. Each player may be tracked and viewed after the practice to see exactly how the players reacted and what the players may have done differently. It should be noted that a hat/headgear may be light weight. Further, an object tracking may be used to follow players and the ball. The object tracking may be done using transponders and a video object recognition. The video object recognition may enable monitoring of a game play velocity, trajectory, hits, scores, and errors.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the players point of view.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the players. In one embodiment, a lightweight hat or headgear may be offered for wearer protection. Further, the lightweight hat or headgear may be integrated with a communication module for enhanced data tracking and coaching. Further, other equipment such as headgear elbow pads, knee pads, shoes with footbed sensors, may be integrated with transmitting devices.

In one embodiment, the players may wear mocap suit for recording kinematic profiles during each play. Such kinematic profiles may enable a coach to analyze the players offensive and defensive moves relative to each play to see how the player reads and readies for an offensive/defensive maneuver based on a particular play. Further, a footbed sensor may track each players weight distribution throughout the entire play. In one embodiment, timecode may be used to synchronize each play so that motion and weight distribution of each player may be captured during the play, and thus eliminates conventional video training that requires the coach to remember or isolate each specific play or event and attempt to recall the entire play even if the video only shows the ball and the players near the ball.

Further, one or more cameras may be placed at strategic (i.e., 10 yard) increments along a side of the field in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be timecode synched with the foot sensors and the motion capture headgears which may render all visual and physical motion during a practice or tournament. Further, reference videos or students' past recordings may provide a progressive and graduated learning curve of reference to track what the player did each time to see how the player truly progresses.

In one embodiment, the training and the recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and tournament play. The individual metrics may include completed serves, volleys, returns, errors and faults, a comprehensive physiological record of the players stamina, time on the field, acceleration, play performance metrics, impacts, successful penetration of an offensive play, and/or defensive success on an opposing play. Further, additional metrics such as retinal tracking and a specific direction of attention during the play may be used to help optimize strategic game play awareness. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Track (Running)

In track, runners may require training in one or more key skills to prepare physically and mentally before participating in any session. The one or more key skills may include, but not limited to, how to stride and pace for endurance, starting positions and acceleration, and hand position may be seen in the wearable glasses. Further, a body scanning may be used to determine muscle mass and individual body rotational flex points. Further, the one or more key skills may include mapping and understanding each player individual optimal balance to enhance and increase performance potential in a game play. In one embodiment, a video demonstration may be used to learn the one or more key skills. Further, the players may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, one or more things may be required for training individual skills to the players off the field. The one or more things may include a simulation treadmill equipped with a video camera and an AR motion capture to analyze participants ability and stride. Further, sprinting and cardio workouts may help the players for short high energy duration practice. Further, one or more technologies may be needed to train the players off the field and/or on the field. The one or more technologies may include a sanctioned competition play vs training, a granularity of motion and video captured using one or more field cameras. In one embodiment, the one or more field cameras may be at least 1. In another embodiment, the one or more field cameras may be more 20. Further, a lightweight wearable glasses camera and a body motion tracker system may work in conjunction with a synchronized clock to synchronize all equipment for capturing a simultaneous player motion and individual video. It should be noted that the individual video overlay may combine a three-dimensional (3D) motion capture files with an actual motion video. Further, the racing track training may include a projected runner with an accurate motion recording to display exactly how a runner effectively moves during each competition or event.

Further, a hat/headgear may be integrated with a body motion tracker and cameras. The cameras may provide synchronized body motion and each players point of view of what the players see. Further, one or more physical locations may be calculated relative to all other players. Each player may be tracked and viewed after the practice to see exactly how the players reacted and what the players may have done differently. It should be noted that a hat/headgear may be light weight. Further, an object tracking may be used to follow runner. The object tracking may be done using transponders and a video object recognition. The video object recognition may enable monitoring of start, velocity, time, stride, and acceleration.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the players point of view.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the players. In one embodiment, a lightweight hat may be offered for wearer protection. Further, the lightweight hat may be integrated with a communication module for enhanced data tracking and coaching. Further, other equipment such as headgear elbow pads, knee pads, shoes with footbed sensors, may be integrated with transmitting devices.

In one embodiment, the players may wear mocap suit for recording kinematic profiles during each play. Such kinematic profiles may enable a coach to analyze the players offensive and defensive moves relative to each play to see how the player reads and readies for an offensive/defensive maneuver based on a particular play. Further, a footbed sensor may track each players weight distribution throughout the entire play. In one embodiment, timecode may be used to synchronize each play so that motion and weight distribution of each player may be captured during the play.

Further, one or more cameras may be placed at strategic (i.e., 10 yard) increments along a side of the field in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be timecode synched with the foot sensors and the motion capture headgears which may render all visual and physical motion during a practice or tournament. Further, reference videos or students' past recordings may provide a progressive and graduated learning curve of reference to track what the player did each time to see how the player truly progresses.

In one embodiment, the training and the recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and tournament play. The individual metrics may include completed events, acceleration, strides, awards, a comprehensive physiological record of the players stamina, time on the field, acceleration, play performance metrics, impacts, successful penetration of an offensive play, and/or defensive success on an opposing play. Further, additional metrics such as retinal tracking and a specific direction of attention during the play may be used to help optimize strategic game play awareness. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Volleyball

For playing the volleyball, the players may require training in one or more key skills to prepare physically and mentally before participating in any session. The one or more key skills may include, but not limited to, how to serve, set, dig, pass, bump, overhand serve, underhand serve, dive, set to front mid and back of count. Further, the one or more key skills may include scanning to determine muscle mass and individual body rotational flex points, mapping and understanding each player individual optimal balance to enhance and increase performance potential in a game play. In one embodiment, a video demonstration may be used to learn the one or more key skills. Further, the players may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

It should be noted that the volleyball may be played on sand or on gymnasium floor (i.e., boards). Further, the volleyball may be played on a volleyball court which is 18 meters (i.e., 59 feet) long and 9 meters (i.e., 29.5 feet) wide. Further, the volleyball court may be divided into two 9×9 meter halves by a one-meter (i.e., 40-inch) wide from the net. Further, a top of the net may be 2.43 meters (i.e., 7 feet 11⅝ inches) above the center of the volleyball court for men's competition, and 2.24 meters (i.e., 7 feet 4⅛ inches) for women's competition. It will be apparent to one skilled in the art that heights may be varied for veterans and junior competitions, without departing from the scope of the disclosure.

Further, one or more technologies may be needed to train the players off the court and/or on the court. The one or more technologies may include a sanctioned competition play vs training, a granularity of motion and video captured using one or more field cameras. In one embodiment, the one or more field cameras may be at least 1. In another embodiment, the one or more field cameras may be more 20. Further, a lightweight wearable glasses camera and a body motion tracker system may work in conjunction with a synchronized clock to synchronize all equipment for capturing a simultaneous player motion and individual video. It should be noted that the individual video overlay may combine a three-dimensional (3D) motion capture files with an actual motion video. Further, the volleyball training may include a projected player with accurate motion recording to display exactly how a player moves during each competition or event.

Further, a hat/headgear may be integrated with a body motion tracker and cameras. The cameras may provide synchronized body motion and each players point of view of what the players see. Further, one or more physical locations may be calculated relative to all other players and the ball. Each player may be tracked and viewed after the practice to see exactly how the players reacted and what the players may have done differently. It should be noted that a hat/headgear may be light weight. Further, an object tracking may be used to follow players and the ball in double or team. The object tracking may be done using transponders and a video object recognition. The video object recognition may enable monitoring of serve, blocks, digs, hits and points scored. Further, hardcourt with shoes may employ footbed sensors to indicate pressure on ball, midfoot and heel. The footbed sensors may tell the wearer and coach balance and body pressure exerted at every motion. Further, sand volleyball may be played with sox or barefoot, where sox may be used as a sensor for tracking response time and foot action.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the players point of view.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the players. In one embodiment, a lightweight hat or headgear may be offered for wearer protection. Further, the lightweight hat or headgear may be integrated with a communication module for enhanced data tracking and coaching. Further, other equipment such as headgear elbow pads, knee pads, shoes with footbed sensors, may be integrated with transmitting devices.

In one embodiment, the players may wear mocap suit for recording kinematic profiles during each play. Such kinematic profiles may enable a coach to analyze the players offensive and defensive moves relative to each play to see how the player reads and readies for an offensive/defensive maneuver based on a particular play. Further, a footbed sensor may track each players weight distribution throughout the entire play. In one embodiment, timecode may be used to synchronize each play so that motion and weight distribution of each player may be captured during the play, and thus eliminates conventional video training that requires the coach to remember or isolate each specific play or event and attempt to recall the entire play even if the video only shows the ball and the players near the ball.

Further, one or more cameras may be placed at strategic increments along a side of the court in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be timecode synched with the foot sensors and the motion capture headgears which may render all visual and physical motion during a practice or tournament. Further, reference videos or students' past recordings may provide a progressive and graduated learning curve of reference to track what the player did each time to see how the player truly progresses.

In one embodiment, the training and the recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and tournament play. The individual metrics may include completed events, acceleration, strides, awards, a comprehensive physiological record of the players stamina, time on the field, acceleration, play performance metrics, impacts, successful penetration of an offensive play, and/or defensive success on an opposing play. Further, additional metrics such as retinal tracking and a specific direction of attention during the play may be used to help optimize strategic game play awareness. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Formula 1, Stock Car, and Drag Racing

For Formula 1, stock car, sports car, drag racing, boat racing, open wheel racing, off-road racing, etc., drivers may require muscle memory training in one or more required skills to prepare physically and mentally before participating in a session. The one or more required skills may include, but are not limited to, training for driver endurance, reaction time reduction, setup and exit strategy for each corner, balance with braking and acceleration, passing strategy, drafting strategy, how to strategize for each race and understand the other competitors, road course memorization, and learning other drivers' and teams' strategies. In one embodiment, a body scanning may be performed to determine muscle mass and individual body rotational flex points. Further, the one or more key skills may include mapping and understanding each player individual optimal balance to enhance and increase performance potential while driving. In one embodiment, a previously recorded video may help demonstrate how a particular maneuver may require retraining or additional muscle memory training for a specific leg (i.e., calf, quad), or an arm (i.e., flexor, biceps, core muscles). Specific focus on muscle memory may be beneficial for reducing reaction time, increasing strength and dexterity to benefit endurance, acceleration, and direction transition. In one embodiment, potential competitive advantages regarding passes may be enhanced and decoded by monitoring eye targets and body positioning of the players.

Further, one or more driving habits may be discovered and modified to enhance driving skill and reduce lap times. The one or more options for retraining may include simulation driving trainers that may start with a general-purpose game console interchangeable with steering wheels, throttle, brake, and shifter. Further, advanced simulators may be an exact duplicate of the vehicle's functions in a motion simulator that duplicates yaw, pitch, acceleration, deceleration, and sounds. Further, hundreds of scanned racetracks may be available with mapped surfaces, surrounding environments, and variable conditions. Further, vehicle options may include engine horsepower (HP) output, tire selection and tire hardness/softness stiction, suspension tunability, traction control, weather, temperature, humidity, day and night.

Further, one or more technologies may be needed to train the drivers on and off the track. The one or more technologies may include a sanctioned competition play vs training, a granularity of motion and video captured using one or more track cameras. In one embodiment, the one or more track cameras may be at least 1. In another embodiment, the one or more track cameras may be more than 20. Further, a lightweight helmet shield camera and a body motion tracker system may work in conjunction with holographic data ("holodata") micro-clocking synchronization for recording all individual and vehicle sensor and video event motion combined with simultaneous on track vehicle location capture. Further, the helmet may be integrated with a communication module for enabling the player and coach to have 1 on 1 personal training with synchronized POV video, communication and onboard body and vehicle telemetry, in real time.

Further, one or more training systems may employ a simulator with an individual track and a vehicle selection to practice at any pre-recorded track and with a specific vehicle. Further, pressure sensors may record hand foot and body pressure exerted during any practice or race session. Further, simulations may provide drivers a safer and less expensive way to practice driving and increase performance by learning to optimize cornering, breaking, and acceleration. In one embodiment, the helmet may be integrated with a helmet motion tracker that may be used to know a precise physical location of the driver/trainee. Further, the helmet motion tracker may enable the coach and trainee to better perceive and see an exact position as the coach and the trainee may navigate each turn and set up for a next turn based on holographic data ("holodata") micro-clocking timecodes synchronized to a master clock for synchronizing all embedded sensors and equipment. Further, the helmet may provide eye tracking to see where the trainee is looking at during an event. Such eye tracking may help the coach and the trainee to train on what is important and how to look at a particular scenario as a trained participant. Further, a holographic camera from the athlete's point of view allows the coach and the trainee to see what the players were looking at on a racecourse. Further, a body scanner may allow the coach and the trainee to actually see what the coach and the trainee were doing at the instant when the action was unfolding. Further, anticipation and action may be compared to a moment that is essential in training each participant as to what to do and when to do. Additionally, when an error occurs, the body motion may be synchronized to the event for determining when the trainee did or did not execute a play or move. In one embodiment, an ability to project the coach to familiarize drivers with a new racecourse. Further, the helmet may track the driver's pupil to verify exactly where the drivers are looking at and how often the drivers are looking at particular information, gauges, other drivers, surroundings and track.

Further, a vehicle position relative to the track and other vehicles on the course may be tracked. Further, a body position of the driver, hands of the driver, and feet of the driver, may be tracked. In one embodiment, footbed sensors may be used to indicate pressure on ball, midfoot and heel. Further, the footbed sensors may tell the wearer and the coach regarding balance of the wearer and body pressure exerted at every motion. Further, a communication may be synchronized for any event to know what was said and when between the coach and teammate or driver. Further, any telemetry or actuation on a steering wheel or a feedback steering wheel, brakes and shifting, may be tracked for training the players/trainee.

Further, a remote coaching and data collection may be feasible using holographic data ("holodata") telemetry synchronization, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each driver, coach, and spectator. The motion analytic view may display synchronized statistics and driver performance to track each play. Further, such techniques may automate a visual replay of the vehicle and a physical body motion with a video of the action. Therefore, synchronized motion analysis, telemetry and video may make the analysis of action more obvious and easier to critique from the coach and the players point of view. In one embodiment, equipment such as Go Pro, RacePac, or Holley, may provide components of metadata set.

Further, the teammates and a selective individual (i.e., 1:1 or 1 to many) may be in metered and direct communication with each other during a practice and a competitive driving. Such type of the group thinking may result in enhanced individual strategy and team strategy, and thereby increasing the performance and strategic potential of the individual and the team. Further, one or more protective gears may be used for protection of the players. In one embodiment, a lightweight helmet or headgear may be offered for wearer protection. Further, the lightweight helmet or headgear may be integrated with a communication module for enhanced data tracking and coaching. Further, other holographic data ("holodata")-synchronized equipment such as headgear elbow pads, knee pads, and shoes with footbed sensors, may be integrated with transmitting devices.

In one embodiment, the players may wear mocap suit for recording kinematic profiles during each session. Such kinematic profiles may enable a coach to analyze the drivers offensive and defensive moves relative to each play to see how the driver reads and readies for an offensive/defensive maneuver based on the particular location. Further, hand bed sensors, neck bed sensors, body bed sensors, and footbed sensors may track each players weight distribution throughout the session. In one embodiment, holographic data ("holodata")-synchronized timecode may be used to analyze each play so that motion and weight distribution of each player may be captured in conjunction with video and automatically synchronized during the session.

Further, one or more cameras may be placed at strategic locations along a side of the track in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be holographic data ("holodata")-timecode-synchronized with the foot sensors and the motion capture headgears which may render all visual and physical motion during a practice or race. Further, reference video or students' past recordings may provide a progressive and graduated learning curve of the reference to track what the player did each time to see how the player truly progresses. In one embodiment, additional metadata may include air pressure, air temperature, wind speed and direction, tire traction and friction meters including where rubber build up on the track is located.

Each driver may focus on and rehearse specific tracks and corners without actual racers on the track. Further, driving and recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each coach and the driver may replay and rehearse the motion moves and/or review other players or team videos to strategically coordinate and synchronize the plays. It should be noted that each practice event may allow each player and coach to rehearse, refine training, and game strategy using a playback system.

In one embodiment, individual metrics may be tracked and catalogued for practices and sanctioned competition. The individual metrics may be completed events, acceleration, braking, strategies including a comprehensive physiological record of the players stamina and time on the track. Further, additional metrics such as retinal tracking and a specific direction of attention during the play may be used to optimize strategic driver awareness. Further, when a driver starts training or attempts to learn a new maneuver, then the player may know exactly what to concentrate and work on to progress more rapidly and with more certainty. Further, the individual metrics may be raised as each driver/trainee has more certainty of exactly what the drivers did right and wrong, so they may have greater confidence in their actions and what the driver was doing wrong so that the driver may quickly identify, stop, or change bad habits and begin to improve training methodology to quickly advance ability in the sport.

Kartin

In karting, each driver may receive engineered algorithm and training regimes. Further, each equipment may be specifically tuned for each player. In one embodiment, the players may require one or more key skills such as, but not limited to, training for drivers endurance, a corner set up and exit strategy, balance with braking and acceleration, passing strategy, drafting strategy, how to strategize for each race and understand the other competitors, road course memorization, lean other drivers and team strategies, body scanning to determine muscle mass and individual body rotational flex points, mapping and understanding each players individual optimal balance to enhance and increase performance potential in a game play. In one embodiment, a video demonstration may be used to learn the one or more key skills. Further, the players may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, one or more things may be required for training individual skills to the players off the field. The one or more things may include simulation trainers that may start with a general-purpose game console interchangeable with steering wheels, throttle, brake, and shifter. Further, advanced simulators may be an exact prototype of the automobile functioning in a motion simulator that duplicates yaw, pitch, acceleration, and sounds. Further, hundreds of scanned tracks internationally may be available with mapped surfaces with surrounding environments and conditions. Further, vehicle options may include engine horsepower (HP) output, tire selection and tire hardness/softness stiction, suspension tunability, traction control, weather, temperature, humidity, day and night.

Further, one or more technologies may be needed to train the players off the field and/or on the field. The one or more technologies may include a sanctioned competition play vs training, a granularity of motion and video captured using one or more field cameras. In one embodiment, the one or more field cameras may be at least 1. In another embodiment, the one or more field cameras may be more 20. Further, a lightweight helmet shield camera and a body motion tracker system may work in conjunction with a synchronized clock for recording all individual event motion combined with simultaneous on track vehicle location capture. Further, the helmet may be integrated with a communication module for enabling the player and coach to have 1 on 1 personal training with synchronized POV video, communication and onboard telemetry, in the real time.

Further, one or more training systems may employ a simulator with an individual track and a vehicle selection to practice at any pre-recorded track and with a specific vehicle. Further, pressure sensors may record hand foot and body pressure exerted during any practice or race session. Further, simulations may provide drivers a safer and less expensive way to practice driving and increase performance by learning to optimize cornering, breaking, and acceleration. In one embodiment, the helmet may be integrated with a helmet motion tracker that may be used to know a precise physical location of the driver/trainee. Further, the helmet motion tracker may enable the coach and trainee to better perceive and see an exact position as the coach and the trainee may navigate each turn and set up for a next turn based on timecodes synchronized to a master clock. Further, the helmet may provide eye tracking to see where the trainee is looking at during an event. Such eye tracking may help the coach and the trainee to train on what is important and how to look at a particular scenario as a trained participant. Further, a POV Holocam may allow the coach and the trainee to see what the players were looking at on a racecourse. Further, a body scanner may allow the coach and the trainee to actually see what the coach and the trainee were doing at the instant when the action was unfolding. Further, anticipation and action may be compared to a moment that is essential in training each participant as to what to do and when to do. Additionally, when an error occurs, the body motion may be synchronized to the event for determining when the trainee did or did not execute a play or move. In one embodiment, an ability to project the coach to familiarize drivers with a new racecourse. Further, the helmet may track the driver's pupil to verify exactly where the drivers are looking at and how often the drivers are looking at particular information, gauges, other drivers, surroundings and track.

Further, a vehicle position relative to the track and other vehicles on the course may be tracked. Further, a body position of the driver, hands of the driver, and feet of the driver, may be tracked. In one embodiment, footbed sensors may be used to indicate pressure on ball, midfoot and heel. Further, the footbed sensors may tell the wearer and the coach regarding balance of the wearer and body pressure exerted at every motion. Further, a communication may be synchronized for any event to know what was said and when between the coach and teammate or driver. Further, telemetry or actuation on a steering wheel or a feedback steering wheel, brakes and shifting, may be tracked for training the players/trainees.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each driver, coach, and spectator. The motion analytic view may display synchronized statistics and driver performance to track each play. Further, such techniques may automate a visual replay of the vehicle and a physical body motion with a video of the action. Therefore, synchronized motion analysis, telemetry and video may make the analysis of action more obvious and easier to critique from the coach and the players point of view. In one embodiment, equipment such as Go Pro, RacePac, or Holley, may provide components of metadata set.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the players. In one embodiment, a lightweight helmet or headgear may be offered for wearer protection. Further, the lightweight helmet or headgear may be integrated with a communication module for enhanced data tracking and coaching. Further, other equipment such as headgear elbow pads, knee pads, and shoes with footbed sensors, may be integrated with transmitting devices.

In one embodiment, the players may wear mocap suit for recording kinematic profiles during each play. Such kinematic profiles may enable a coach to analyze the drivers offensive and defensive moves relative to each play to see how the player reads and readies for an offensive/defensive maneuver based on the particular play. Further, hand bed sensors, neck bed sensors, body bed sensors, and footbed sensors may track each players weight distribution throughout the play. In one embodiment, timecode may be used to synchronize each play so that motion and weight distribution of each player may be captured during the play.

Further, one or more cameras may be placed at strategic locations along a side of the track in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be timecode synched with the foot sensors and the motion capture headgears which may render all visual and physical motion during a practice or race. Further, reference video or students' past recordings may provide a progressive and graduated learning curve of the reference to track what the player did each time to see how the player truly progresses. In one embodiment, additional metadata may include air pressure, air temperature, wind speed and direction, tire traction and friction meters including where rubber build up on the track is located.

Each driver may focus on and rehearse specific tracks and corners without actual racers on the track. Further, driving and recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each coach and the driver may replay and rehearse the motion moves and/or review other players or team videos to strategically coordinate and synchronize the plays. It should be noted that each practice event may allow each player and coach to rehearse, refine training, and game strategy using a playback system.

In one embodiment, individual metrics may be tracked and catalogued for practices and sanctioned competition. The individual metrics may be completed events, acceleration, braking, strategies including a comprehensive physiological record of the players stamina and time on the track. Further, additional metrics such as retinal tracking and a specific direction of attention during the play may be used to optimize strategic driver awareness. Further, when a driver starts training or attempts to learn a new maneuver, then the driver may know exactly what to concentrate and work on to progress more rapidly and with more certainty. Further, the individual metrics may be raised as each driver/trainee has more certainty of exactly what the driver did right and wrong, so they may have greater confidence in their actions and what the driver was doing wrong so that the driver may quickly identify, stop, or change bad habits and begin to improve training methodology to quickly advance ability in the sport.

Motorcycle Road Racing and Motocross

For Motorcycle racing and Motocross, the players may require training in one or more key skills to prepare physically and mentally before participating in any session. The one or more key skills may include, but not limited to, training for rider's endurance, a corner set up and exit strategy, balance with braking and acceleration, passing strategy, drafting strategy, how to strategize for each race and understand the other competitors, road course memorization, and lean other riders and team strategies. In one embodiment, a body scanning may be performed to determine muscle mass and individual body rotational flex points. Further, the one or more key skills may include mapping and understanding each player individual optimal balance to enhance and increase performance potential in a game play. In one embodiment, key interior and abductors/adductors may be used for anterior hip flexors, fore arms and shoulders for muscle memory training. Further, ballet bars may be used for slow and fast twitch muscles. In one embodiment, a video demonstration may be used to learn the one or more key skills. Further, the players may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, one or more things may be required for training individual skills to the players off the field. The one or more things may include motorsports simulations that may be provided in a 20'×20' room equipped with walls with rear projection screens to display racecourse. Further, a motorcycle simulator may be used to train the rider on the equipment and familiarize the rider with different racecourses, and riding-cornering techniques. Further, a hydraulic motorcycle stand, a video display, and a static motorcycle trainer with spring assist, may be used.

Further, one or more technologies may be needed to train the players off the field and/or on the field. The one or more technologies may include an AR helmet, track telemetry sensors on clutch and brake, body positioning trackers, tank pad sensors, body sensors, bike cameras, and corner cameras. In an example, a granularity of motion and video of the riders may be captured using one or more field cameras. In one embodiment, the one or more field cameras may be at least 1. In another embodiment, the one or more field cameras may be more 20. Further, a helmet may be equipped with a camera and a body motion tracker that work in conjunction with a synchronized clock for recording all simultaneous player motion capture and individual video overlay combining three-dimensional (3D) motion capture files with an actual motion video. Further, the rider and motobike trajectory may be tracked to display the driving path for driving and training.

Further, one or more training systems may employ a simulator with an individual track and a vehicle selection to practice at any pre-recorded track and with a specific vehicle. Further, pressure sensors may record hand foot and body pressure exerted during any practice or race session. Further, simulations may provide riders a safer and less expensive way to practice driving and increase performance by learning to optimize cornering, breaking, and acceleration. In one embodiment, each event and all equipment may be synchronized to track action by time code that identifies where each rider may be located on the track, what was the physical state of readiness or anticipation the riders were making for the shift after each corner or pass/overtake.

Further, the helmet may be integrated with a helmet motion tracker that may be used to know a precise physical location of the rider/trainee. Further, the helmet motion tracker may enable the coach and trainee to better perceive and see an exact position as the coach and the trainee may navigate each turn and set up for a next turn based on timecodes synchronized to a master clock. Further, the helmet may provide eye tracking to see where the trainee is looking at during an event. Such eye tracking may help the coach and the trainee to train on what is important and how to look at a particular scenario as a trained participant. Further, a POV Holocam may allow the coach and the trainee to see what the players were looking at on a racecourse. Further, a body scanner may allow the coach and the trainee to actually see what the coach and the trainee were doing at the instant when the action was unfolding. Further, anticipation and action may be compared to a moment that is essential in training each participant as to what to do and when to do. Additionally, when an error occurs, the body motion may be synchronized to the event for determining when the trainee did or did not execute a play or move. In one embodiment, an ability to project the coach to familiarize riders with a new racecourse. Further, the helmet may track the rider's pupil to verify exactly where the riders are looking at and how often the riders are looking at particular information, gauges, other riders, surroundings and track.

Further, one or more things such as braking, shifting, clutching throttle, body position, track position and braking markers and track line apexes, eye focus and location of focus, may be tracked. Further, a vehicle position relative to the track and other vehicles on the course may be tracked. Further, a body position of the rider, hands of the rider, and feet of the rider, may be tracked. Further, a communication link between the coach and the riders may be maintained. Further, any telemetry or actuation on a steering wheel or a feedback steering wheel, brakes and shifting, may be tracked for training the riders.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR overlay may depict real-time overlay of the geography and a best line for an experience level. Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the riders. In one embodiment, helmets, riding suits knee puck sensor, hand grip sensors on handlebars, tank knee grip pads, knee pads, and footbed sensors, may be used.

In one embodiment, the players may wear mocap suit for recording kinematic profiles during each play. Such kinematic profiles may enable a coach to analyze the players isolated moves relative to each consecutive move. Further, a full body motion capture system may include a footbed sensor to track each players weight distribution (i.e., ball, mid-foot, heel) throughout the entire practice. Such system may enable the rider to set a proper body position and understand how to best achieve traction.

Further, one or more cameras may be placed at strategic locations along a side of the track in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In an alternate embodiment, a new form of analytical training strategy may be applied. The synchronized volume/motion video may be timecode synched with the foot sensors and the motion capture headgears which may render all visual and physical motion during a practice or race. Further, reference video or students' past recordings may provide a progressive and graduated learning curve of the reference to track what the player did each time to see how the player truly progresses. Such training may give a new racer a skill set before the racer put themselves at risk and immediate feedback for immediate adjustments.

Each rider may focus on and rehearse specific tracks and corners without actual racers on the track. Further, driving and recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each coach and the rider may replay and rehearse the motion moves and/or review other players or team videos to strategically coordinate and synchronize the maneuver. It should be noted that each practice event may allow each rider and coach to rehearse, refine training, and riding strategy using a playback system.

In one embodiment, individual metrics may be tracked and catalogued for practices and sanctioned competition. The individual metrics may be completed events, acceleration, braking, strategies including a comprehensive physiological record of the rider's stamina and time on the track. Further, additional metrics such as retinal tracking and a specific direction of attention during the play may be used to optimize strategic rider awareness. Further, when a rider starts training or attempts to learn a new maneuver, then the rider may know exactly what to concentrate and work on to progress more rapidly and with more certainty. Further, the individual metrics may be raised as each rider/trainee has more certainty of exactly what the rider did right and wrong, so they may have greater confidence in their actions and what the rider was doing wrong so that they may quickly identify, stop, or change bad habits and begin to improve training methodology to quickly advance ability in the sport. Each individual may get to tailor the logistics that applied by engineered algorithm and training regimens. Further, any riding equipment may be specially tuned for each rider.

BMX or Road Bicycling

In Bicycling Motocross (BMX), riders may require training in one or more key skills to prepare physically and mentally before participating in any session. The one or more key skills may include, but not limited to, training for the rider's endurance, corner set up and exit strategy, balance with braking and acceleration, passing strategy, drafting strategy, how to strategize for each race and understand the other competitors, lean other riders and team strategies, road course memorization, body scanning to determine muscle mass and individual body rotational flex points, mapping and understanding each player individual optimal balance to enhance and increase performance potential in a game play. In one embodiment, a video demonstration may be used to learn the one or more key skills. Further, the riders may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the riders.

It should be noted that BMX cycling simulations may be provided in a 20'×20' room equipped with walls with rear projection screens to display any road or racecourse. Further, bike simulators may be used to train the rider and familiarize the rider with different racecourses, braking, gear change, drafting, pacing and cornering techniques.

Further, one or more technologies may be needed to train the players off the field and/or on the field. The one or more technologies may include an AR helmet worn by the rider. In an example, highly granular motion and video of the riders may be captured using one or more field cameras. In one embodiment, the one or more field cameras may be at least 1. In another embodiment, the one or more field cameras may be more 20. Further, a helmet may be equipped with a camera and a body motion tracker that work in conjunction with a synchronized clock for recording all simultaneous player motion capture and individual video overlay combining three-dimensional (3D) motion capture files with an actual motion video. Further, the rider and motobike trajectory may be tracked to display the driving path for driving and training.

Further, one or more training systems may employ a simulator with an individual track and a vehicle selection to practice at any pre-recorded track and with a specific vehicle. Further, pressure sensors may record hand foot and body pressure exerted during any practice or race session. Further, simulations may provide riders a safer and less expensive way to practice driving and increase performance by learning to optimize cornering, breaking, and acceleration. In one embodiment, each event and all equipment may be synchronized to track action by time code that identifies where each rider may be located on the track, what was the physical state of readiness or anticipation the riders were making for the shift after each corner or pass/overtake.

Further, the helmet may be integrated with a helmet motion tracker that may be used to know a precise physical location of the rider/trainee. Further, the helmet motion tracker may enable the coach and trainee to better perceive and see an exact position as the coach and the trainee may navigate each turn and set up for a next turn based on timecodes synchronized to a master clock. Further, the helmet may provide eye tracking to see where the trainee is looking at during an event. Such eye tracking may help the coach and the trainee to train on what is important and how to look at a particular scenario as a trained participant. Further, a POV Holocam may allow the coach and the trainee to see what the players were looking at on a racecourse. Further, a body scanner may allow the coach and the trainee to actually see what the coach and the trainee were doing at the instant when the action was unfolding. Further, anticipation and action may be compared to a moment that is essential in training each participant as to what to do and when to do. Additionally, when an error occurs, the body motion may be synchronized to the event for determining when the trainee did or did not execute a play or move. In one embodiment, an ability to project the coach to familiarize riders with a new racecourse. Further, the helmet may track the rider's pupil to verify exactly where the riders are looking at and how often the riders are looking at particular information, gauges, other riders, surroundings and track.

Further, a vehicle position relative to the track and other vehicles on the course may be tracked. Further, a body position of the rider, hands of the rider, and feet of the rider, may be tracked. Further, an eye location during any action, the communication may be synchronized for any event to know what and when was said between the coach and the rider. In one embodiment, telemetry or actuation on the steering wheel or feedback steering wheel, brakes and shifting may be tracked for training.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the riders. In one embodiment, helmets, riding suits knee puck sensor, hand grip sensors on handlebars, tank knee grip pads, knee pads, and footbed sensors, may be used for the protection of the riders.

In one embodiment, the riders may wear mocap suit for recording kinematic profiles during each play. Such kinematic profiles may enable a coach to analyze the players isolated moves relative to each consecutive move. Further, a full body motion capture system may include a footbed sensor to track each players weight distribution (i.e., ball, mid-foot, heel) throughout the entire practice. Such system may enable the rider to set a proper body position and understand how to best achieve traction.

Further, one or more cameras may be placed at strategic locations along a side of the track in conjunction with body sensors. Such placement of the one or more cameras may provide each coach, trainer and player with a highly accurate record of UHDPV synchronized volume of action video and motion images. Further, a large-scale volume rendering of the motion/video may accurately render the interplay of all players anywhere on the field resulting in an unparalleled view of how each player and the play is executed. In one embodiment, a new racer may be trained by demonstrating the skill or precise playback of the attempt helps to identify more precisely what the new racer did. Further, a new skill set may be demonstrated before the riders put themselves at risk or providing immediate feedback (i.e., an instant replay) for immediate adjustments. Further, reference video or students' past recordings may provide a progressive and graduated learning curve of the reference to track what the player did each time to see how the player truly progresses. Such training may give a new racer a skill set before the racer put themselves at risk and immediate feedback for immediate adjustments.

Each rider may focus on and rehearse specific tracks and corners without actual racers on the track. Further, driving and recorded video practice may be rendered with individually selected ghost team-members and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, each coach and the rider may replay and rehearse the motion moves and/or review other players or team videos to strategically coordinate and synchronize the plays. It should be noted that each practice event may allow each player and coach to rehearse, refine training, and game strategy using a playback system.

In one embodiment, individual metrics may be tracked and catalogued for practices and tournament play. The individual metrics may be completed events, acceleration, braking, strategies including a comprehensive physiological record of the players stamina and time on the field. Further, additional metrics such as retinal tracking and a specific direction of attention during the play may be used to optimize strategic game play awareness. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Martial Arts

For the karate, the players may require training in one or more key skills to prepare physically and mentally before participating in any session. The one or more key skills may include, but not limited to, body awareness of an opponent, how to balance and block attacks from an opponent, how to punch, kick and deflect all offensive moves, how to flow from one move to another, how to transition from one move to another, how to determine options for overcoming the opponent, and/or mapping and understanding each player individual optimal balance to enhance and increase performance potential in a game play. It should be noted that demonstrations and determining options for overcoming the opponent may be seen in the wearable glasses. In one embodiment, a video demonstration may be used to learn the one or more key skills. In one embodiment, potential passes may be decoded by monitoring eye targets and body positioning of the players. Further, a body scanning may be used to determine muscle mass and individual body rotational flex points. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. It should be noted that training of the one or more muscle memories may create a total body unity i.e., all parts and limbs flow as one unit.

Further, one or more things may be required for training individual skills to the players off the field. The one or more things may include, but not limited to, a Martial Combat simulation room. The Martial Combat simulation room may be at least 20'×20' or 40'×40' equipped with multiple video cameras and an AR motion capture to analyze participants ability and moves. Further, recorded motion videos may be used to train students/trainees by enabling playback of any practice motion or combined moves video for analysis and training. Further, each event and all equipment may be synchronized to track action by timecode that identifies where each martial artist is located on the mat, what was the physical state of readiness or anticipation the martial artist were making for the shift after the attack.

Further, one or more technologies may be needed to train the players off the field and/or on the field. The one or more technologies may include one or more cameras for capturing a granularity of motion and video. In one embodiment, the one or more field cameras may be at least 1. In another embodiment, the one or more field cameras may be more 20. Further, a Helmet camera and a body motion tracker system may work in conjunction with a synchronized clock to synchronize all equipment for capturing a simultaneous player motion and individual video. Further, the Martial arts training may include a projected player with an accurate motion recording to display exactly how a player moves during each competition or event. Further, the martial arts training may include an attire such as bare feet and training slippers or shoes. Further, the one or more technologies may follow body motion with a grid overlay to see where the move was and what is correct or incorrect. It should be noted that each move may be shown with a tracking line to see exactly the trajectory of the weapon, hand, and/or foot.

Further, a hat/headgear may be integrated with a body motion tracker and cameras. In one embodiment, the cameras may be integrated in combat kimono or Gi. The cameras may provide synchronized body motion and each players point of view of what the players see. Further, one or more physical locations may be calculated relative to all other players and the ball. Each player may be tracked and viewed after the practice to see exactly how the players reacted and what the players may have done differently. It should be noted that a hat/headgear may be light weight.

Further, body motion, feet and hands, limbs, and weapons may be critical to monitor the event and the action. Further, martial art weapons may be equipped with tracking and acceleration measuring devices to track the trajectory or accuracy of any move. Further, footbed sensors may be used to indicate pressure on ball, midfoot and heel. Further, the footbed sensor may tell the wearer and the coach regarding balance and body pressure exerted at every motion. Further, gloves may be used to sense the power of any punch.

Further, a remote coaching and data collection may be feasible using holographic data ("holodata") telemetry, video or live motion capture feed that may be directed to a secure online address. It should be noted that individuals competing may be tracked in conjunction with all other monitored players. Further, videos with motion capture overlay may be displayed in conjunction with audio 2-way communication between coach and wearer (i.e., players) in the real time. Additionally, multiple players may be added to the communication console to enable team coaching vs 1 on 1.

Further, an AR may provide a motion analytic view of the game to each player, coach, and spectator. The motion analytic view may display synchronized statistics and player performance to track each play. Further, such techniques may automate a visual replay of physical body motion with a video of the play. Therefore, such techniques may make the analysis of the play more obvious and easier to critique from the coach and the players point of view. It should be noted that AR weapons training may enable the student/trainee to fight an opponent with precision attacks and playback review.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, remote coaching may require an external speaker and microphone to keep earphone and other equipment from inuring the trainees.

Further, one or more protective gears may be used for protection of the players. In one embodiment, lightweight hats may be offered for wearer protection. Further, the lightweight hats may be integrated with a communication module for enhanced data tracking and coaching. Further, other equipment such as headgear elbow pads, knee pads, and shoes with footbed sensors, headgears, shin guards, gloves, chest protectors, may be integrated with transmitting devices. In one embodiment, each participant may record an event or practice and playback in slow motion or freeze frames of moves or practice that needs to be studied and reviewed by a live or remote coach.

Further, a body position and a body position of the competitors may be important in analyzing each body move and how to counter the opponent attacks. Further, reference videos or students' past recordings may provide a progressive and graduated learning curve of reference to track what the player did each time to see how the player truly progresses.

In one embodiment, a trainee may be able to visualize and adjust body alignment and rehearse fluid body motion which minimizes injuries. Further, the trainee may be able to know how to practice correctly and minimizing any potential injury practicing on an opponent. Further, video recording during a training practice may be rendered in the real time to present video with maquette skeletal overlay. In one embodiment, the training and the recorded video practice may be rendered with individually selected ghost teammembers and potential offensive players on the field. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice.

Further, each one of the coaches and the fighters may replay and rehearse the motion moves and/or review other players or team videos to strategically coordinate and synchronize the plays. It should be noted that each practice event may allow each player and coach to rehearse and refine training and game strategy, using a playback system.

In one embodiment, each individual may get to tailor the logistics that is applied by engineered algorithm and training regimens. Further, any of the equipment and the body may be specially tuned for each player. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Ice Hockey

For the Ice Hockey, skaters may require training in one or more key skills to prepare physically and mentally before participating in any session. The one or more key skills may include, but not limited to, how to stride, stop and skate forward and backward, stick and puck control, blocking, and anticipation of puck position during a play, body scanning to determine muscle mass and individual body rotational flex points, mapping and understanding each skater individual optimal balance to enhance and increase performance potential in a game play. In one embodiment, a video demonstration may be used to learn the one or more key skills. Further, the skaters may require one or more muscle memories of a specific leg (i.e., calf, quad), or an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the skaters.

Further, the ice hockey may be simulated on a material such as Teflon/polycarbonate ice sheet. It should be noted that simulated ice sheet material may be slightly less slick than ice, which requires greater effort and higher precision. Further, the trainees may require higher concentration while performing on the simulated rink. Such training may give trainees a higher proficiency when the skaters are on ice. Further, off-ice training may be conducted on a 5'+ wide motorized Teflon treadmill or conveyor belt. The treadmill may be regulated with a speed control to modulate skating speed. Such usage of the conveyor belt may be very effective as the coach may observe trainees skating motion without having to skate alongside or backwards and may remain stationary while talking directly to the trainees. Additionally, the skaters may have less exposure to personal injuries on a treadmill. Further, the simulated ice may be equipped with video cameras and motion capture equipment to enable repeatable, highly accurate coaching in an analytically controlled and monitored space. Further, the trainees may increase the ice hockey skills by practicing on skating stride, acceleration, backward skating, advanced footwork, stick control, and puck control.

Further, one or more technologies may be needed to train the skaters off the ice and/or on the ice. The one or more technologies may include a sanctioned competition play vs training, granularity of motion and video may be captured using one or more rink cameras. In one embodiment, the one or more rink cameras may be at least 1. It should be noted that regulation rink dimensions may be 85'×200'. Further, a Helmet camera and Holoscan body motion tracker system may work in conjunction with a synchronized clock for all predetermined plays combined with simultaneous player motion capture and individual video. The individual video overlay may combine a three-dimensional (3D) motion capture files with an actual motion video. Further, the helmet may be integrated with an iris tracking system to analyze the focus and attention of each player as game play progresses. It should be noted that each event and all equipment may be synchronized to track action by timecodes that identify where each player is located on the ice, what was the physical state of readiness or anticipation the skaters were making for the shift after the play.

Such method may be effective for skaters as well as coaches. In one embodiment, the training may be truly individualized for a coach to see what the player does on the ice hockey rink. In another embodiment, a trainee/skater may slow down the action and check exactly what occurred during the practice or game.

Further, the helmet or cap may be integrated with a motion tracker and a position tracker to know a precise physical location of the trainees as they skate on the ice. Such integration may enable the coach and trainee to better perceive and see their body positions while navigating each turn and set up for the next turn or move based on timecode synchronized to a master clock. Further, the helmet may provide eye tracking feature to see what the player is looking at during an event. Such feature may help the coach and the player to train on what is important and how to look at a particular scenario as a trained participant. Further, a point of view Holocam may allow the coach and trainee to see just what the players was looking at on the course to help the players focus on training and at a specific and synchronized moment during the training. Further, a body scanner may allow the trainers to actually see what the skaters were doing at the instant the action was unfolding. Additionally, when an error occurs the body motion of the trainee/skater may be synchronized to the event in order to check when the trainee did or did not go or execute a play or move. Further, the helmet may track the rider's pupil to verify exactly what the rider is looking at and how often the rider looks at particular information, gauges, other riders, and surroundings.

Further, an object tracking may be used to follow the puck, tracked via transponders and video object recognition. Video object recognition may enable monitoring of a game play velocity, trajectory, passing targets, goals and errors. Further, one or more headgears may be connected to a mobile device (i.e., iPhone or Android device) to capture video from personally worn cameras displaying wearers POV, sensors track individual body motion to monitor arms, legs, upper torso, and/or feet. Further, footbed sensors may be used to indicate pressure on a ball, midfoot and heel. The footbed sensors may indicate correct body position to the skater and the coach regarding balance and body pressure exerted at every motion of the skater's reaction.

Further, a remote coaching may be feasible using video or live feed that may be directed to a secure online address. It should be noted that individuals on the rink may be tracked in conjunction with other monitored skaters. Further, an AR may provide a motion analytic view of the game to each skater, coach, and spectator. Further, a video with motion capture overlay may be displayed in conjunction with audio 2-way communication between the coach and the skater in the real time. Additionally, multiple skaters may be added to the communication console to enable team coaching i.e., 1 on 1.

Further, an AR may provide a motion analytic view of the game to each skater, coach, and spectator. The motion analytic view may display synchronized statistics and skater performance to track each play. Further, such techniques may automate a visual replay of physical body motion with video of the play. Therefore, such techniques may make the analysis of the play more obvious and easier to critique from the coach and the skater's point of view.

Further, the teammates and a selective individual (i.e., 1:1 or 1 to many) may be in metered and direct communication with each other during a practice and a competitive play. Such type of the group thinking may result in updating individual strategy and team strategy, and thereby increasing the performance and strategic potential of the individual and the team. Further, one or more protective gears may be used for protection of the skaters. In one embodiment, a lightweight helmet or headgear may be offered for wearer protection and communication integration for enhanced data tracking and coaching. Further, equipment such as, but not limited to, headgear elbow pads, knee pads, and shoes may be integrated with transmitting devices.

In one embodiment, the skaters may wear mocap suit for recoding kinematic profiles during each play. Such kinematic profiles may enable a coach to analyze the skater's offensive and defensive moves relative to each play to see how the skater reads and readies for an offensive/defensive maneuver based on a particular play. Further, the footbed sensors may track each skaters weight distribution throughout the play. Further, gloves with location sensors may be used to track stick position rotation and stroke power. In another embodiment, the timecode may be used to synchronize each play so that motion and weight distribution of each skater may be captured during the play for analytical review.

Further, one or more cameras may be placed at strategic (i.e., 10 yard) increments along a side of the rink in conjunction with body sensors, may provide each coach, trainer and skater with a highly accurate record of UHDPV synchronized volume of action video and motion images. Further, a large-scale volume rendering of motion/video may accurately render the interplay of all skaters anywhere on the ice resulting in an unparalleled view of how each skater and the play is executed. In an alternate embodiment, a new form of analytical training strategy may be studied and applied. The synchronized volume/motion video may be timecode synched with the foot sensors and the motion capture headgears which may render all visual and physical motion during a practice or tournament.

In one embodiment, the video recorded during a training practice may be rendered in the real time to present video with maquette skeletal overlay. Further, a ghost coach training session on the ice may enable skater to consider a new or specific move. Further, a master three-dimensional (3D) file and a view for each skater wearing AR headgears may broadcast and display the skater's field of view, during practice without exposing the skater to potential injuries. Further, each team member may focus on specific plays that may be practiced without actual skaters on the field. In one embodiment, the practice may be specific to the teams approved plays or to strategize new plays against an opponent that runs specific routines. Further, potential injuries that may be sustained on a practice field with inexperienced or error prone poorly rehearsed team members may be reduced as holographic teammates may repeat the practice. Further, each one of the coaches and the team members may replay and rehearse the motion moves and/or review other players or team videos to strategically coordinate and synchronize the plays. It should be noted that each practice event may allow each skater and coach to rehearse and refine training and game strategy, using a playback system.

In one embodiment, individual metrics may be tracked and catalogued for practices and tournament play. The individual metrics may include completed passes, errors, advanced opportunities and unsuccessful attempts, including a comprehensive physiological record of the players stamina, time on the field, acceleration, play performance metrics, impacts, successful penetration of an offensive play, or defensive success on an opposing play. Further, additional metrics such as retinal tracking and a specific direction of attention during the play may be used to help optimize strategic game play awareness. Further, when a player starts training or attempts to learn a new maneuver, then the player may know exactly what to concentrate and work on to progress more rapidly and with more certainty. Further, the individual metrics may be raised as each player/trainee has more certainty of exactly what the players did right and wrong so that the players may have greater confidence in the moves and what the players were doing wrong so that the players may quickly stop or change bad habits and begin to improve the training methodology to quickly advance the ability in the sport.

Figure Skating

In the Figure Skating, the skaters may require training in one or more key skills for one or more stages. In a first stage, the skaters may require the one or more key skills such as sit/stand on and off Ice, march in place, march forward 10 steps, march and glide, and/or dip. In a second stage, the skaters may require the one or more key skills such as arch and Glide, dip-moving, back walk 6 steps, back wiggles 6 in a row, forward swizzles 3 in a row, snowplow, and/or two-foot hop. In a third stage, the skaters may require the one or more key skills such as skating 10 strides, glide L and R, forward swizzles 6 in a row, backward swizzles 3 in a row, forward snowplow stop, two-foot hop, forward skating 10 strides, forward 1-foot glide, forward swizzle 6 in a row, backward swizzle 3 in a row, forward snow plow stop two feet, and/or curves. In a fourth stage, the skaters may require the one or more key skills such as Forward skating, backward two-foot glide, backward swizzles 6 in a row, rocking horse 1 forward-1 backward swizzle-twice, two-foot turns forward/backward in place, and/or two-foot hop.

In a first basic stage, the skater may require the one or more key skills such as sit and stand on ice, march forward, forward two-foot glide, dip, forward swizzles 8 in a row, backward swizzles 8 in a row, beginning snowplow, and/or two-foot hop. In a second basic stage, the skaters may require the one or more key skills such as scooter pushes left and right, forward one-foot glide left and right, backward two-foot glide, forward swizzle-1, backward swizzle, backward swizzle 6 in a row, two-foot turns from forward to backward in place clockwise and counterclockwise, moving snowplow stop, and/or curves. In a third basic stage, the skaters may require the one or more key skills such as forward stroking, forward half-swizzle pumps on a circle 8 consecutive clockwise and counterclockwise, moving forward to backward two-foot turns on a circle (i.e., clockwise and counterclockwise), beginning backward one-foot glides-with balance, backward snowplow stop right and left, forward slalom forward pivots clockwise and counterclockwise.

The one or more muscle memories may include a specific leg (i.e., calf, quad), an arm (i.e., flexor, biceps, core muscles), a frontal plane muscle groups targeted for increased strength and flexibility to benefit endurance, acceleration and direction transition, and decoding potential passes by monitoring eye targets and body positioning of the skaters. Further, ice figure skating may be simulated on a material such as Teflon/polycarbonate ice sheet. It should be noted that the material may be placed as interlocking squares or on a 3'+ wide motorized conveyor belt. The conveyor belt may be regulated with a speed control to modulate skating speed. Further, the simulated ice may be equipped with video cameras and motion capture equipment to enable highly accurate coaching in an analytically controlled and monitored space. Further, skating stride, acceleration, backward skating edge control, stick control, and puck control, may be used for training the skaters off the field.

Further, one or more technologies may be needed to train the skaters off the rink and/or on the rink. The one or more technologies may include a sanctioned competition play vs training, a granularity of motion and video may be captured using one or more rink cameras. In one embodiment, the one or more field cameras may be at least 1. It should be noted that regulation rink dimensions may be 85'×200'. Further, a Helmet camera and Holoscan body motion tracker system may work in conjunction with a synchronized clock for all predetermined plays combined with simultaneous player motion capture and individual video. The individual video overlay may combine a three-dimensional (3D) motion capture files with an actual motion video.

Further, the helmet or Cap may be integrated with a motion tracker and a position tracker to know a precise physical location of the trainees. Such integration may enable the coach and trainee to better perceive and see the position as the coach navigates each turn and set up for the next turn based on timecode synchronized to a master clock. Further, the helmet may provide eye tracking feature to see what the player is looking at during an event. Such feature may help the coach and the player to train on what is important and how to look at a particular scenario as a trained participant. Further, a point of view Holocam may allow the coach and trainee to see just what the players was looking at on the course to help the players focus on training and at a specific and synchronized moment during the training. Further, a body scanner may allow the trainers to actually see what the skaters were doing at the instant the action was unfolding. Additionally, when an error occurs the body motion of the trainee/skater may be synchronized to the event in order to check when the trainee did or did not go or execute a play or move. Further, the helmet may track the rider's pupil to verify exactly what the rider is looking at and how often the rider looks at particular information, gauges, other riders, and surroundings.

Further, an object tracking may be used to follow the puck, tracked via transponders and video object recognition. The video object recognition may enable monitoring of a game play velocity, trajectory, passing targets, goals and errors. Further, one or more headgears may be connected to a mobile device (i.e., iPhone or Android device) to capture video from personally worn cameras displaying wearers POV, sensors track individual body motion to monitor arms, legs, upper torso, and/or feet. Further, footbed sensors may be used to indicate pressure on ball, midfoot and heel. The footbed sensors may tell the skater and the coach regarding balance and body pressure exerted at every motion of the skaters.

Further, a remote coaching may be feasible using video or live feed that may be directed to a secure online address. It should be noted that individuals on the rink may be tracked in conjunction with other monitored skaters. Further, an AR may provide a motion analytic view of the game to each skater, coach, and spectator. Further, video with motion capture overlay may be displayed in conjunction with audio 2-way communication between the coach and the skater in the real time. Additionally, multiple skaters may be added to the communication console to enable team coaching i.e., 1 on 1.

Further, an AR may provide a motion analytic view of the game to each skater, coach, and spectator. The motion analytic view may display synchronized statistics and skater performance to track each play. Further, such techniques may automate a visual replay of physical body motion with video of the play. Therefore, such techniques may make the analysis of the play more obvious and easier to critique from the coach and the skater's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual. In one embodiment, a lightweight hat or headgear may be used for wearer protection. Further, an equipment may be light weight and intended to broadcast video POV and display AR images for ghost training. It should be noted that real-time local and remote coaching may be enhanced with video and audio communication.

In one embodiment, the skaters may wear mocap suit for recoding kinematic profiles during each play. Such kinematic profiles may enable a coach to analyze the skater's offensive and defensive moves relative to each consecutive move. Further, a footbed sensor may track each skaters weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any skater motion capture and weight distribution may be merged as the analytic may be composed and the routine may be processed for review.

Further, a placement of one or more cameras at strategic (i.e., 10 yard) increments along a side of the rink in conjunction with body sensors, may provide each coach, trainer and skater with a highly accurate record of UHDPV synchronized volume of action video and motion images. Further, a large-scale volume rendering of motion/video may accurately render the interplay of all skaters anywhere on the ice resulting in an unparalleled view of how each skater and the play is executed. In an alternate embodiment, a new form of analytical training strategy may be studied and applied. The synchronized volume/motion video may be timecode synched with the foot sensors and the motion capture headgears which may render all visual and physical motion during a practice or competition.

In one embodiment, a video recorded during a training practice may be rendered in the real time to present video with maquette skeletal overlay. Further, a ghost coach training session on the ice may enable skater to consider a new or specific move. Further, a master three-dimensional (3D) file and a view for each skater wearing AR headgears may broadcast and display the skater's field of view, during practice without exposing the wearer to potential injuries. Further, each team member may focus on specific plays that may be practiced without actual skaters on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice. Further, coaching for the figure skating may be a personal sport, however dancing and professional choreography for ice shows may enhance the practice and training elements of an Ice show.

Further, each one of the coaches and the team members may replay and rehearse the motion moves and/or review other players or team videos to strategically coordinate and synchronize the plays. It should be noted that each practice event may allow each skater and coach to rehearse and refine training and game strategy, using a playback system.

In one embodiment, individual metrics may be tracked and catalogued for practices and individual routine learning. The individual metrics may include completed attempts, successful attempts, unsuccessful attempts may be reviewed, including a comprehensive physiological record of the players stamina, time on the ice, acceleration, practice performance metrics, impacts, successful progress and recording of personal goals. Further, additional metrics such as retinal tracking and a specific direction of attention during the play may be used to optimize strategic game focus. Further, when a skater starts training or attempts to learn a new maneuver, then the skater may know exactly what to concentrate and work on to progress more rapidly and with more certainty. Further, the individual metrics may be raised as each skater/player/trainee has more certainty of exactly what the skaters did right and wrong so that the skaters may have greater confidence in the moves and what the skaters were doing wrong so that the skaters may quickly stop or change bad habits and begin to improve the training methodology to quickly advance the ability in the sport.

Snow Skiing

For snow skiing, the skiers may require training in one or more key skills to prepare physically and mentally before participating in any session. The one or more key skills may include, but not limited to, how to carve and turn, lateral acceleration, lateral projection, navigate gates, ruts and bumps, skating, pole plants, reading ahead to next turn and anticipation, body scanning to determine muscle mass and individual body rotational flex points, mapping and understanding each skater individual optimal balance to enhance and increase performance potential in a game play. Further, the skaters may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. It should be noted that training of the one or more muscle memories may create a total body unity i.e., all parts and limbs flow as one unit. In one embodiment, a video demonstration may be used to learn the one or more key skills. In one embodiment, potential passes may be decoded by monitoring eye targets and body positioning of the players.

Further, the snow skiing may be simulated on a material such as Teflon/polycarbonate ice sheet. It should be noted that the material may be rotated on 15'+ wide motorized conveyor belt. The conveyor belt may be regulated with a speed control to modulate skating speed. Further, the simulated snow may be equipped with video cameras and motion capture equipment to enable highly accurate coaching in an analytically controlled and monitored space. Further, skating stride, acceleration, edge changes, and gliding, may be practiced with reduced injury.

Further, one or more technologies may be needed to train the skiers off the slopes and/or on the slopes. The one or more technologies may include a sanctioned competition play vs training, a granularity of motion and video may be captured using one or more slope cameras. In one embodiment, the one or more slope cameras may be at least 1. In another embodiment, the one or more slope cameras may be more than 20. Further, a Helmet camera and Holoscan body motion tracker system may work in conjunction with a synchronized clock for all predetermined plays combined with simultaneous player motion capture and individual video. The individual video overlay may combine a three-dimensional (3D) motion capture files with an actual motion video.

Further, the helmet may be integrated with a motion tracker and a position tracker to know a precise physical location of the trainees. Such integration may enable the coach and trainee to better perceive and see the position as the coach navigates each turn and set up for the next turn based on timecode synchronized to a master clock. Further, the helmet may provide eye tracking feature to see what the skier is looking at during an event. Such feature may help the coach and the skier to train on what is important and how to look at a particular scenario as a trained participant. Further, a point of view Holocam may allow the coach and trainee to see just what the skier was looking at on the course to help the skier focus on training and at a specific and synchronized moment during the training. Further, a body scanner may allow the trainers to actually see what the skiers were doing at the instant the action was unfolding. Additionally, when an error occurs the body motion of the trainee/skier may be synchronized to the event in order to check when the trainee did or did not go or execute a run or routine. Further, the helmet may track the skier's pupil to verify exactly what the skier is focusing on and how often the skier looks at particular information, metrics, other skiers, and surroundings.

Further, an object tracking may be used to follow the skier's body, legs, and arms motion during a practice session and competition. Further, one or more headgears may be connected to a mobile device (e.g., iPhone or Android device) to capture video from personally worn cameras displaying wearers POV, sensors track individual body motion to monitor arms, legs, upper torso, and/or feet. Further, footbed sensors may be used to indicate pressure on ball, midfoot and heel. The footbed sensors may tell the skater and the coach regarding balance and body pressure exerted at every motion of the skaters.

Further, remote coaching may be feasible using video or live feed that may be directed to a secure online address. It should be noted that individuals on the rink may be tracked in conjunction with other monitored skaters. Further, AR may provide a motion analytic view of the game to each skater, coach, and spectator. Further, video with motion capture overlay may be displayed in conjunction with audio 2-way communication between the coach and the skater in the real time. Additionally, multiple skaters may be added to the communication console to enable team coaching i.e., 1 on 1.

Further, AR may provide a motion analytic view of the game to each skater, coach, and spectator. The motion analytic view may display synchronized statistics and skater performance to track each play. Further, such techniques may automate a visual replay of physical body motion with video of the play. Therefore, such techniques may make the analysis of the play more obvious and easier to critique from the coach and the skater's point of view.

Further, the teammates and a selective individual (i.e., 1:1 or 1 to many) may be in metered and direct communication with each other during practice and competitive play. Such group thinking may result in updating individual strategy and team strategy towards each compulsory move, and thereby increasing the performance and strategic potential of the individual. In one embodiment, lightweight headgear may be used for wearer protection. Further, equipment may be light weight and intended to broadcast video POV and display AR images for ghost training. It should be noted that real-time local and remote coaching may be enhanced with video and audio communication. In one embodiment, alpine, freestyle, and aerial skiing competition may be practiced and competed with the helmet.

In one embodiment, the skaters may wear a mocap suit for recoding kinematic profiles during each play. Such kinematic profiles may enable a coach to analyze the skater's offensive and defensive moves relative to each consecutive move. Further, a footbed sensor may track each skaters weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any skater motion capture and weight distribution may be merged as the analytic may be composed and the routine may be processed for review.

Further, a placement of one or more cameras at strategic (i.e., 10 yard) increments along a side of the rink in conjunction with body sensors, may provide each coach, trainer and skater with a highly accurate record of UHDPV synchronized volume of action video and motion images. Further, a large-scale volume rendering of motion/video may accurately render the interplay of all skaters anywhere on the ice resulting in an unparalleled view of how each skater and the play is executed. In an alternate embodiment, a new form of analytical training strategy may be studied and applied. The synchronized volume/motion video may be timecode synched with the foot sensors and the motion capture headgears which may render all visual and physical motion during a practice or competition.

In one embodiment, a video recorded during a training practice may be rendered in the real time to present video with maquette skeletal overlay. Further, a ghost coach training session on the ice may enable skater to consider a new or specific move. Further, a master three-dimensional (3D) file and a view for each skater wearing AR headgears may broadcast and display the skater's field of view, during practice without exposing the wearer to potential injuries. Further, each team member may focus on specific plays that may be practiced without actual skaters on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice routine.

Further, each one of the coaches and the team members may replay and rehearse the motion moves and/or review other players or team videos to strategically coordinate and synchronize the plays. It should be noted that each practice event may allow each skater and coach to rehearse and refine training and game strategy, using a playback system.

In one embodiment, individual metrics may be tracked and catalogued for practices and individual routine learning. The individual metrics may include completed attempts, successful attempts, unsuccessful attempts may be reviewed, including a comprehensive physiological record of the players stamina, time on the ice, acceleration, practice performance metrics, impacts, successful progress and recording of personal goals. Further, additional metrics such as retinal tracking and a specific direction of attention during the play may be used to optimize strategic game focus. Further, when a skater starts training or attempts to learn a new maneuver, then the skater may know exactly what to concentrate and work on to progress more rapidly and with more certainty. Further, the individual metrics may be raised as each skater/player/trainee has more certainty of exactly what the skaters did right and wrong so that the skaters may have greater confidence in the moves and what the skaters were doing wrong so that the skaters may quickly stop or change bad habits and begin to improve the training methodology to quickly advance the ability in the sport.

Golf

For golf, the players may require training in one or more key skills to prepare physically and mentally before participating in any session. The one or more key skills may include, but not limited to, how to place the ball, club selection, swing execution, how to read the line on the green, chipping, driving, and putting. Body scanning to determine muscle mass and individual body rotational flex points, and mapping and understanding each player's individual optimal balance can enhance and increase performance potential during game play. In one embodiment, a video demonstration may be used to learn the one or more key skills. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, the golf simulations may be provided in a Holosports practice room with dimensions of at least 20'×20'. The room may be equipped with walls with rear projection screens to display any golf course, fairway, or hole. Further, when a ball may be hit, then a trajectory of the ball may be simulated with a proper distance and landing in the rough or on the fairway or green.

Further, one or more technologies may be needed to train the players off the course. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video such as how a drive put, or play is completed during each shot. It should be noted that a ball trajectory may be tracked to display the flight path and landing for future training.

Further, golf simulation and augmented training of a player may be recorded how a player drive, putted, read, and play a ball's position during each shot. Further, a real ball is teed, driven or putted to a specific hole. In one embodiment, when driven the ball, the ball may hit down the fairway and/or towards a hole. Such trajectory of the ball may be mapped from origin and when the ball hits the back wall. Thereafter, the ball trajectory may be simulated to continue the flight toward the intended hole. For example, during a putt, the trajectory of the ball may break left or right depending on the greens slope and cut. It should be noted that each play may be repeated or play through the course to understand many aspects of the course.

Further, the helmet may be integrated with a motion tracker and a position tracker to know a precise physical location of the trainees. Such integration may enable the coach and trainee to better perceive and see the position as the coach navigates each turn and set up for the next turn based on timecode synchronized to a master clock. Further, the helmet may provide eye tracking feature to see what the player is looking at during an event. Such feature may help the coach and the player to train on what is important and how to look at a particular scenario as a trained participant. Further, a point of view Holocam may allow the coach and trainee to see just what the players was looking at on the course to help the players focus on training and at a specific and synchronized moment during the training. Further, a body scanner may allow the trainers to actually see what the players were doing at the instant the action was unfolding. Additionally, when an error occurs the body motion of the player may be synchronized to the event in order to check when the trainee did or did not go or execute a play or move.

Further, a golf club tracking and ball contact transmitters may assist the player to know exactly how and where to hit the ball. Further, an object tracking may be used to follow the player's body, legs and arms motion during a practice session and competition. Further, one or more headgears may be connected to a mobile device (i.e., iPhone or Android device) to capture video from personally worn cameras displaying wearers POV, sensors track individual body motion to monitor arms, legs, upper torso, and/or feet. Further, footbed sensors may be used to indicate pressure on ball, midfoot and heel. The footbed sensors may tell the player and the coach regarding balance and body pressure exerted at every motion of the players.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each golfer, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual. In one embodiment, the player's hats, clubs, and balls may have sensors or transmitters. Further, the foot sensor may give the player and the coach a complete and highly accurate rendition of the players transfer of weight from the front, mid and back distribution of the weight on left and right foot as well as the balance, the players exhibit as the players swing and putt.

In one embodiment, the players may wear mocap suit for recoding kinematic profiles during each play. Such kinematic profiles may enable a coach to analyze the golfer's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, one or more cameras may be placed at strategic (i.e., 10 yard) increments along a side of the tee, fairway, or green, in conjunction with body sensors. Such placement may provide each coach, trainer, and golfer with a highly accurate record of UHDPV synchronized volume of action video and motion images. Further, a large-scale volume rendering of motion/video may accurately render the interplay of all players anywhere on the ice resulting in an unparalleled view of how each player and the play is executed. In an alternate embodiment, a new form of analytical training strategy may be studied and applied. The synchronized volume/motion video may be timecode synched with the foot sensors and the motion capture headgears which may render all visual and physical motion during a practice or competition.

In one embodiment, a video recorded during a training practice may be rendered in the real time to present video with maquette skeletal overlay. Further, a ghost coach training session on the ice may enable golfer to consider a new or specific move. In one embodiment, the practice may be specific to the teams approved plays or to strategize new plays against an opponent that runs specific routines. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a golfer starts training or attempts to learn a new maneuver, then the golfer may know exactly what to concentrate and work on to progress more rapidly and with more certainty. Further, the individual metrics may be raised as each golfer has more certainty of exactly what the golfers did right and wrong so that the golfers may have greater confidence in the moves and what the golfers were doing wrong so that the golfers may quickly stop or change bad habits and begin to improve the training methodology to quickly advance the ability in the sport.

Baseball

For the baseball, the players may require training in one or more key skills to prepare physically and mentally before participating in any session. The one or more key skills may include, but not limited to, how to properly swing a bat, hit the ball in a particular direction, run the bases, bunt, hit a fly ball, hit a line drive, slide, base running strategy, run the bases, keep an eye on the ball to discern the rotation as the ball leaves the pitchers hand, body scanning to determine muscle mass and individual body rotational flex points, mapping and understanding each player individual optimal balance to enhance and increase performance potential in a game play. In one embodiment, a video demonstration may be used to learn the one or more key skills. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, the baseball simulations may be provided in a 20'×20' room equipped with walls with rear projection screens to display any field or stadium. It should be noted that when the player hits the ball, then the trajectory may be simulated with a proper distance and fielding.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. It should be noted that the trajectory of the ball may be tracked to display the flight path and landing for future training.

Further, the helmet may be integrated with a lightweight camera and body motion tracker that works in conjunction with a clock to synchronize all equipment for simultaneous player motion capture and individual video. Further, the golf training may include a projected player with accurate motion recording to display exactly how a player moves during each competition or event. Further, the baseball simulations may use a bat equipped with a gimballed gyroscope to simulate the impact of the ball when the bat is swung. Further, a slow-motion pitch may be presented to the batter to see the result of an off-speed pitch, curve ball, slider, knuckleball or fastball. Further, the slow-motion playback on the shield of the helmet may enable the batter to read and prepare for the pitch and dial in the batting techniques as the speed is increased.

Further, the helmet or Cap may be integrated with a motion tracker and a position tracker to know a precise physical location of the trainees. Such integration may enable the coach and trainee to better perceive and see the position as the coach navigate each turn and set up for the next turn based on timecode synchronized to a master clock. Further, the helmet may provide eye tracking feature to see what the player is looking at during an event. Such feature may help the coach and the player to train on what is important and how to look at a particular scenario as a trained participant. Further, a point of view Holocam may allow the coach and trainee to see just what the players was looking at on the course to help the players focus on training and at a specific and synchronized moment during the training. Further, a body scanner may allow the trainers to actually see what the players were doing at the instant the action was unfolding. Additionally, when an error occurs the body motion of the trainee may be synchronized to the event in order to check when the trainee did or did not go or execute a play or move.

Further, a baseball tracking and ball contact transmitters may assist the player to know exactly how and where to hit the ball. Further, an object tracking may be used to follow the player's body, legs and arms motion during a practice session and competition. Further, one or more headgears may be connected to a mobile device (i.e., iPhone or Android device) to capture video from personally worn cameras displaying wearers POV, sensors track individual body motion to monitor arms, legs, upper torso, and/or feet. Further, footbed sensors may be used to indicate pressure on ball, midfoot and heel. The footbed sensors may tell the player and the coach regarding balance and body pressure exerted at every motion of the players.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, the baseball players may wear protective helmets while batting. Further, the baseball players on the field may have standard uniforms. Further, tracking may be integrated in the bat and the ball. Further, footbed sensors may be used to detect reaction to a play, and the balance of any player as the players bat, field plays or run the bases.

In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, one or more cameras may be placed at strategic increments along a side of the field, in conjunction with body sensors. Such placement may provide each coach, trainer and player with a highly accurate record of UHDPV synchronized volume of action video and motion images. Further, a large-scale volume rendering of motion/video may accurately render the interplay of all players anywhere on the ice resulting in an unparalleled view of how each player and the play is executed. In an alternate embodiment, a new form of analytical training strategy may be studied and applied. The synchronized volume/motion video may be timecode synched with the foot sensors and the motion capture headgears which may render all visual and physical motion during a practice or competition.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the players may have greater confidence in the moves and what the players were doing wrong so that the players may quickly stop or change bad habits and begin to improve the training methodology to quickly advance the ability in the sport.

Single- and Multi-Player AR Gaming

For the single-player and multi-player AR gaming, the players may require training in one or more key skills to prepare physically and mentally before participating in any session. The one or more key skills may include, but not limited to, how to strategize for each session specifically at each players level, learn other players abilities and team strategies, game element memorization and review before entering the game, mapping and understanding each player individual optimal balance to enhance and increase performance potential in a game play. In one embodiment, review and testing to use each controller to the optimum setting for each game along with optional setups to make the remote more agile. Further, a body scanning may be performed to determine muscle mass and individual body rotational flex points. In one embodiment, a video demonstration may be used to learn the one or more key skills. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, the multi-player gaming may combine near-field three dimensional (3D) objects that are displayed in each player wearable glasses. Further, far field background images may be projected on each room walls depicting any selected location or environment. Further, one or many players perspective may be seen by each player in each location. Further, a doorway or corner may provide an ideal transition for each scene as each player advances through the maze. Further, the maze may be infinitely long as each player may advance through a complex series of turns and corridors that are designed to "loop back" to a virtual point of origin and may project different locations and scenarios from each "Set" location. It should be noted that the players may need to progress close together out of a particular "same set of location" otherwise the loop may introduce lagging or ahead players in a repeat scenario and the players may be inappropriately brought back into the game in a different location. Further, avatar escorts may be programmed to usher a lagging or advanced person to a nearby or proper location. Further, individuals may remain or progress at own pace learning each routine or solving each game issue. It should be noted that learning may be both physical movement as well as repeating a process move for each fundamental training routine, without departing from the scope of the disclosure.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the player/rider and all motion trajectory may be tracked to display the players path for training.

In one embodiment, the one or more technologies may be used on the field. The one or more technologies may include player consoles with high speed connections to a central game plex and maximum reduced delayed response time, and game specific tracking equipment such as surface, balls, bat, glove, stick, or specified weapons. It should be noted that each event and all equipment may be synchronized to track action by timecode that identifies where each player is located during the game, what was the physical state of readiness or anticipation the player was making for the shift after each play. Further, equipment for each game may be optimized for response time and may provide a training regime for each tool or piece of equipment.

Further, the helmet may provide eye tracking feature to see what the player is looking at during an event. Such feature may help the coach and the player to train on what is important and how to look at a particular scenario as a trained participant. Further, a point of view Holocam may allow the coach and trainee to see just what the players was looking at on the course to help the players focus on training and at a specific and synchronized moment during the training. Further, a body scanner may allow the trainers to actually see what the players were doing at the instant the action was unfolding. Additionally, when an error occurs the body motion of the trainee may be synchronized to the event in order to check when the trainee did or did not go or execute a play or move.

Further, equipment tracking and contact transmitters may assist the player to know exactly how and where to hit the ball. Further, an object tracking may be used to follow the player's body, legs and arms motion during a practice session and competition. Further, one or more headgears may be connected to a mobile device (i.e., iPhone or Android device) to capture video from personally worn cameras displaying wearers POV, sensors track individual body motion to monitor arms, legs, upper torso, and/or feet. Further, footbed sensors may be used to indicate pressure on ball, midfoot and heel. The footbed sensors may tell the player and the coach regarding balance and body pressure exerted at every motion of the players.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

In one embodiment, the tracking of the body and the limbs, may be performed in AR games. In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, midfoot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the players may have greater confidence in the moves and what the players were doing wrong so that the players may quickly stop or change bad habits and begin to improve the training methodology to quickly advance the ability in the sport.

Swimming

For the swimming, the players may require training in one or more key skills to prepare physically and mentally before participating in any session. The one or more key skills may include, but not limited to, different strokes, an optimal hydrodynamic strategy, flip turns, diving and underwater propulsion, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, Holoswim lap tank may create a beautiful and immersive video swimming exercise environment. It should be noted that the player may choose music, images, and duration of each learning module. Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the player/rider and all motion trajectory may be tracked to display the players path for training.

Further, the swimming training may include a projected player with accurate motion recording to display exactly how a player moves during each competition or event. Further, the swimming headgear may enable a system to track body motion and to provide a remote method to capture how and when the trainee moves in a given situation. Further, the swimming headgear may record a POV video. Further, the swimming headgear may include retinal tracking feature to compare the field of view to what is being watched and a communication system to link the student to the coach. It should be noted that any personal telemetry may be relayed through the headgear, without departing from the scope of the disclosure.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each swimmer, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

In one embodiment, the tracking may be integrated via underwater cameras and motion body sensors. In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, midfoot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, a new skill set may be demonstrated before the riders put themselves at risk or providing immediate feedback (i.e., an instant replay) for immediate adjustments. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

Gymnastics

For the Gymnastics, the players may require training in one or more key skills to prepare physically and mentally before participating in any session. The one or more key skills may include, but not limited to, balance and optimized moves with least effort, specify and display each routine move, scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, gymnastic events, routines, and/or individual tricks may be recorded in a 20×20' room for beginning, intermediate, and advanced training sessions. Further, headgears may record and display in regular or slow motion any practice routine to enable the trainee to see, understand, and learn each move that others perform during the session. Further, body tracking may display each recorded move to allow the coach or student to analyze the efforts.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the player/rider and all motion trajectory may be tracked to display the players path for training.

The one or more technologies may be used to allow trainees to familiarize themselves with the fundamentals of any new move or routine. Further, gymnasts may overcome a difficulty of executing a practice maneuver for the first time or to rehearse how to do the gymnastics better. Further, in gymnastics, bare feet and training slippers, may be required to accommodate balance. In one embodiment, recorded motion capture or video to follow body motion with a superimposed layered grid overlay to see precisely what the move was and to determine whether the body motion is correct or incorrect. It should be noted that each move may be shown with a tracking line to see exactly the trajectory of the body on the apparatus or tracked in floor exercise.

During practice session of gymnastics, a lightweight headgear or integrated camera may be worn to see the gymnast's POV. Additionally, body motion stationary cameras may be used for tracking. Further, the player's point of view camera may provide synchronized body motion for coaching the gymnasts.

In one embodiment, body motion, feet, hands, and limbs may be critical to monitor the event and the action. Further, the trajectory of the limbs may be tracked for accuracy of any move. Further, footbed sensors may be used to indicate pressure on ball, midfoot and heel. Further, the footbed sensors may tell the wearer and coach regarding balance and body pressure exerted at every motion. Further, gloves may be equipped with sensors that may be used to sense weighting and unweighting on an apparatus (i.e., gymnast's apparatus).

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR training may enable the gymnast player to practice with a better understanding of the precision and transitions for each move to study during a playback review. Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, light headgears and any camera tracking equipment may be installed around and near any apparatus. Further, the footbed sensors may assist in balance and pressure orientation and training. In one embodiment, the players may wear mocap suit for recoding kinematic profiles during each play. Such kinematic profiles may enable the coach and the trainee to rapidly identify exactly where the body position was during any part of the routine.

Further, analysis of the track may give the coach and trainee, a reference and clear identification that a move was or was not executed correctly. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. Further, a master three-dimensional (3D) file and a view for each player wearing AR headgears may broadcast and display the player's field of view, during practice without exposing the wearer to potential injuries. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice routine.

Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. Further, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the players may have greater confidence in the moves and what the players were doing wrong so that the players may quickly stop or change bad habits and begin to improve the training methodology to quickly advance the ability in the sport.

Hunting

For Hunting, the players may require training in one or more key skills to prepare physically and mentally before participating in any session. The one or more key skills may include, but not limited to, how to differentiate a dominate eye, how to aim, lead and squeeze the trigger, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, a 20'×20' target practice room with a front, side and rear screen projection may be used to practice and train how to lead and shoot more accurately and with higher precision. Further, the hunting game may combine near-field three dimensional (3D) objects that are displayed in each player wearable glasses. Further, far field background images may be projected on each room walls depicting any selected location or environment. Further, one or many players perspective may be seen by each player in each location. Further, a doorway or corner may provide an ideal transition for each scene as each player advances through the maze. Further, the maze may be infinitely long as each player may advance through a complex series of turns and corridors that are designed to "loop back" to a virtual point of origin and may project different locations and scenarios from each "Set" location. It should be noted that the players may need to progress close together out of a particular "same set of location" otherwise the loop may introduce lagging or ahead players in a repeat scenario and the players may be inappropriately brought back into the game in a different location. Further, avatar escorts may be programmed to usher a lagging or advanced person to a nearby or proper location. Further, individuals may remain or progress at own pace learning each routine or solving each game issue. It should be noted that learning may be both physical movement as well as repeating a process move for each fundamental training routine, without departing from the scope of the disclosure.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the player/rider and all motion trajectory may be tracked to display the players path for training.

Further, a Helmet camera and Holoscan body motion tracker system may work in conjunction with a synchronized clock for recording all individual and team plays combined with simultaneous player motion capture and individual video. Further, the hunting training may include a projected player with accurate motion recording to display exactly how a player moves during each competition or event. It should be noted that the hunting technology may be designed to familiarize each trainee with loading, aiming and firing the weapon safely and with greater accuracy.

Further, the hunting headgears may enable a system to track body motion and to provide a remote method to capture how and when the trainee moves in a given situation. Further, the headgears may record the POV video. Further, the headgears may include retinal tracking feature to compare the field of view to what is being watched and a communication system to link the trainee to the coach. It should be noted that any personal telemetry may be relayed through the headgears, without departing from the scope of the disclosure.

In one embodiment, the equipment may include rifle, pistol, bow and target, for tracking. Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, the hunters may wear hats, glasses, gloves in cold weather, and ear plugs for the protection. It should be noted that light-weight headgears may be integrated with communication module. In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, practice session of each player may be recorded to enable the coach and trainee to easily see and identify any changes that may help the player to learn the sports systematically. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

Bowling

For bowling, the players may require training in one or more key skills to prepare physically and mentally before participating in any session. The one or more key skills may include, but not limited to, where to stand in a lane, how to hold a ball, how to select the ball, what are the techniques to pick off pins, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, a 20'×20' target bowling room with a front, side and rear screen projection that may be used to practice and train how to lead and shoot more accurately and with higher precision. It should be noted that virtual bowling pins may be replaced for children with animated objects to make the room more fun and energizing for parties and events.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the bowler's body motion and ball trajectory may be tracked to display the routine moves for training.

Further, the bowling training may include a projected player with accurate motion recording to display exactly how a player moves during each competition or event. Further, the bowling technology may assist a new or accomplished bowler by enabling the bowler to see exactly how the bowler approaches the line and what the bowler does during the approach and release of the bowling ball.

Further, the headgears may record a POV video. Further, the headgears may include a retinal tracking feature to compare the field of view to what is being watched and a communication module to link the trainee to the coach. It should be noted that any personal telemetry may be relayed through the headgears, without departing from the scope of the disclosure. Further, the equipment such as ball and pins may be tracked in the bowling practice session.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, one or more protective gears may include a hat that is integrated with a wrist tracker. Further, footbed sensors may identify the pressure and balance when bowling. In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, practice session of each player may be recorded to enable the coach and trainee to easily see and identify any changes that may help the player to learn the sports systematically. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice.

Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

Skateboarding

For skateboarding, the players may require training in one or more key skills to prepare physically and mentally before participating in any session. The one or more key skills may include, but not limited to, balancing on a board pressing on the board at various speeds and angular momentum, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, a 20'×20' skate practice room with a front, side, and rear screen projection that may be used to practice and train how to begin skateboarding or observe and practice tricks with a real time video or live/online coaching.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, boarder's body motion and trajectory may be tracked to display the routine moves for training. Further, the skateboarding training may include a projected player with accurate motion recording to display exactly how a player moves during each competition or event.

Further, the headgears may record a POV video. Further, the headgears may include a retinal tracking feature to compare the field of view to what is being watched and a communication module to link the trainee to the coach. It should be noted that any personal telemetry may be relayed through the headgears, without departing from the scope of the disclosure. Further, the equipment such as skateboard and training objects, may be tracked.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, an equipment such as a lightweight hat or headgear may be used as protective gears. Such equipment may be light weight and intended to broadcast video POV, and display AR images for ghost training. It should be noted that each equipment or board may be affixed with a Bluetooth or transmitting device that senses location, speed, wheel pressure, and board rotation. In one embodiment, the boarder may wear a footbed sensor to track the pressure applied to the foot.

In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any skater motion capture and weight distribution may be merged as the analytic may be composed and the routine may be processed for review.

Further, practice session of each player may be recorded to enable the coach and trainee to easily see and identify any changes that may help the player to learn the sports systematically. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each team member may focus on specific plays that may be practiced without actual skaters on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice.

Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

Surfing

For surfing, the players may require training in one or more key skills to prepare physically and mentally before participating in any session. The one or more key skills may include, but not limited to, balancing on a board pressing on the water at various speeds and angular momentum, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, a 20'×40' surf practice room may use a high-volume pump that is capable of generating a wave up to 6 feet tall. It should be noted that locations may be projected to display well-known surf sites, without departing from the scope of the disclosure.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the surfer's body motion and trajectory may be tracked to display the routine moves for training. Further, the surfing training may include a projected player with accurate motion recording to display exactly how a player moves during each competition or event. Further, the surfing may be simulated in a motion wave tank that simulates the wave and enables the surfer to ride an endless breaking wave to practice the tricks or routines in a controlled environment.

Further, the headgears may record a POV video. Further, the headgears may include a retinal tracking feature to compare the field of view to what is being watched and a communication module to link the trainee to the coach. It should be noted that any personal telemetry may be relayed through the headgears, without departing from the scope of the disclosure. Further, the equipment such as surfer sensor pads and foot position trackers, may be used.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, an equipment such as a lightweight waterproof cap/helmet integrated with a body tracker may be used as protective gears. Further, a deck pad may be used to sense foot placement and weight distribution.

In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, practice session of each player may be recorded to enable the coach and trainee to easily see and identify any changes that may help the player to learn the sports systematically. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice.

Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

Wake Surfing

For wake surfing, the players may require training in one or more key skills to prepare physically and mentally before participating in any session. The one or more key skills may include, but not limited to, balancing on a board pressing on the water at various speeds and angular momentum, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, a pump generated wave may be run to simulate a wave up to 6 feet tall. It should be noted that locations may be projected to display well-known lake or tropical locations, without departing from the scope of the disclosure.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the surfer's body motion and trajectory may be tracked to display the routine moves for training. Further, the wake surfing training may include a projected player with accurate motion recording to display exactly how a player moves during each competition or event. Further, the wake surfing may be simulated in a motion wave tank that simulates the wave and enables the surfer to ride an endless breaking wave to practice the tricks or routines in a controlled environment.

Further, the headgears may record a POV video. Further, the headgears may include a retinal tracking feature to compare the field of view to what is being watched and a communication module to link the trainee to the coach. It should be noted that any personal telemetry may be relayed through the headgears, without departing from the scope of the disclosure. Further, the equipment such as wake surfboard and foot position trackers, may be used.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, an equipment such as a lightweight waterproof cap/helmet integrated with a body tracker may be used as protective gears. Further, a deck pad may be used to sense foot placement and weight distribution.

In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, practice session of each player may be recorded to enable the coach and trainee to easily see and identify any changes that may help the player to learn the sports systematically. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice.

Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

Tactical Simulations

For tactical simulations, the players may require training in one or more key skills to prepare physically and mentally before participating in any session. The one or more key skills may include, but not limited to, familiarization and knowing the environment, equipment that requires skill building (i.e., muscle memory) to understand and assess and prioritize each element available or condition that presents itself, an array of situational awareness updates that may keep each player sharp and safe, all available key environmental and tactical elements are presented for each participant to organize and scan in preparation for an encounter, prioritization of all elements that may be practiced to reduce preparation time, along with each tactical requirement, body scanning, mapping and understanding each player individual optimal balance to enhance and increase performance potential in a game play. Further, the players may require one or more muscle memories of a head, shoulders, hips, specific leg (i.e., calf, quad), and an arm (i.e., flexor, biceps, core muscles), to build. The one or more muscle memories may be used for increasing strength and flexibility to benefit endurance, acceleration and direction transition. In one embodiment, potential passes may be decoded by monitoring eye targets and body positioning of the players.

Further, the tactical multiplayer gaming may combine near-field three dimensional (3D) objects that are displayed in each player wearable glasses. Further, far field background images may be projected on each room walls depicting any selected location or environment. Further, one or many players perspective may be seen by each player in each location. Further, a doorway or corner may provide an ideal transition for each scene as each player advances through the maze. Further, the maze may be infinitely long as each player may advance through a complex series of turns and corridors that are designed to "loop back" to a virtual point of origin and may project different locations and scenarios from each "Set" location. It should be noted that the players may need to progress close together out of a particular "same set of location" otherwise the loop may introduce lagging or ahead players in a repeat scenario and the players may be inappropriately brought back into the game in a different location. Further, avatar escorts may be programmed to usher a lagging or advanced person to a nearby or proper location. Further, individuals may remain or progress at own pace learning each routine or solving each game issue. It should be noted that learning may be both physical movement as well as repeating a process move for each fundamental training routine, without departing from the scope of the disclosure.

Further, each event and all equipment may be synchronized to track action by timecode that identifies where each warfighter is located on the map, what was the physical state of readiness or anticipation the warfighter was making for the shift after the event. Further, the warfighters attention may be tracked to maintain tactical readiness and situational awareness to remain vital, to know what each warfighter is looking at and what the warfighters recognize. Such recognition may be critical in discovering what is easy and difficult to discover or decode during specific tactical simulations. It should be noted that a number of false ID's vs discoveries that lead to a win may be a critical algorithm.

Further, one or more technologies may be needed to train the players off the field. The one or more technologies may include multiple cameras for recording a granularity of motion and video. In one embodiment, the cameras may be at least 1. In another embodiment, the cameras may be more than 20. Further, a Helmet camera and Holoscan body motion tracker system may work in conjunction with a synchronized clock for recording all individual and team plays combined with simultaneous player motion capture and individual video. The individual video overlay may combine a three-dimensional (3D) motion capture files with an actual motion video. Further, the tactical simulation training may include a projected player with accurate motion recording to display exactly how a player moves during each competition or event. Further, the tactical simulations may be rehearsed in training rooms equipped with video projection on one or more walls. It should be noted that the video may be synchronized with AR images to create separately controlled multiple layers of interactive players and situational elements to confront and navigate around.

Further, the headgears may record a POV video. Further, the headgears may include a retinal tracking feature to compare the field of view to what is being watched and a communication module to link the trainee to the coach. It should be noted that any personal telemetry may be relayed through the headgears, without departing from the scope of the disclosure. Further, one or more weapons and equipment involved in the tactical simulation may be tracked.

Further, a remote coaching may be feasible using video or live feed that may be directed to a secure online address. It should be noted that individuals on the field may be tracked in conjunction with other monitored players. Further, an AR may provide a motion analytic view of the game to each player, coach, and spectator. Further, video with motion capture overlay may be displayed in conjunction with audio 2-way communication between the coach and the player in the real time. Additionally, multiple players may be added to the communication console to enable team coaching i.e., 1 on 1.

Further, an AR may provide a motion analytic view of the game to each player, coach, and spectator. The motion analytic view may display synchronized statistics and player performance to track each play. Further, such techniques may automate a visual replay of physical body motion with video of the play. Therefore, such techniques may make the analysis of the play more obvious and easier to critique from the coach and the player's point of view.

Further, the teammates and a selective individual (i.e., 1:1 or 1 to many) may be in metered and direct communication with each other during practice and competitive play. Such type of the group thinking may result in updating individual strategy and team strategy towards each compulsory move, and thereby increasing the performance and strategic potential of the individual.

Further, the tactical simulations may employ full body armor and helmets so that all equipment may be tracked. In one embodiment, the players may wear mocap suit for recoding kinematic profiles during each play. Such kinematic profiles may enable a coach to analyze the player's isolated moves relative to each consecutive move. Further, a footbed sensor may track each players weight distribution (i.e., ball, mid-foot, heel) throughout the entire play or practice session. Further, conventional video recording for training may require the coach to remember or isolate each specific move and attempt to recall the entire routine. The video may show the timecode which may synchronize each move so that any player motion capture and weight distribution may be merged as the analytic may be composed and the routine may be processed for review.

Further, practice session of each player may be recorded to enable the coach and trainee to easily see and identify any changes that may help the player to learn the sports systematically. Further, reference video or students' past recordings may provide a progressive and graduated learning curve of the reference to track what the player did each time to see how the player truly progresses.

In one embodiment, a video recorded during a training practice may be rendered in the real time to present video with maquette skeletal overlay. Further, a ghost coach training session on the ice may enable player to consider a new or specific move. In one embodiment, the practice may be specific to the teams approved plays or to strategize new plays against an opponent that runs specific routines. Further, each team member may focus on specific plays that may be practiced without actual players on the field. In one embodiment, the practice may be specific to the teams approved plays or to strategize new plays against an opponent that runs specific routines. Further, the potential injuries that may be sustained on a practice field with inexperienced or error prone poorly rehearsed team members may be reduced as holographic teammates may repeat the practice.

Further, each one of the coaches and the team members may replay and rehearse the motion moves and/or review other players or team videos to strategically coordinate and synchronize the plays. It should be noted that each practice event may allow each player and coach to rehearse and refine training and game strategy, using a playback system.

In one embodiment, individual metrics may be tracked and catalogued for practices and individual routine learning. In one embodiment, when a player starts training or attempts to learn a new maneuver, then the player may know exactly what to concentrate and work on to progress more rapidly and with more certainty. Further, the individual metrics may be raised as each player has more certainty of exactly what the players did right and wrong so that the player may have greater confidence in the moves and what the players were doing wrong so that the players may quickly stop or change bad habits and begin to improve the training methodology to quickly advance the ability in the sport.

It will be apparent to one skilled in the art that the above-mentioned sports have been provided only for illustration purposes. In some embodiments, other sports may be used as well without departing from the scope of the disclosure.

It should be noted that the above-mentioned methodology may be employed in social media by using machine learning to automatically tag the sport. Further, the system may include normal holograms (e.g., free space, volumetric imaging, ionizing air, or lasers on a 3D substrate), air ionization using lasers, laser projection on fog, medium-based holography, Pepper's ghost and full-sized "holography" in which the user may see the image with a mirror (e.g., the Tupac hologram), non-3D head-tracking perspective, any future holography techniques, and/or projection on film or a translucent window.

The disclosed methods and systems, as illustrated in the foregoing description or any of its components, may be embodied in the form of a computer system. Typical examples of a computer system include a general-purpose computer, a programmed microprocessor, a microcontroller, a peripheral integrated circuit element, and other devices, or arrangements of devices that are capable of implementing the steps that constitute the method of the disclosure.

The computer system may comprise a computer, an input device, a display unit, and the internet. The computer may further comprise a microprocessor. The microprocessor may be connected to a communication bus. The computer may also include a memory. The memory may be random-access memory or read-only memory. The computer system may further comprise a storage device, which may be a hard disk drive or a removable storage device such as a floppy disk drive, an optical disk drive, an SD card, flash storage, or the like. The storage device may also be a means for loading computer programs or other instructions into the computer system. The computer system may also include a communication unit. The communication unit may allow the computer to connect to other computer systems and the Internet through an input/output (I/O) interface, allowing the transfer and reception of data to and from other systems. The communication unit may include a modem, an Ethernet card, or similar devices that enable the computer system to connect to networks such as LANs, MANs, WANs, and the Internet. The computer system facilitates input from a user through input devices accessible to the system through the I/O interface.

To process input data, the computer system may execute a set of instructions stored in one or more storage elements. The storage element(s) may also hold other data or information, as desired. Each storage element may be in the form of an information source or a physical memory element present in or connected to the processing machine.

The programmable or computer-readable instructions may include various commands that instruct the processing machine to perform specific tasks, such as steps that constitute the method of the disclosure. The systems and methods described can also be implemented using software alone, hardware alone, or a varying combination of the two. The disclosure is independent of the programming language and the operating system used by the computers. The instructions for the disclosure may be written in any programming language, including, but not limited to, assembly language or machine instructions, C, C++, Objective-C, Java, Swift, Python, and JavaScript. Further, software may be in the form of a collection of separate programs, a program module containing a larger program, or a portion of a program module, as discussed in the foregoing description. The software may also include modular programming in the form of object-oriented programming. The processing of input data by the processing machine may be in response to user commands, the results of previous processing, or a request made by another processing machine. The methods and systems of the disclosure may also be implemented using various operating systems and platforms, including, but not limited to, Unix, Linux, BSD, DOS, Windows, Android, iOS, Symbian, a real-time operating system, and a purpose-built operating system. The methods and systems of the disclosure may be implemented using no operating system as well. The programmable instructions may be stored and transmitted on a computer-readable medium. The disclosure may also be embodied in a computer program product comprising a computer-readable medium with any product capable of implementing the above methods and systems or the numerous possible variations thereof.

Various embodiments of the methods and systems for training people using spacial computing and mixed-reality technologies have been disclosed. However, it should be apparent to those skilled in the art that modifications in addition to those described are possible without departing from the inventive concepts herein. The embodiments, therefore, are not restrictive, except in the spirit of the disclosure. Moreover, in interpreting the disclosure, all terms should be understood in the broadest possible manner consistent with the context. In particular, the terms "comprises," "comprising," "including," and "id est" should be interpreted as referring to elements, components, or steps in a non-exclusive manner, indicating that the referenced elements, components, or steps may be present, used, or combined with other elements, components, or steps that are not expressly referenced.

A person with ordinary skill in the art will appreciate that the systems, modules, and submodules have been illustrated and explained to serve as examples and should not be considered limiting in any manner. It will be further appreciated that the variants of the above disclosed system elements, modules, and other features and functions, or alternatives thereof, may be combined to create other, different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules, and are not limited to any particular computer hardware, firmware, software, middleware, microcode, instruction set, or the like.

What is claimed is:

1. A helmet apparatus, comprising:

a forward facing imaging element of a camera, including:

a first lens fitted within a surface of an outer shell of the helmet apparatus such that the first lens does not extend beyond the surface of the outer shell of the helmet apparatus, is positioned above a face shield of the helmet apparatus, and provides a high field of view corresponding to a field of view of the driver wearing the helmet apparatus;

a sensor, fitted within the helmet apparatus, wherein the sensor is coupled to the first lens and operable to convert an optical image from the first lens into an electrical signal and provide the electrical signal to a component that is remote from the helmet apparatus, and wherein the component that is remote from the helmet apparatus includes other components or circuitry of the camera;

a second lens fitted within a lower surface of the outer shell of the helmet apparatus below the face shield of the helmet apparatus that provides a low field of view corresponding to the field of view of the driver wearing the helmet apparatus, wherein the field of view of the driver, regardless of a direction in which the driver is looking, will correspond with at least a portion of the high field of view or the low field of view; and a connection point communicatively coupled to the sensor of the forward facing imaging element, wherein the connection point at least:

enables a separable wired connection between the helmet apparatus and an in-vehicle computing device;

receives power from the separable wired connection when connected;

provides power to the forward facing imaging element when power is received from the separable wired connection when connected; and provides, when connected, the electrical signal from the sensor to the component that is remote from the helmet apparatus.

2. The helmet apparatus of claim 1, further comprising:

a microphone communicatively coupled to the connection point;

a transducer communicatively coupled to the connection point; and wherein the connection point at least:

receives first audio data from the microphone and provides the first audio data to the separable wired connection when connected; and receives second audio data from the separable wired connection when connected and provides the second audio data to the transducer for output by the transducer.

3. The helmet apparatus of claim 1, further comprising:

a heads-up projector communicatively coupled to the connection point and positioned to project visual data received from the connection point into a field of view of a driver; and wherein the connection point at least:

receives visual data from the separable wired connection when connected to the separable wired connection; and provides the visual data to the heads-up projector for presentation by the heads-up projector.

4. The helmet apparatus of claim 1, further comprising:

one or more gaze tracking cameras communicatively coupled to the connection point, positioned in the helmet apparatus, and oriented toward one or more eyes of a driver.

5. The helmet apparatus of claim 1, wherein:

the outer shell of the helmet apparatus is retrofitted to include a ferrule that includes one or more ridges that allow the first lens to be inserted into the ferrule but not removed from the ferrule; and the first lens is positioned within the ferrule.

6. A method to fabricate or retrofit a racing helmet, comprising:

inserting, into a shell of the racing helmet, a first lens and a sensor of a camera, wherein:

the first lens and the sensor are operable to convert an optical image into an electrical signal;

the first lens, when inserted into the shell does not extend beyond an outer surface of the shell, is positioned above a face shield of the racing helmet, and provides a high field of view corresponding to a field of view of a driver when the driver is wearing the racing helmet;

the sensor is fitted within the racing helmet, is coupled to the first lens, and provides the electrical signal to a component that is remote from the racing helmet, wherein the component that is remote from the racing helmet includes other components or circuitry of the camera;

including, on a surface of the shell, a connection point;

inserting, into the shell of the racing helmet, a second lens, wherein the second lens, when inserted into the shell does not extend beyond the outer surface of the shell, is positioned below the face shield of the racing helmet, and provides a low field of view corresponding to the field of view of a driver when the driver is wearing the racing helmet, wherein the field of view of the driver, regardless of a direction in which the driver is looking, will correspond with at least a portion of the high field of view or the low field of view; and extending, along the surface of the shell, at least one wire between the sensor and the connection point such that the electrical signal may be transmitted across the wire from the sensor to the connection point and to the component that is remote from the racing helmet.

7. The method of claim 6, further comprising:

inserting, into a rim of a face opening of the racing helmet, a third lens, such that the third lens is oriented in a direction of a pupil of an eye of the driver wearing the racing helmet.

8. The method of claim 6, further comprising:

inserting a third lens into the shell of the racing helmet such that the third lens is oriented in a downward direction toward a body of a driver wearing the racing helmet.

9. The method of claim 6, further comprising:

inserting, into the shell of the racing helmet, an output device, wherein the output device is operable to present visual information into a field of view of a driver when wearing the racing helmet.

10. The method of claim 6, wherein inserting, into the shell of the racing helmet, the second lens and the sensor further includes:

inserting the second lens into a vent included on the racing helmet.

11. The method of claim 6, wherein the connection point enables a separable wired connection between the racing helmet and an in-vehicle computing device.

12. The method of claim 6, further comprising:

receiving, at the connection point and from a source that is external to the racing helmet, power; and providing the power to the first lens and the sensor.

13. A system, comprising:

at least one imaging element of a camera included in a shell of a helmet, the imaging element operable to generate first image data and including:

a first lens fitted within a surface of an outer shell of the helmet such that the lens does not extend beyond the surface of the outer shell of the helmet, is positioned above a face shield of the helmet, and provides a high field of view corresponding to a field of view of a driver wearing the helmet;

a sensor, fitted within the helmet, wherein the sensor is coupled to the lens and operable to convert an optical image from the lens into an electrical signal and provide the electrical signal to a component that is remote from the helmet, wherein the component that is remote from the helmet includes other components or circuitry of the camera;

a second lens fitted within a lower surface of the outer shell of the helmet below the face shield of the helmet that provides a low field of view corresponding to the field of view of the driver wearing the helmet apparatus, wherein the field of view of the driver, regardless of a direction in which the driver is looking, will correspond with at least a portion of the high field of view or the low field of view;

a connection point included in the shell of the helmet and communicatively coupled to the sensor of the at least one imaging element, wherein the connection point:

enables a separable connection between the helmet and an in-vehicle computing device;

provides power to the at least one imaging element; and provides, when connected, the first image data received from the at least one imaging element to the in-vehicle computing device; and program instructions maintained on a memory of the in-vehicle computing device, the program instructions, when executed by one or more processors of the in-vehicle computing device causing the in-vehicle computing device to at least:

receive the first image data; and transmit the first image data from the in-vehicle computing device to a remote computing device that is separate from a vehicle in which the in-vehicle computing device is located.

14. The system of claim 13, wherein the program instructions, when executed by the one or more processors of the in-vehicle computing device, further causing the one or more processors to at least:

cause the in-vehicle computing device to provide power to the connection point.

15. The system of claim 13, wherein the separable connection between the connection point of the helmet is a wired connection that may be separated upon application of a force.

16. The system of claim 13, further comprising:

at least one output device included in the shell of the helmet, wherein:

the output device is communicatively coupled to the connection point; and the output device is operable to present visual data received from the connection point into a field of view of a driver while the driver is wearing the helmet.

17. The system of claim 16, wherein the program instructions, when executed by the one or more processors of the in-vehicle computing device, further causing the one or more processors to at least:

receive at least one of driver data, vehicle data, or event data; and provide to the connection point and for visual presentation by the output device, the received at least one of the driver data, the vehicle data, or the event data.

18. The helmet apparatus of claim 1, further comprising:

a third lens included in the helmet apparatus and oriented toward a body of a driver wearing the helmet apparatus.

19. The system of claim 13, wherein the program instructions maintained on the memory of the in-vehicle computing device, when executed by the one or more processors of the in-vehicle computing device, further cause the one or more processors of the in-vehicle computing device to at least:

obtain a driver eye profile for a driver wearing the helmet;

monitor, based at least in part on the driver eye profile, for at least one of an alertness blink rate of the driver, an awareness of the driver, an anisocoria comparison, a pupil dilation of the driver, or a reaction time of the driver;

determine, based at least in part on the monitored at least one of the alertness blink rate of the driver, the awareness of the driver, the anisocoria comparison, the pupil dilation of the driver, or the reaction time of the driver, that a threshold has been exceeded; and in response to determination that the threshold has been exceeded, provide at least one of a notification or an alert.

20. The helmet apparatus of claim 1, further comprising:

a heads-up projector communicatively coupled to the connection point and positioned to project visual data received from the connection point into a field of view of a driver;

a microphone communicatively coupled to the connection point;

wherein the connection point at least:

receives first visual data from the separable wired connection when connected to the separable wired connection;

provides the first visual data to the heads-up projector for presentation by the heads-up projector;

subsequent to presentation by the heads-up projector, receives first audio data from the microphone that includes an adjustment command to adjust the presentation of the visual data;

provides the first audio data to the separable wired connection when connected;

receives second visual data from the separable wired connection when connected to the separable wired connection, wherein the second visual data includes a presentation arrangement of the visual data that is different than the first visual data; and provides the second visual data to the heads-up projector for presentation by the heads-up projector.

21. The system of claim 13, wherein the program instructions maintained on the memory of the in-vehicle computing device that, when executed by the one or more processors of the in-vehicle computing device further cause the one or more processors to at least:

send in real-time or near real-time, for presentation on a display that is separate and remote from the vehicle, at least one of driver data, vehicle data, event data, or at least a portion of the first image data.

22. The system of claim 21, wherein the program instructions maintained on the memory of the in-vehicle computing device that, when executed by the one or more processors of the in-vehicle computing device, further cause the one or more processors to at least:

receive a current gaze direction indication of a driver wearing the helmet; and overlay the current gaze direction indication of the driver on the at least a portion of the first image data to illustrate a portion of the at least a portion of the first image data that corresponds to a current gaze direction of the driver.

* * * * *